US011306533B2

(12) United States Patent
Teuscher

(10) Patent No.: US 11,306,533 B2
(45) Date of Patent: Apr. 19, 2022

(54) VERTICAL BLIND ASSEMBLY

(71) Applicant: Wondershades LLC, New York, NY (US)

(72) Inventor: Jason B. Teuscher, New York, NY (US)

(73) Assignee: Sunflower Shades and Blinds LLC, Lewes, DE (US)

( * ) Notice: Subject to any disclaimer, the term of this patent is extended or adjusted under 35 U.S.C. 154(b) by 581 days.

(21) Appl. No.: 16/127,935

(22) Filed: Sep. 11, 2018

(65) Prior Publication Data

US 2019/0010755 A1 Jan. 10, 2019

Related U.S. Application Data

(63) Continuation-in-part of application No. 15/712,931, filed on Sep. 22, 2017, now Pat. No. 10,731,410, (Continued)

(51) Int. Cl.
*E06B 9/262* (2006.01)
*E06B 9/386* (2006.01)
(Continued)

(52) U.S. Cl.
CPC ..... *E06B 9/262* (2013.01); *E06B 9/322* (2013.01); *E06B 9/362* (2013.01); *E06B 9/364* (2013.01);
(Continued)

(58) Field of Classification Search
CPC ... E06B 9/38; E06B 9/386; E06B 9/30; E06B 9/322; E06B 2009/2625; E06B 2009/2627;
(Continued)

(56) References Cited

U.S. PATENT DOCUMENTS 591,918 A 10/1897 Friedrich
1,557,058 A 10/1925 Johansen
(Continued)

FOREIGN PATENT DOCUMENTS

CA 2510265 A1 5/2006
CA 2516086 2/2007
(Continued)

OTHER PUBLICATIONS

International Search Report and Written Opinion dated Nov. 21, 2011 for International Application No. PCT/US2011/000588 filed Apr. 1, 2011 by Jason T. Birkestrand, 36 pages.
(Continued)

*Primary Examiner* — Johnnie A. Shablack
*Assistant Examiner* — Jeremy C Ramsey
(74) *Attorney, Agent, or Firm* — Cesari and McKenna, LLP

(57) ABSTRACT

A modular shade includes at least one module that consists of a head rail unit, a foot rail unit, at least one intermediate rail unit, and a plurality of slat components. A top slat may be coupled to the head rail unit and the intermediate rail unit, and a bottom slat component may be coupled to the intermediate rail unit and the foot rail unit. Further, additional intermediate rail units and intermediate slat components may be added to the module to alter the shape and size of the module, and the module may be coupled to one or more additional modules to change the overall shape and size of the modular shade.

8 Claims, 107 Drawing Sheets

Related U.S. Application Data which is a continuation-in-part of application No. 15/348,416, filed on Nov. 10, 2016, now Pat. No. 10,030,437, which is a continuation-in-part of application No. 15/228,429, filed on Aug. 4, 2016, now Pat. No. 10,253,561, which is a continuation-in-part of application No. 15/062,900, filed on Mar. 7, 2016, now Pat. No. 9,739,087, which is a continuation-in-part of application No. 14/932,300, filed on Nov. 4, 2015, now Pat. No. 9,732,554, which is a continuation-in-part of application No. 14/489,002, filed on Sep. 17, 2014, now Pat. No. 9,260,913, which is a continuation-in-part of application No. 13/963,683, filed on Aug. 9, 2013, now Pat. No. 9,322,211, which is a continuation-in-part of application No. 13/575,083, filed as application No. PCT/US2011/000588 on Apr. 1, 2011, now Pat. No. 8,851,142.

(60) Provisional application No. 61/322,981, filed on Apr. 12, 2010.

(51) Int. Cl.

| | |
|---|---|
| ***E06B 9/382*** | (2006.01) |
| ***E06B 9/322*** | (2006.01) |
| ***E06B 9/36*** | (2006.01) |
| ***E06B 9/388*** | (2006.01) |
| ***E06B 9/42*** | (2006.01) |
| *E06B 9/24* | (2006.01) |

(52) U.S. Cl.

CPC ..... *E06B 9/367* (2013.01); *E06B 9/368* (2013.01); *E06B 9/382* (2013.01); *E06B 9/386* (2013.01); *E06B 9/388* (2013.01); *E06B 9/42* (2013.01); *E06B 2009/2447* (2013.01); *E06B 2009/2622* (2013.01); *E06B 2009/2625* (2013.01); *E06B 2009/2627* (2013.01)

(58) Field of Classification Search

CPC ..... E06B 9/262; E06B 9/2622; E06B 9/26; E06B 9/384; E06B 9/382; E06B 9/264; E06B 2009/2429

See application file for complete search history.

(56) References Cited

U.S. PATENT DOCUMENTS

| | | | | |
|---|---|---|---|---|
| 2,100,976 | A | 11/1937 | Norton | |
| 2,207,720 | A | 7/1940 | Cole et al. | |
| 2,370,794 | A | 3/1945 | Walter | |
| 2,500,074 | A | 12/1948 | Violet | |
| 2,636,556 | A | 4/1953 | Light et al. | |
| 2,855,241 | A | 10/1958 | Walter | |
| 3,075,805 | A | 1/1963 | Golde et al. | |
| 3,322,182 | A | 5/1967 | Palella | |
| 3,777,800 | A * | 12/1973 | Susoev | A47H 23/01 160/84.04 |
| 3,946,788 | A | 3/1976 | Van Muyen | |
| 4,006,770 | A | 2/1977 | Ferguson et al. | |
| 4,418,461 | A | 12/1983 | Spohr | |
| 4,641,700 | A | 2/1987 | Zveibil | |
| 4,813,468 | A | 9/1989 | Fraser | |
| 4,945,969 | A | 8/1990 | Schnebly et al. | |
| 5,010,940 | A | 4/1991 | Marocco | |
| 5,090,466 | A | 2/1992 | Hong | |
| 5,111,866 | A | 5/1992 | Prostko | |
| 5,129,440 | A | 7/1992 | Colson | |
| 5,203,395 | A | 4/1993 | Koller et al. | |
| 5,231,708 | A | 8/1993 | Hansen | |
| 5,273,096 | A | 12/1993 | Thomsen et al. | |
| 5,400,848 | A | 3/1995 | Gainer, Jr. | |
| 5,566,735 | A | 10/1996 | Jelic | |
| 5,632,316 | A | 5/1997 | Cohen | |
| 5,638,881 | A | 6/1997 | Ruggles et al. | |
| 5,690,156 | A | 11/1997 | Ruggles | |
| 5,791,390 | A | 8/1998 | Watanabe | |
| 5,862,850 | A | 1/1999 | Yang | |
| 5,974,763 | A | 11/1999 | Colson et al. | |
| 6,006,812 | A | 12/1999 | Corey | |
| 6,354,353 | B1 * | 3/2002 | Green | E06B 9/26 160/84.04 |
| 6,502,619 | B1 | 1/2003 | Kraeutler | |
| 6,561,251 | B1 | 5/2003 | Prosch | |
| 6,598,650 | B1 | 7/2003 | Palmer | |
| 6,668,899 | B1 | 12/2003 | Thomas, Jr. | |
| 6,854,500 | B2 * | 2/2005 | Chen | E06B 9/262 160/84.01 |
| 6,899,156 | B2 | 5/2005 | Tyner | |
| 7,516,769 | B2 * | 4/2009 | Yu | E06B 9/384 160/84.04 |
| 7,631,682 | B2 | 12/2009 | Lamers et al. | |
| D632,493 | S | 2/2011 | Colson | |
| 8,235,086 | B2 | 8/2012 | Smith | |
| 8,353,325 | B2 | 1/2013 | Chen et al. | |
| 8,544,522 | B2 | 10/2013 | Lin | |
| 9,133,661 | B2 | 9/2015 | Birkestrand | |
| 9,260,913 | B2 | 2/2016 | Birkestrand | |
| 9,493,981 | B2 | 11/2016 | Bishop | |
| 9,624,689 | B2 | 4/2017 | Bailey et al. | |
| 9,732,554 | B2 | 8/2017 | Birkestrand | |
| 9,739,087 | B2 | 8/2017 | Birkestrand | |
| 9,970,233 | B2 * | 5/2018 | Hsu | E06B 9/262 |
| 10,724,297 | B2 | 7/2020 | Colson et al. | |
| 2002/0088559 | A1 | 7/2002 | Green et al. | |
| 2005/0224188 | A1 | 10/2005 | Nien | |
| 2006/0096716 | A1 | 5/2006 | Yu et al. | |
| 2006/0191646 | A1 | 8/2006 | Harper et al. | |
| 2006/0249260 | A1 | 11/2006 | Nien | |
| 2006/0289122 | A1 | 12/2006 | Lin | |
| 2007/0163723 | A1 | 7/2007 | Liang | |
| 2007/0235147 | A1 | 10/2007 | Zakowski | |
| 2012/0031569 | A1 | 2/2012 | Elinson et al. | |
| 2012/0102707 | A1 | 5/2012 | Chen | |
| 2012/0103539 | A1 | 5/2012 | Chen | |
| 2012/0227910 | A1 | 9/2012 | Lin | |
| 2013/0068401 | A1 | 3/2013 | Birkestrand | |
| 2013/0340973 | A1 | 12/2013 | Zhou et al. | |
| 2014/0027070 | A1 | 1/2014 | Birkestrand | |
| 2014/0034251 | A1 | 2/2014 | Colson | |
| 2015/0184455 | A1 * | 7/2015 | Perkowitz | E06B 9/262 160/319 |
| 2015/0275571 | A1 | 10/2015 | Guhl | |
| 2016/0235237 | A1 | 8/2016 | Chu | |
| 2016/0340973 | A1 | 11/2016 | Birkestrand | |
| 2018/0010386 | A1 | 1/2018 | Birkestrand | |

FOREIGN PATENT DOCUMENTS

| | | |
|---|---|---|
| EP | 692603 | 7/1994 |
| EP | 1 881 148 A1 | 1/2008 |
| GB | 2140490 | 11/1984 |
| JP | 1991250186 | 11/1991 |
| JP | 404070490 A | 3/1992 |
| JP | 2000-186476 A | 7/2000 |
| KR | 100 817 245 B1 | 3/2008 |
| WO | 2005-019584 | 3/2005 |

OTHER PUBLICATIONS

International Search Report and Written Opinion dated Jan. 24, 2019 for International Application No. PCT/US18/51877 for Jason B. Teuscher filed Sep. 20, 2018, 22 pages.

Supplementary Partial European Search Report dated Aug. 30, 2021, for International Application No. EP18859401.4 for Wondershades LLC, 13 pages.

* cited by examiner

VERTICAL BLIND ASSEMBLY

CROSS-REFERENCE TO RELATED APPLICATION

The present application is a continuation in part application of U.S. patent application Ser. No. 15/712,931 filed Sep. 22, 2017, which is a continuation in part application of U.S. patent application Ser. No. 15/348,416, filed Nov. 10, 2016, now patented as U.S. Pat. No. 10,030,437 on Jul. 24, 2018, which is a continuation in part application of U.S. patent application Ser. No. 15/228,429, filed Aug. 4, 2016 which is continuation in part application of U.S. patent application Ser. No. 15/062,900, filed Mar. 7, 2016, now patented as U.S. Pat. No. 9,739,087 on Aug. 22, 2017, which is a continuation in part application of U.S. patent application Ser. No. 14/932,300, filed Nov. 4, 2015, now patented as U.S. Pat. No. 9,732,554 on Aug. 15, 2017, which is a continuation in part application of U.S. patent application Ser. No. 14/489,002, filed Sep. 17, 2014, now patented as U.S. Pat. No. 9,260,913 on Feb. 16, 2016, which is a continuation in part application of U.S. patent application Ser. No. 13/963,683, filed Aug. 9, 2013, now patented as U.S. Pat. No. 9,322,211 on Apr. 26, 2016, which is a continuation in part application of U.S. patent application Ser. No. 13/575,083, filed Jul. 25, 2012, now issued as U.S. Pat. No. 8,851,142 on Oct. 7, 2014, which is a 371 application of International Application No. PCT/US2011/000588 filed on Apr. 1, 2011, which claims the benefit of Provisional Application Ser. No. 61/322,981, filed Apr. 12, 2010, the contents of each of which are hereby incorporated by reference herein.

BACKGROUND OF THE INVENTION

Conventional vertical window blinds have vertical slats on louvers suspended from a head rail that can be mounted at the top of a window so that the slats extend down to the bottom of the window. By turning a wand, the slats can be rotated in unison about their vertical axes between a closed position wherein the slats lie almost parallel to the window essentially forming a single panel which blocks the light and an open position wherein the slats are oriented at right angles to the window, thus allowing a maximum amount of light to pass through the blind. The slats can also be set at any angle between those two extremes. However, even when slats of the prior blinds are in their fully open position, they still occlude the window to some extent in that an observer sees the edges of the slats when looking out the window.

Some vertical blinds are also disadvantaged in that they are usually fabricated in relatively few widths to fit standard window sizes. Therefore, they may not be suitable for windows that do not conform to those standards.

SUMMARY OF THE INVENTION

Accordingly, the present invention aims to provide an improved vertical blind assembly which is of a modular construction so that it can be made to fit substantially any size window.

Another object of the invention is to provide an assembly of this type whose vertical slats can be raised and lowered in unison like a window shade for any shape or sized window, such as a square, round, or semi-round windows.

A further object of the invention is to provide such an assembly whose vertical slats can be rotated about their vertical axes, even when the slats are partially raised. The vertical slats may be rotated manually, or using an electric motor that is housed in one or more of the assemblies, where the electric motors can be used for all individual units with or without a remote control including a bevel gear which may turn all the individual assemblies/units in unison. The use of the electric motor may be particularly advantageous for windows that have heights that are too high or too long in length that would be difficult for a user to reach by hand.

Another object of the invention is to provide a vertical window blind assembly whose slats are easily replaceable when damaged or for decorative reasons.

Still another object of the invention is to provide a window blind assembly which is devoid of the unsightly cords and travelling slat supports required in conventional horizontally drawn blinds.

An additional object of the invention is to provide a window blind assembly which is easy to put up and take down, making it especially suitable for renters.

Another object of the invention is to provide a vertical window blind assembly where each blind can be cleaned upon raising and lowering the blind.

Another object of the invention is to provide a vertical window blind assembly where each blind can be individually sized to surround or accommodate objects placed in the window.

Another object of the invention is to provide a vertical window blind assembly where at the bottom of each blind is coupled to an additional blind that may extend and retract.

Other objects will, in part, be obvious and will, in part, appear hereinafter. The invention accordingly comprises the features of construction, combination of elements and arrangement of parts which will be exemplified in the following detailed description and the scope of the invention will be indicated in the claims.

In general, my vertical blind assembly has a head rail for mounting horizontally in an opening and a vertically extensible blind, including slats and a foot rail, suspended from the head rail. The head rail and blind are composed of a sufficient number of similar modules connected together side by side to span the opening. Each module includes a head rail unit coupled to at least one adjacent head rail unit, a housing pivotally connected by an axle to the associated head rail unit, an elongated flexible slat coiled in the associated housing with an end of the slat projecting from the housing enabling the slat to be extended from and retracted back into the housing, and a foot rail unit connected to at least one adjacent foot rail unit and being pivotally secured along its width to the projecting end of the associated slat. The head rails may be in a modular format to ensure mounting for round or square windows, or any sized window. The pivot axis of the foot rail unit is collinear to the axle so that when the blind is extended to position the foot rail at any selected distance from the head rail, the slats of all of the modules may be turned between closed positions wherein the slats are parallel to the head and foot rails and block the openings and open positions wherein the slats are perpendicular to the head and foot rails and expose the opening. A turning mechanism in the head rail unit of each module connects to similar turning mechanisms in the other module(s) to turn the slats of all the modules in unison between their respective open and closed positions.

In an alternative embodiment, the head rail unit may be mounted to a side wall that is adjacent to the opening, or to a top wall that is above the opening. This head rail unit may be a venetian accordion type blind that may be connected to the head rail unit or secured to the head rail in a manner known by those skilled in the art. The venetian accordion blind may be raised or lowered by lifting or pulling the foot rail.

Further, the foot rail unit may house an additional slat that may extend from the foot rail to provide a wider range of uses for the blind assembly. Specifically, for a large window, the slat extending to the foot rail may stay at a fixed position, while the additional slat from the foot rail unit to an additional foot rail unit may be raised or lowered. The additional foot rail unit may have its own turning mechanism, or the turning mechanism in the head rail unit may be utilized to turn the slat and the additional slat in unison.

Moreover, the head rail unit may house, for example, an electric motor that may be utilized to rotate the blind assemblies in unison using a bevel gear for example, wherein the electric motor may be controlled by a remote control. The use of the electric motor may be particularly advantageous for windows that have heights that are too high or too long in length that would be difficult for a user to reach by hand. Further, in alternative embodiments, electric motors may be utilized to raise/lower the blinds.

In a further embodiment, a modular roman shade includes at least one module that consists of a head rail unit, a foot rail unit, at least one intermediate rail unit, and a plurality of slat components. In addition, a top slat may be coupled to the head rail unit and the intermediate rail unit, and a bottom slat component may be coupled to the intermediate rail unit and the foot rail unit. Further, additional intermediate rail units and intermediate slat components may be added to the module to alter the shape and size of the module. In addition, the module may be coupled to one or more additional modules to change the overall shape and size of the modular roman shade. Each slat component may be individually removed between the individual rail units. For example, the individual slat components may be removed to be cleaned, or to be substituted with a different slat component (e.g., having a different pattern or being of a different material). For example, a user may desire to have a particular design make up the entire modular roman shade and thus may select particular materials and/or patterns for each slat component of the modular roman shade.

Thus, by employing an appropriate number of modules, the assembly can be fitted to a window of practically any width. Even bow or bay windows may be accommodated by employing flexible couplings between the adjacent modules as will be described in detail later.

As will also be seen, the modules are easy to assemble and the assembly as a whole is easy to install in a window or other opening. Therefore, the assembly should find wide application, particularly in the apartment rental market.

In a further embodiment, an adjustable roman shade attachment that includes a plurality of components may be utilized. The assembled adjustable roman shade attachment illustratively includes a center tube, two bracket clips, two adjustment arms, and two edge inserts. Slits associated with each of the components are utilized to secure or hold onto material of the roman shade, such as slat components. Specifically, when ends of two slat components are positioned in the slits, adjustment screws may be tightened to close the slits to securely clamp portions of the slat component within the slits. Alternatively, screws may not be utilized and the thickness of the material may hold the material itself in the slits. Further, the edge inserts may be curved portions and utilized to hold excess material associated with the slat components, such that the excess material is wrapped around to the back of the adjustable roman shade attachment. In addition, and in an embodiment, the edge inserts may include hinges such that the edge inserts may be manipulated, by a user, between a curved configuration and a straight configuration. Advantageously, a user can feed the material of the roman shade in the slits while the edge inserts are unhinged and in a straight configuration, and then manipulate the edge inserted to be hinged such that the edge inserts are curved and the excess material is hidden in the back of the shade. Alternatively, dowels may be utilized in place of the components to alter the width of the shade and/or to add rigidity to the shade.

In a further embodiment, a plurality of slat components may be coupled to each other with a zipper mechanism or a variety of other securing mechanism, such as, but not limited to strings, buttons, magnets, hook and loop fasteners, such as Velcro®, clips, etc. Each of the plurality of slat components may include a mechanism, e.g., buttons, strings, etc., to secure excess material to the back of slat components. In addition, dowels may be positioned at various points along the back of a roman shade to provide rigidity and/or structure to the overall roman shade. The dowels may also be utilized to allow the overall width of the roman shade to be adjusted. Further, strings may be utilized to alter the overall length of the roman shade.

In a further embodiment, one or more slat components may include a plurality of layers that are coupled together. The exterior of each slat component may include a mechanism such that the slat component can be coupled to an exterior of a sheath and/or coupled to each other. In addition, one or more strips may be positioned within the interior of the slat component to provide rigidity and to alter the sheath, and thus an overall width or length of the shade. For example, two strips may be positioned within the slat component and overlap a selected distance selected by a user. Excess material of the slat component, that extends past the overall length of the strips, may be folded over and inserted into an opening of the slat component created by the coupling of the layers of the slat component. Advantageously, the overall width or length of the shade may be altered to a width or length desired by the user. In addition, the sheath, slat component, and/or strips may be coupled to an adjacent sheath, adjacent slat component, and/or adjacent strips. The shade may be lowered and raised by respectively pulling and pushing the sheath and/or slat components.

In a further embodiment, the shade may include a head rail unit that is coupled to a roller that includes one or more ribbon strings. In addition, one or more sheaths are coupled to the head rail unit, wherein the sheath includes one or more exterior securing mechanisms. The ribbon string of the roller may be fed through slot openings of the exterior securing mechanisms located on a single sheath and then knotted at a position after where the ribbon string passes the slot openings of the exterior securing mechanisms of the sheaths. Further, one or more slat components may be coupled to the exterior of the sheaths utilizing a slat component securing mechanism that engages with the exterior securing mechanism of the sheath. When the shade is raised, the ribbon strings roll onto the roller causing the sheaths to rise, which in turn causes the slat component to also rise.

BRIEF DESCRIPTION OF THE DRAWINGS

For a fuller understanding of the nature and objects of the invention, reference should be made to the following detailed description taken in connection with the accompanying drawings, in which:

FIGS. 38D-38J are detailed depictions of a shade that includes exemplary slat components as described with respect to FIGS. 38A-38C;

FIGS. 39F-39K are detailed depictions of a shade that includes exemplary slat components as described with respect to FIGS. 39A-39C and 39E.

DESCRIPTION OF ILLUSTRATIVE EMBODIMENTS

Figure 1A:
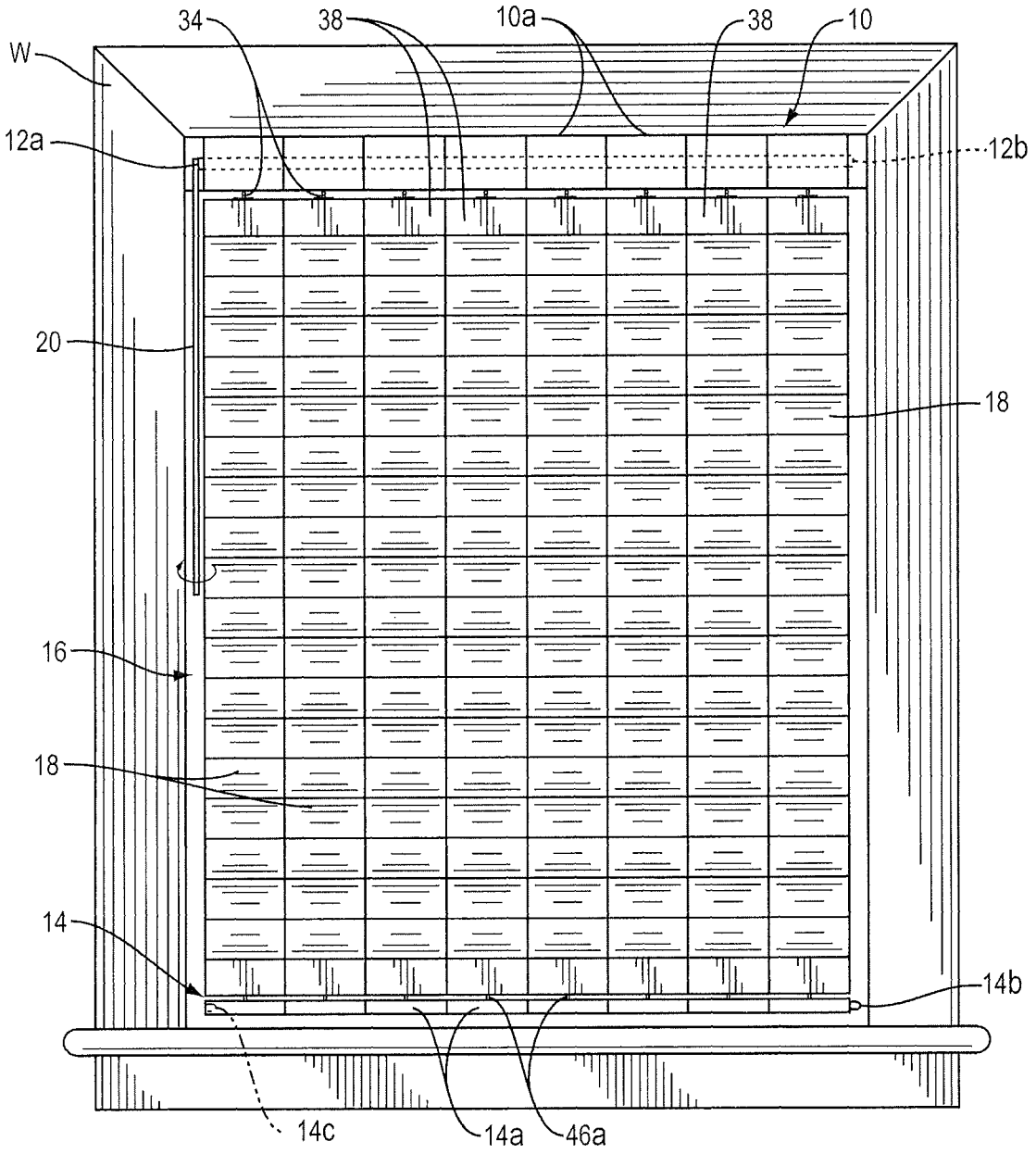
FIG. 1A is a front elevational view of my modular window blind assembly whose blind, composed of a plurality of modules, is in a fully extended or lowered position in a window and with the slats of the blind shown in their fully closed positions thus preventing light from passing through the blind.
Figure 1B:
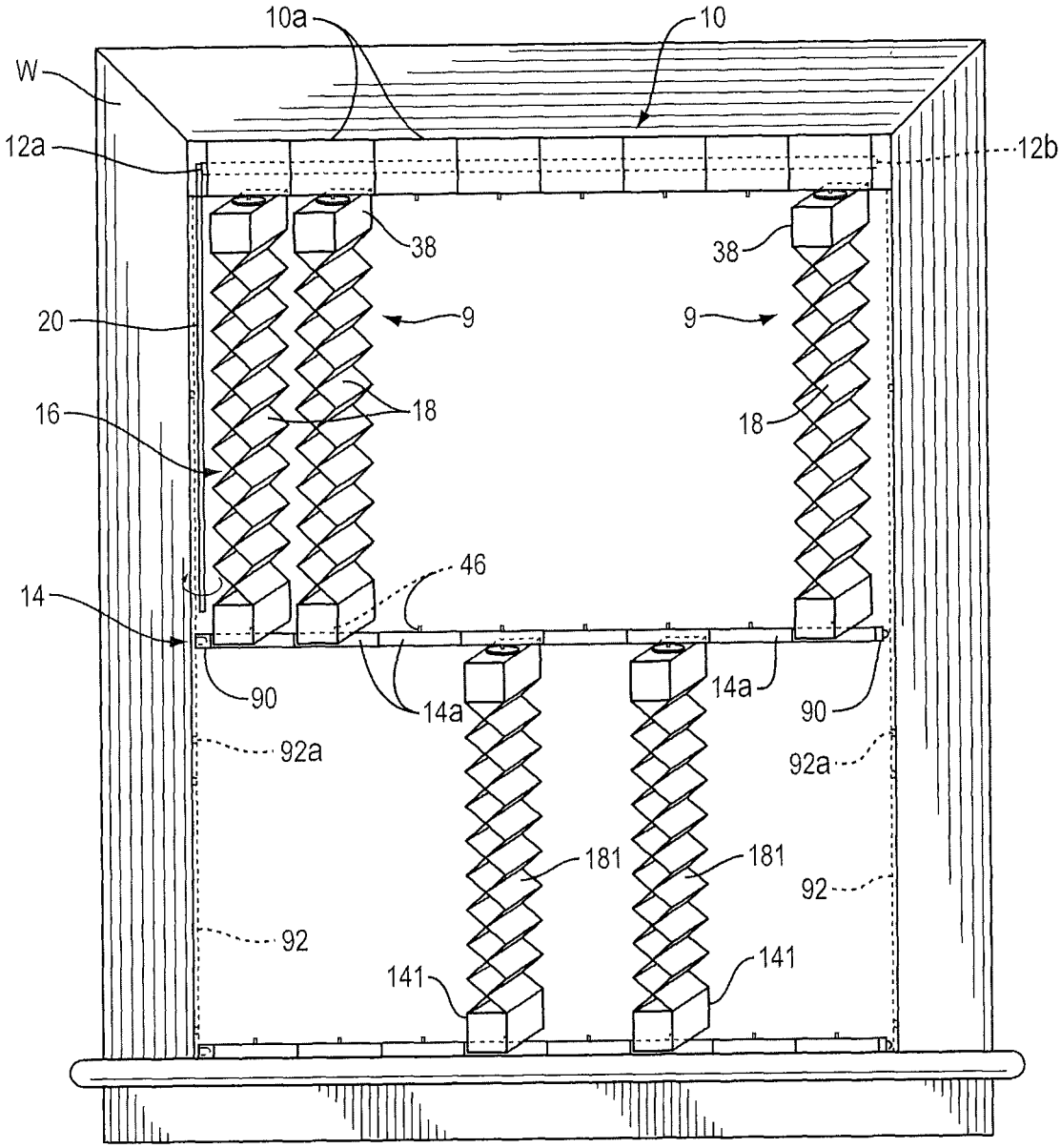
FIG. 1B is a similar view of the assembly showing the blind in a partially raised position with the slats partially open so that a desired amount of light can pass through the blind.

As shown in FIGS. 1A and 1B, my vertical blind assembly comprises a head rail 10 mounted at the top of a window W by means of brackets 12*a* and 12*b* which support the opposite ends of the head rail. The assembly also includes a foot rail shown generally at 14, and extending between the head rail and the foot rail is a window blind 16 comprised of a plurality of vertical slats or louvers 18. By pulling down or lifting up the foot rail 14, the blind 16 may be moved from a fully extended or lowered position shown in FIG. 1A to a partially retracted or raised position shown in FIG. 1B and then to a fully raised or retracted position, not shown, wherein the foot rail 14 lies just under the head rail 10 so that the blind 16 does not obstruct the view through the window. Furthermore, by turning a wand 20 in one direction or the other, the slats 18 of blind 16 can be rotated about their vertical axes from a fully closed position as shown in FIG. 1A wherein the slats lie parallel to the head and foot rails and the window forming a panel that covers the window, through a partially open position shown in FIG. 1B so that a selected amount of light can pass through the blind to a fully open position wherein the slats 18 are perpendicular to the head and foot rails and window so that light can pass through the extended length of blind 16. In an alternative embodiment, an electric motor (not shown) may be housed in the head rail 10, where the electric motor can be used for all individual units, with or without a remote control, including a bevel gear which may turn all the individual assemblies/units in unison. The use of the electric motor may be particularly advantageous for windows that have heights that are too high or too long of lengths that would be difficult for a user to reach by hand.

Thus, my window blind assembly is quite versatile in that when blind 16 is in its fully raised position, there is substantially no visual obstruction of the window W. Also, when the blind is in a partially raised position as shown in FIG. 1B, the slats 18 can still be oriented so that they prevent direct sunlight from entering the room through the upper portion of the window, yet an observer can look through the lower area of the window without having to see slat edges, as is the case with conventional vertical window blind assemblies. For especially tall windows, it is even possible to mount two of the illustrated assemblies in the same window, one at the top and the other, say, halfway down the window so that the amount of light entering through the upper and lower halves of the window can be controlled separately.

In addition, and as shown in FIG. 1B, additional slat 181 may extend from each foot rail unit 14*a* to additional foot rail unit 141. Advantageously, the slat 18 may be raised or lowered by extending or lowering foot rail unit 14*a* and/or slat 181 may be raised or lowered by extending or lowering foot rail unit 141. It is noted that each of the slats 18 and 181 may be configured to individually pivot or pivot in unison.

In addition, it is noted that additional foot rail 141 may be secured to the exterior of the window by brackets similar to brackets.

Figure 1C:
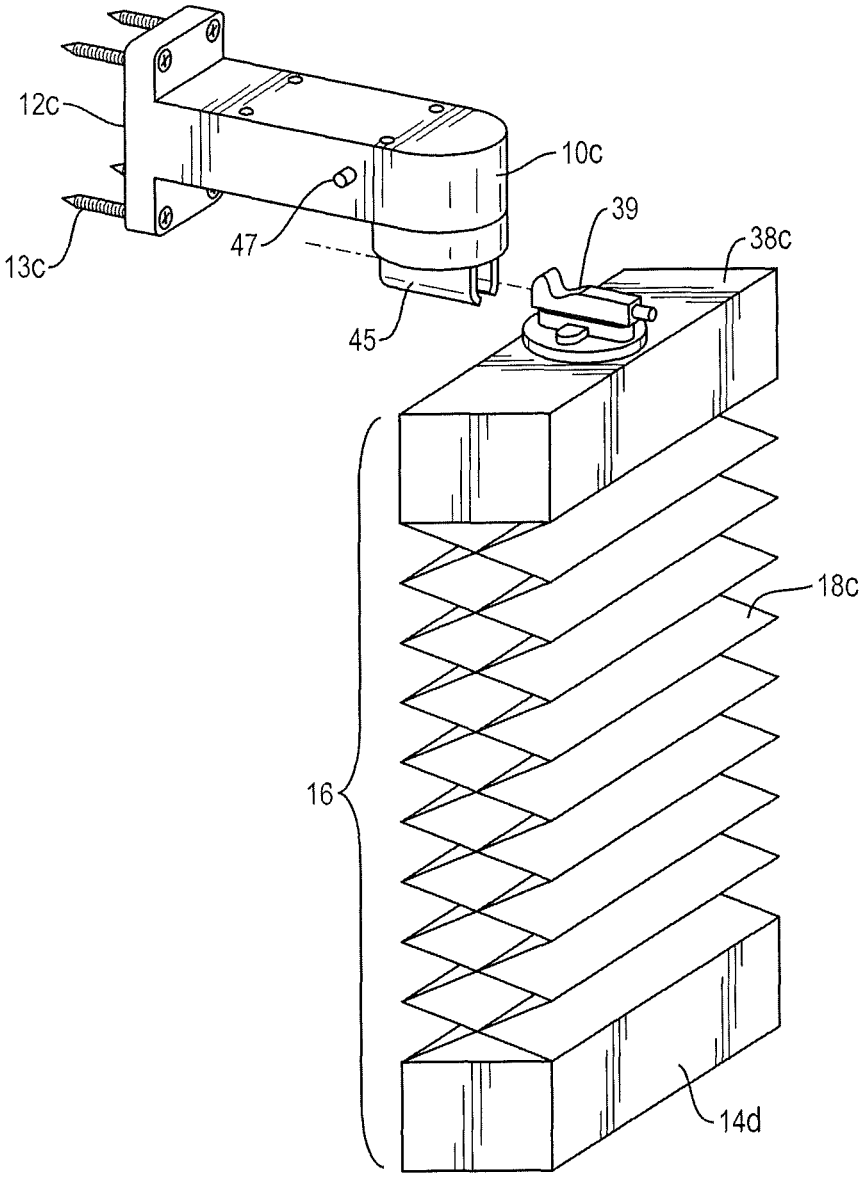
FIG. 1C is a front elevation view of my module window blind assembly whose blind may be secured to the side or top of an opening and may include a venetian accordion type blind, wherein the blind may be connected to or attached to the head rail unit.

As shown in FIG. 1C, my vertical blind assembly may comprise a head rail unit 10*c* mounted to the side of a window W by means of a back bracket 12*c*, utilizing screws 13*c* for example, which supports the head rail unit 10*c*. The head rail unit 10*c* may have a fixed arm shape, for example as seen in FIG. 1C. The assembly 300 includes a foot rail shown generally as 14*d* that is at a bottom of the window blind 16. Window blind 16 includes a venetian accordion slat 18*c*. By pulling down or lifting up the foot rail 14*cd* the venetian accordion slat 18*c* may be moved from a fully extended or lowered position (e.g., open accordion configuration) to a partially retracted or raised position and then to a fully raised or retracted position, wherein the foot rail 14*d* lies just under housing unit 38*c* of blind 16 so that the venetian accordion slat 18*c* does not obstruct the view through the window.

Figure 1D:
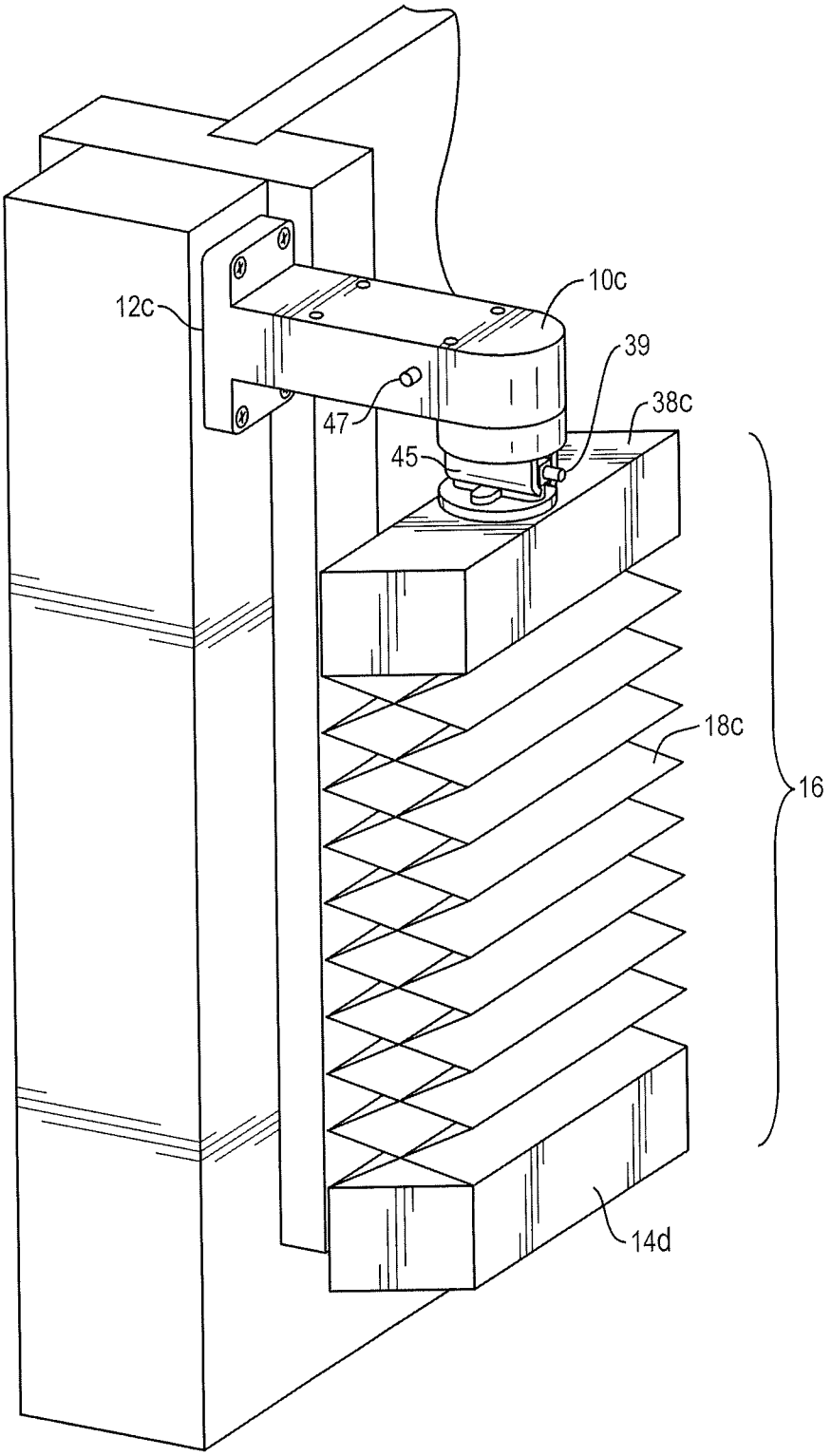
FIG. 1D is a front elevation view of my module window blind assembly whose blind may be secured to the side or top of an opening and may include a venetian accordion type blind, wherein the blind is in a fully extended or lowered position in a window and with the slats of the blind shown in their fully open positions thus permitting light to enter through the blind.
Figure 1E:
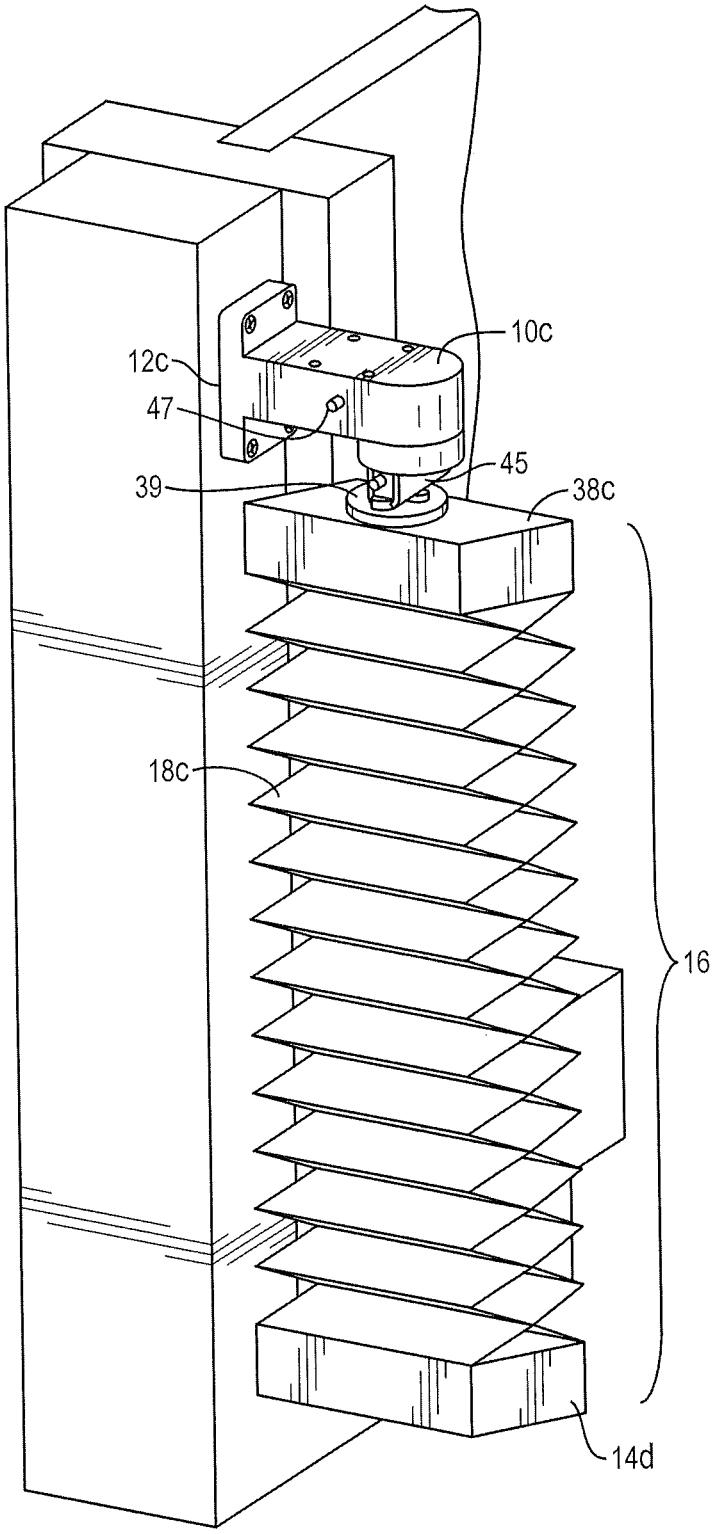
FIG. 1E is a front elevation view of my module window blind assembly whose blind may be secured to the side or top of an opening and may include a venetian accordion type blind, wherein the blind is in a fully extended or lowered position in a window and with the slats of the blind shown in their fully open positions thus permitting light to enter through the blind.

Furthermore, by turning, either clockwise or counter clockwise, pin 47 extending from head rail unit 10*c*, the blind 16 can be rotated about its axis to a fully closed position as shown in FIG. 1D. Further, the venetian vertical slat 18*c* of blind 16 can be rotated, again utilizing pin 47, about its axis to a partially open position, not shown, so that a selected amount of light can pass through the blind, to a fully open position as shown in FIG. 1E so that light can pass through the extended length of blind 16. Further, it is noted that the one or more slats 18*c* may be rotated or turned, while other slats 18*c* may remained stationary. In addition, it is noted that a turning mechanism may extend from the foot rail or be housed in the foot rail unit 14*a* to turn or rotate slat 181 about its axis to a partially open position, closed position, etc.

In an alternative embodiment, the housing unit 38*c* may house, for example, an electric motor that may be utilized to rotate the blind assemblies in unison using a bevel gear for example, wherein the electric motor may be controlled by a remote control. The use of the electric motor may be particularly advantageous for windows that have heights that are too high or too long in length that would be difficult for a user to reach by hand. Further, in an alternative embodiment, slat 18*c* may be a roller blind, instead of a venetian accordion blind, that may be controlled by the electric motor in housing unit 38*c*. Specifically, the electric motor may allow the roller blind to roll up and down to cover or expose the window.

It is noted that the weight of the blind is centered so any connection to the housing will have ample room to ensure the blind is parallel to the base of the window sill.

Each blind 16 includes the housing unit 38*c*, wherein connector 39, on a top portion of housing unit 38*c*, can be 'snapped" into an accepting connector 45 of head rail unit 10*c*. It is noted that any other securing mechanism may be utilized to attach or connect the top of the housing unit 38*c* to head rail unit 10*c*. Advantageously, blind 16 can be quickly and easily replaced. Further, it is noted that housing unit 38*c* and foot rail 14*d* of blind 16 may be angled, so that when pin 47 is turned to configure the blind 16 in a closed position, the head rail unit 10*c* and foot rail 14*d* of blind 16 will form a seal with the head rail unit 10*c* and foot rail 14*d* of other blinds. This is advantageous when respective head rail units 10*c* may be connected to form a rail, as described below, that is long enough to span the window opening. Each housing 38*c* of blind 16 holds a bail retraction mechanism, not shown, to allow for the venetian according slat 18*c* to be retracted or raised, by pulling or lifting foot rail 14*d*, as known by those skilled in the art. Specifically, and with reference to FIG. 1E, the assembly may be a cordless balanced venetian blind or shade with consistent variable spring motion. Advantageously, minimal force (e.g., by pulling or lifting) is required to position the blind 16 at the desired height (e.g., open, closed, midway) with no required "snapping" or "locking mechanism."

Further, foot rail 14*d* may be different sizes and depths and the depiction of 14*d* is simply exemplary in nature. For example, foot rail 14*d* may be extremely thin and shorter in height than that of head rail unit 38*c*.

Figure 1F:
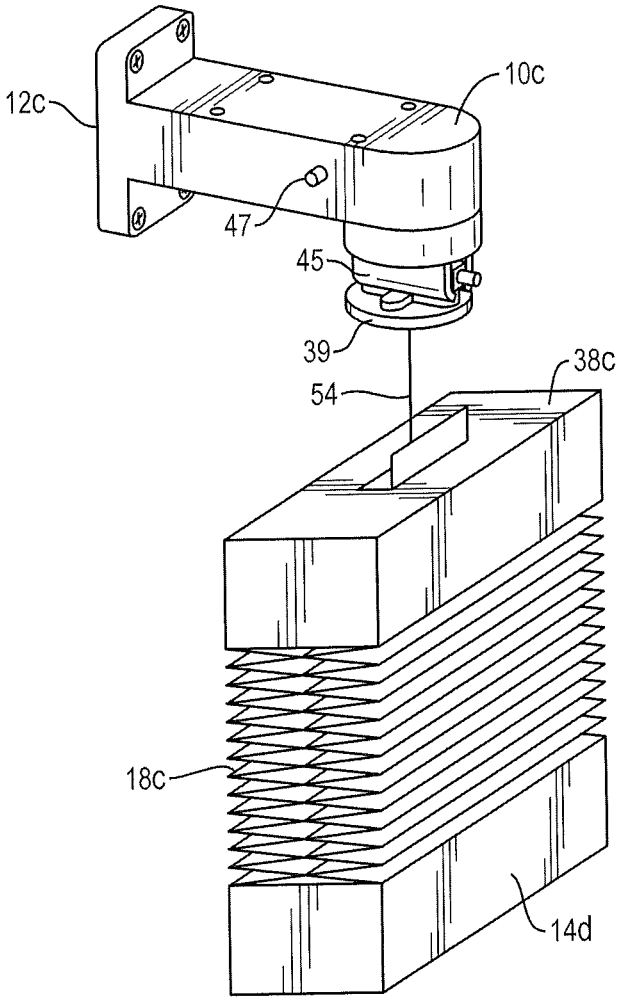
FIG. 1F is a view of the assembly that utilizes a string or tape measure within the head unit to only protect a lower portion of a window opening from light.

FIG. 1F shows an alternative embodiment where a string 54 of a pulley mechanism for example, or other hanging type of apparatus such as a tape measure configuration, may be provided and coiled in head unit 10*c*. The other end of the string 54 or tape measure may also be attached to connector 39. Thus, by allowing string 10*c* to uncoil from head rail unit 10*c* that is attached to connector 39, blind 16 can be moved in a downward direction to block a lower portion of the window W from light and to permit light to enter an upper portion of window W. It is noted that although this embodiment is described with reference to FIG. 1C-1E, this embodiment may be applied to the assembly as described in FIGS. 1A and 1B and those assemblies described below.

Figure 1G:
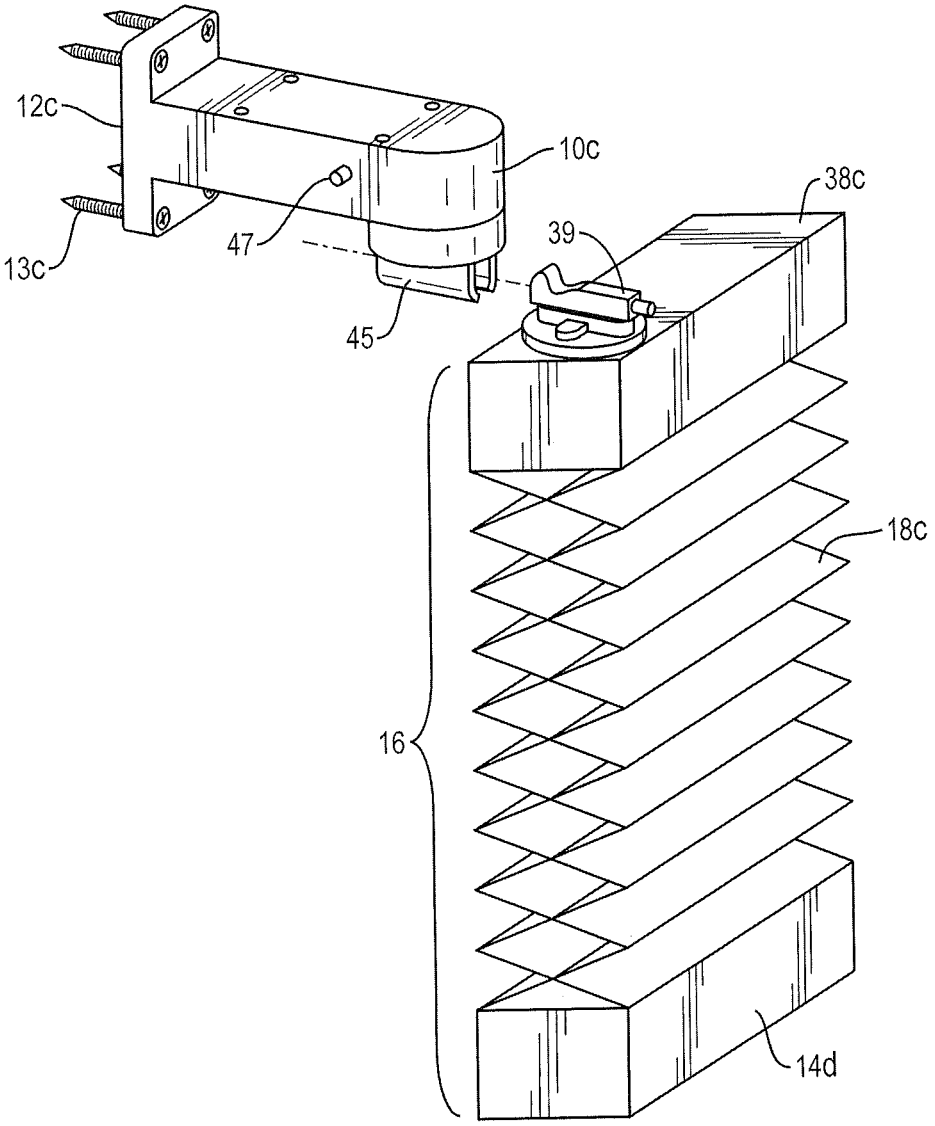
FIG. 1G is a view of the assembly where the connector is located at an end of the housing unit.

FIG. 1G is a view of the assembly where the connector 39 is located at an end of the housing unit 38*c*. This type of configuration allows for the blind 16 to be closer to the window when it is attached to head rail unit 10*c*. The attachment between head rail unit 10*c* and connector 39 has a firm connection to handle the extra weight and force exerted on the connector 39 and head rail unit 39, since it is not balanced as it would be with the connector 39 in the middle of head rail unit 38*c*. Further, it is noted that connector 39 can be positioned at any location on head rail unit 38*c* and the depiction in FIG. 1G is exemplary in nature.

Figure 2A:
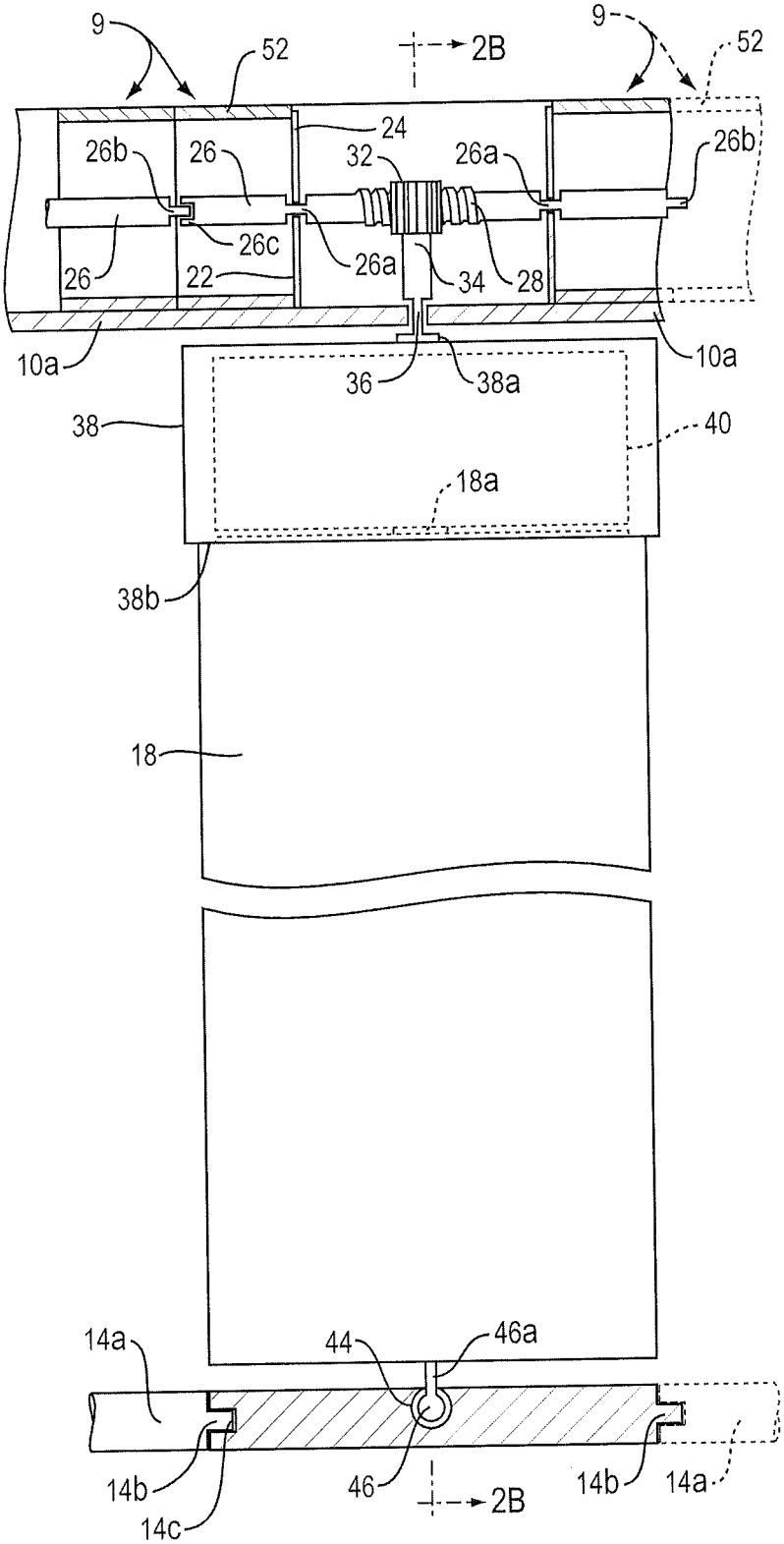
FIG. 2A is a front elevational view with parts broken away, on a larger scale, showing a module of the FIG. 1A assembly in greater detail.
Figure 2B:
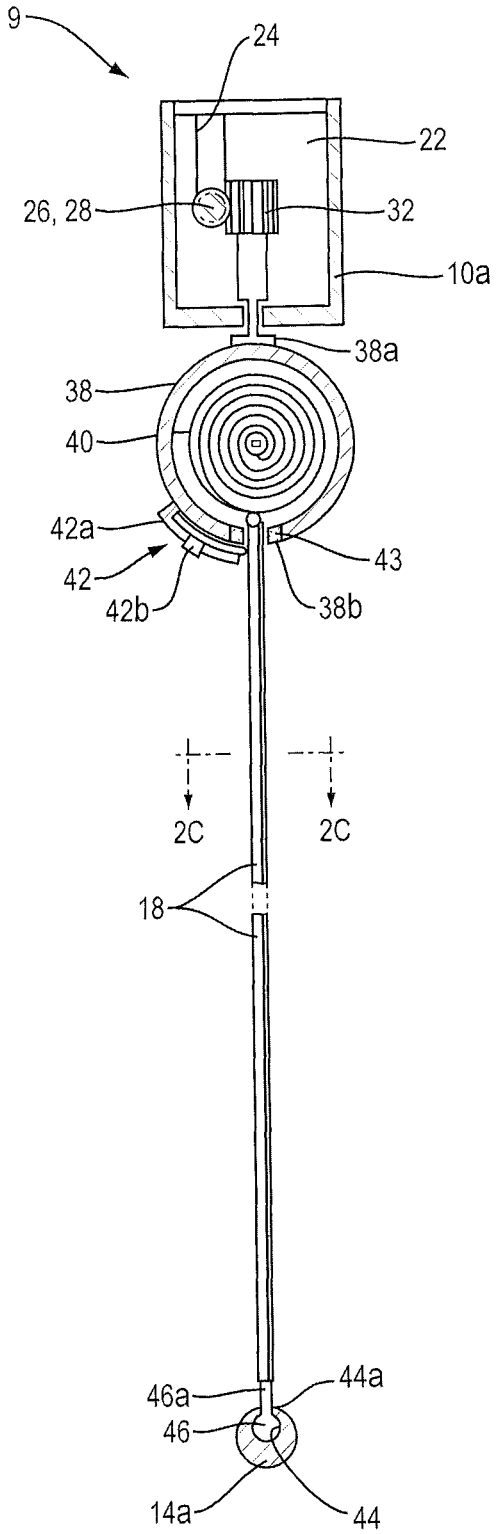
FIG. 2B is a sectional view taken along line 2B-2B of FIG. 2A.

Referring now to FIGS. 1A, 2A and 2B, the blind assembly is illustratively composed of a plurality of substantially identical modules 9, one for each slat 18. Each module includes a head rail or segment 10*a* which can be connected end to end to the units or segments 10*a* of adjacent modules 9 to form a head rail 10 that is long enough to span the window opening. Each unit 10*a* has a generally U-shaped cross-section and is provided with a pair of interior partitions 22 spaced apart along its length, each partition being formed with a vertical slot 24. The two slots 24 are aligned and adapted to receive a shaft segment 26 whose length is more or less the same as that of unit 10*a*. The shaft segment is necked down at 26*a* where it contacts the edges of the slots so that when the shaft 26 bottoms in the slots, it is captured axially by the slot walls, yet is free to rotate about its axis. One end of shaft segment 26 is formed with a key 26*b*, and a keyway 26*c* is present at the other end of the shaft segment. Also, a worm gear 28 is located midway along the segment.

Worm gear 28 meshes with a gear 32 at the upper end of an axle 34 forming a motion converter. The axle is rotatably mounted at 36 to the bottom wall of unit 10*a* so that axle 34 is fixed in the axial direction but free to rotate. Mounted to the lower end of axle 34 is a cylindrical housing 38 which contains a spring mechanism 40 similar to the one present in a conventional tape measure. Preferably, the housing 38 is releasably secured to the lower end of axle 34 so that it can be removed and replaced easily. For example, the lower end of axle 34 may have a non-circular cross section and plug into a similarly shaped socket 38*a* at the top of the housing. A spring-loaded ball 41 (FIGS. 4A and 4B) present near the end of axle 34 releasably engages in a groove to retain the shaft end in the socket.

Figure 2C:
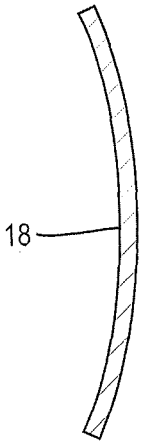
FIG. 2C is a sectional view on a still larger scale taken along line 2C-2C of FIG. 2B.

The upper end of the corresponding slat 18 is releasably connected at 18*a* to that mechanism 40 so that the slat can be wound up into a coil inside the housing. Slat 18 is similar to the tape in a conventional tape measure except that it is wider. That is, the slat is made of a springy metal or plastic material and has a camber as shown in FIG. 2C so that the slat may be rolled up in, and dispensed from, the housing 38 via a slot 38*b* therein located opposite axle 34, yet the slat is relatively stiff when extended much like the metal tape of a tape measure. In other words, when each slat 18 is pulled down via foot rail 14, it is drawn from the associated housing 38 in opposition to the bias of spring mechanism 40 therein and when the slat is pushed up, it is automatically wound up inside the housing by that mechanism.

A manually adjustable brake shown generally at 42 may be mounted to the outside of housing 38 adjacent to slot 38*b*. As best seen in FIG. 2B, the brake includes a slide 42*a* integral to the outside of the housing and a slider 42*b* movable along the slide. When the slider 42*b* is slid toward slat 38*b*, an end thereof frictionally engages the face of slat 18. The slider can be adjusted so that it exerts just the right amount of drag on slat 18 so that the slat will remain at the elevation to which it is set by the user.

Also, if desired, the edges of the housing slot 80*b* may be lined with a flock or brush material 43 so that the slat 18 is automatically dusted when moved in and out of the housing 38.

Each module 9 of the assembly also includes a foot rail unit 14*a* in the form of a generally cylindrical rod which may be connected end to end to the foot rail units 14*a* of adjacent modules to form the complete foot rail 14 shown in FIGS. 1A and 1B. To achieve this objective, one end of each unit 14*a* has a key 14*b* and the other end is formed with a keyway 14*c*. Each unit 14*a* also has a keyhole-type socket 44 midway along its length. The socket is shaped and adapted to accept a ball 46 affixed via a stem 46*a* to the lower end of the associated slat 18 so that once the ball is inserted into the socket via a socket mouth 44*a* (FIG. 2B), it is locked therein but still free to rotate about a vertical axis that is collinear to the axle 34 of that module 9.

Figure 1H:
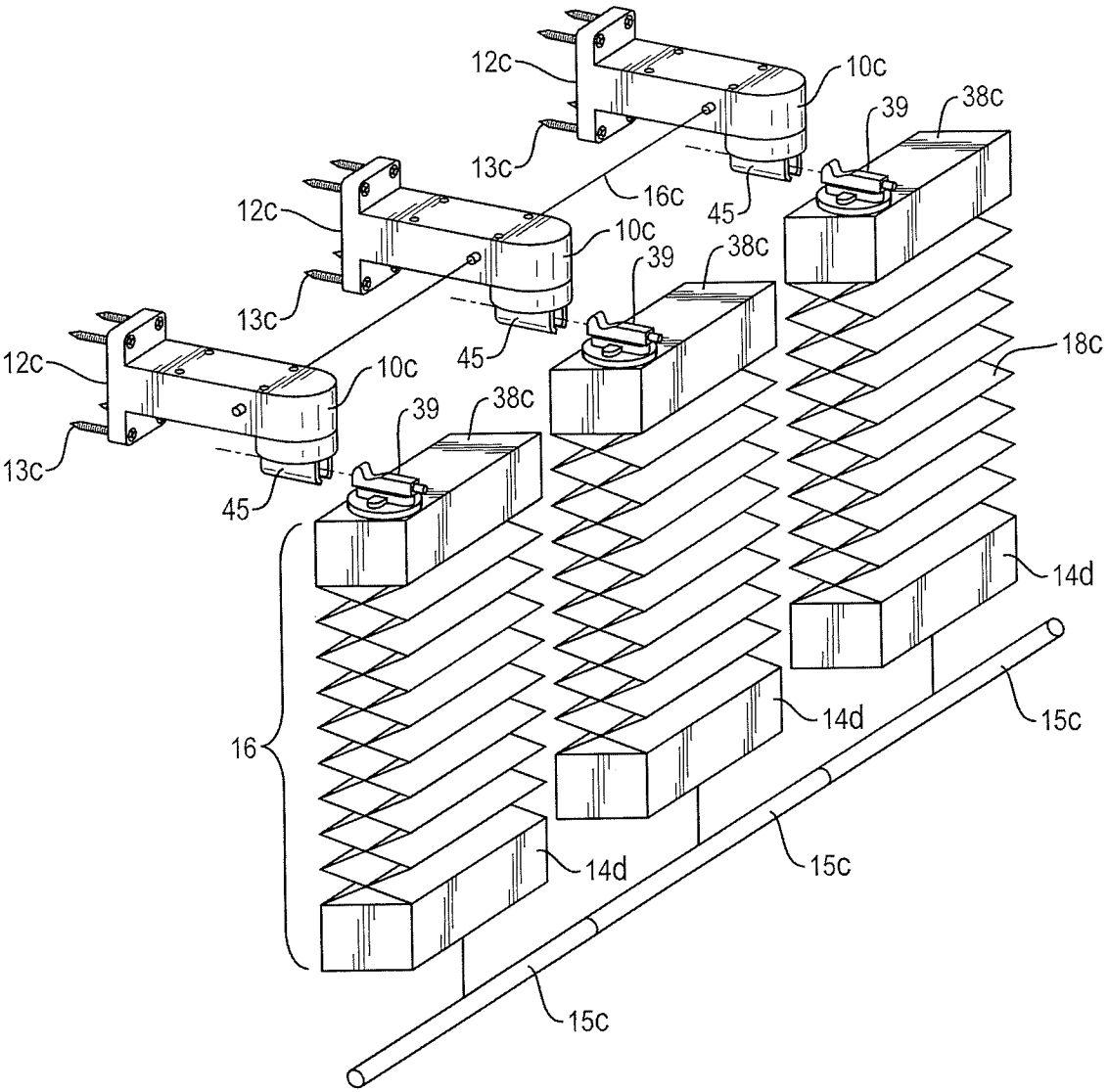
FIG. 1H that shows a plurality of assemblies that are connected to one another.

Similarly, and with reference to FIG. 1H that shows a plurality of assemblies that are connected to one another, rails 15*c* may be utilized to connect foot rails 14*d* of adjacent assemblies. Specifically, each rail 15*c* may be attached to the underside of foot rail 14*d*, and the rails 15*c* may be joined together as shown in FIG. 1H. Rail 15*c* may further be utilized to move all adjacent assemblies in unison to a desired height by pulling or pushing rail 15*c* in a particular direction. In an alternative embodiment, a first set of window assemblies may be connected together using rails 15*c*, while other assemblies may not be connected. This allows a user to raise or lower the connected assemblies without modifying the height of the assemblies that are not connected, or vice versa. Further, and as shown in FIG. 1H, a wire attachment 16*c* may be utilized to pivot or rotate the blind 16 of adjacent assemblies in unison. Further, it is noted that foot rails 14*d* of adjacent assemblies may be joined utilizing rail 15*c* regardless of the fact that adjacent assemblies may be different sizes.

Figure 1I:
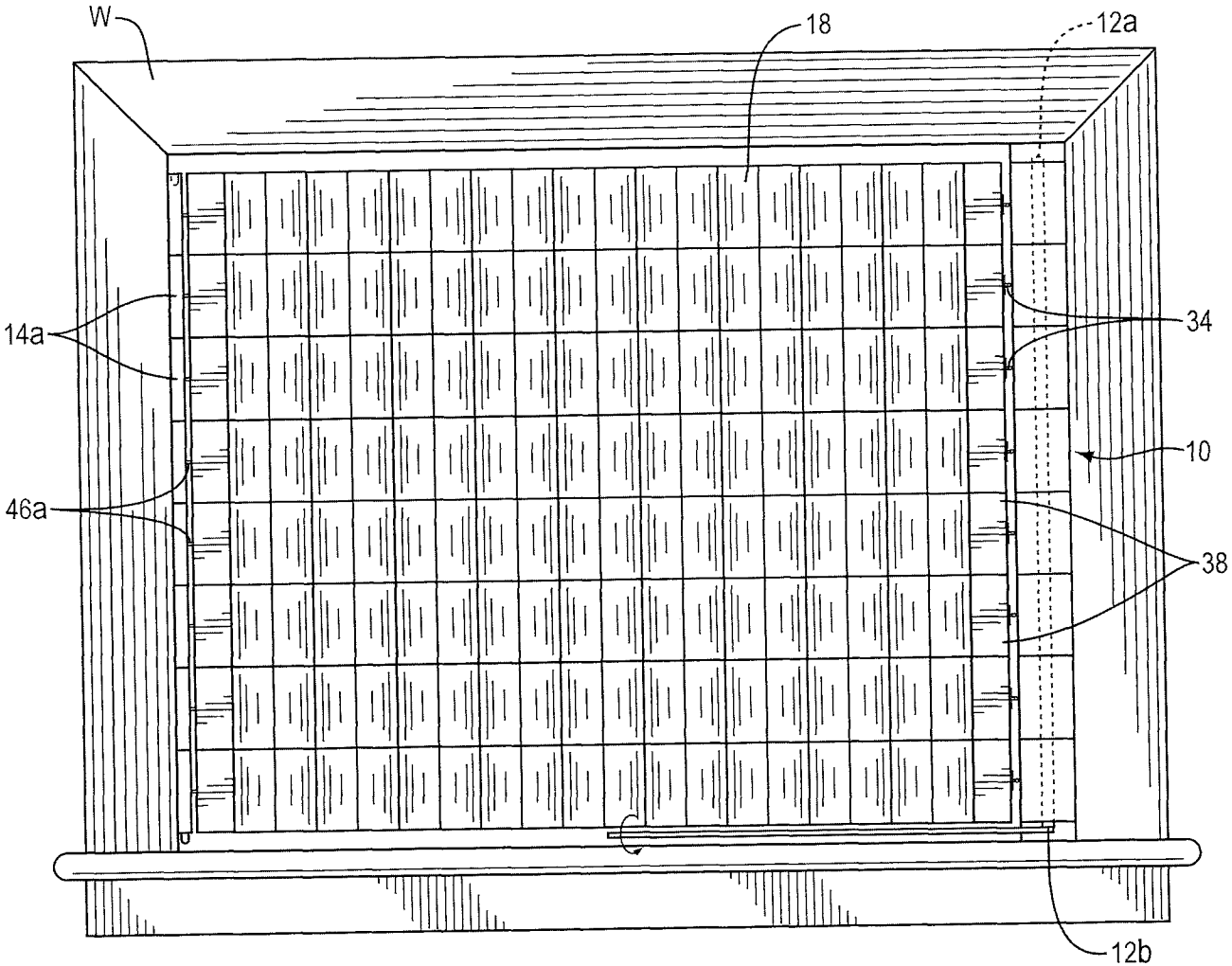
FIG. 1I is a front elevational view of my modular window blind assembly whose blind, composed of a plurality of modules, that can be manipulated to and from a fully retracted position and a fully extended position.

As shown in FIG. 1I my vertical blind assembly may include a head rail 10 mounted at a side of the window W by means of brackets 12*a* and 12*b* which support the opposite ends of the head rail. The assembly also includes a foot rail shown generally at 14, that extends on the other side of the window W and between the head rail and the foot rail is a window blind 16 comprised of a plurality of vertical slats or louvers 18. It is noted that foot rail 14 may be secured to the exterior of the window by brackets similar to brackets 12*a* and 12*b*. By extending or lowering the foot rail 14 to and away from the head rail 10, the blind 16 may be moved from a fully extended or retracted position shown in FIG. 1I to a partially retracted or extended position, not shown, and then to a fully extended or retracted position, not shown, wherein the foot rail 14 lies next to the head rail 10 so that the blind 16 does not obstruct the view through the window. Furthermore, by turning a wand 20 in one direction or the other, the slats 18 of blind 16 can be rotated about their horizontal axes from a fully closed position as shown in FIG. 1I, through a partially open position shown not shown so that a selected amount of light can pass through the blind to a fully open position not shown wherein the slats 18 are perpendicular to the head and foot rails and window so that light can pass through the extended length of blind 16. In an alternative embodiment, an electric motor (not shown) may be housed in the head rail 10, where the electric motor can be used for all individual units, with or without a remote control, including a bevel gear which may turn all the individual assemblies/units in unison. The use of the electric motor may be particularly advantageous for windows that have heights that are too high or too long of lengths that would be difficult for a user to reach by hand.

Figure 1J:
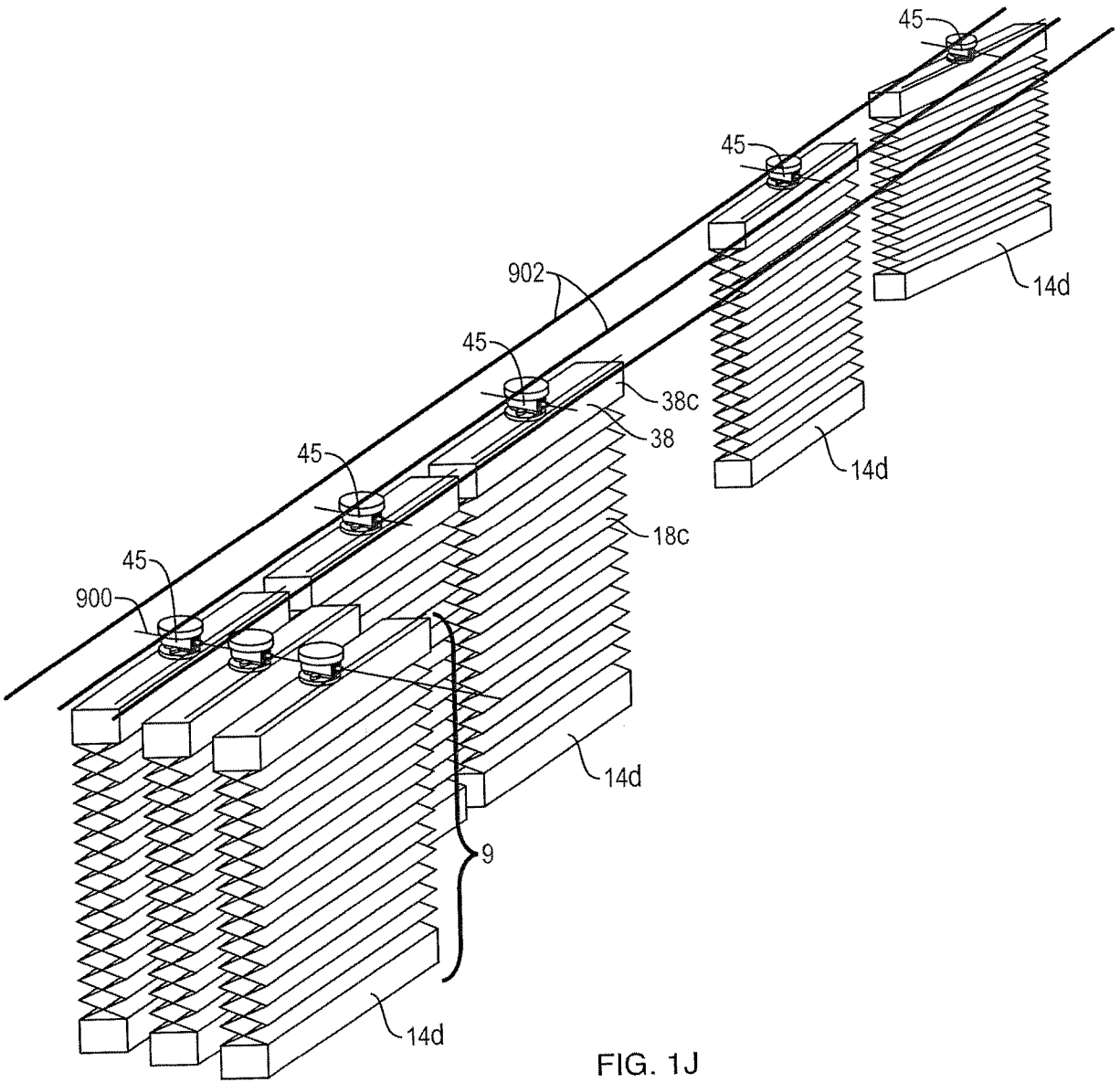
FIG. 1J is a front elevation view of my modular window blind assembly whose blind, composed of a plurality of modules, are stacked at one end.

As shown in FIG. 1J, my vertical blind assembly may comprise a plurality of modules 9 stacked on extension 900 located at the end of a window. Specifically, when the modules are moved or positioned to one side of the window, for example, on rail(s) 902, the modules 900 can be stacked, one in front of the other to save space and for organization purposes. Specifically, each module may be recessed on a rod or extension 900 that exists on the side of the window.

As noted above, each module 9 may be joined to adjacent similar modules. More particularly, as shown in FIG. 2A, each head rail unit 10*a* may be connected to an adjacent head rail unit by a tubular coupling 52 which slides into the ends of the abutting units 10*a*, until it is stopped by partitions 22. When this connection is made, the key 26*b* of the shaft segment 26 in one unit 10*a* may be inserted into the keyway 26*c* of the shaft segment 26 of the adjacent unit 10*a*. In addition, the foot rail units 14*a* of the adjacent modules 9 being joined together may be linked by inserting the key 14*b* of one unit or segment 14*a* into the keyway 14*c* of the abutting unit 14*a*. Preferably, the keys 14*b* and keyways 14*c* are designed so that when the units 14*a* are keyed together, all of the sockets 44 face upwards as shown in FIGS. 1A and 2A.

Thus, when all of the modules 9 are joined together, head rail units 10*a* collectively form a common, straight rigid head rail 10 and the foot rail units 14*a* collectively form a common, straight foot rail 14. Also, the shaft segments 26 of all the modules 9 are keyed together end to end to form a common shaft which may be rotated from one end. As best seen in FIG. 2A, when the shaft segments 26 are rotated in one direction or the other, their worm gears 28 turn the corresponding gears 32 which, via axles 32, rotate housings 38 and the slats 18 extending therefrom in unison about the longitudinal axes of the slats. The slats are free to rotate relative to the straight foot rail 14 by virtue of the ball and socket connections between the individual slats and their associated foot rail units or segments 14*a*. In this way, the slats can be turned in unison between their respective open and closed positions.

In the window blind assembly depicted in FIGS. 1A and 1B, the housings 38, slats 18 and foot rail segments 14*a* have the same width as head rail segments 10*a*. Resultantly, when the blind 16 is in its closed condition shown in FIG. 1A, the slats 18 are arranged edge to edge. In some applications, the blind may be designed so that when it is closed, the adjacent slats 18 overlap to some extent. For this, the housings 38, slats 18 and foot rail units 14*a* are made, say, 10% wider than the head rail units 10*a* so that when the blind 16 is fully closed, the overlapping housings 38, slats 18 and foot rail units 14*a* are oriented at a small angle, e.g., 10-15°, which assures that there will be no gaps between the slats when blind 16 is closed.

Figure 3:
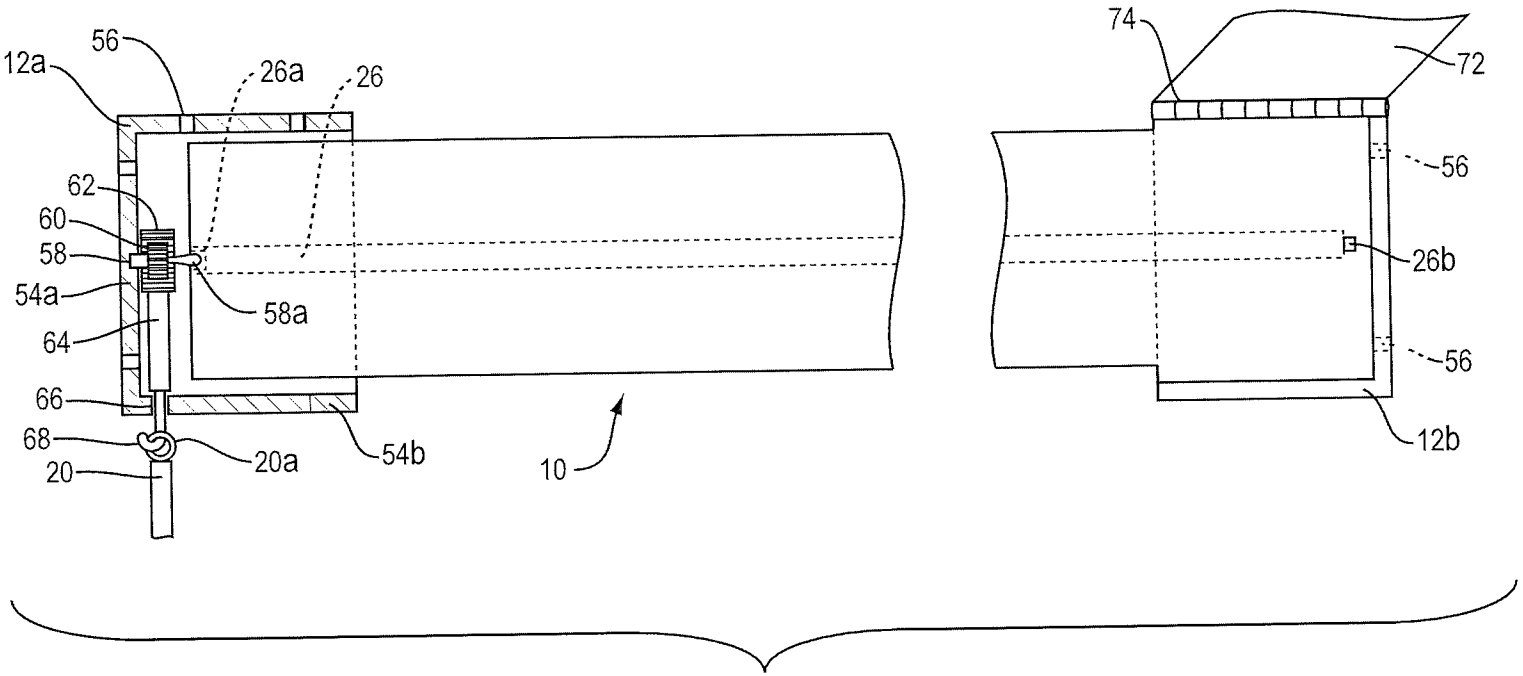
FIG. 3 is a longitudinal sectional view, with parts broken away, showing the ends of the FIGS. 1A and 1B assembly in greater detail.

Turning now to FIG. 3, as noted above, the head rail 10 is supported by brackets 12*a* and 12*b*. Bracket 12*a* is formed as a rectangular cap lying on its side. That is, it has an end wall 54*a* and fastener holes 56 for mounting the bracket to the casing of window W (FIG. 1A). Rotatably mounted to that wall is one end of an axle 58 whose other end is formed as a key 58*a* which keys into the keyway 26*c* of the shaft 26 at the left end of head rail unit 10 when that end is inserted into bracket 12*a*. Axle 58 carries a gear 60 which meshes with a worm gear 62 at the upper end of a shaft 64 rotatably mounted at 66 in the lower wall 54*b* of bracket 12*a*. The lower end of shaft 64 extending down from the bracket terminates in a hook 68 which hooks through an eye 20*a* at the upper end of wand 20. Thus, when the wand 20 is rotated about its axis, that motion is transmitted to the worm gear 62 which, in turn, rotates all of the shaft segments 26 and thus all of the gears 32 and slats 18 in unison.

The other bracket 12*b* supporting the right end of head rail 10 has a configuration similar to that of bracket 12*a* except that it has a front wall or corner 72 that is hinged at 74 to the top wall of the bracket so that the cover can be swung up to allow the right end of head rail 10 to be inserted into bracket 12*b* after the left end of the head rail has been plugged into bracket 12*a* as just described. After the right end of the rail 10 is seated in bracket 12*b*, the cover 72 may be swung down to close the front of the bracket. The lower end of the cover 72 may be formed with a lip (not shown) which underhangs the lower wall of bracket 12*b* to retain the corner in its closed position.

It will be appreciated from the foregoing that the modular construction of my assembly enables modules 9 to be joined so that the blind assembly as a whole can be made to fit a window of almost any size. Also, if one or another of the slats 18 should become damaged, it is easily replaced by disconnecting its upper end connection 18*a* at the associated housing 38 and disconnecting its ball 46 from the associated foot rail unit 14*a*. Alternatively, the housing may be separated at its socket 38*a* from the associated axle 34 and the associated foot rail segment 14*a* detached from its neighboring segments 14*a*. In a similar fashion, the slats 18 may be changed easily to suit a particular user's decorative intent.

It is apparent from the foregoing that the various modules 9 are easy to assemble and the overall assembly is easy to install in, and take down from, a window so that the blind assembly is particularly useful to people who move frequently or who rent apartments. When the assembly is in place, its blind 16 can be raised and lowered easily by lifting up and pulling down the foot rail 14 and even when the blind 16 is in a partially raised or extended position, the slats 18 still can be oriented to allow the desired amount of light to pass through the blind.

Figure 4B:
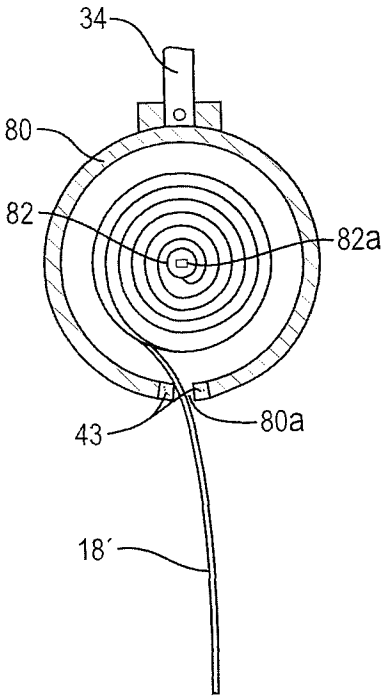
FIG. 4B is a sectional view taken along line 4B-4B of FIG. 4A.
Figure 4A:
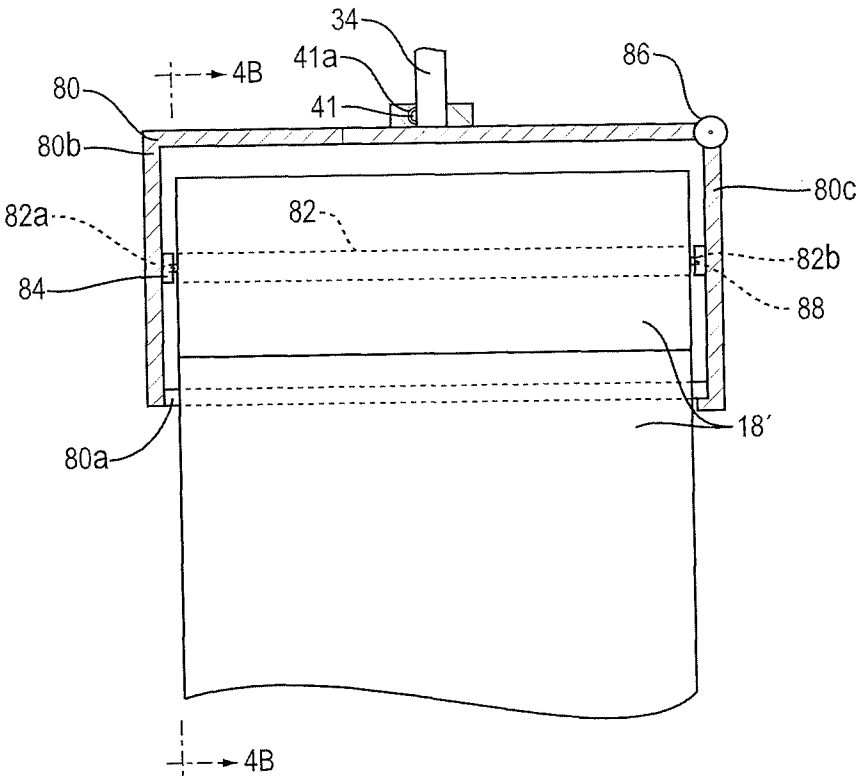
FIG. 4A is a front elevational view, with parts in section, of an alternative module embodiment for use in the FIGS. 1A and 1B assembly.

Referring now to FIGS. 4A and 4B, in some applications it may be desirable for the blind 16 (FIG. 1A) to comprise slats 18' of a non-springy fabric or plastic material. In alternative embodiments, slats 18' may be a bendable material such as bendable electronic display that allows for the display of video, television, and/or pictures. Advantageously, presentations or advertisements or other digital pictures, may be displayed on slats 18'. Further, the bendable material may be bendable solar panels, mirrors, and/or mosquito netting, as well as other bendable materials as known by those skilled in the art. Such a slat may be dispensed through a slot 80*a* of a cylindrical housing 80 comparable to housing 38 in FIGS. 2A and 2B. In this case, however, housing 80 contains a roller 82 around which the slat 18' may be wound. Roller 82 is similar to a conventional window shade roller except that it is quite short commensurate with the narrow width of the slat 18'. The roller 82 does contain the usual spring and ratchet found in a standard window shade roller so that the slat 18' can be drawn from, and rolled up on, the roller.

Housing 80 has an end wall 80*b* formed with a rectangular hole 84 for receiving the usual flat end of the ratchet axle 82*a* projecting from one end of roller 82. The other end wall 80*c* of housing 80 is hinged at 86 to the top of the housing so that it can be opened, enabling roller 82 to be inserted into the housing. The wall 80*c* is formed with a round hole 88 so that when the door is closed, hole 88 receives the round axle 82*b* that projects from the adjacent end of roller 82. Thus, when the wall 80*c* is closed, roller 82 is rotatably supported within the housing 80 and when it is rotated to dispense slat 18', the roller spring is wound up so that there is an upward bias on the slat 18'. However, upward movement of the slat is prevented by the ratchet in the roller unless the ratchet is released by pulling down, and then releasing, the slat as is done with the panel of a conventional window shade. The ratchets in the rollers 82 of all modules comprising the assembly should be aligned initially so that they all operate substantially in unison when blind 16 is raised and lowered. A window blind 16 incorporating the flexible slats 18' can be adjusted to open and close the slats even when the blind is in a partially raised position in the same manner described above in connection with the assembly depicted in FIGS. 1A and 1B.

In some instances, it may be desirable to positively secure the foot rail 14 when the shade 16 is at a desired elevation in window W particularly when the blind comprises fabric slats 18'. For this, one or more foot rail extensions 90 may be added to the opposite ends of the foot rail 14 as shown in FIG. 1B to extend the foot rail to the sides of the window casement. Also, a vertical strip 92 formed with a series of spaced apart keys or keyways 92*a* may be adhered or otherwise secured to the interior side walls of the window casement as shown in phantom in FIG. 1B. In FIG. 1B, the right hand strip 92 carries keyways to receive the key 14*b* at the extended right end of the foot rail 14 and the strip 92 at the left side of that figure has keys which can project into the keyway 14*c* at the extended left end of the foot rail 14. In this way, the blind 16 can be secured at a variety of different elevations in the window W. Of course, when the shades are secured in this fashion, the brake and ratchet mechanisms in the housings 38 and 80 for controlling the vertical movement of the slats would not be required.

Figure 5:
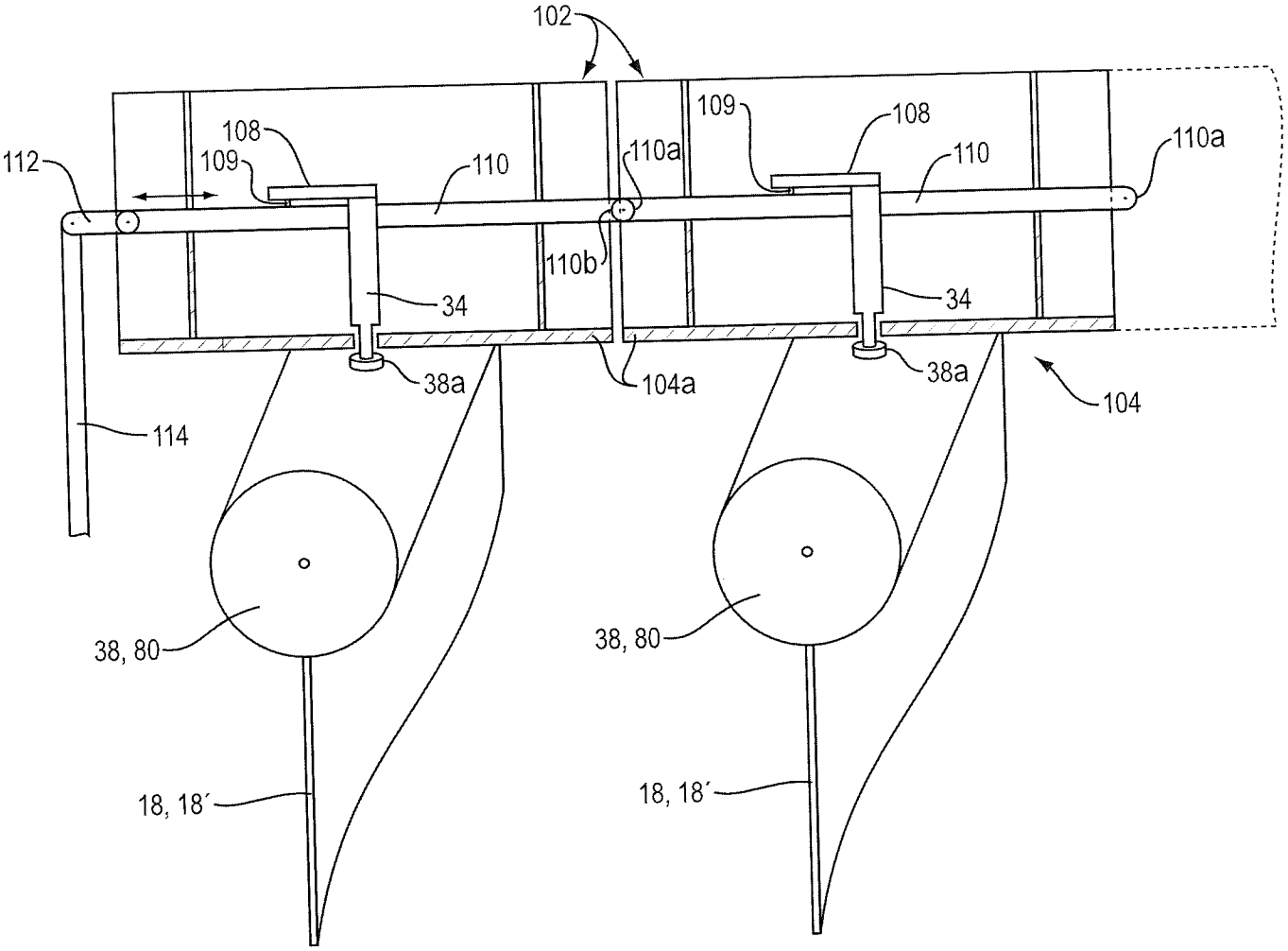
FIG. 5 is an isometric view with parts cut away showing still another module embodiment for use in the FIGS. 1A and 1B assembly.

Refer now to FIG. 5 illustrating another embodiment of my window blind assembly which includes a somewhat different mechanism for rotating the slats 18 or 18'. This embodiment is comprised of identical modules shown generally at 102, each of which includes a channel-shaped head rail unit or segment 104*a* similar to unit 10*a* described above. The couplings 52 for joining adjacent units to form a complete head rail 104 have been omitted for ease of illustration. As before, each module 102 also includes a slat housing 38 or 80 pivotally connected by an axle 34 to the bottom wall of each unit 104*a* midway along its length. However, instead of providing a worm gear at the upper end of axle 34 to form the motion converter, that axle is topped off by a short lever arm 108 which extends laterally within the head rail unit or segment 104*a*. The free end of the lever arm 108 is pivotally connected at 109 to an actuator unit or segment 110 which extends along the length of that unit 104*a* and is slidably supported by slotted partitions 111. Each actuator unit 110 is formed with a hook 110*a* at one end and an eye 110*b* at its opposite end, the hook and eye being adapted to mate with the eye and hook, respectively, of adjacent actuator units 110. When the actuator units or segments 110 are secured together and moved one way or the other along the head rail 104, the slats 18 or 18' are rotated in unison between their open and closed positions as described above.

To facilitate moving the actuator units, an actuator extension 112 may be connected to the actuator unit at an end of the head rail 104, e.g. the left end as shown in FIG. 5. The other end of the extension 112 connects to a vertical wand 114 by which a user may open and close the slats 18 or 18', even when the slats are partially raised. Thus, the FIG. 5 embodiment has all of the advantages described above in connection with the blinds depicted in the other drawing figures. It has an additional advantage in that it is less expensive to make than those other embodiments because it requires no gears.

Figure 6:
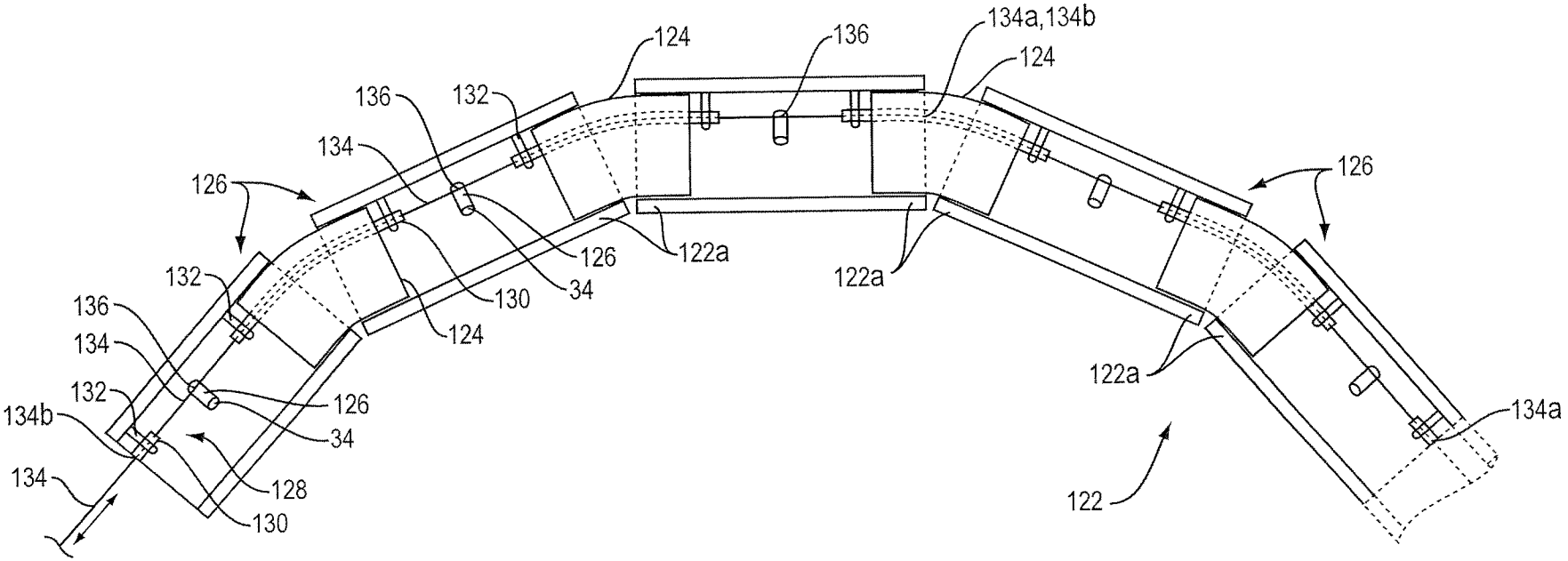
FIG. 6 is a top plan view of a modular blind assembly embodiment suitable for a bow window.

Refer now to FIG. 6, which illustrates an embodiment of my window blind assembly which may be fitted to a bow window having substantially any curvature. This embodiment comprises a plurality of similar modules indicated at 120, each of which includes a channel-shaped head rail unit or segment 122*a*. The units 122*a* of adjacent modules may be secured together by flexible couplings 124 to form a complete head rail 122. A slat housing 38 or 80 (not shown) is suspended from each head rail unit by an axle 34, which in this case is topped off by a lever arm 126.

Positioned inside each head rail unit 122*a* is a segment 128 of coaxial cable similar to a speedometer cable. That is, cable segment 128 has a flexible outer sheath 130 which is secured at two points 132 along the sheath to the associated unit 122*a* and a flexible inner wire 134 which is movable relative to sheath 130, both rotationally and longitudinally. The sheath 130 is cut away between points 132 to allow a connection at 136 of the cable wire 134 to the free end of the lever arm 126 in that unit or segment 122*a*. Preferably, each connection 136 is adjustable, e.g. a sleeve at the end of the lever arm with a set screw, so that the connections 136 can be adjusted along the wires 134. In this way, the open and closed positions of all of the slats in the blind can be set, depending on the curvature of the bow window, so that all the slats open and close together.

Still referring to FIG. 6, the wire component 134 of the cable segment 128 in each head rail unit or segment 122*a* is formed with a hook 134*a* at one end and an eye 134*b* at the other end, enabling those wires to be hooked to the eyes and hooks, respectively, of the wires 134 in the adjacent head rail units 122*a* comprising the head rail 122. A wire extension 138 may be hooked to the wire 134 at one end of the head rail, e.g. the left end shown in FIG. 6, that extension leading to a wand (not shown), enabling a user to move all of the wires 134 in one direction or the other to rotate all of the housings 38 or 80 in unison to open and close the slats 18 or 18', as described above. Due to the presence of the bow, the edges of adjacent slots may be spaced apart to some extent. However, the blind will still block most of the sunlight incident on the blind. To avoid such gaps, the slats can be designed to overlap as described above.

Of course, if each wire 134 were fitted with a worm gear along its length for meshing with a gear mounted to the top of axle 34 of the associated module 120, the common wire could be rotated to turn the slats 18 or 18' in the same manner described above in connection with FIGS. 2A and 2B.

Figure 6B:
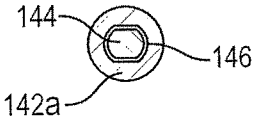
FIG. 6B is a sectional view taken along line 6B-6B of FIG. 6A.
Figure 6A:
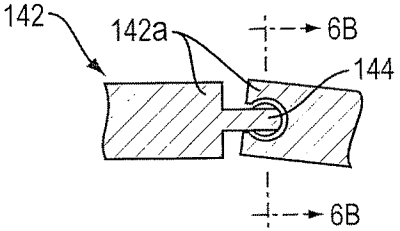
FIG. 6A is a fragmentary longitudinal sectional view showing a segment of a curved foot rail for use in the FIG. 6 embodiment.

Since the blind assembly shown in FIG. 6 has a curved head rail, it should also have a curved foot rail as shown generally at 142 in FIG. 6A. Rail 142 is composed of straight foot rail units or segments 142*a* which are similar to unit 14*a* depicted in FIG. 2A except that the key and keyways at the ends of the unit are replaced by a ball 144 and socket 146, both of which have flats at their tops and bottoms as shown in FIGS. 6A and 6B so that the adjacent keyed-together units 142*a* can pivot in a horizontal direction but not in a vertical direction.

Figure 7:
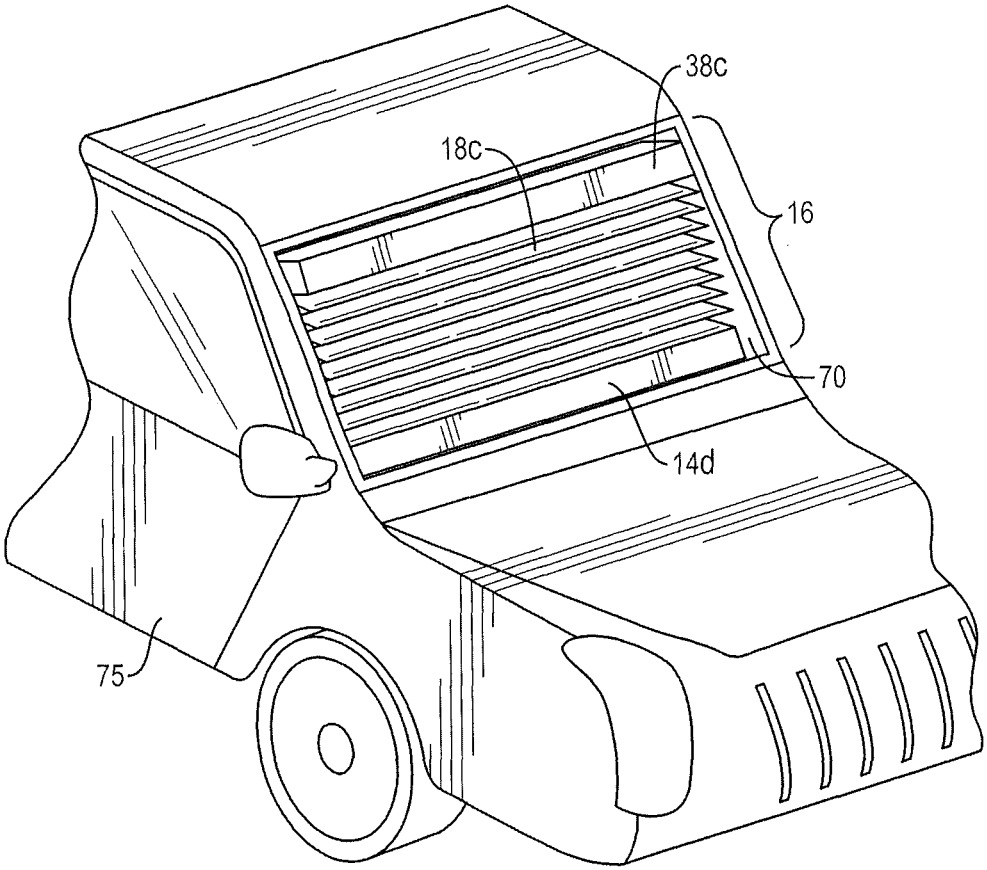
FIG. 7 is a venetian accordion blind that may be utilized in a motor vehicle.

FIG. 7 is a venetian accordion blind that may be utilized in a motor vehicle 75, such as a car or boat, to deflect heat or provide privacy. It is noted that blind 16 can be adjusted in a similar manner, as described above, to be sized to fit within a windshield 70 by simply pulling or pushing foot rail 14*c* to a certain height.

Figure 8:
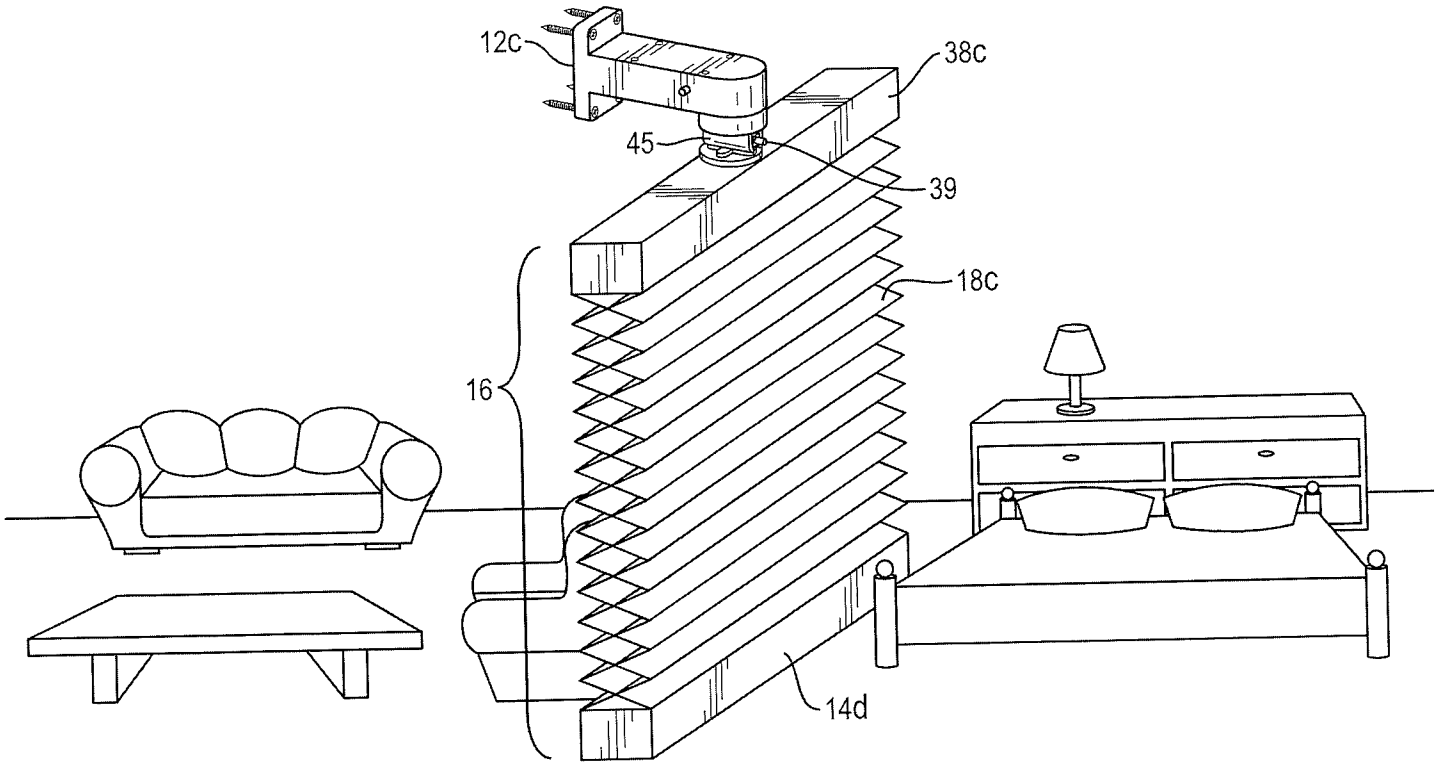
FIG. 8 is a venetian accordion blind that may be utilized as a door or a room divider.

FIG. 8 is a venetian accordion blind that may be utilized as a door or a room divider. Specifically, different materials may be utilized for the slats 18, 18*c*, and a user may attach head rail 10 or head rail unit 10*c* to a ceiling or wall. Advantageously, a user can join a plurality of assemblies and can utilize the venetian accordion blind(s) to divide or split a room or space. When the user does not wish to divide the room, the user can raise the foot rails 14 of the joined assemblies, as described above. It is noted that the blinds may be controlled by the electric motor, as described above, to easily and quickly allow the user to expose or hide the room divider.

Figure 9:
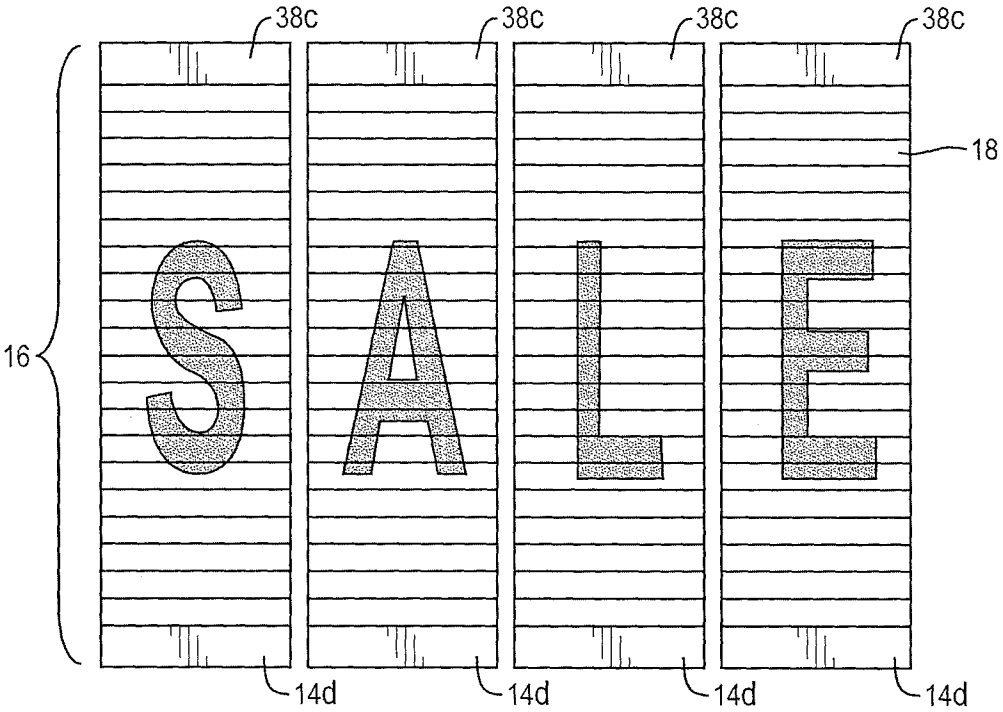
FIG. 9 are venetian accordion blinds that may be utilized as a banner or advertisement.

FIG. 9 are venetian accordion blinds that may be utilized as a banner or advertisement. Specifically, the head rails 10 or head rail units 10*c*, may be pivoted in unison to expose or show the advertisement. For example, the advertisement may be displayed in a window, that for example, may be rounded, or from light posts that require a rounded view. Each assembly may be in the "open" position, so that the banner or advertisement is not shown. However, and as shown in FIG. 9, when the assemblies are pivoted, the banner or advertisement 94 that reads "SALE" may be displayed or exposed. It will be appreciated that in alternative embodiments, differing text may be utilized. As such, the description of the banner reading "SALE" should be taken as exemplary only. In alternative embodiments and as described above, one or more slats 18*c*, may be a bendable electronic display to display the banner or advertisement digitally or utilizing a television, projector, or other device as known by those skilled in the art.

Figure 10:
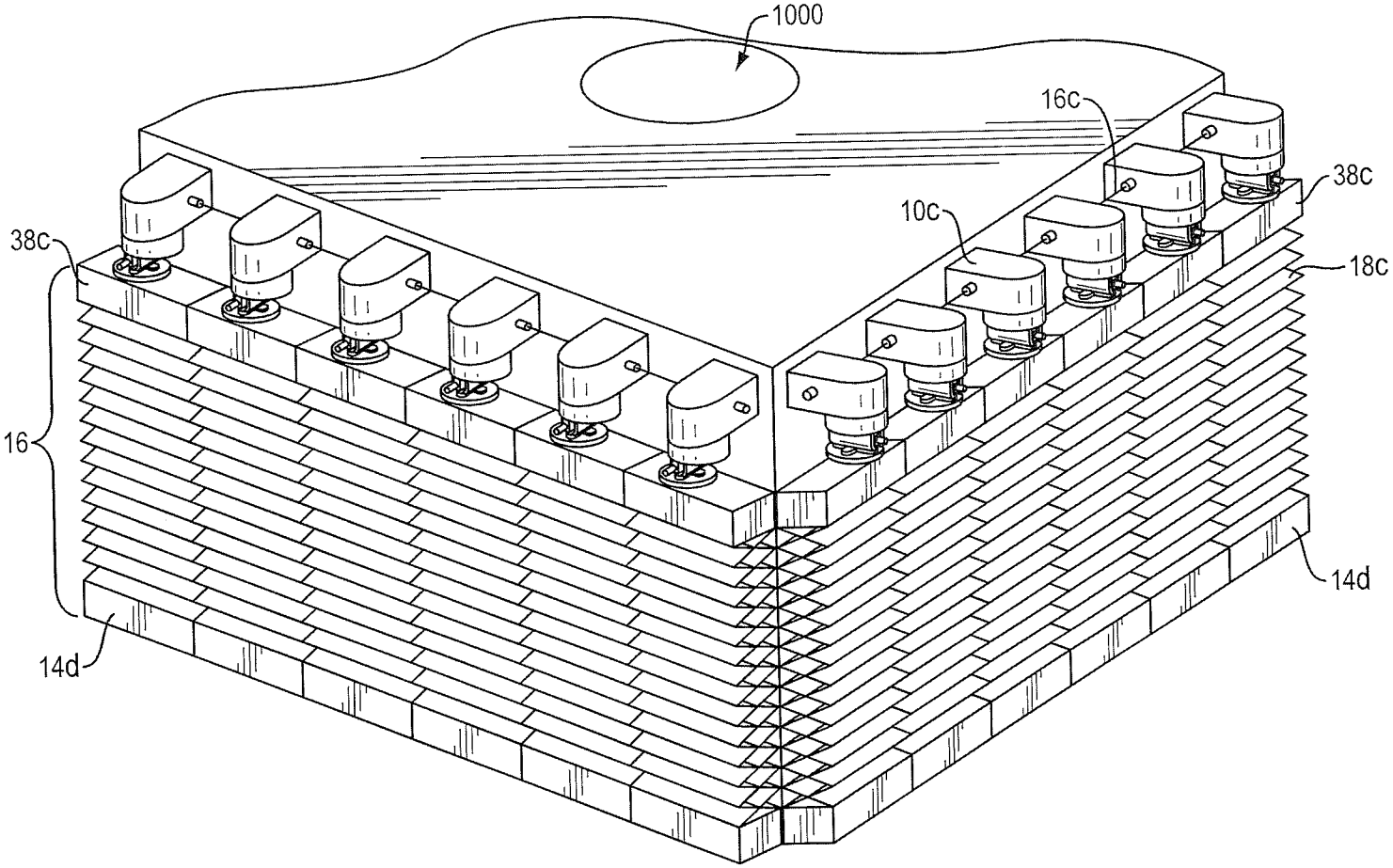
FIG. 10 are venetian accordion blinds that may be utilized as a lamp or light shade.

FIG. 10 are venetian accordion blinds that may be utilized as a lamp or light shade. Specifically, the head rail or head rail units 10*c* may be joined to make a square, circle or other shape that may surround a light source, such as a recessed light, lamp or light fixture 1000. Specifically, and as seen in FIG. 10, the length of the blinds can be altered by raising rail 14*d*. Further, more light may be emitted or allowed to travel outwardly by pivoting the assembly utilizing string 16*c*, or different mechanism such as a tape measure style arrangement, that allows the assemblies to rotate or pivot in unison.

Figure 11:
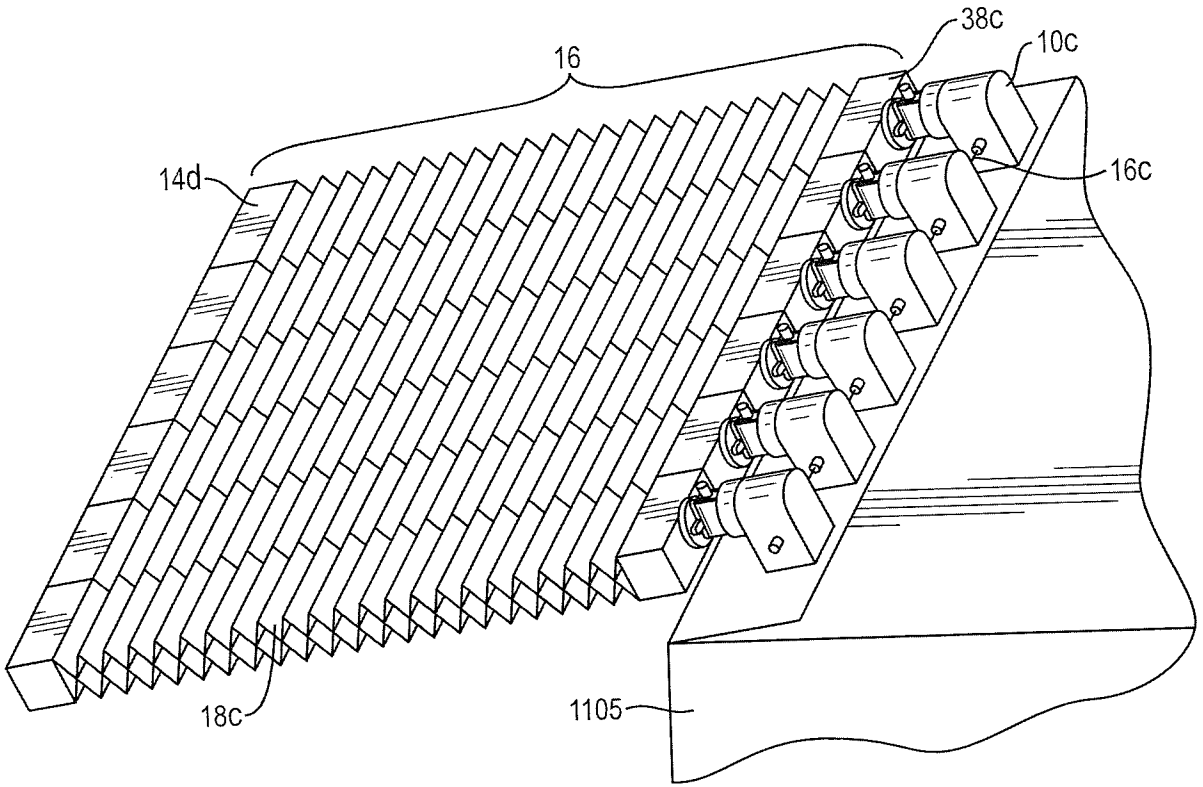
FIG. 11 are venetian accordion blinds that may be utilized as an awning.

FIG. 11 are venetian accordion blinds that may be utilized as an awning. Specifically, the head rail or head rail units 10*c* may be joined and attached to a home or building or other frame 1105 as shown in FIG. 11 to block or shade the sun.

Figure 12:
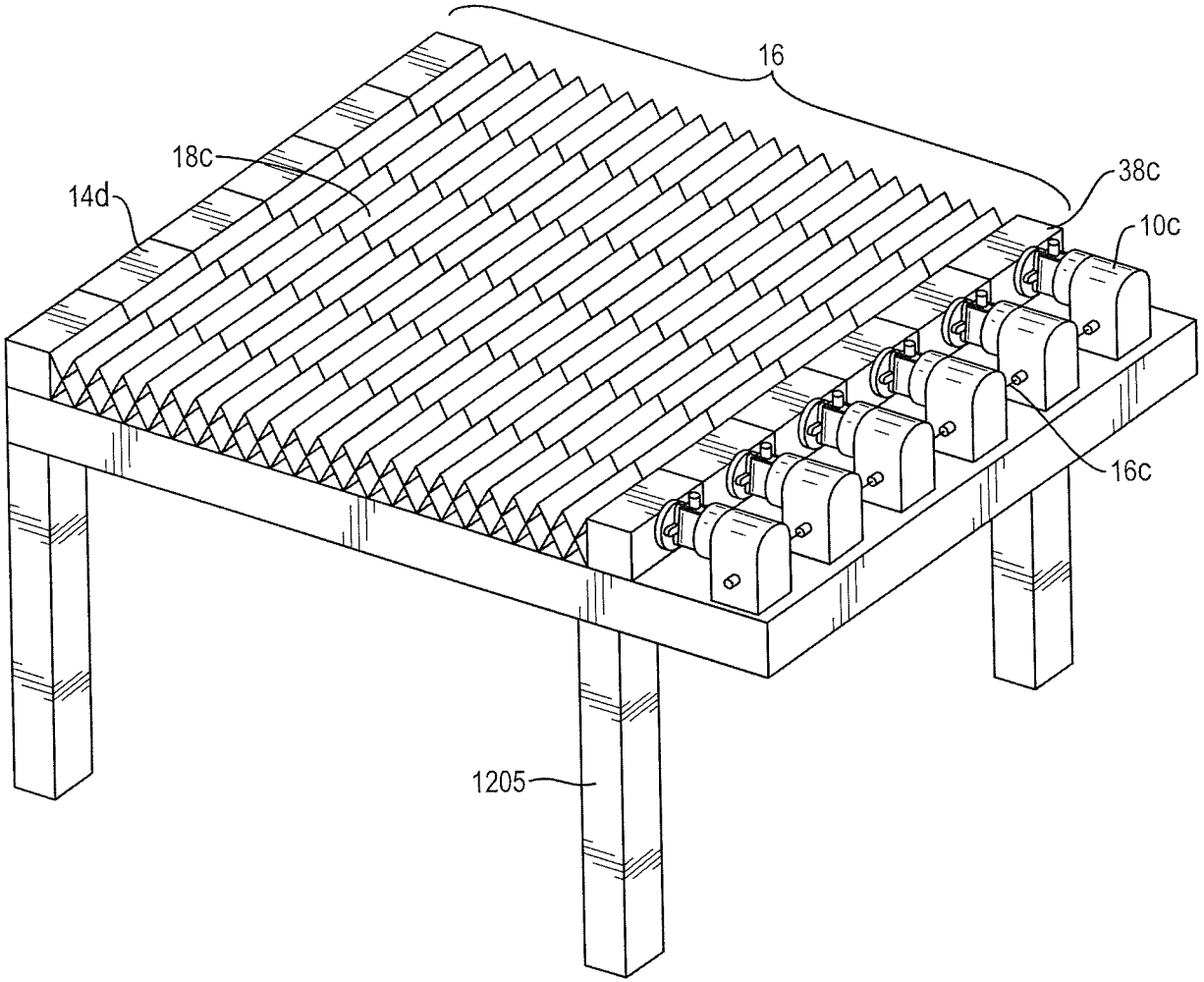
FIG. 12 are venetian accordion blinds that may be utilized as a sunshade.

FIG. 12 are venetian accordion blinds that may be utilized as a sunshade. Specifically, the head rail or head rail units

10*c* may be joined and attached to frames 1205 to block or shade the sun. It is noted that the slats 18 may be opened to allow sun to enter.

Figure 13:
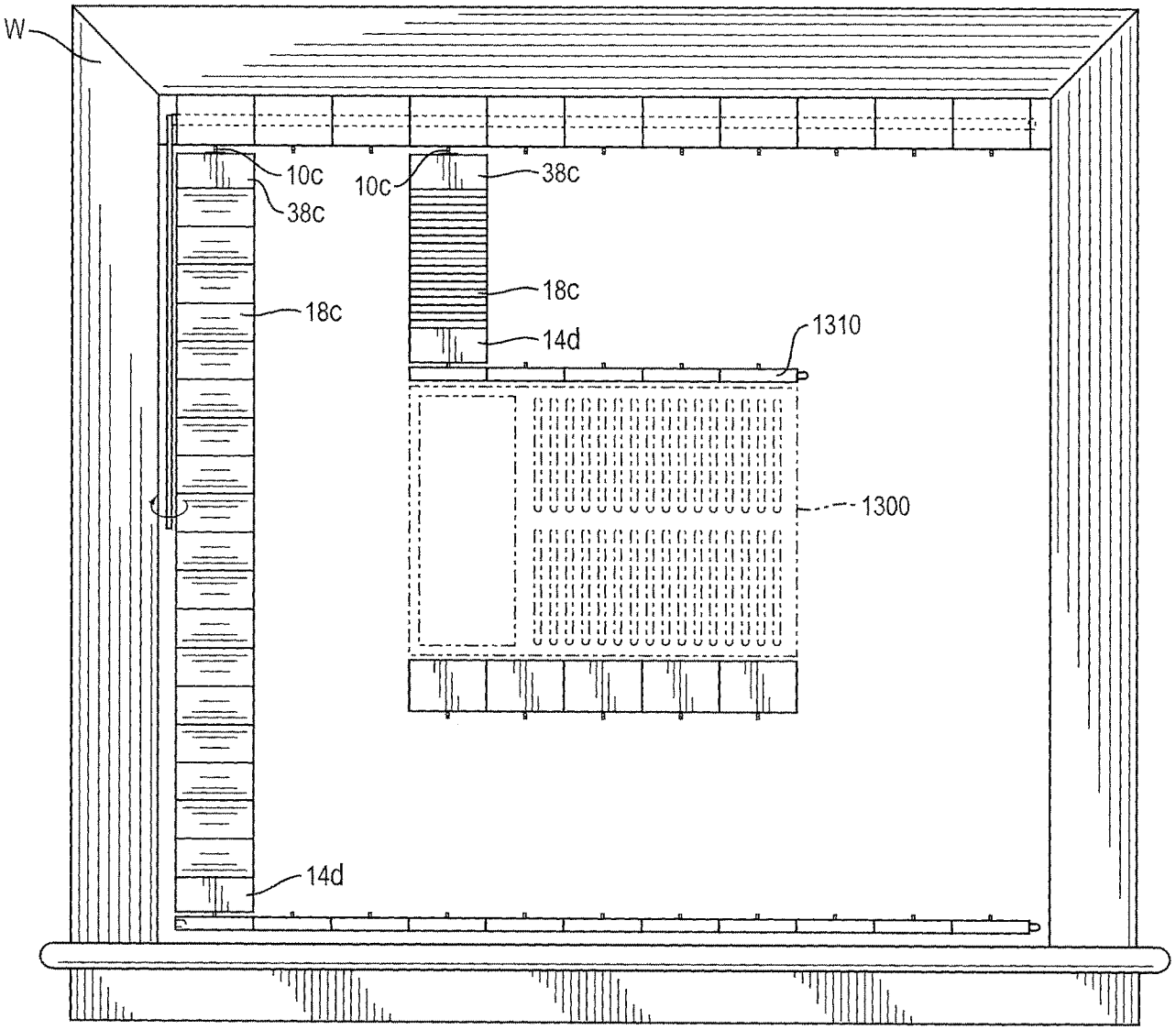
FIG. 13 are venetian accordion blinds that may be utilized to accommodate an object placed in a window.

FIG. 13 are venetian accordion blinds that may be utilized to accommodate an object placed in a window. In FIG. 13, the object in the window is an air conditioning system 1300. It is noted that one slat 18*c* or a plurality of slats 18*c* may be utilized to accommodate the air conditioning system 1300. For example, a single slat 18*c* may be sized, (e.g., width and/or length), to accommodate the air conditioning system 1300 (not shown). Alternatively, and as shown in FIG. 13, a plurality of slats 18*c* may be of different sizes (e.g., width and/or length) to accommodate the air conditioning system 1300. It is noted that housing unit 38*c* and/or 14*d*, may, in an embodiment, be secured to rail 1310 that is attached to the air conditioning system 1300. It is also noted that the blinds of FIG. 13 may be connected to a preexisting window shade or blind to then accommodate the air conditional system 1300, or any device or object in the window space.

Figure 14:
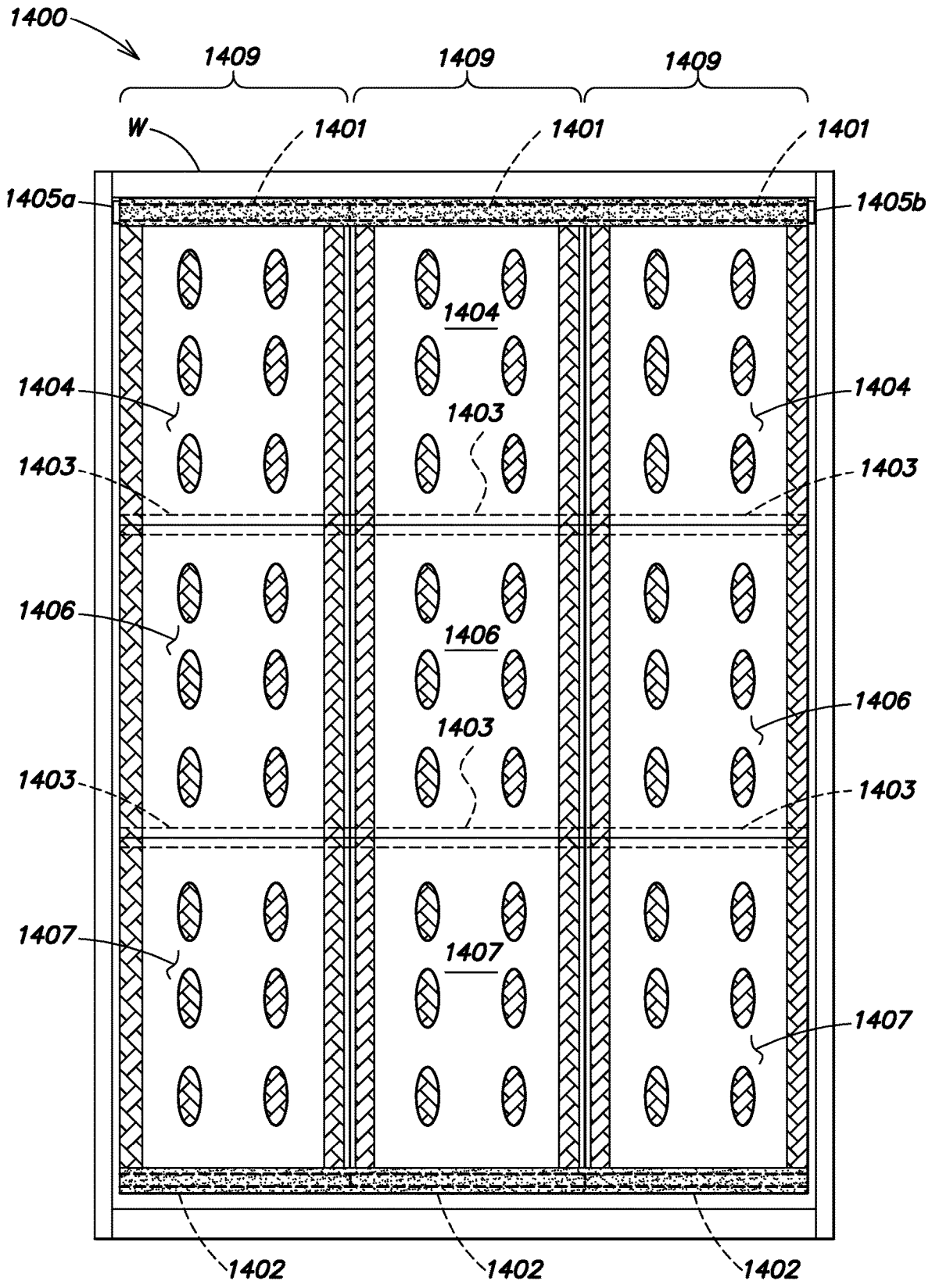
FIG. 14 is a elevational view of a modular roman shade in accordance with an illustrative embodiment of the present invention.

FIG. 14 is a front view of a modular roman shade 1400 that may be mounted at the top of a window W by means of brackets 1405*a* and 1405*b*. The modular roman shade 1400 includes a head rail unit 1401, a foot rail unit 1402, at least one intermediate rail unit(s) 1403, and a plurality of slat components. Each head rail unit 1401 is coupled to a top slat component 1404. For example, the head rail unit 1401 may be a tube, and portions of a first end of the top slat component 1404 may be inserted inside the head rail unit 1401, as will be described in further detail with respect to FIG. 16A. Alternatively, the first end of the top slat component 1404 may be clipped, or otherwise attached to the head rail unit 1401 in a variety of different ways, as known by those skilled in the art. The other end ("second end") of top slat component 1404 may be coupled to the intermediate rail unit 1403 (as shown in phantom), and a first end of the intermediate slat component 1406 may also be coupled to the intermediate rail unit 1403. For example, and as will be described in further details with respect to FIG. 16A, the intermediate rail unit 1403 may be a tube wherein portions of the second end of the top slat component 1404 and the first end of the intermediate slat component 1406 may be inserted into the intermediate rail unit 1403. The coupling of the top slat component 1404 and the intermediate slat component 1406 to the intermediate rail unit 1403 allows for the transition from the top slat component 1404 to the intermediate slat component 1406 to appear seamless and also appear as a single piece of fabric with a simple crease.

In addition, and as depicted in FIG. 14, a second end of the intermediate slat component 1406 may be coupled to an additional intermediate rail unit 1403, and a first end of a bottom slat component 1407 may also be coupled to the additional intermediate rail unit 1403. The intermediate slat component 1406 and the bottom slat component 1407 may be coupled to the additional intermediate rail unit 1403 in a similar manner as described above with reference to the coupling of the top slat component 1404 and the intermediate slat component 1406 to the intermediate rail unit 1403. In addition, the coupling of the intermediate slat component 1406 and the bottom slat component 1407 to the additional intermediate rail unit 1403 allows for the transition from the intermediate slat component 1406 to the bottom slat component 1407 to appear seamless and also appear as a single piece of fabric with a simple crease. A second end of the bottom slat component 1407 may be coupled to the foot rail unit 1402 in a similar manner as described above with reference to the coupling of the first end of the top slat component 1404 to the head rail unit 1401.

Thus, the modular roman shade 1400 includes at least one module 1409 that consists of the head rail unit 1401, at least one intermediate head rail unit 1403, and the foot rail unit 1402. It is expressly contemplated that the head rail unit 1401, at least one intermediate rail unit 1403, and foot rail unit 1402 may be any size and/or shape, and that the individual rail units may be different sizes. For example, the head rail unit 1401 may be a different shape and/or size than that of the foot rail unit 1402 and further the foot rail unit 1402 may be a different size and/or shape than the at least one intermediate rail unit 1403. In addition, although the modular roman shade 1400 as depicted in FIG. 14 includes two intermediate rail units 1403 and a single intermediate slat component 1406, it is expressly contemplated that the modular roman shade 1400 may include a single intermediate rail unit 1403 with no intermediate slat component where the top slat component 1404 and the bottom slat component 1407 are coupled to a single intermediate rail unit 1403. Alternatively, any additional number of intermediate rail units 1403 and intermediate slat components 1406 may be added to the module 1409 of the modular roman shade 1400. Further, although the modular roman shade 1400 as depicted in FIG. 14 includes three modules 1409 that are coupled together, as will be described in further detail with respect to FIG. 15, it is expressly contemplated that the modular roman shade 1400 may include one module 1409, or any number of modules 1409 coupled with one or more adjacent modules 1409.

Each slat component (e.g., the top slat component 1401, the bottom slat component 1406, and the intermediate slat component 1407) may be individually removed between the individual rail units. For example, the individual slat components may be removed to be cleaned, or to be substituted with a different slat component (e.g., having a different pattern and/or being of a different material). For example, a user may desire to have a particular design make up the entire modular roman shade 1400 and thus may select particular materials and/or patterns for each slat component of the modular roman shade 1400. Further, it is expressly contemplated that each slat component may be different sizes and/or shapes to fit any windows or enclosures.

In addition, it is noted that each head rail unit 1401 and foot rail unit 1402 may include a mechanism for attachment, such as an adhesive component or a hook and loop fastener (e.g., Velcro®) on a front portion of the head rail unit 1401 and a front portion of the foot rail unit 1402, as will be described in further detail below. The adhesive component or hook and loop fastener, may, for example, be utilized to allow a user to add a design to the top and bottom of the modular roman shade 1400 in the form of a valence.

Figure 15A:
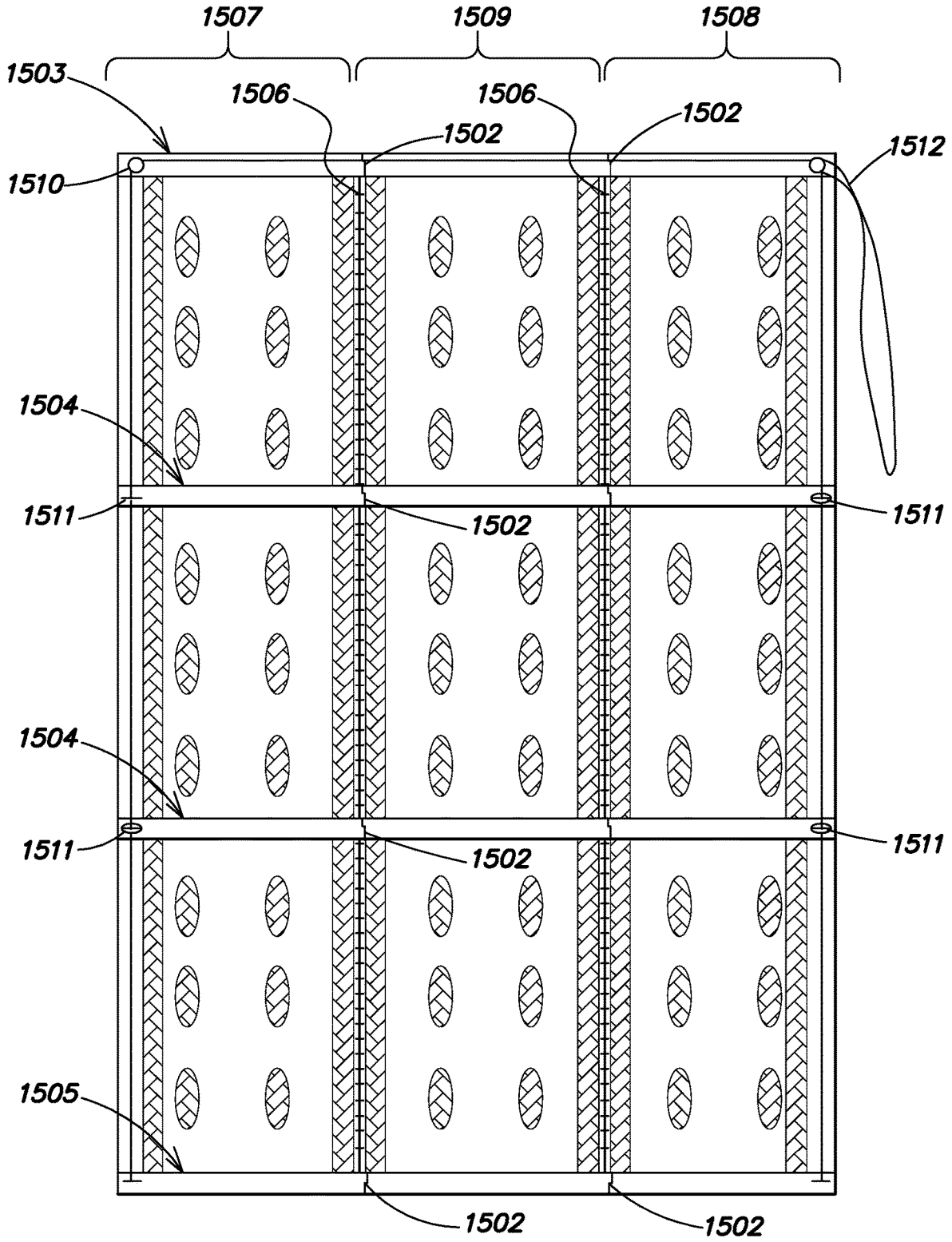
FIG. 15A is a rear view of a modular roman shade in accordance with an illustrative embodiment of the present invention.

FIG. 15A is a rear view of the modular roman shade 1400. It is noted that the modular roman shade 1400 includes three modules (e.g., 1507, 1508, and 1509), where respective components of the three modules are coupled to make up the single modular roman shade 1400. It is expressly contemplated that although the modular roman shade 1400 depicted in FIG. 15A includes three modules, it is expressly contemplated that the modular roman shade 1400 may include a single module or additional modules. In addition, although the modular roman shade 1400 includes two intermediate rails (e.g., 1504), it is expressly contemplated that the modular roman shade 1400 may include a single intermediate rail or any other number of intermediate rails. Specifically, a user may add any number of intermediate rail units to change the overall size and shape of the modular roman shade 1400. For example, for a window that is long in length, the user may add a particular number of intermediate rail units and additional intermediate slats to change the size of the modular roman shade 1400. Further, for a window that is extremely wide, the user may add additional modules to increase the overall width of the modular roman shade 1400. Furthermore, if the window is bow shaped, or a different shape, the user may customize the modular roman shade 1400 by adding or removing particular slat components and rail units. Advantageously, a user can alter the size (e.g., length and/or width) and/or shape of the modular roman shade 1400 in an efficient and easy manner.

As depicted in FIG. 15A, each head rail unit may be connected to or coupled to one or more adjacent head rail units utilizing a rail unit fastener 1502 to form a single head rail 1503. Specifically, and as depicted in FIG. 15A, the head rail unit of the left most module 1507 and the head rail unit of the right most module 1508 are coupled to opposing ends of the head rail unit of the middle module 1509 through use of respective rail unit fasteners 1502. In addition, adjacent foot rail units and adjacent intermediate rail units may also be coupled utilizing rail unit fasteners 1502 to form one or more single intermediate rails 1504 and a single foot rail 1505.

It is noted that the respective head rail units, foot rail units, and the intermediate rail units 1403 may be made of any type of material, such as, but not limited to, metal, wood, bamboo, plastic, etc. In addition, the rail unit fasteners 1502 may comprise any of a variety of fastener, such as, but not limited to, a male/female coupling system, clips, zipper(s), adhesive, etc. As further depicted in FIG. 15A, each slat component may be coupled to an adjacent slat utilizing slat fasteners 1506. The slat fasteners 1506 may be a variety of fastener, such as, but not limited to, a male/female coupling system, clips, zipper(s), adhesive, etc. Thus, when the adjacent rail units and adjacent slat components are coupled utilizing respective rail unit fasteners 1502 and slat fasteners 1506, to couple the components of the adjacent modules (e.g., 1507, 1508, and 1509), the modular roman shade 1400 is formed.

In addition, the modular roman shade 1400 may include a pulley system 1510 that is housed in the single head rail 1503 that may be utilized to raise and lower the modular roman shade 1400. Specifically, the pulley system 1510 may include a string that may be threaded from the single head rail 1503, through a connector 1511, such an eye hook connector, of the one or more single intermediate rails 1504, and eventually to the single foot rail 1505. Thus, and in operation, a user may pull on initiator cord 1512 of the pulley system 1510 to cause the string to coil up or uncoil to raise and lower the modular roman shade 1400, thus allowing light to enter/leave the window area, for example. Alternatively (not shown), the pulley system 1510 may not be attached to the single foot rail 1505 and may be coupled to the one or more single intermediate rails 1504, thus raising the modular roman shade 1400 at a position of the particular single intermediate rail 1504 at which the pulley system 1510 is ultimately connected to. Advantageously, the modular roman shade 1400 can be raised or lowered to any height, utilizing, for example, the pulley system 1510. It is expressly contemplated that a variety of mechanisms may be utilized to raise and lower the modular roman shade 1400, as known by those skilled in the art.

Alternatively, the single head rail 1503 may hold a bail retraction mechanism, not shown, to allow for the modular roman shade 1400 to be raised or lowered, by pulling or lifting the single foot rail 1505, as known by those skilled in the art. Specifically, the modular roman shade 1400 may be a cordless balanced roman shade with consistent variable spring motion. Advantageously, minimal force (e.g., by pulling or lifting) is required to position the modular roman shade 1400 at the desired height (e.g., open, closed, midway) with no required pulley system or "locking mechanism."

Figure 15B:
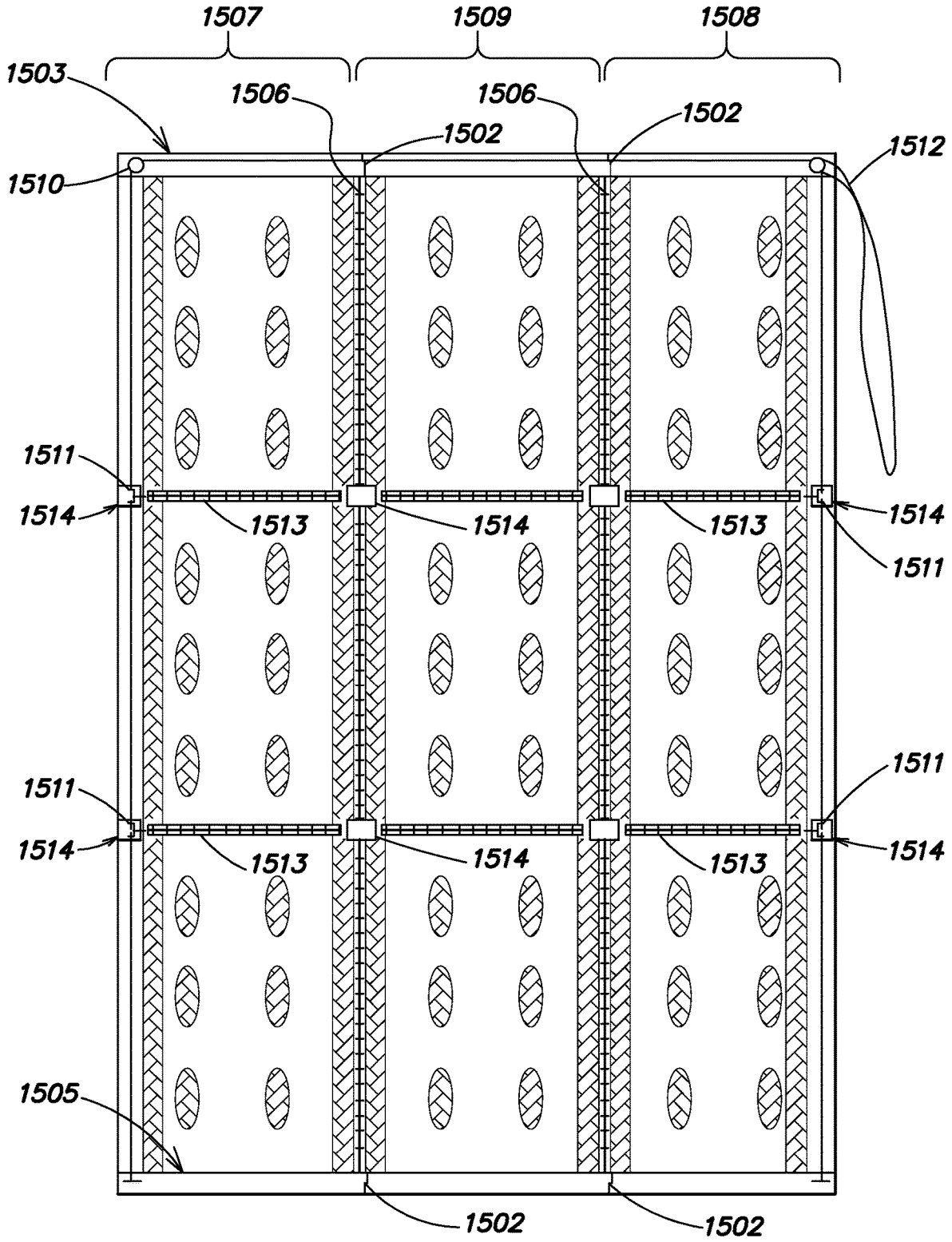
FIG. 15B is a rear view of a modular roman shade in accordance with an illustrative embodiment of the present invention.

FIG. 15B is a rear view of the modular roman shade 1400 where intermediate rail units pieces are utilized, and wherein the intermediate rail units do not form a single rail. Specifically, the modular roman shade 1400 may include a single head rail 1503, a single foot rail 1505, intermediate rail unit pieces 1514, and slat components. As depicted in FIG. 15B, intermediate rail unit pieces 1514 may be positioned at the ends and also positioned where two slat components meet. Specifically, the intermediate rail unit pieces 1514 on the ends of the modular roman shade 1400 may include the eye hook 1511, while the intermediate rail unit pieces 1514 on the interior of the modular roman shade 1400 may be a fastener to connect two adjacent slat components. The intermediate rail unit pieces 1514 may be, for example, a variety of fasteners utilized to provide rigidity or structure to the overall modular roman shade 1400. In addition, the slat components that utilize the intermediate rail unit pieces 1514 (e.g., a top slat component and an intermediate slat component) may be coupled to each other utilizing, for example, zipper mechanism 1513 to provide further rigidity or structure. Although reference is made to zipper mechanism, it is expressly contemplated that a variety of coupling mechanisms may be utilized. Thus, and in operation, a user may pull on initiator cord 1512 of the pulley system 1510 to cause the string to coil up or uncoil to raise and lower the modular roman shade 1400, thus allowing light to enter/leave the window area, for example.

Although FIG. 15B is described to include single foot rail 1505, it is expressly contemplated that the modular roman shade 1400 may include a single head rail 1503, intermediate rail unit pieces 1514, and slat components. As such, the bottom portions of the bottom most slat component may be rigid or include a material that provides structure to the bottom of the overall modular roman shade 1400. That is, in alternative embodiments, a modular roman shade 1400 may be constructed without a single foot rail 1505. In such embodiments, the description of the single foot rail 1505 should be construed as any structure that provides structure to the bottom of the overall modular roman shade 1400.

Figure 16A:
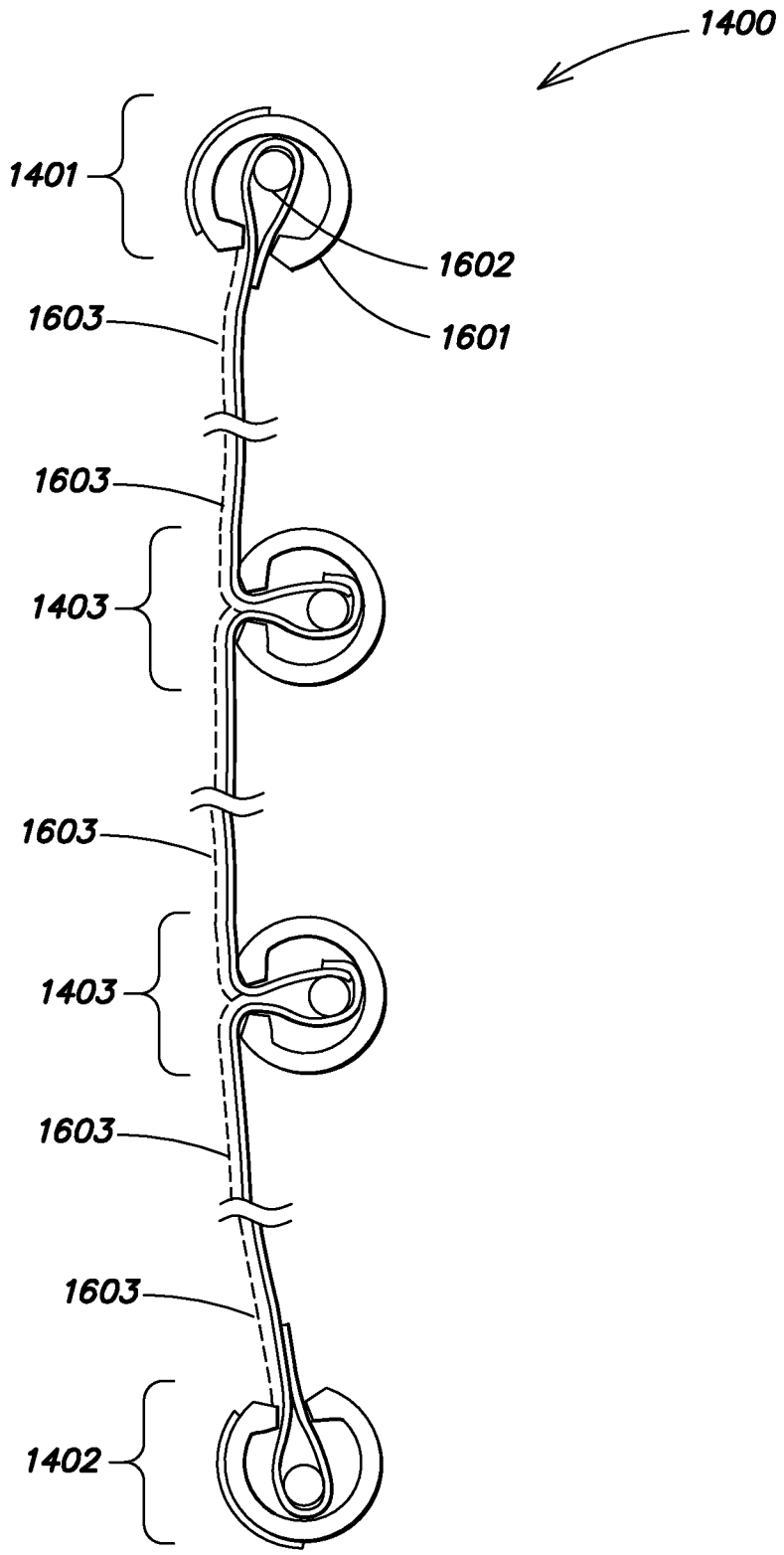
FIG. 16A is a side view of a modular roman shade utilizing a solid tube in accordance with an illustrative embodiment of the present invention.

FIG. 16A is a side view of the modular roman shade 1400. Specifically, FIG. 16A shows the individual slats (e.g., top slat component, intermediate slat component, and bottom slat component) being inserted in the head rail unit 1401, intermediate rail units 1403, and foot rail unit 1402. In one embodiment, the rail units are tubes 1601 what include a rod (e.g., a fastener) 1602 to hold the individual slat components within the tubes 1601. Specifically, the individual ends of the slat components may be inserted into the tubes 1601 and the rod 1602 may be snapped within the tube 1601 to hold the ends of the respective slat components within the tube 1601. For example, the head rail unit 1401 and foot rail unit 1402 may each hold an end of a single slat component, and specifically a first end of the top slat component 1404 and a second end of the bottom slat component 1407. In addition, each intermediate rail unit 1403 may hold or house respective ends of two slat components. Specifically, an intermediate rail unit 1403 may hold a second end of the top slat component 1404 and a first end of the intermediate slat component 1406, while the additional intermediate rail unit

1403 may hold a second end of the intermediate slat component 1406 and a first end of the bottom slat component 1407.

In addition, the slats of the modular roman shade 1400 may be layered and may include one or more additional slat components 1603 (shown in phantom). The additional slat components 1603 may be of any material, such as, but not limited to, vinyl or any other materials to add rigidity to the modular roman shade 1400, or to act as a liner to the modular roman shade 1400. It is noted that the one or more additional slat components 1603 can be any size and do not have to match the size of the other slat components (e.g., top slat component, intermediate slat component, and bottom slat component).

Figure 16B:
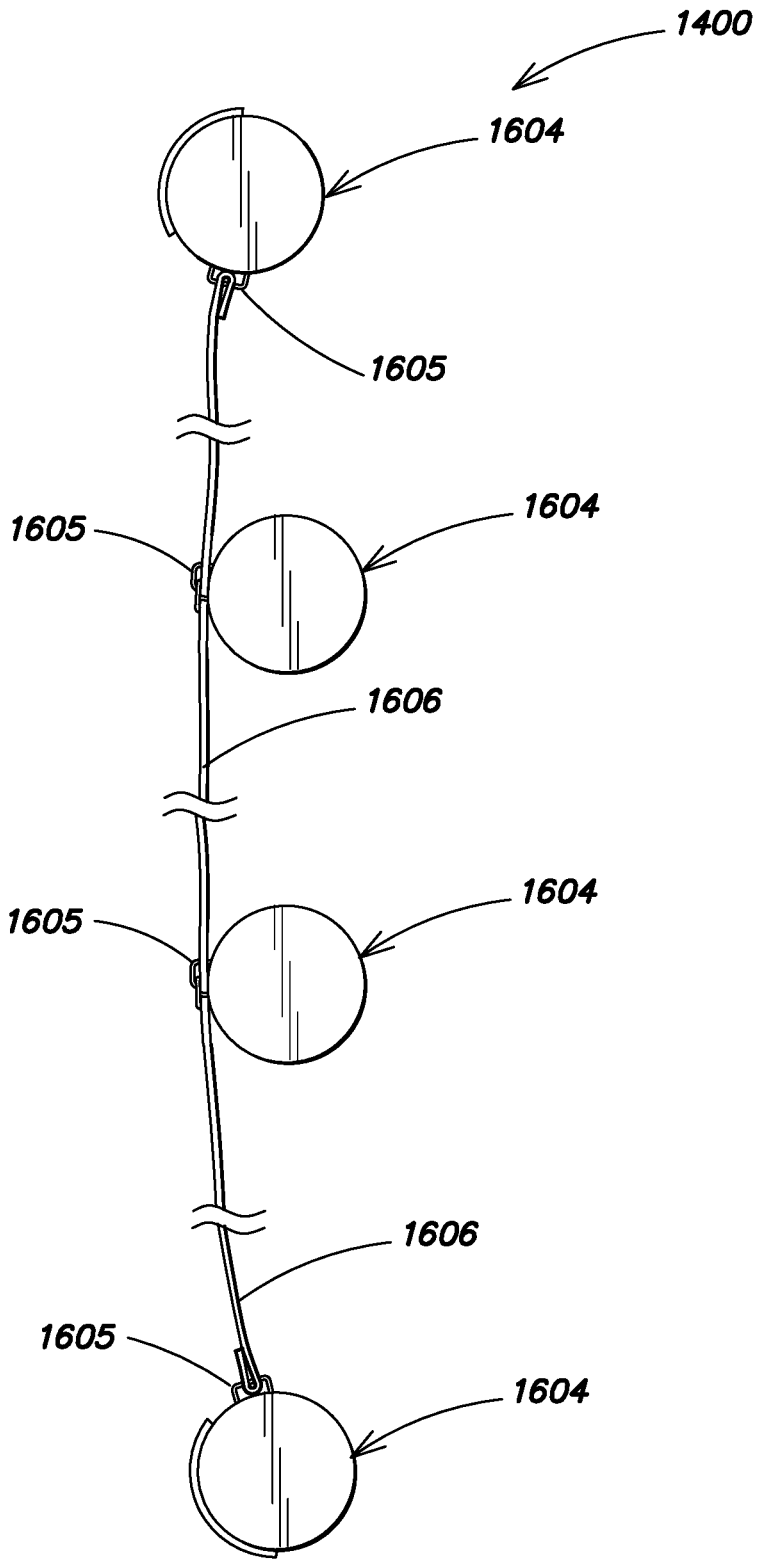
FIG. 16B is a side view of a modular roman shade utilizing a solid tube in accordance with an illustrative embodiment of the present invention.
Figure 17A:
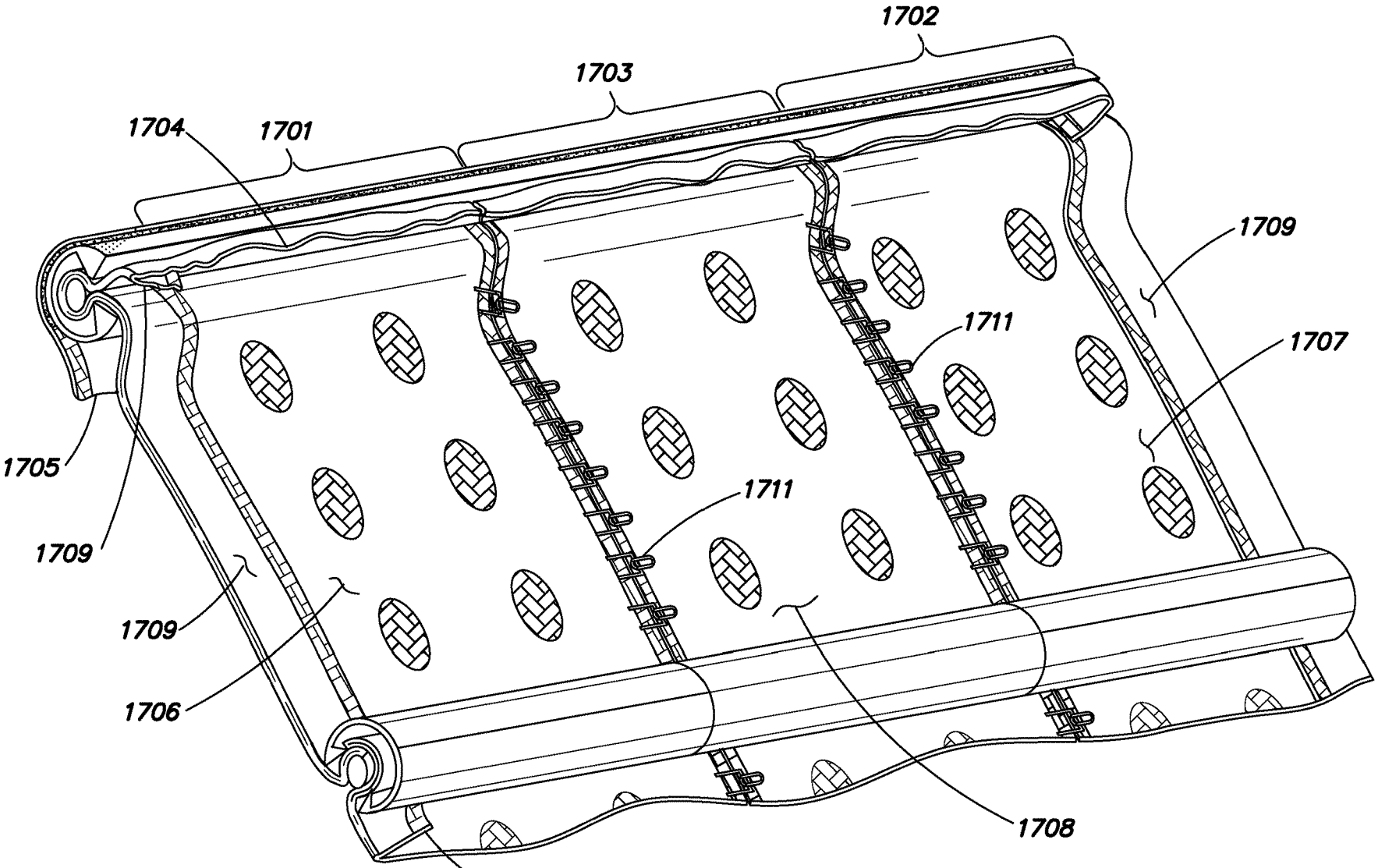
FIGS. 17A-17E are detailed depictions of the connections between slat components and the manner in which the slat components may be coupled to each other through use of the rail units to form the modular roman shade in accordance with an illustrative embodiment of the present invention.
Figure 17B:
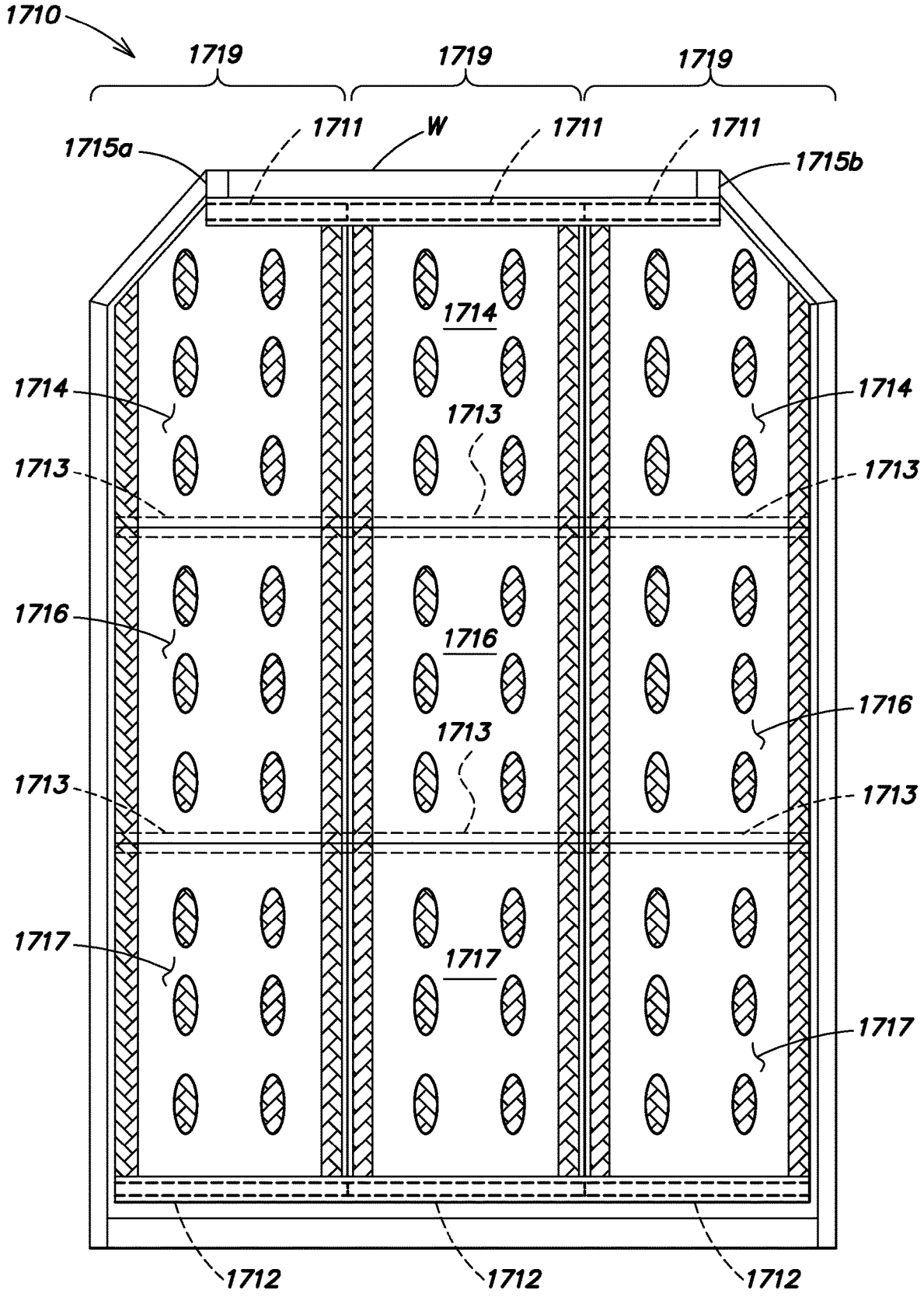
Figure 17C:
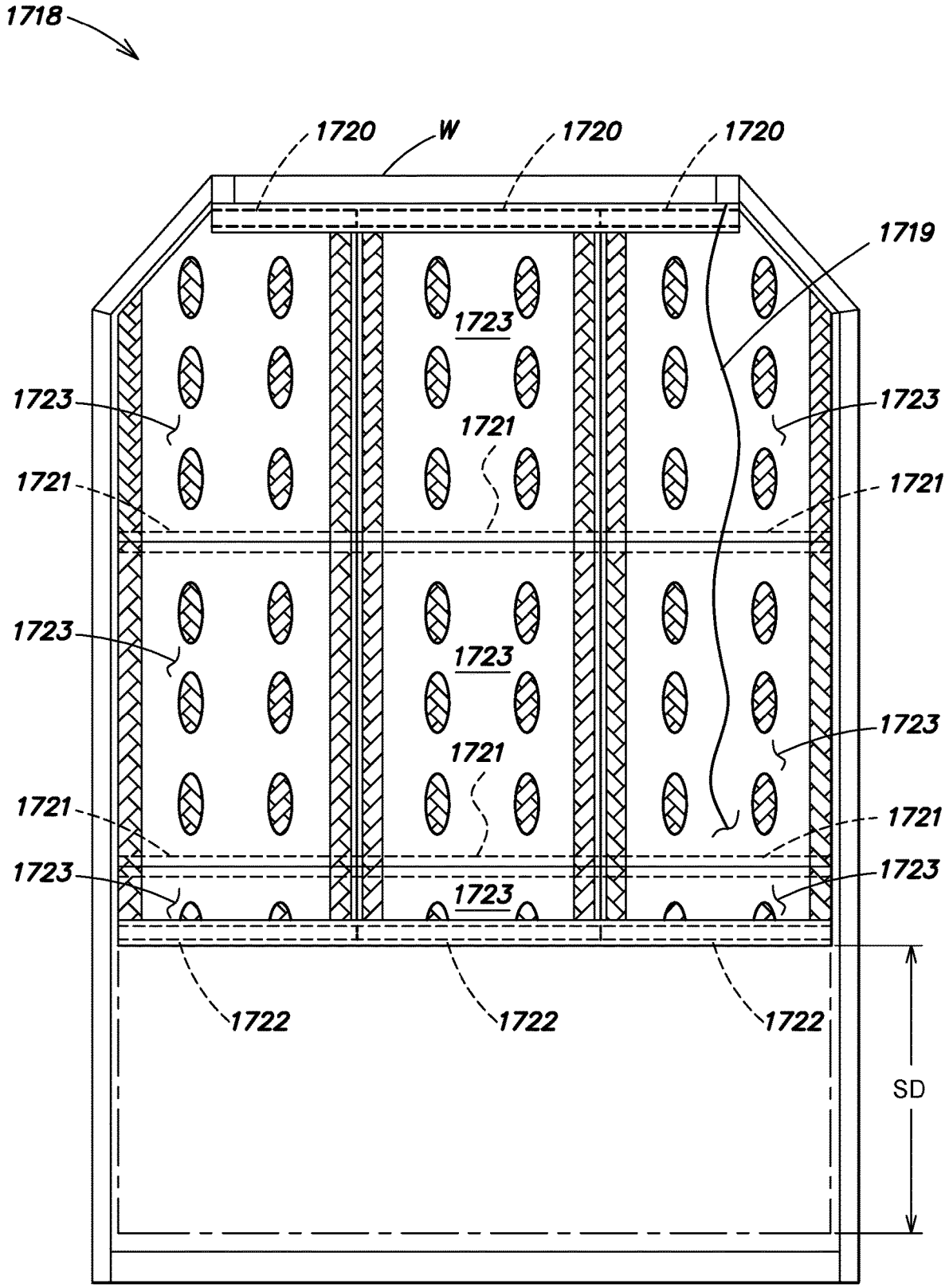
Figure 17D:
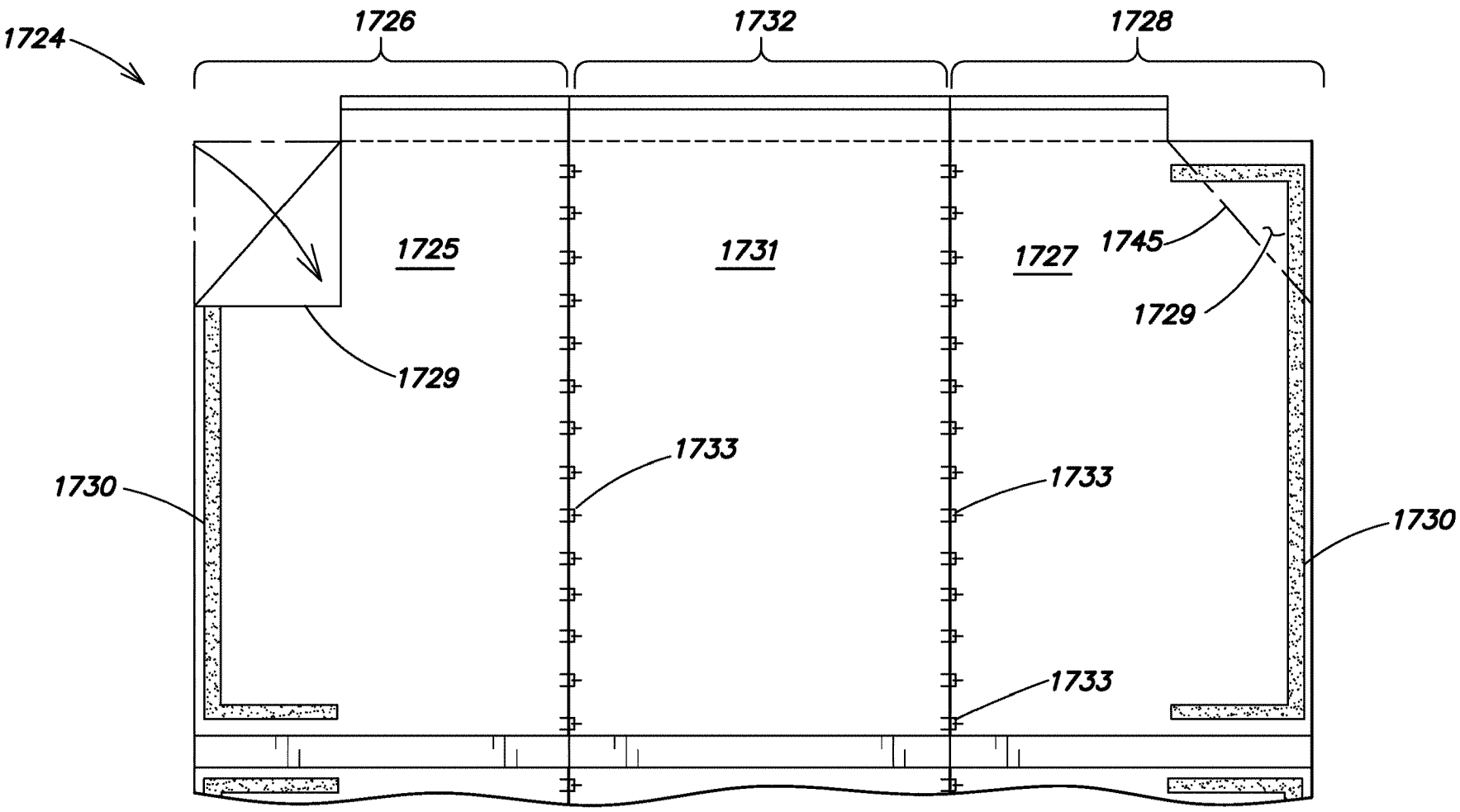
Figure 17E:
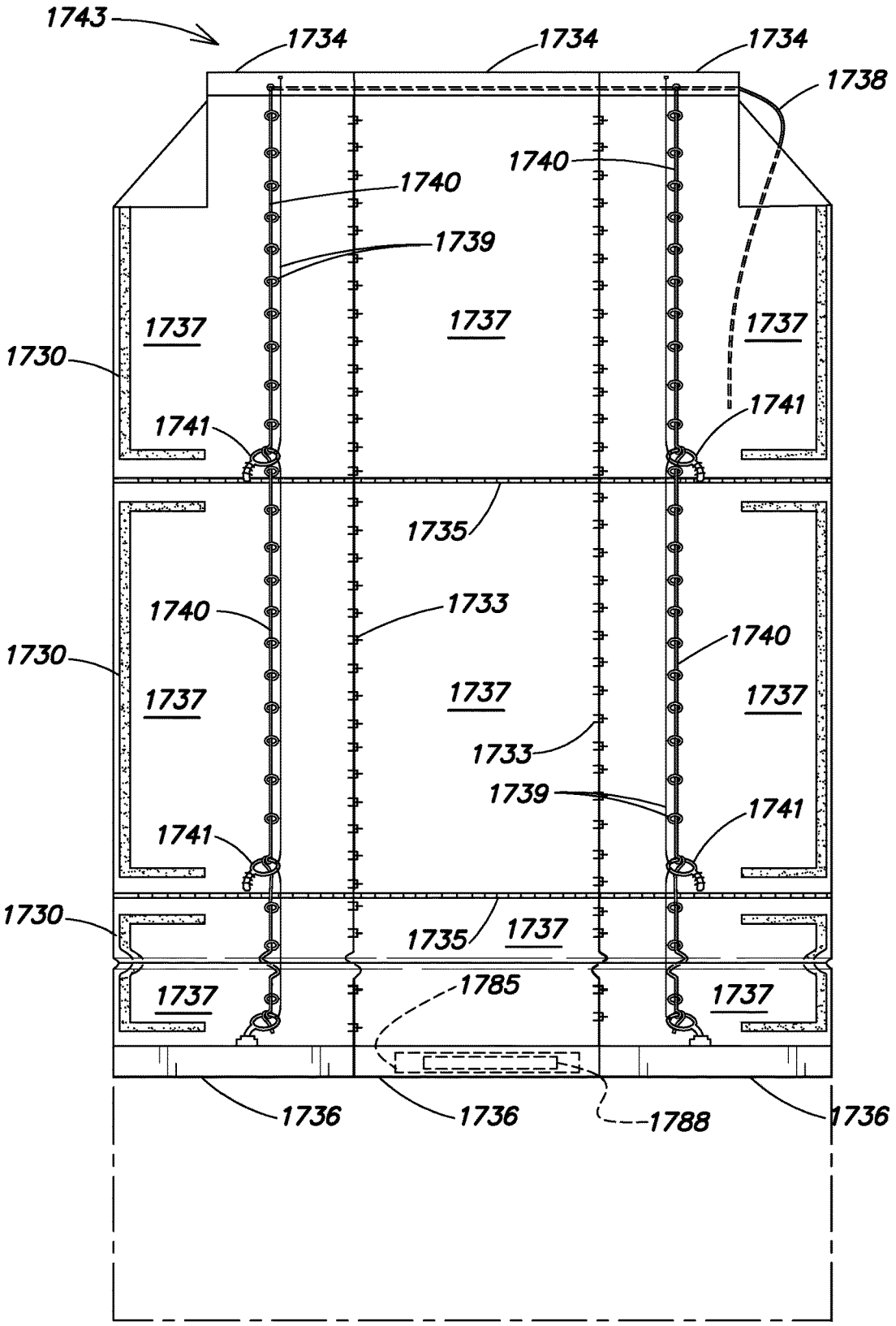

Although reference is made to the rails units being hollow tubes, it is expressly contemplated that the rail units may be solid tubes, or any shaped rails where the respective slats may be coupled to the rail units. For example, the rail units may be solid tubes 1604 and have a clipping fastener 1605 on the front as shown in FIG. 16B, to allow for the respective slat components 1606 to be coupled to the rail units to form the entire modular roman shade 1400.

FIG. 17 is a detailed depiction of the connections between slat components and the manner in which the slat components may be coupled to each other through use of the rail units to form the modular roman shade 1400. Specifically, and with reference to FIG. 17, it is noted that there may be excess material associated with the slat component 1706 of the left most module 1701 and the slat component 1707 of the right most module 1702. More specifically, there may be excess material 1709 on the left side of slat component 1706 of left most module 1701, and excess material 1704 at the top of the slat component 1706 of the left most module 1701. The excess material 1709 may be folded over to size the left side of the slat component 1706 to have the appropriate width to match the size of the head rail unit and intermediate rail unit of the left most module 1701. In addition, the excess material 1704 on the top of the slat component 1706 may be inserted within the respective rail unit such that the excess material is hidden within the respective rail unit.

Advantageously, the user can size the slat component to be any size by simply folding the side and/or "tucking" the top and/or bottom excess material within the rail units. In an alternative embodiment, the excess material 1709 may not be folded over such that the slat component is greater in length or shorter in length than the head rail unit. The slat component 1707 of the right most module 1702 may be altered in size in a similar manner as described with respect to the left most module 1701. In addition, the top and bottom excess material of middle module 1703 may be sized in a similar manner as described above, where the excess material is tucked into the rail units.

In addition, the slat component 1706 of the left most module 1701 and the slat component 1707 of the right most module 1702 are coupled to the slat component 1708 of middle module 1703 utilizing clipping fasteners 1711. Although reference is made to clipping fasteners 1711, it is expressly contemplated that a variety of fasteners may be utilized to couple the slat components together. In addition, and as depicted in the FIG. 17, a valence 1705 may be attached to the adhesive or hook and loop fastener 1706 to add a decoration to the modular roman shade 1400. Although FIG. 17 depicts valence 1705 on the top of the modular roman shade 1400, it is expressly contemplated that the bottom of the modular roman shade 1400 (e.g., on foot rail unit(s)) may also include a valence 1705 to add a decoration to the bottom of the modular roman shade 1400.

Figure 18:
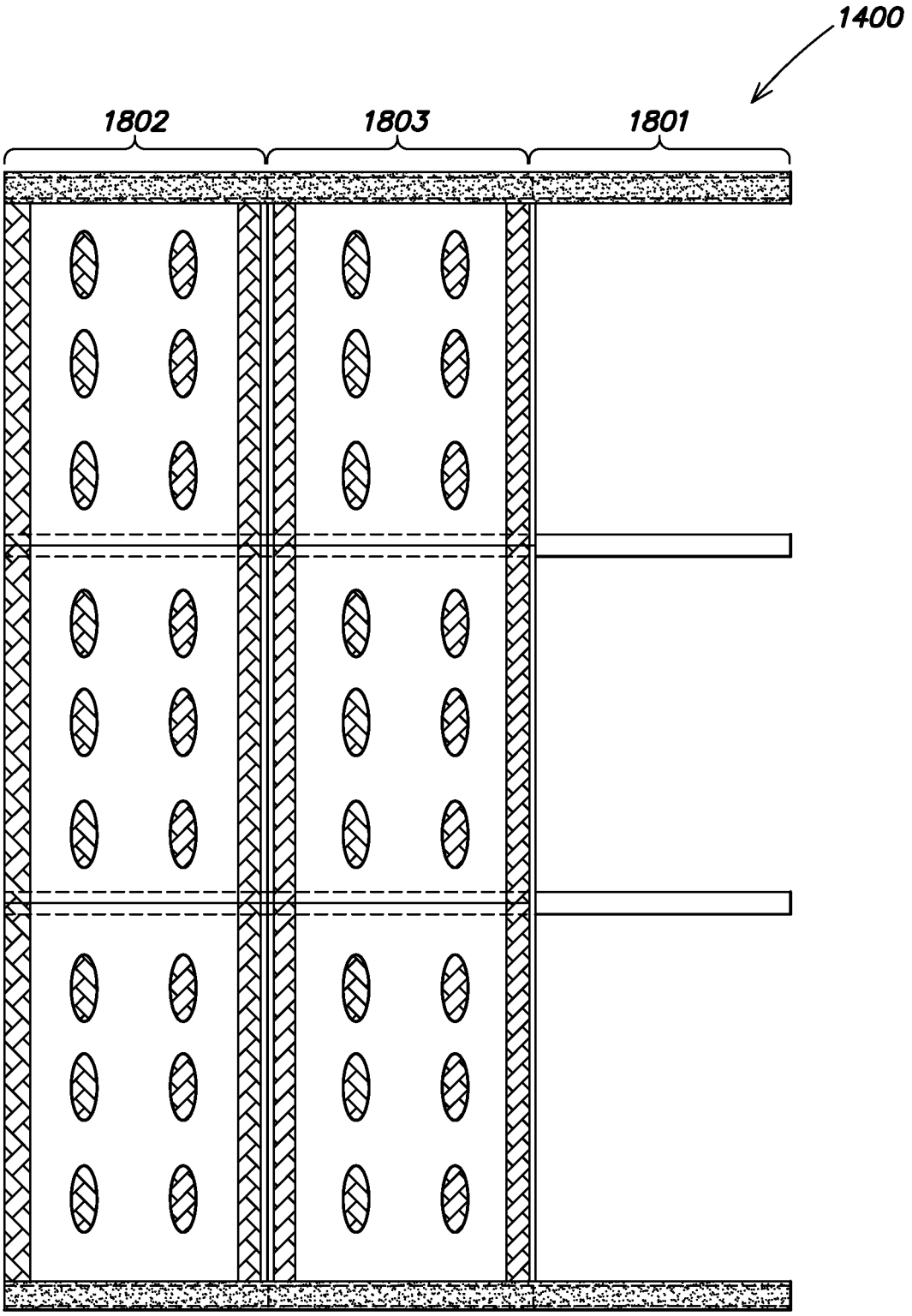
FIG. 18 is a front view of the modular roman shade where particular slat components have been removed in accordance with an illustrative embodiment of the present invention.

FIG. 18 is a front view of the modular roman shade 1400 where particular slat components have been removed. Specifically, and as shown in FIG. 18, the three individual slat component of the right most module 1801 have been removed, while the individual slat components of the left most module 1802 and the middle module 1803 remain intact. Advantageously, a user can remove any number of slat components and have those slat components washed, for example, and/or replaced with a different slat having a different pattern. Thus, a user can design the modular roman shade 1400 to have any number of patterns, materials etc. In addition, for example, a window opening may include an object, such as an air conditioner, and the user can remove the particular slat components where the air condition is positioned, such that the modular roman shade 1400 surrounds the air condition that is in the window. Advantageously, the size and shape of the modular roman shade 1400 can be dynamically altered in an user friendly way by allowing the user to simply attach or remove particular slat components.

Figure 19:
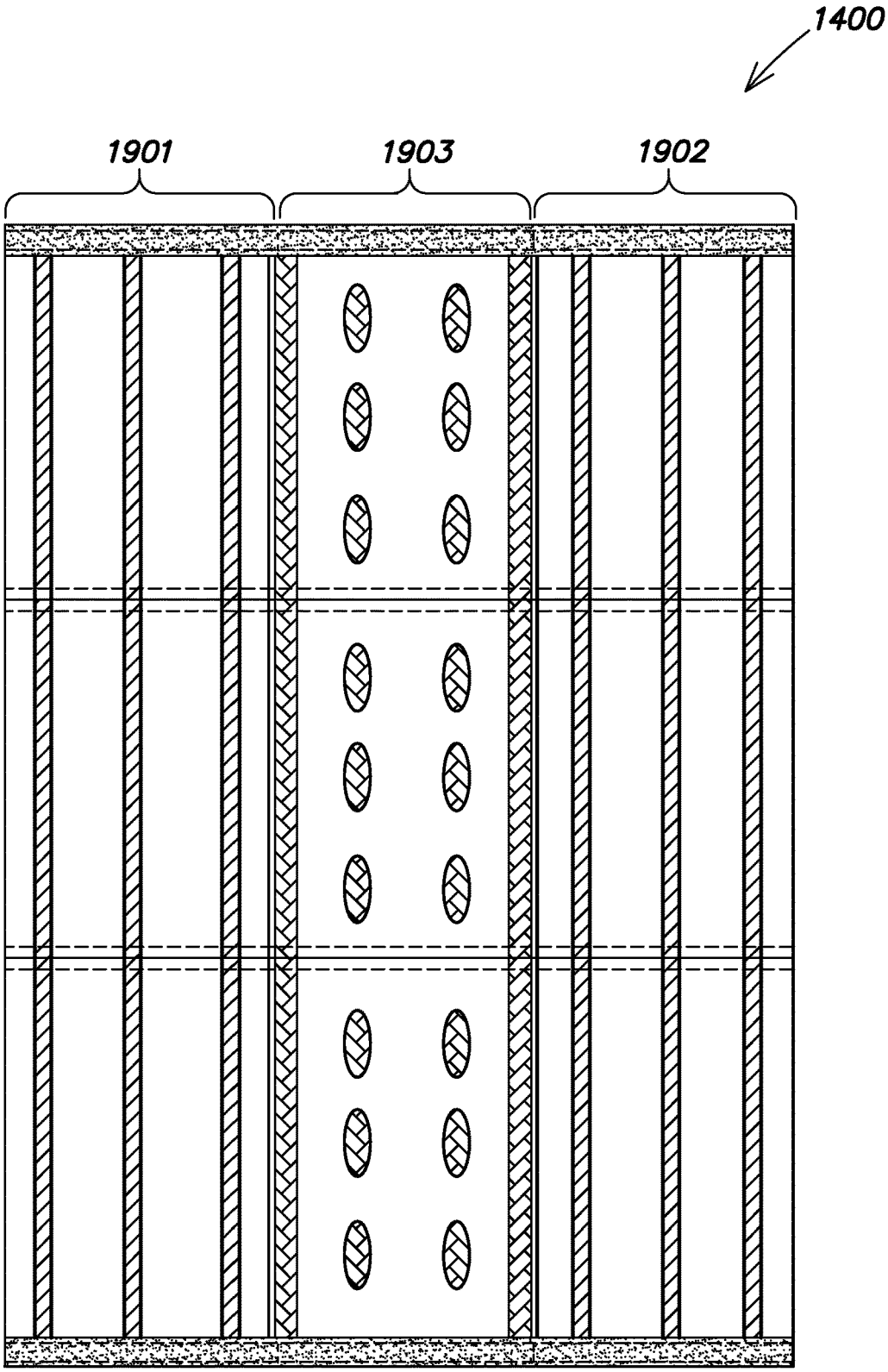
FIG. 19 is a front view of the modular roman shade where particular slat components have a different pattern than other slat components in accordance with an illustrative embodiment of the present invention.

FIG. 19 is a front view of the modular roman shade 1400 where particular slat components have a different pattern than other slat components. Specifically, and as shown in FIG. 19, the left most module 1901 and the right most module 1902 includes slat components with a first pattern, while the middle module 1903 includes slat components with a second pattern. Advantageously, a user can easily and efficiently change the overall look and appearance of the modular roman shade 1400. Although FIG. 19 depicts particular patterns with respect to particular slat components, it is expressly contemplated that any pattern or material may be used for each slat component.

Figure 20A:
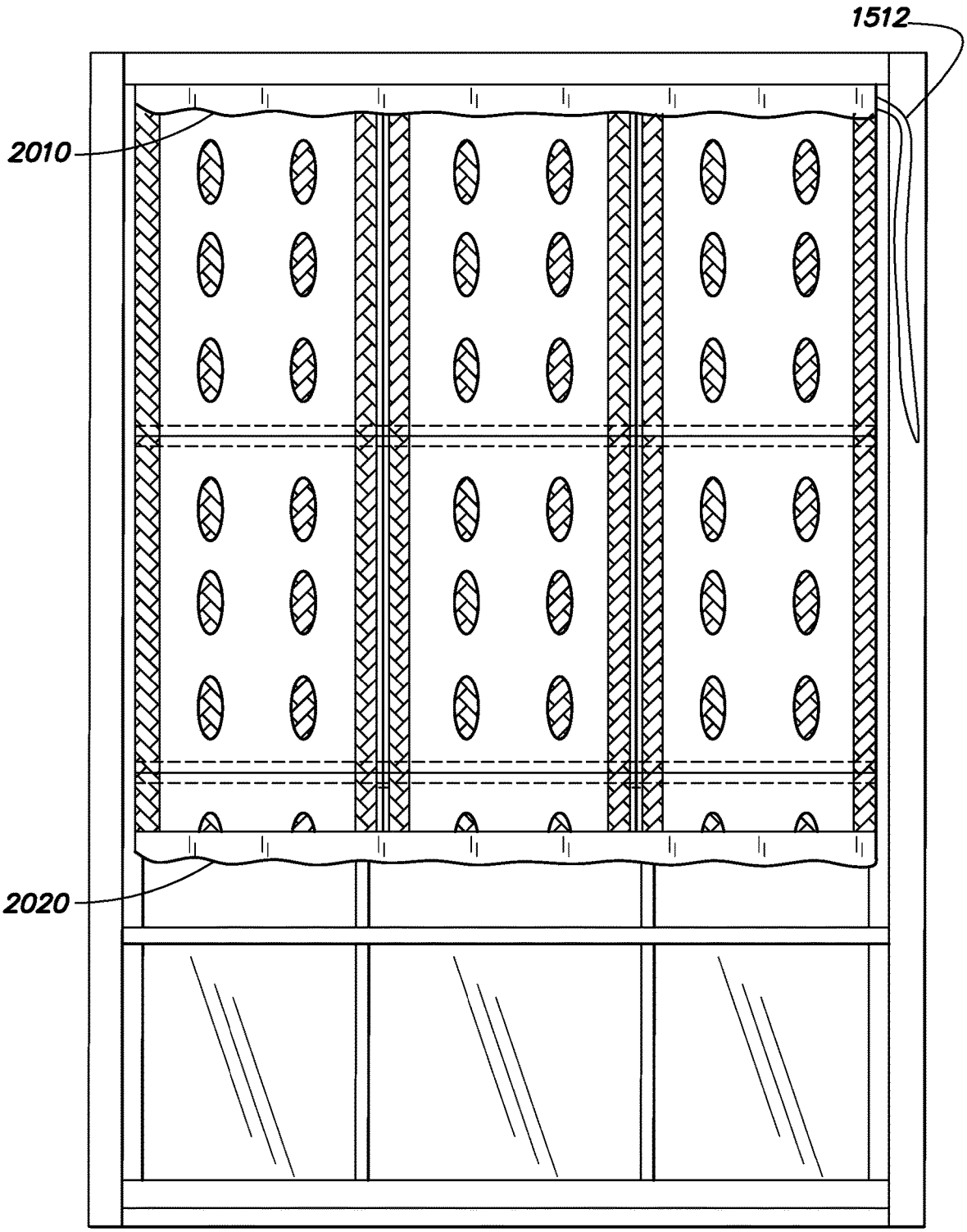
FIG. 20A is a front view of the modular roman shade in a retracted or raised position in accordance with an illustrative embodiment of the present invention.
Figure 20B:
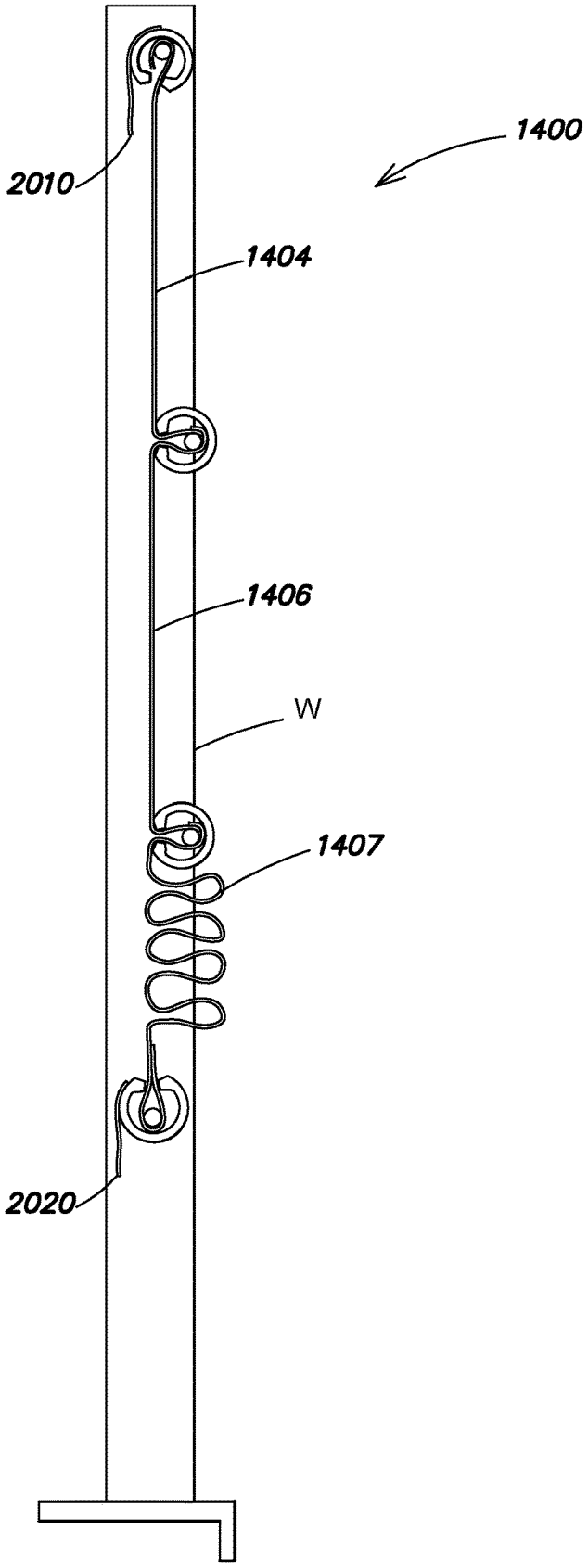
FIG. 20B is a side view of the modular roman shade in a retracted or raised position in accordance with an illustrative embodiment of the present invention.

FIGS. 20A and 20B are respectively a front view and a side view of the modular roman shade 1400 in a retracted or raised position. Specifically, a user may pull initiator cord 1512 to initiate the pulley system, as described with respect to FIG. 15, to cause the modular roman shade 1400 to raise or lower as shown in FIG. 20A, thereby allowing light to enter at the bottom of the window W. It is noted that FIG. 20A shows a top valence 2010 and a bottom valence 2020 that are added for decoration. Alternatively (not shown), a bail retraction mechanism may be utilized to allow the user to simply pull or push the foot rail unit(s) to raise and lower the modular roman shade 1400. FIG. 20B show the modular roman shade 1400 raised from the side view. As shown in FIG. 20B, the modular roman shade 1400 includes valences 2010 and 2020. In addition, the bottom slat 1407 is raised shortened based on the raising of the modular roman shade 1400.

Figure 21:
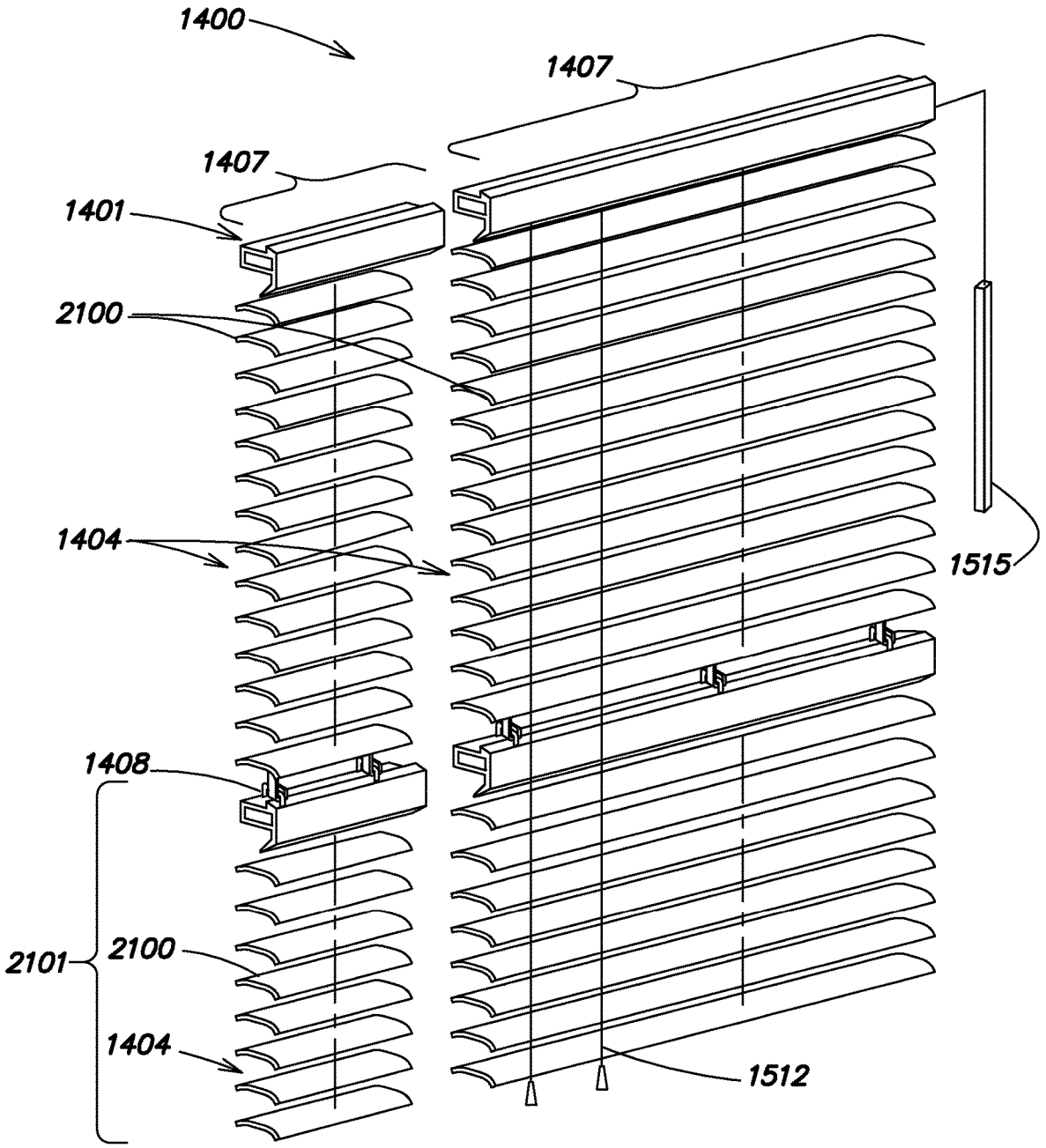
FIG. 21 is a front view of the modular shade in accordance with an illustrative embodiment of the present invention.

FIG. 21 is a front view of the modular shade 1400 that includes head rail units 1401 that may be coupled together and slat components 1404 that may be coupled together. For example, each slat component 1404 of module 1407 (that includes the head rail unit 1401 and slat component 1404) may be a venetian type blind including a plurality of elements 2100. Specifically, each of the plurality of elements 2100 may be coupled to an element 2100 of an adjacent slat component 1404. That is, each of the plurality of elements 2100 may "snap into" or "slide into" an element 2100 of an adjacent slat component 1404. Advantageously, the overall width or size of the modular shade 1400 may be altered, by a user, for example, by simply sliding an element 2100 of slat component 1404 a selected distance within an element 2100 of an adjacent slat component 1404. Alternatively, any of a variety of coupling mechanisms may be utilized to couple an element 2100 to an element 2100 of an adjacent slat component 1404. Although the modular shade 1400 as described with reference to FIG. 21 includes head rail units 1401 and slat components 1404, it is expressly contemplated that the modular shade 1400 may also include intermediate rail units and foot rail units.

In addition, additional module 2101 (including a head rail unit 1401 and a slat component 1404) may be added to the module 1407 to increase the size of the modular shade 1400. For example, and with reference to FIG. 21, the additional module 2101 may be attached to the slat component 1404 of the module 1407 utilizing a male/female connector 1408. Alternatively, the additional module 2101 may be attached to a bottom of the slat component 1404 of the module 1407 utilizing a clipping mechanism (not shown). It is expressly contemplated that a variety of different connecting mechanisms may be utilized to couple the additional module 2101 to the bottom of the slat component 1404 of the module 1407. Further, wand 1515 may be utilized to open/close the elements 2100 of the slat components 1404, as known by those skilled in the art. In addition, the modular shade 1400 may be raised and lowered by pulling on initiator cord 1512, as described above.

Figure 22:
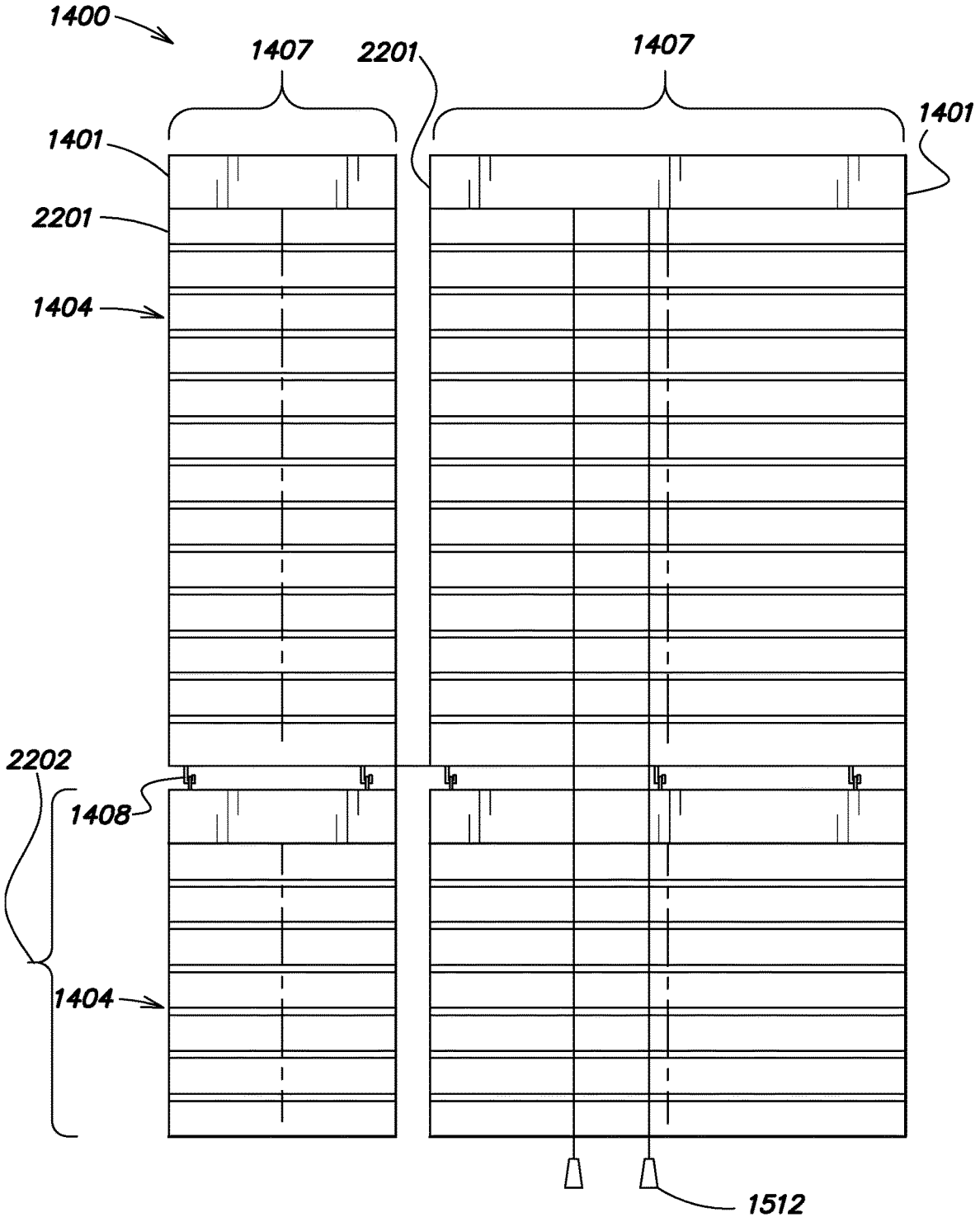
FIG. 22 is a front view of the modular shade in accordance with an illustrative embodiment of the present invention.

FIG. 22 is a front view of the modular shade 1400 that includes head rail units 1401 that may be coupled together and slat components 1404 that may be coupled together. For example, each slat component 1404 of module 1407 may including one or more element 2201. It is expressly contemplated that the one or more elements 2201 may be bamboo, wood, faux wood, plastic, or any number of materials. Specifically, the one or more elements 2201 of the slat component 1404 may be coupled to the one or more elements 2201 of an adjacent slat component 1404. That is, each of the one or more elements 2201 may "snap into" or "slide into" an element 2201 of an adjacent slat component 1404. Alternatively, any of a variety of coupling mechanisms may be utilized to couple the one or more elements 2201 to an element 2201 of an adjacent slat component 1404.

In addition, additional module 2202 (including a head rail unit 1401 and a slat component 1404) may be added to the module 1407 to increase the size of the modular shade 1400. For example, and with reference to FIG. 22, the additional module 2202 may be attached to a bottom of the slat component 1404 of the module 1407 utilizing a male/female connector 1408. Alternatively, the additional module 2202 may be attached to the slat component 1404 of the module 1407 utilizing a clipping mechanism (not shown). It is expressly contemplated that a variety of different connecting mechanisms may be utilized to couple the additional module 2202 to the slat component 1404 of the module 1407. Further, the modular shade 1400 may be raised and lowered by pulling on initiator cord 1512, as described above. Although the modular 1400 as described with reference to FIG. 22 includes head rail units 1401 and slat components 1404, it is expressly contemplated that the modular shade 1400 may also include intermediate rail units and foot rail units.

Figure 23A:
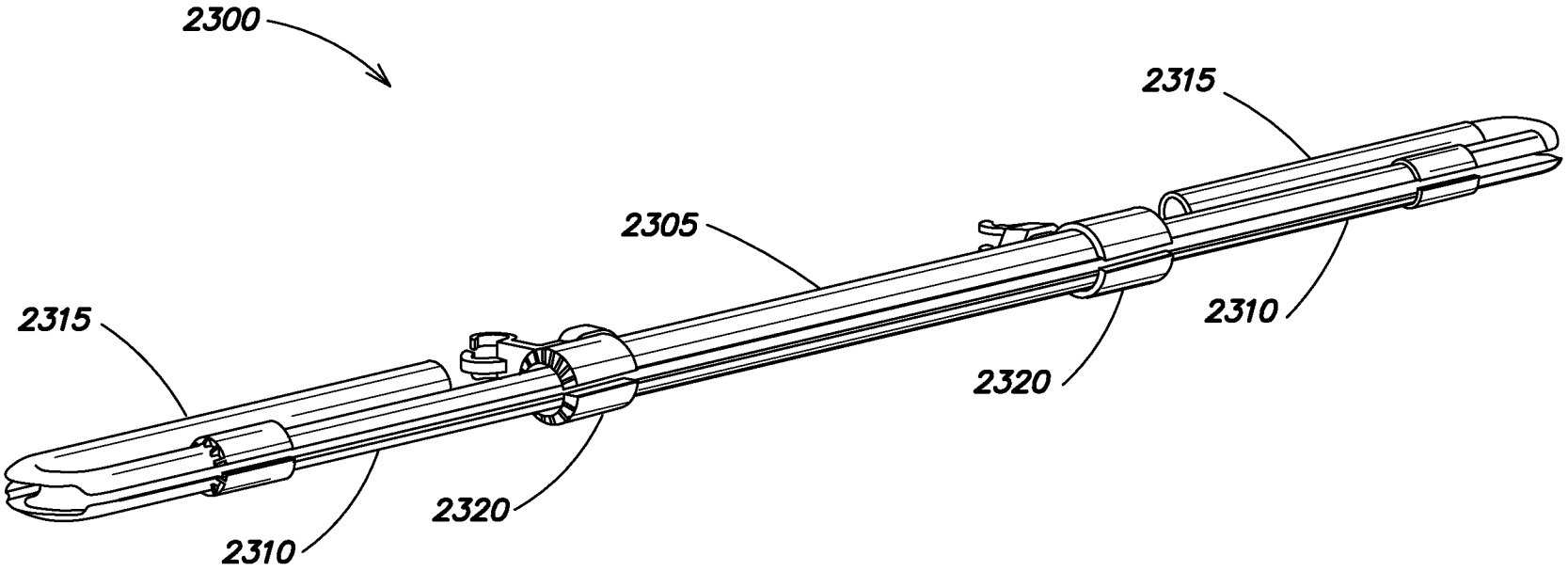
FIGS. 23A and 23B are detailed depictions of an adjustable roman shade attachment that included a plurality of components in accordance with an illustrative embodiment of the present invention.
Figure 23B:
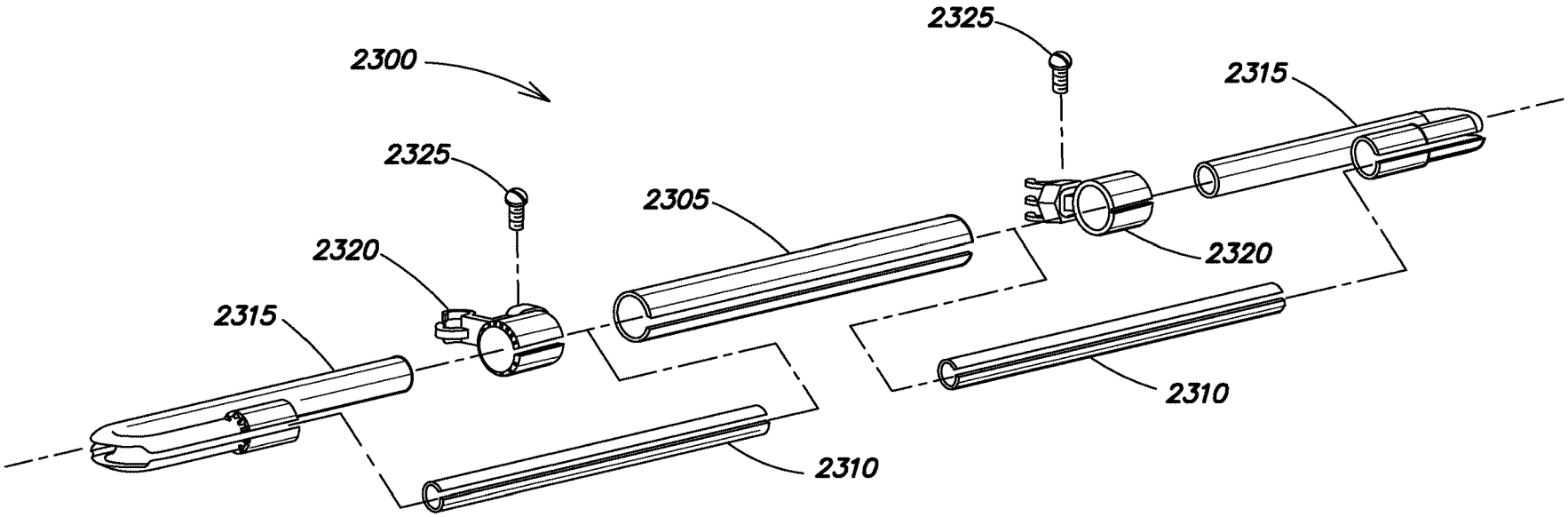

FIGS. 23A and 23B are detailed depiction of an adjustable roman shade attachment that included a plurality of components. The assembled adjustable roman shade attachment 2300 is shown in FIG. 23A, while an exploded view of the adjustable roman shade attachment 2300 is shown in FIG. 23B. The Adjustable roman shade attachment 2300 includes a center tube 2305, two bracket clips 2320, two adjustment arms 2310, and two edge inserts 2315. The two bracket clips 2320 attach to the exterior of the center tube 2305. The components may be made of plastic, steel, or any of a variety of materials. Specifically, the two bracket clips 2320 may be positioned at any location on the center tube 2305. For example, when a user moves the two bracket clips 2320 to desired locations on the center tube 2305, the user may tighten adjustment screws 2325, that are illustratively positioned in an opening in the bracket clips 2320, such that the two bracket clips 2320 are secured at the desired locations. Thus, the adjustment screws 2325 act as securing devices that secure the bracket clips 2320 on the center tube 2305. Although FIGS. 23A and 23B are depicted with two bracket clips 2320, it is expressly contemplated that the adjustable roman shade attachment may include one or any number of bracket clips 2320. In addition, each of the components (e.g., the center tube 2305, the two bracket clips 2320, the two adjustment arms 2310, and the two edge inserts 2315) include a slit or opening that is utilized to secure or hold onto the material of the roman shade, such as slat components, as will be described in further detail below. In addition, the adjustment screws 2325 are tightened to close the slits to securely clamp portions of the slat component within the slits, as will be described in further detail below. That is, and since the bracket clips 2320 are on the exterior of the center tube 2305, when the adjustment screws 2325 are tightened, the slit of the bracket clips 2320 becomes smaller (i.e., closes), thus causing the slits of the center tube 2305, the adjustment arms 2310, and/or the edge inserts to becomes smaller, which in turn causes the slat components to be lodged and clamped within the silts of the adjustable roman shade attachment 2300.

The center tube 2305 may be hollow and have a circumference that is greater than the circumference of the two adjustment arms 2310, such that the two adjustment arms 2310 may be inserted and housed inside respective ends of the center tube 2305. Specifically, the adjustment arms 2310 may be inserted at different depths on either side of and within the center tube 2305 to adjust the overall size of the adjustable roman shade attachment 2300, to, for example, accommodate window openings of different sizes and shades of different widths.

The adjustment arms 2310 may also be hollow and have a circumference that is less than the circumference of at least a portion of the two edge inserts 2315, such that the other ends of the adjustment arms 2310, that are not inserted in the center tube 2305, may be inserted and housed inside respective edge inserts 2315. The edge inserts 2315 include curved portions that are utilized to hold excess material associated with the slat components, such that the excess material is wrapped around to the back of the adjustable roman shade attachment 2300, as will be described in further detail below. In addition, and as will be described in further detail below with respect to FIG. 27B, the edge inserts 2315 may be hinged. The assembled adjustable roman shade attachment, including the assembled components as described above, can be seen in FIG. 23B.

Figure 24:
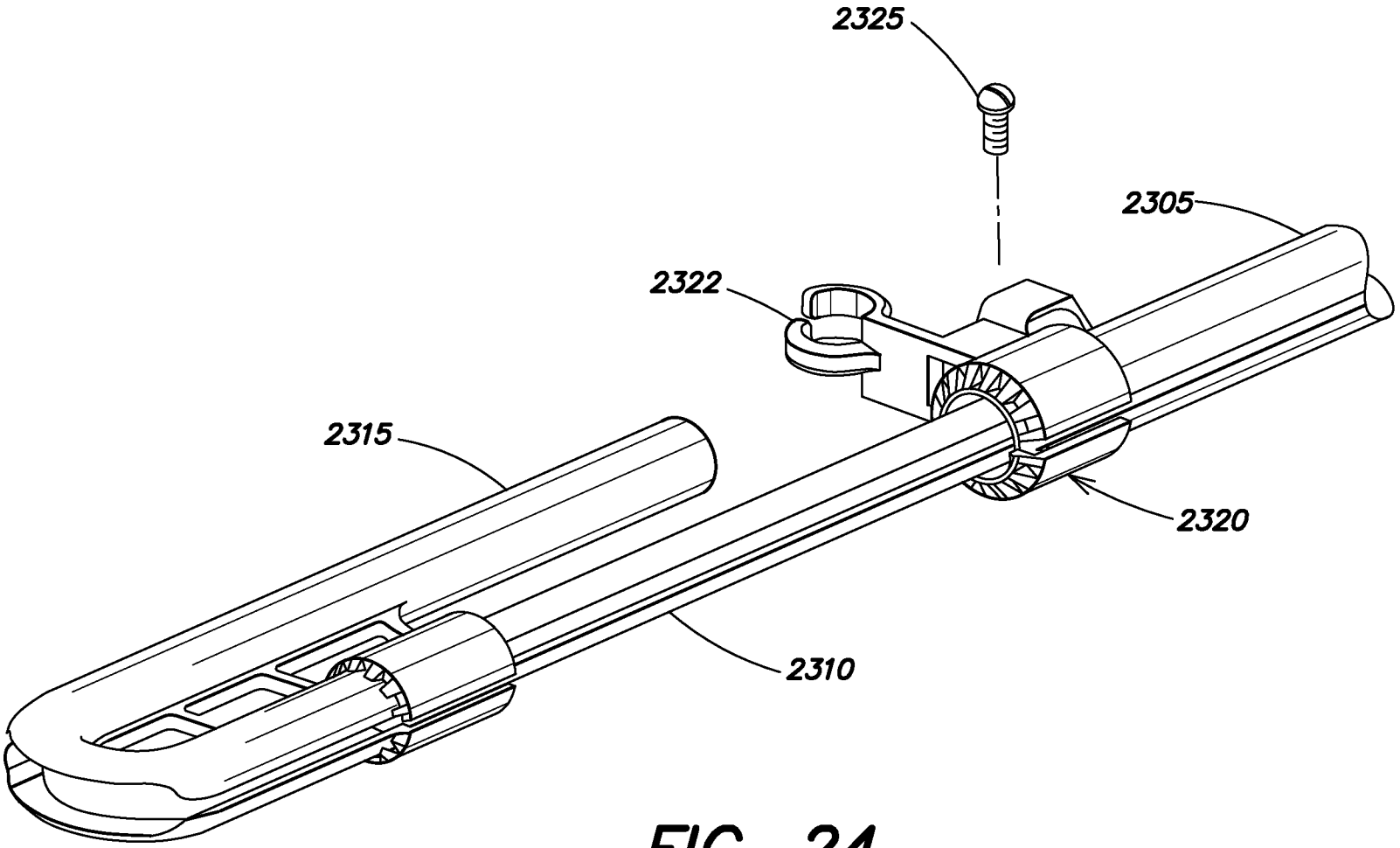
FIG. 24 is a detailed depiction of a close up view of an adjustable roman shade attachment in accordance with an illustrative embodiment of the present invention.

FIG. 24 is a detailed depiction and a close up view of an end of the adjustable roman shade attachment 2300 where a first end of the adjustment arm 2310 is inserted into the center tube 2305 and a second end of the adjustment arm 2310 is inserted into an edge insert 2315. The first end of the adjustment arm 2310 may be inserted at different depths within the center tube 2305 to adjust the overall size of the adjustable roman shade attachment 2300. The edge insert 2315 includes the curved portion (that also includes the slit or opening) that is utilized to accommodate the excess material associated with the slat components. Although not shown in FIG. 24, the edge insert 2315 may be hinged, as will be described in further detail with respect to FIGS. 27B and 27C. In addition, and as depicted in FIG. 24, the bracket clip 2320 is secured to the center tube 2305 at the end of the center tube 2305 utilizing the adjustment screw 2325. However, it is expressly contemplated that the bracket clip 2320 may be position and secured at any location on the center tube 2305. The bracket clip 2320 includes a protruding eye hook 2322 that may be utilized to couple a plurality of adjustable roman shade attachments 2300 together, so that the plurality of adjustment roman shade attachments 2300 act in unison as part of a mechanism, to, for example, raise and/or lower the shade that will be described in further detail below. Further, it is noted that in an illustrative embodiment, the slits or openings of the components (e.g., the adjustment arm 2310, the center tube 2305, the edge insert 2315, and the bracket clip 2320) line up such that when the slat components are inserted into the slits, a crease or fold is created that looks uniform and straight. It is noted that although FIG. 24 is a close up view of a single end of the adjustable roman shade attachment 2300, the other end of the adjustable roman shade attachment 2300 may be configured and operated in a similar manner.

Figure 25:
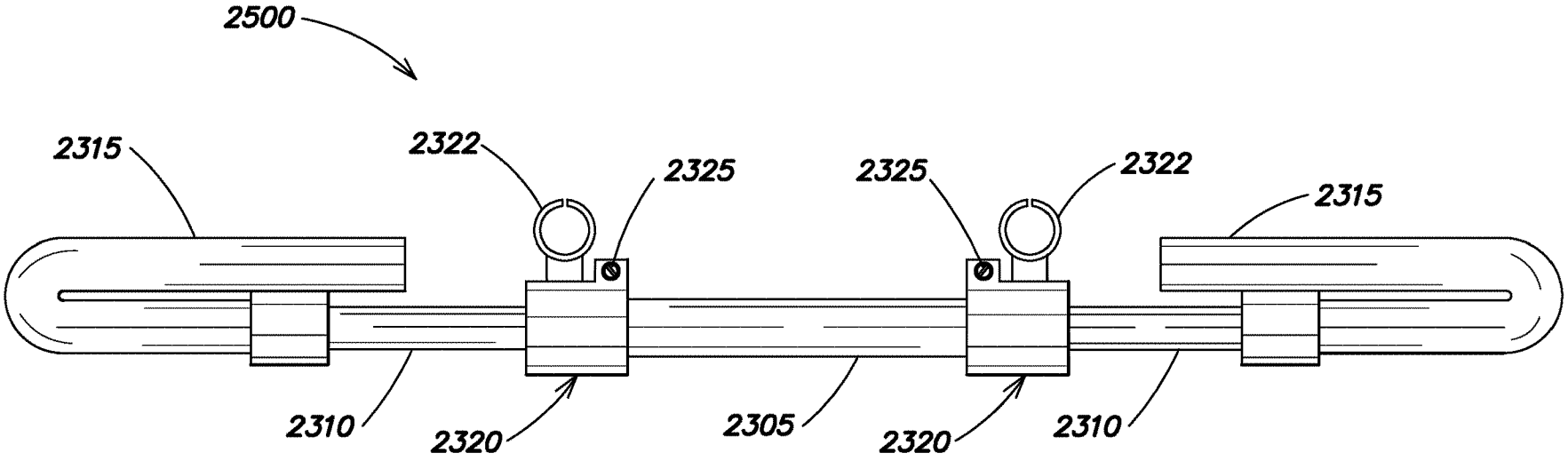
FIG. 25 is a detailed depiction of a top view of an adjustable roman shade attachment in accordance with an illustrative embodiment of the present invention.

FIG. 25 is a detailed depiction of an exemplary assembled adjustable roman shade attachment 2500 from a top view. The two adjustment arms 2310, which are inserted into the center tube 2305, may be positioned at different selected depths within the center tube 2305 by a user, for example, to alter the overall size of the adjustable roman shade attachment 2500, such that the adjustable roman shade attachment 2500 matches a size of a window. After the adjustable roman shade attachment 2500 has been adjusted to a selected size, the adjustable roman shade attachment 2500 may be attached to the slat components (e.g., shade material) by inserting the material in the slits/openings of each component, such that the slat components are secured to the adjustable roman shade attachment 2500. Specifically, the slit of each component acts as a clamp that holds onto a portion of the slat components after inserting the slat components in the slits and then tightening the adjustment screws 2325 such that the material is secured in the slits, as will be described in further detail below.

Figure 26A:
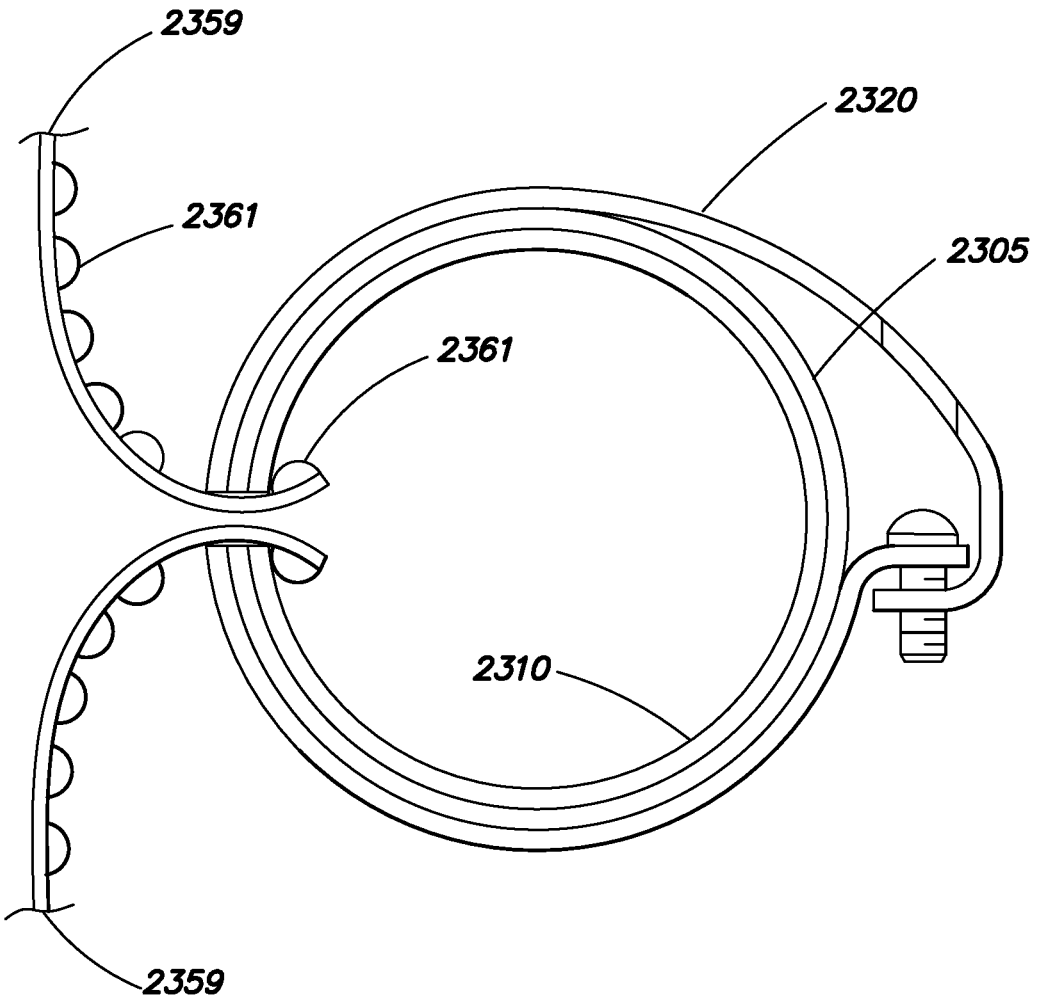
FIGS. 26A-26F are detailed depictions of an adjustable roman shade attachment with slat components positioned in slits in accordance with an illustrative embodiment of the present invention.

FIG. 26A is a detailed depiction according to an embodiment of a cross-sectional view an assembled adjustable roman shade attachment with two slat components positioned within the slits of the components of the adjustable roman shade attachment. As shown, the slits of the center tube 2305, the adjustment arm 2310, the edge inserts (not shown), and bracket clip 2399 (in an embodiment and without an eye hook) that are on the exterior of the center tube 2305 are aligned, such that the slat components 2359 may be inserted within the slits. Specifically, particular ends of two different slat components 2359 are inserted into the slits of the assembled adjustable roman shade attachment 2300. In an embodiment, there may be a plurality of half circles 2359 that run along the entire length of one side of each slat component 2359, and specifically, along the side of the slat component that is not exposed. In an alternative embodiment, the half circles 2359 may only be located at the edges of each slat component 2359 that are to be inserted into the slits of the components of the adjustable roman shade attachment 2300. When the particular ends of the two different slat components 2359 are inserted into the silts, the half circles of the two different slat component 2359 form a full circle that acts as a securing mechanism to hold the slat components 2359 within the components of the adjustable roman shade attachment 2300. It is noted that in FIG. 26A, the adjustment screws 2325 are not tightened. As such, the slits as depicted in FIG. 26A are at their maximum and not clamped down on the slat components 2359.

Figure 26B:
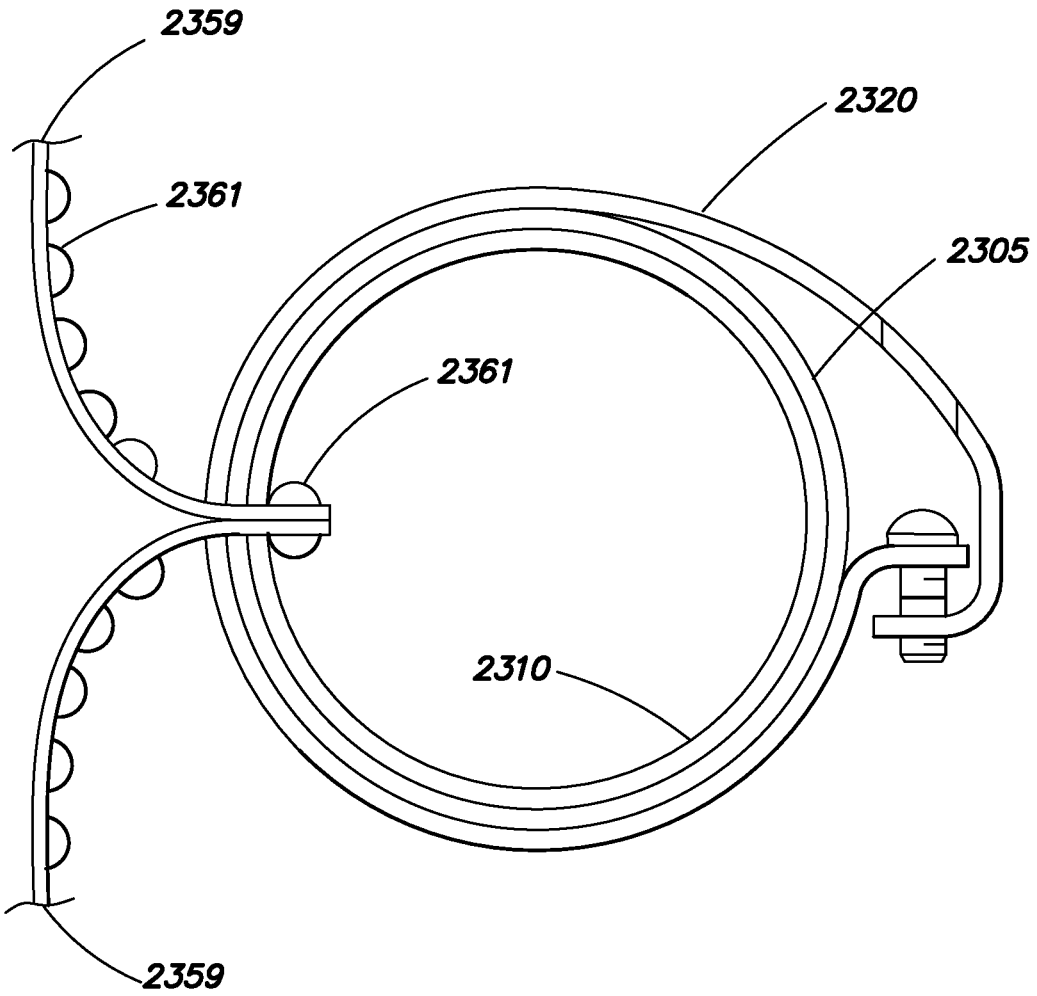

FIG. 26B shows a cross-sectional view with the silts closed or clamped down on the slat components 2359. Specifically, and to ensure that the two slat components 2359 stay secured in the slits, the adjustment screws 2325 may be tightened to close the slits or make the opening of the silts smaller such that the components of the adjustable roman shade attachment 2300 clamp down on the slat components 2359. It is noted that although FIGS. 26A and 26B do not depict the edge inserts 2315, it is expressly contemplated that the two different slat components 2359 are inserted and clamped down in the slits of the edge inserts 2315 in a similar manner.

Figure 26C:
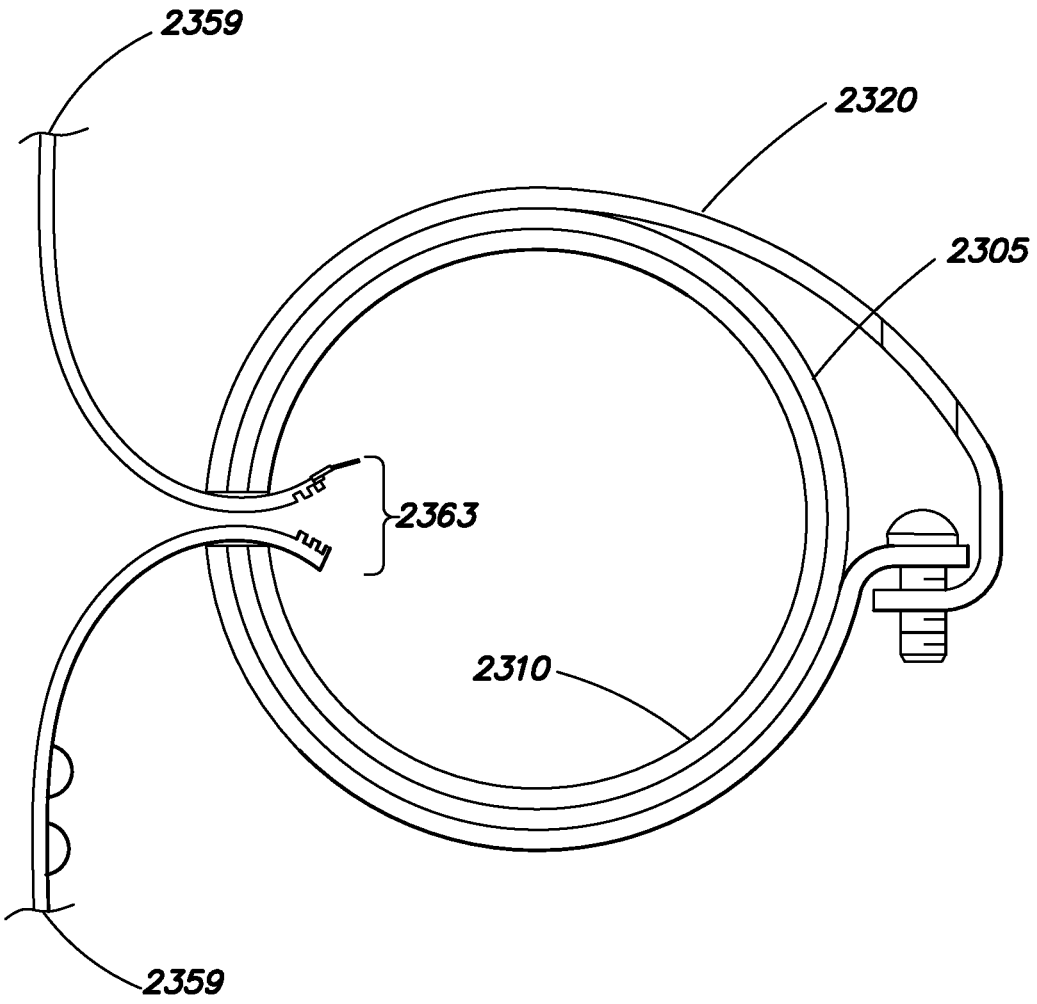
Figure 26D:
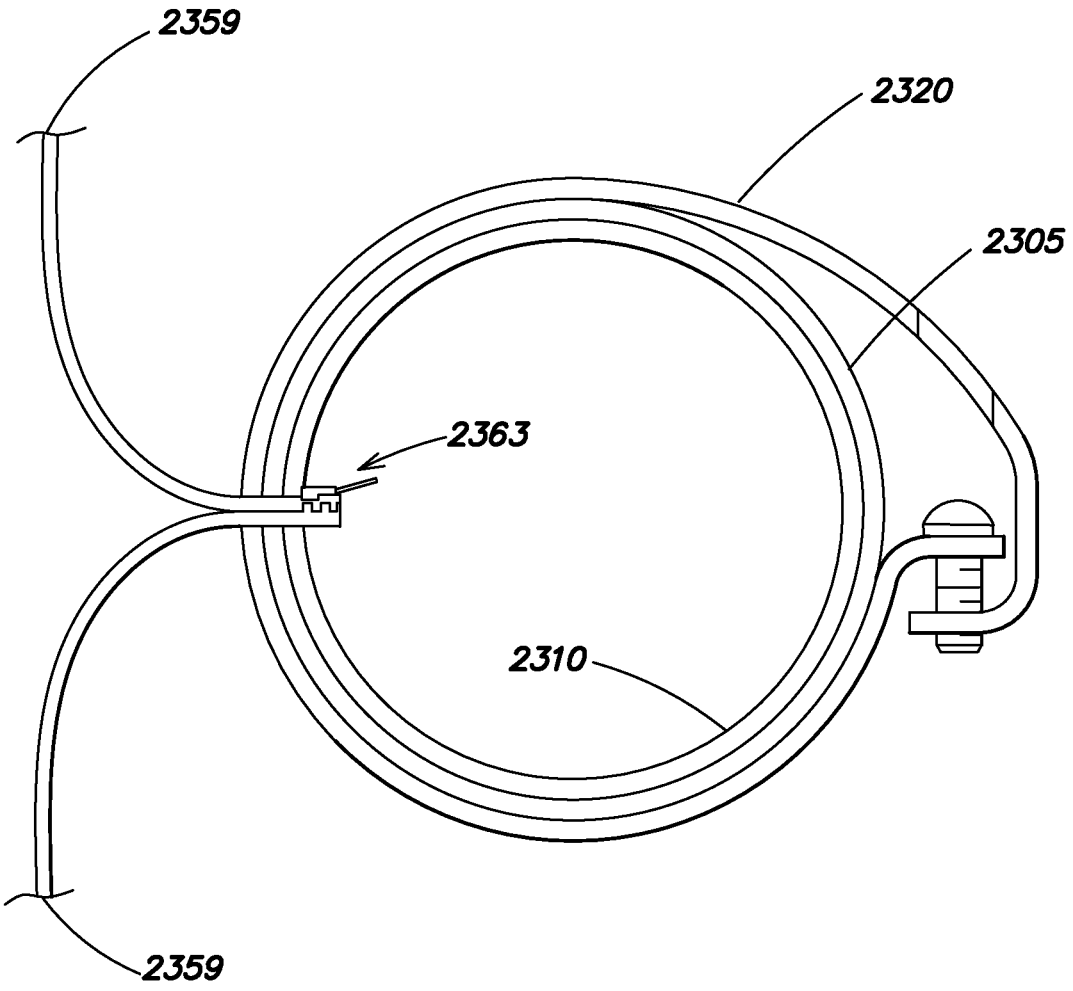

FIG. 26C is a detailed depiction of a cross-sectional view of an assembled adjustable roman shade attachment with two slat components positioned within the slits of the components of the adjustable roman shade attachment. In the embodiment that is depicted in FIG. 26C, two slat components 2359 are coupled to each other through use of a zipper mechanism 2363. Specifically, each end of the slat components 2359 may include "teeth" associated with a zipper mechanism 2363, and one of the slat components may include a "slide" that may be slid in one direction to bring the two row of teeth on the ends of the slat components 2359 together to secure the two slat components together. The slide may also be slid in the opposite direction to disengage the two rows of teeth to detach the two slat components 2359. Although reference is made to utilizing of the zipper mechanism 2363, it is expressly contemplated that a variety of other securing mechanisms may be utilized. Such other securing mechanisms, may include, but are not limited to, clips, hooks, hook and loop fasteners, such as Velcro®, etc. Once the two slat components are secured utilizing the zipper mechanism 2363, for example, the two slat components 2359 may be inserted into the center tube 2305, the adjustment arm 2310, the edge inserts (not shown), and bracket clip 2399 that are on the exterior of the center tube 2305 as depicted in FIG. 26C. In addition, and as depicted in FIG. 26D, the adjustment screws 2325 may be tightened to close the slits or make the opening of the silts smaller such that the components of the adjustable roman shade attachment 2300 clamp down on the slat components 2359.

Figure 26E:
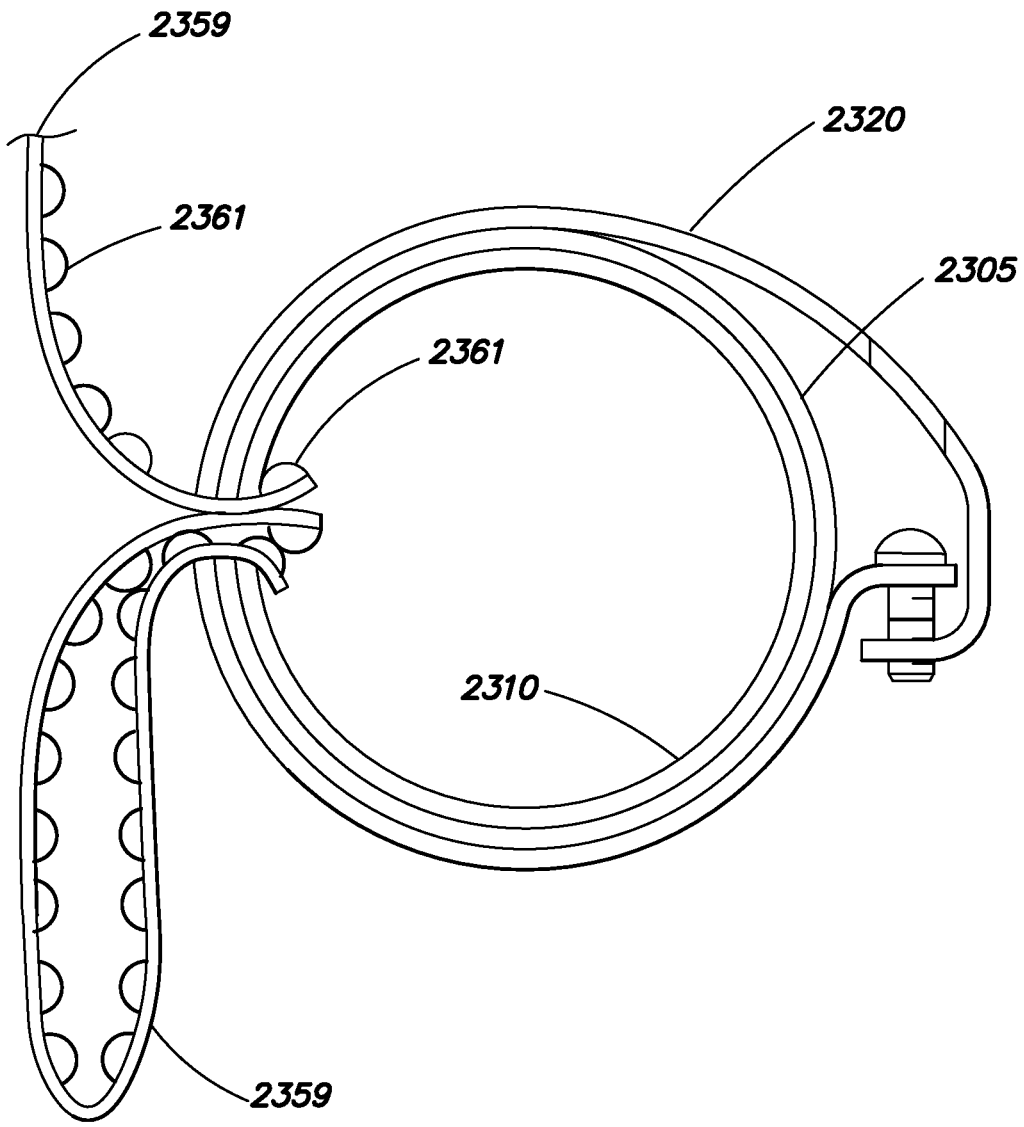

FIG. 26E is a detailed depiction of a cross-sectional view of an assembled adjustable roman shade attachment 2300 that may be positioned at the bottom of the roman shade. Specifically, and as shown in FIG. 26E, the two slat component 2359 may be inserted and secured in the slits in a similar manner as described with respect to FIGS. 26A through 26D. In addition, the bottom most slat component 2359 may be folded and inserted into the slits such that the bottom slat component 2359 hangs below to act as a valence, such that the bottom portion of the bracket clip 2399, the adjustment arm 2305, the center tube 2310, and edge inserts 2315 are not exposed or in view. It is noted that although FIG. 26E depicts the half circles as described with reference to FIGS. 26A and 26B, it is expressly contemplated that FIG. 26E may be utilized with a zipper mechanism, or other mechanism, as described with reference to FIGS. 26C and 26D.

Figure 26F:
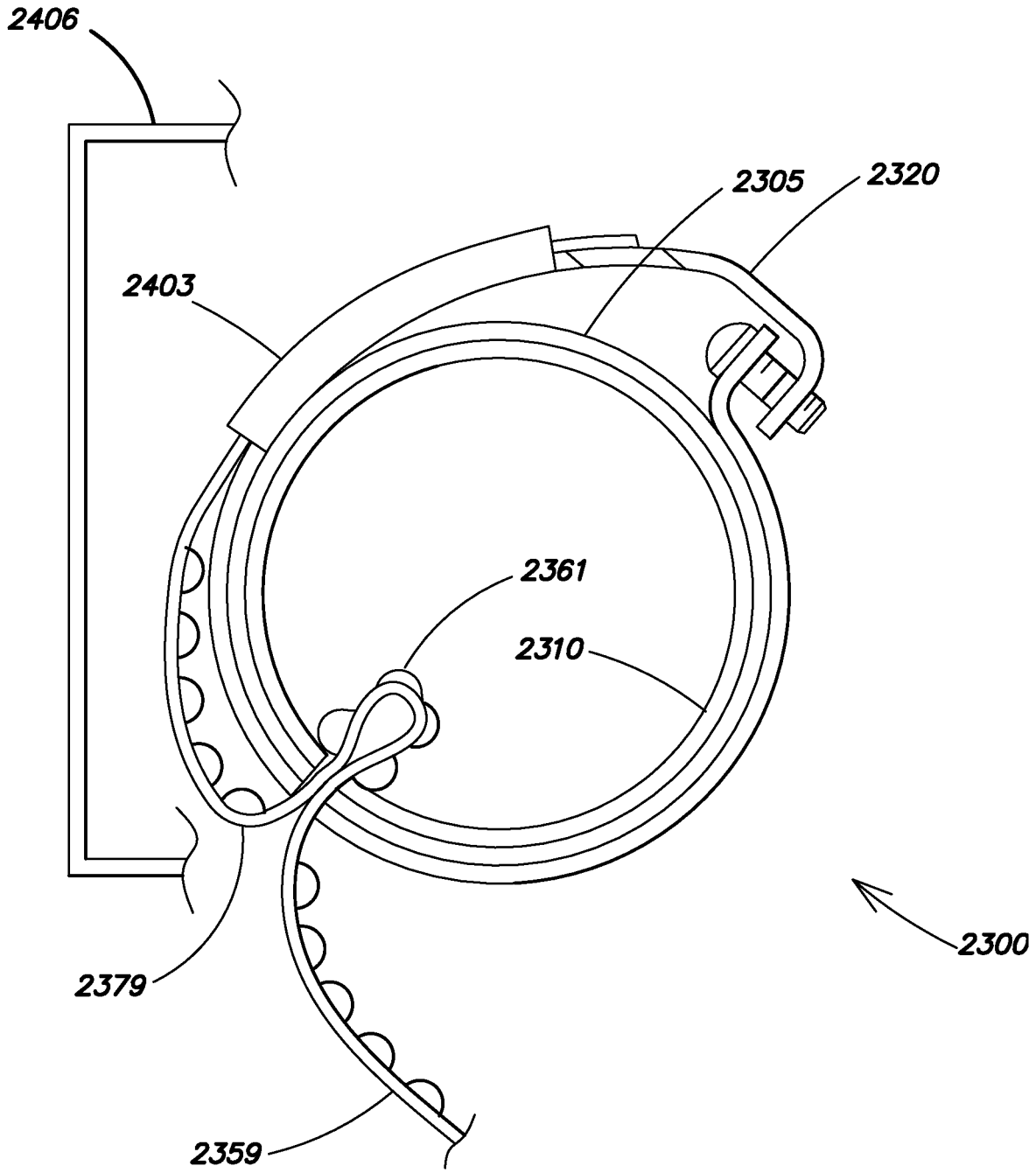

FIG. 26F is a detailed depiction of an assembled adjustable roman shade attachment 2300 that may be positioned at the top of the roman shade. Specifically, and as shown in FIG. 26F, the slits of the components may be positioned at a downward angle. In addition, the top slat component 2359 may be inserted and secured in the slits in a similar manner as described with respect to FIGS. 26A through 26E. Further, the top slat component 2359 may be folded such that excess material 2379 may be wrapped around the top adjustable roman shade attachment 2300. The excess material 2379 of the top most slat component 2359 may be rolled over and clipped on the top most adjustable roman shade attachment 2300 utilizing clip 2403, such that the excess material 2379 of the top most slat component is in the back of the shade out of view. In addition, a mechanism utilized to raise and lower the shade, such as a motor, a bail retraction mechanism, or a pulley system as described above (not shown) may be attached to the top most adjustable roman shade attachment 2300.

Further, a valence 2406 may be attached to the top most adjustable roman shade attachment 2300, to hide the mechanism to raise and lower the roman shade and the clip 2403 used to secure the top most slat component 2359 to the top adjustable roman shade attachment 2300. In addition, and similarly, the clip 2403 may be used to secure the bottom most slat component, as depicted in FIG. 26E, to the bottom most adjustable roman shade attachment 2300. It is noted that although FIG. 26F depicts the half circles as described with reference to FIGS. 26A and 26B, it is expressly contemplated that FIG. 26F may be utilized with a zipper mechanism as described with reference to FIGS. 26C and 26D. Although reference is made to utilizing an adjustment with respect to FIGS. 26A-26F, it is expressly contemplated that no screws may be utilized and the slat component may be secured within the adjustable roman shade attachment 2300 their natural weight and/or friction.

Figure 27A:
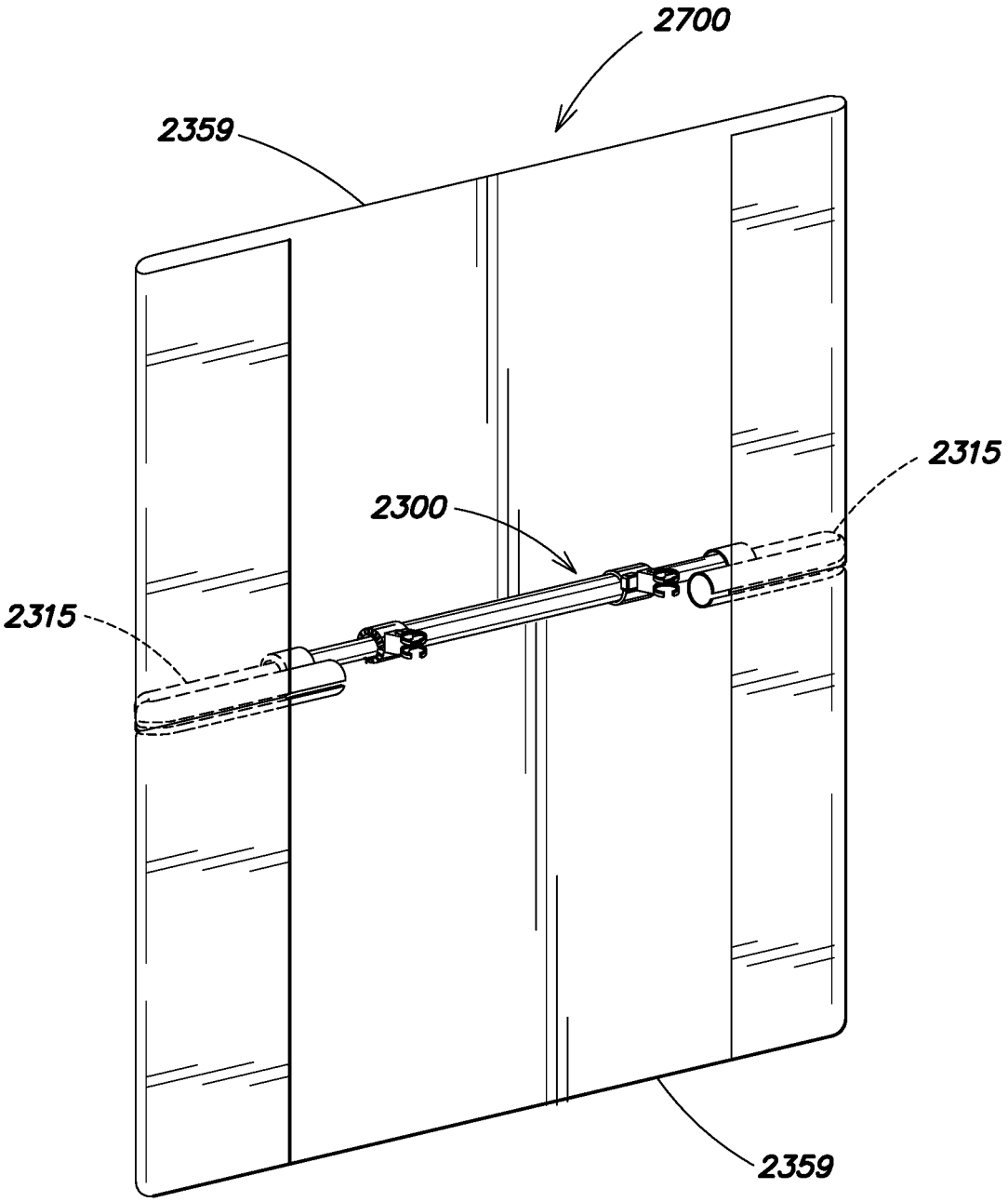
FIGS. 27A-27C is a detailed depiction an adjustable roman shade attachment with slat components in accordance with an illustrative embodiment of the present invention.

FIG. 27A is a detailed depiction of a back view of a roman shade 2900 including an adjustable roman shade attachment 2300 with inserted slat components. It is noted that excess material of the slat components 2359 are inserted in the slits of the edge inserts 2315 such that the excess material wraps around on the curved portion of the edge inserts 2315 so that the excess material, that, for example, is wider than a window opening, can be hidden. As such, the adjustable roman shade attachment 2300 can be sized to fit any sized window, and the excess material of the slat components 2359 can be hidden on the back side of the shade by utilizing the silts of the edge inserts 2315 that are curved.

Figure 27B:
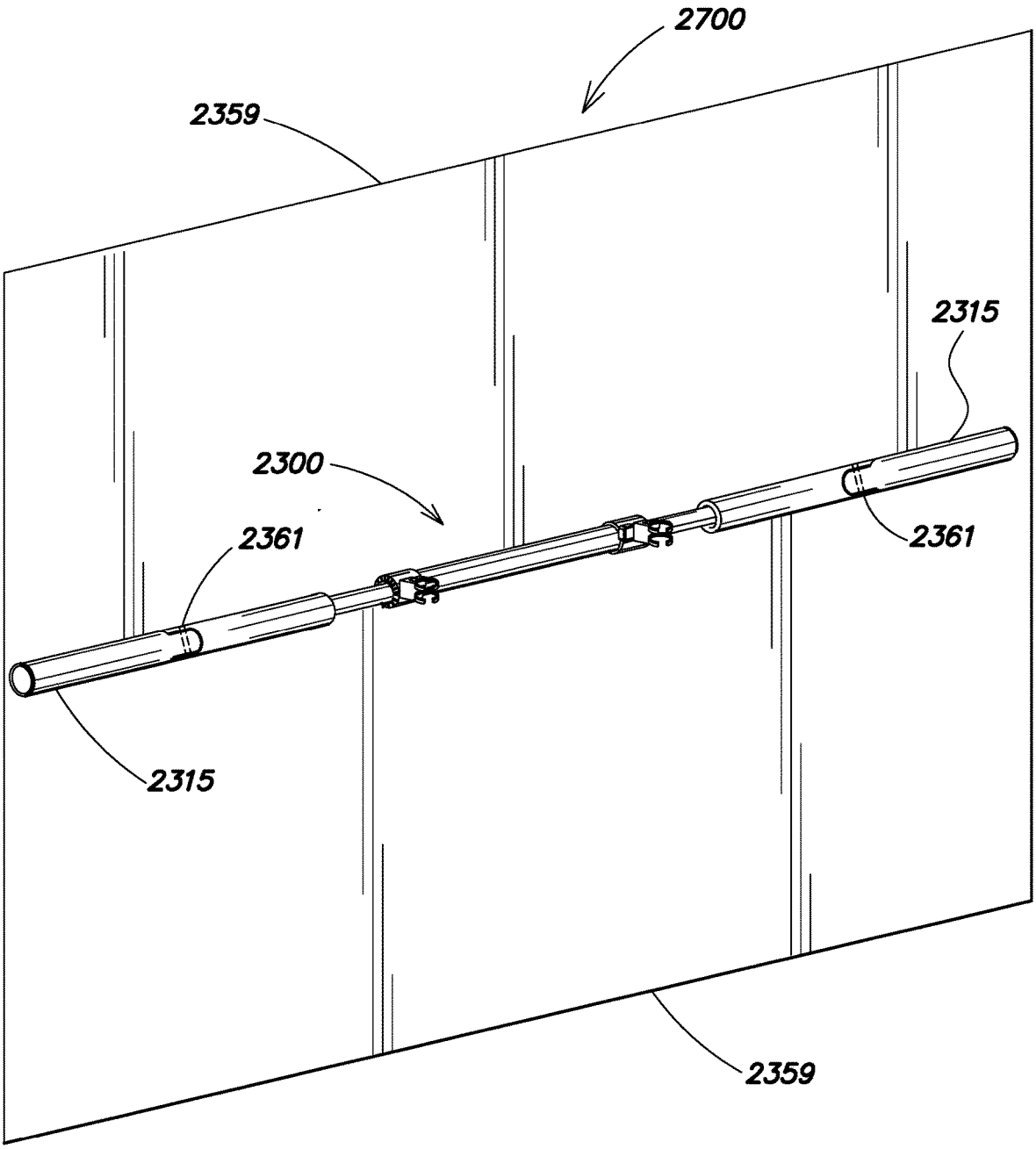
Figure 27C:
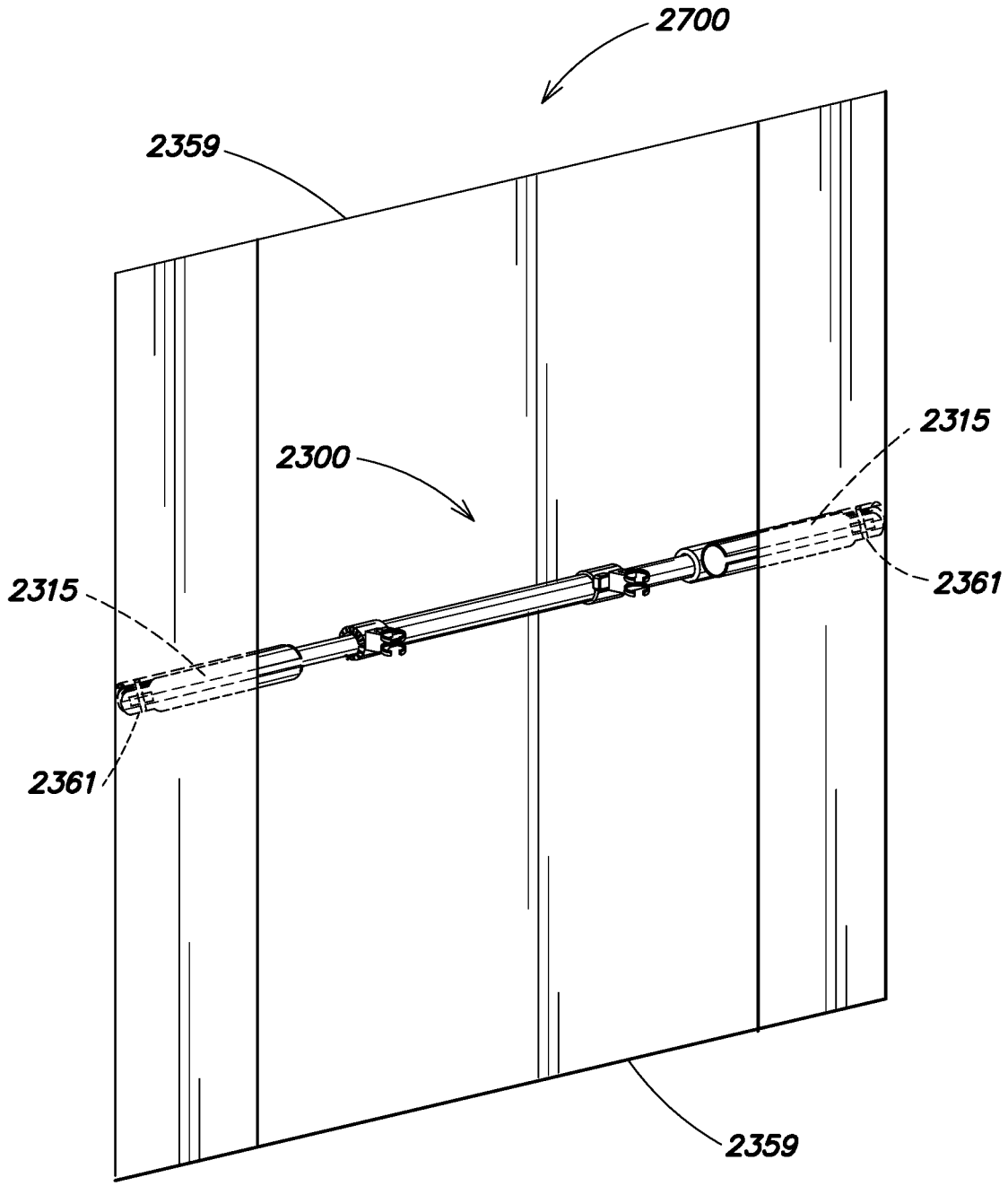

FIGS. 27B and 27C are detailed depictions of a back view of a roman shade 2700 including an adjustable roman shade attachment 2300 with edge inserts 2315 that include hinges 2361. As depicted in 27B, the hinges 2361 are in a first configuration such that the edge inserts 2315 are straight and not curved. Having the edge inserts 2315 in a straight configuration gives a user the ability to more easily insert the slat components 2359 into the slits of the adjustable roman shade attachment 2300. After the slat components are secured in the slits of the adjustable roman shade attachment 2300, a user may manipulate the hinges 2361 such that the edge inserts 2315 are then curved such that the excess material of the slat components is in the back of the shade as depicted in FIG. 27C.

Figure 28A:
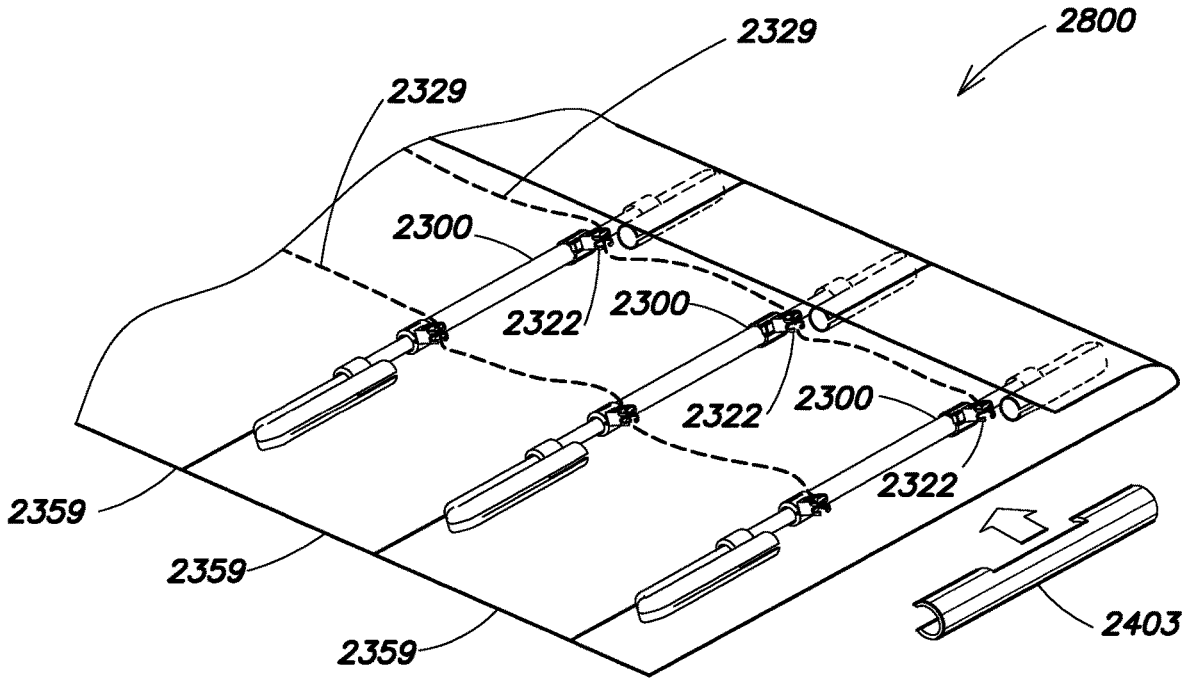
FIGS. 28A and 28B are detailed depictions of a back view of a roman shade utilizing a plurality of adjustable roman shade attachments with slat components in accordance with an illustrative embodiment of the present invention.
Figure 28B:
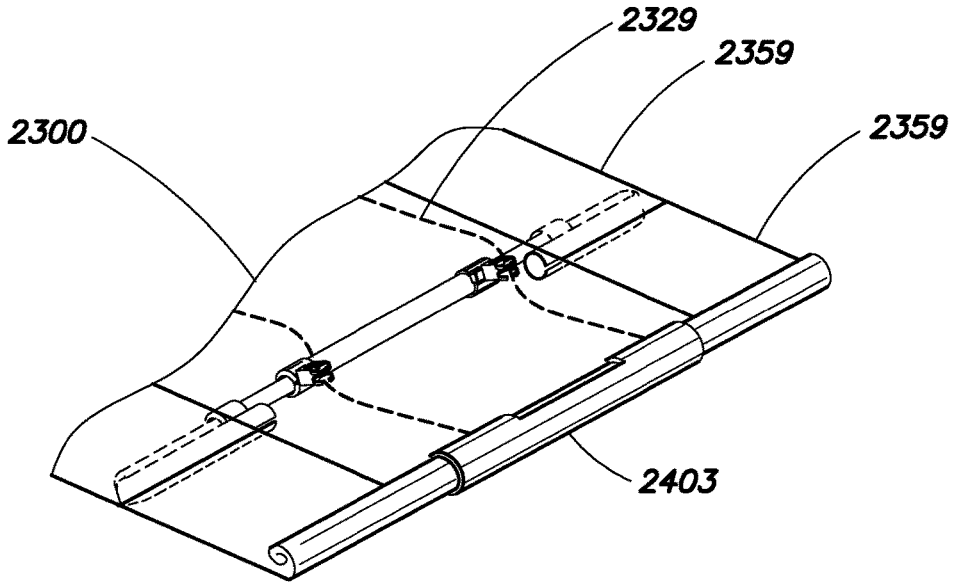

FIGS. 28A and 28B are detailed depiction of a back view of a roman shade 2800 having a plurality of adjustable roman shade attachment 2300 coupled together. Specifically, the coupling is achieved through use of cords 2329 that are fed through the protruding eye hooks 2322 of each of the adjustable roman shade attachments 2300. For example, there may be a pull string (shown in FIGS. 24A and 24B) on the front of the roman shade such that when a user pulls the pull string associated with a pulley system, and the cords 2329 retract such that the bottom portion of the roman shade raises to let light within the window, as described above. Alternatively a motor or a bail and retraction mechanism may be utilized, as described above, to cause the cords 2329 to shorten or retract such that the bottom of the shade is raised. That is, the eye hook 2322 of the bottom most adjustable roman shade attachment 2300 is tied to, or secured such that when the user wants to raise the shade, the bottom adjustable roman shade attachment 2300 moves up and closer to the adjustable roman shade attachment 2300 that is directly above the bottom most adjustable roman shade attachment 2300. In addition, and as shown in FIGS. 28A and 28B, the clip 2403 may be utilized to secure the bottom most slat component to the bottom most adjustable roman shade attachment 2300.

Figure 29B:
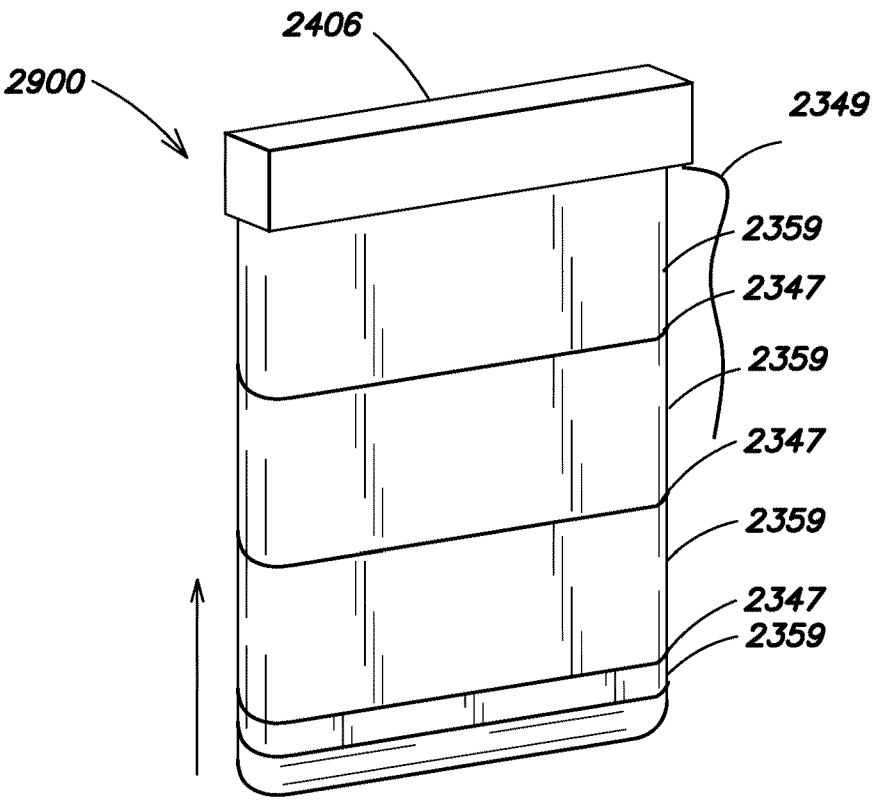
FIGS. 29A and 29B are detailed depictions of a front view of a roman shade utilizing an adjustable roman shade attachment in accordance with an illustrative embodiment of the present invention.
Figure 29A:
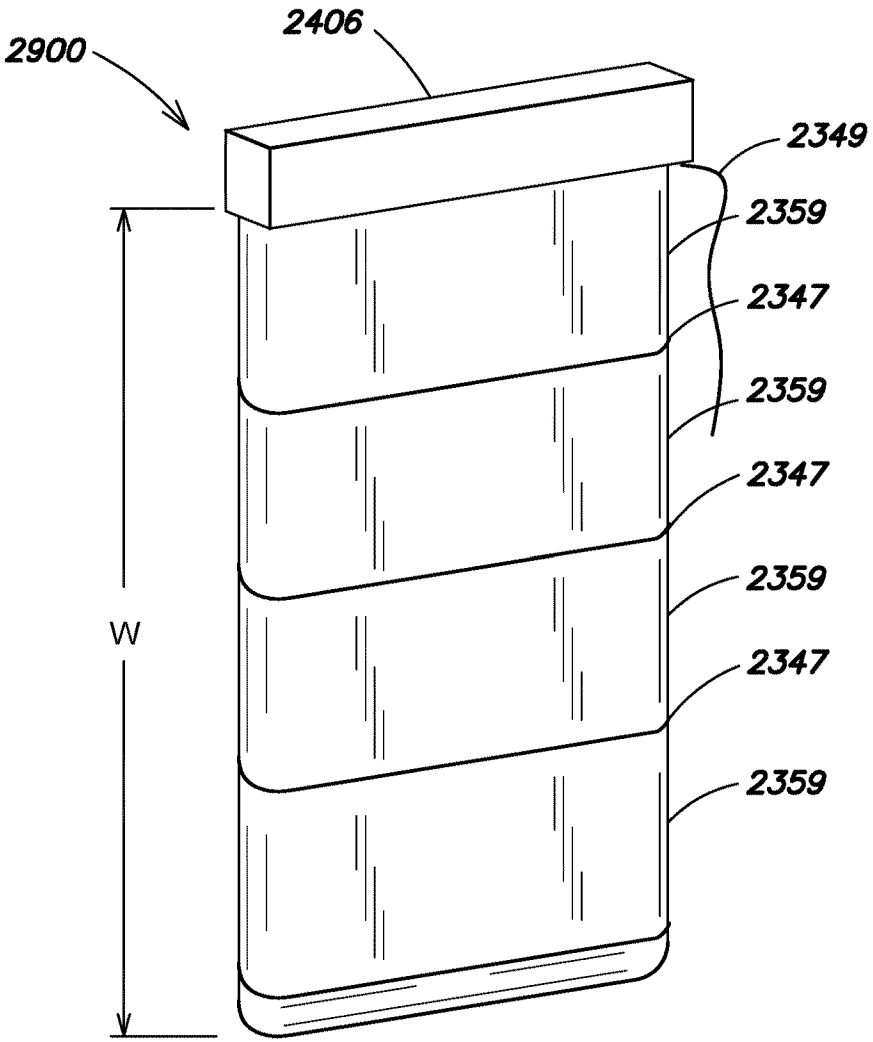

FIGS. 29A and 29B are detailed depictions of a front of a roman shade 2900 having plurality of adjustable roman shade attachment 2300. Specifically, the roman shade may be placed in a window opening in a similar manner as described above. FIGS. 29A and 29B show the plurality of slat components 2359 with four creases or folds 2347. The four creases or folds 2347 are formed based on the insertion of two slat components in the slits of the adjustable roman shade attachments 2300, as described above. FIG. 29A shows the roman shade 2900 in its extended state and covering the entire window opening, prior to, for example, a user raising the roman shade 2900 utilizing a particular mechanism.

Specifically, pull string 2349 may be utilized to activate a pulley system, as described above, to cause the cords 2329 in the back of the roman shade 2900 to be pulled up to raise the shade 2900 a selected distance that allows light to enter the window area from below. Alternatively, the user may press a button that causes a motor to raise the shade, or the user may simply push or pull the bottom most adjustable roman shade attachment 2300 to raise or lower the shade (e.g., a bail retraction mechanism). FIG. 29B shows a shade 2900 that has been raised a selected distance.

As shown in FIGS. 29A and 29B, the excess material is inserted in the slit of the edge insert 2315 (not shown) such that the excess material wraps around and is hidden in the back of the shade. The shade may also include a valence 2406, for example, at the top of the shade as a decorative feature such that the mechanism that is utilized to raise/lower the shade 2900 is hidden. In addition, the bottom most adjustable roman shade attachment 2300 includes an extra fold (not shown) such that the bottom portion of the bottom most adjustable roman shade attachment 2300 is hidden. Thus, the valence 2406 and extra fold are decorative features that allow the shade to look more aesthetically pleasing and to hide the adjustable roman shade attachments 2300 from the front view.

Figure 30:
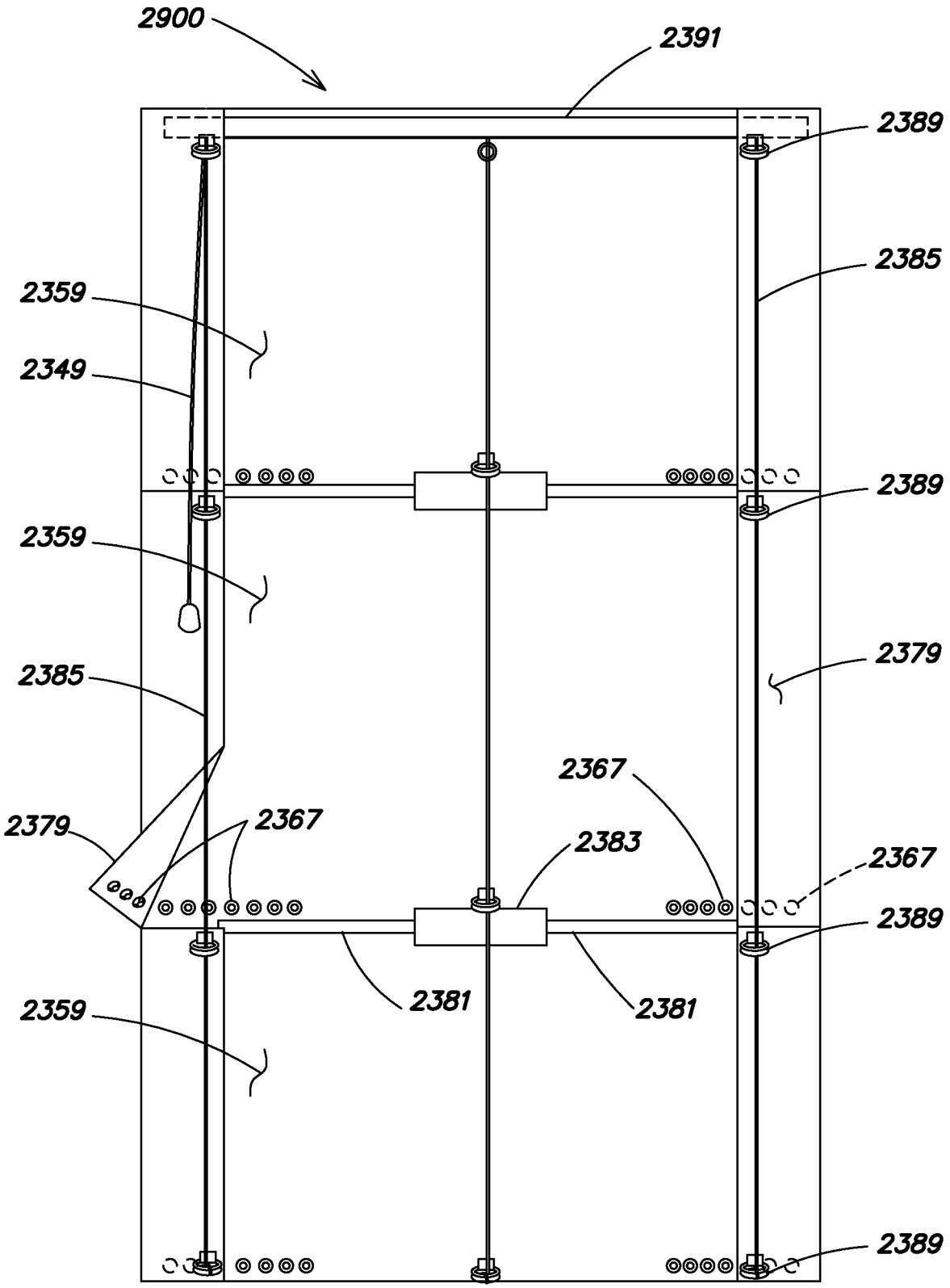
FIG. 30 is a detailed depiction of an adjustable roman shade in accordance with an illustrative embodiment of the present invention.

FIG. 30 is a detailed depiction of an alternative embodiment of a back of a roman shade. The plurality of slat components 2359 may be coupled to each other with a zipper mechanism 2363, as described above with respect to FIGS. 26C and 26D, or a variety of other securing mechanism, such as, but not limited to strings, buttons, magnets, hook and loop fasteners, such as Velcro®, clips, etc. Each of the plurality of slat components 2359 may include alternating males and female buttons 2367 that run along the bottom and top edges of each slat component 2359. The alternating male and female buttons 2367 may run along the entire edges or only on the outer portions of the edges. Thus, the excess material 2379 may be folded and buttoned to a corresponding button on the back of a slat component of the plurality of slat component 2359. Alternatively, the excess material may be attached to the back of the roman shade utilizing any of a variety of different securing mechanisms, such as, but not limited to, hook and loop fasteners, such as Velcro®, hooks, clips, etc.

In addition, one or more dowels 2381 may be positioned at various points along the back of a roman shade 2900 to provide rigidity or structure to the overall roman shade 2900. Further, the one or more dowels 2381 may cause creases or folds to form at the position at where the dowels are positions and holds the folds, based on, for example, a user pulling a pull string 2349 associated with a pulley system, as described above. The one or more dowels 2381 may be secured to the back of the roman shade 2900 in a variety of different ways. For example, the one or more dowels 2381 may be secured to the back of the roman shade 2900 utilizing clips, fasteners, hook and loop fasteners, such as Velcro®, a zipper mechanism, strings, etc. As depicted, in FIG. 30, a dowel acceptor 2383 may be fastened, clipped or secured to the back of the roman shade 2900. The dowel acceptor 2383 includes two openings on either side such that two dowel may be screwed into either sides of each openings to adjust the overall length of the dowel. For example, the dowel is screwed into the screw structure causes the dowel to be shorter in length. Advantageously, a user can alter the length of the dowel to a variety of desired lengths on the back of the roman shade based on for, example, the type, size, or shape of the window. It is noted that the dowels may be any shape, such as, but not limited to, circular, square, rectangle, flat, etc.

Further, draw string 2385 may extend the length of the roman shade 2900 and may be stitched or secured to the top most portion of the roman shade 2900. In addition, a plurality of eye hooks 2389 may be position on the back of the roman shade 2900. The eye hooks 2389 may be stitched to the back of the roman shade 2900, or attached utilizing hook and loop fasteners, such as Velcro®, a clip, a hook, etc. Each eye hook 2389 may have the draw string 2385 go through it. By having the drawing string 2385 go through the eye hooks 2389 a clean and uniform retraction of the roman shade 2900 is provided when the pull string 2349 is utilized to raise the roman shade 2900. Specifically, when a user pulls pull string 2349, it may activate a pulley mechanism (not shown) that is also coupled to the draw strings 2385 in housing 2391, which raises the shade a desired height as described above. As such, the draw strings 2385 cause the shade to be raised in a uniform manner as described above.

Figure 31A:
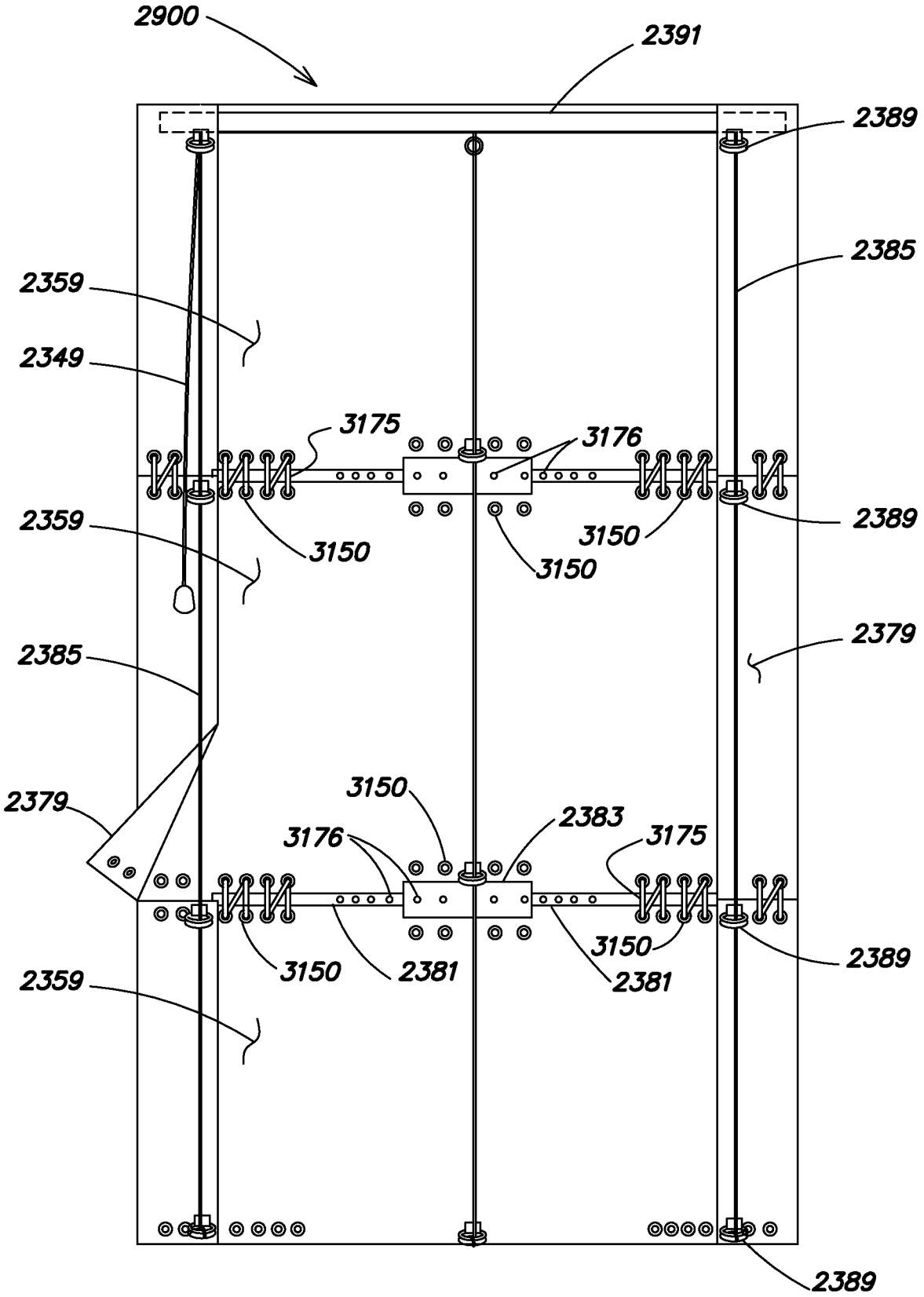
FIG. 31A-31E are detailed depictions of an adjustable roman shade in accordance with an illustrative embodiment of the present invention.

FIG. 31A is a detailed depiction of an embodiment of a back of a roman shade. The plurality of slat components 2359 may be coupled to each other utilizing any of the above described mechanism, such as, but not limited to a zipper mechanism 2363, as described above with respect to FIGS. 26C and 26D, or a variety of other securing mechanism, such as, but not limited to strings, buttons, magnets, hook and loop fasteners, such as Velcro®, clips, etc. In addition to the dowels 2381 and dowel acceptor 2383, each of the plurality of slat components 2359 may include a plurality of through holes 3150 that run along the bottom and top edge of each slat component 2359. The through holes 3150 may run along the entire edge or only on selected portions of the edges as depicted in FIG. 31A. Thus, the excess material 2379 may be folded and tied to the back of the shade utilizing the through holes 3150. For example, and after the excess material 2379 has been folded over a particular amount, a user may feed the string 3175 between the through holes 3150 and tie the string 3175 to ensure the excess material 2359 stays folder over.

In addition, the through holes 3150 may be utilized to secure the one or more dowels 2381 and/or the dowel acceptor 2383 to the back of the roman shade 2900. For example, the strings 3175 may be fed between the through holes 3150 to and tied to secure the one or more dowels 2381 and/or the dowel acceptor 2383 to the back of the roman shade 2900. Alternatively, the one or more dowels 2381 and/or the dowel acceptor 2383 may include device holes 3176 such that the string 3175 can be fed through holes 3150 and device holes 3176 to secure the one or more dowels 2381 and/or the dowel acceptor 2383 to the back of the roman shade 2900 in a more rigid manner. In addition, one or more other strings, clips, etc. may be utilized to secure the components such that if the strings 3175, there is added securing mechanisms to hold the components together.

Figure 31B:
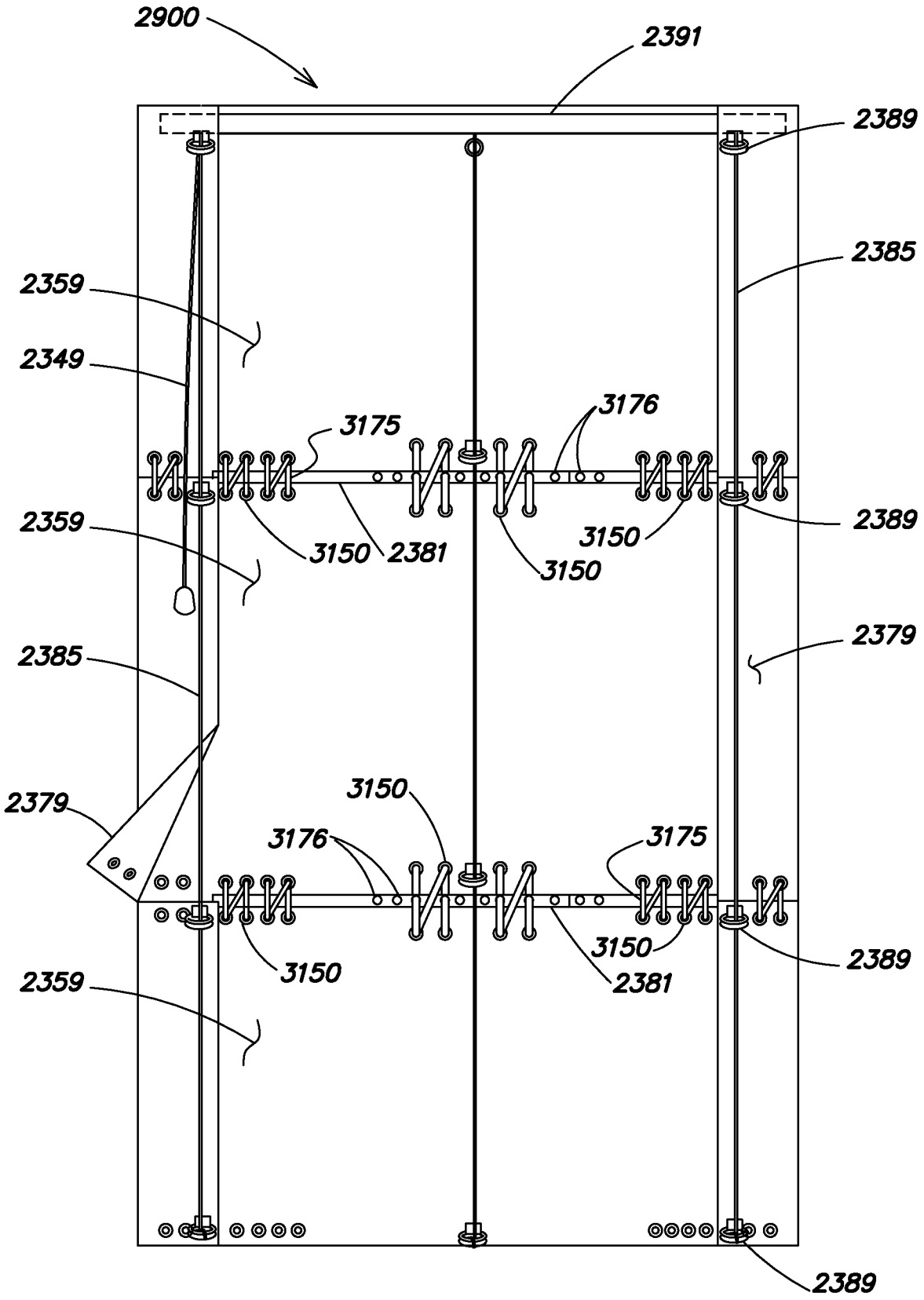

FIG. 31B is a detailed depiction of an embodiment of a back of a roman shade. The plurality of slat components 2359 may be coupled in a similar manner as described with respect to FIG. 31A. Further, FIG. 31B includes dowels 2381 but does not include dowel acceptor 3150. Instead, the two dowels 2381 overlap to adjust the overall width of the roman shade 2900. Specifically, the roman shade 2900 becomes smaller in width the more the two dowels 2381 overlap. Conversely, the roman shade 2900 becomes larger in width the less the two dowels 2381 overlap. In addition, the string 3175 is fed through the holes 3150 and through the device holes 3176 of the dowels to secure the dowels 2381 to the back of the roman shade 2900.

Figure 31C:
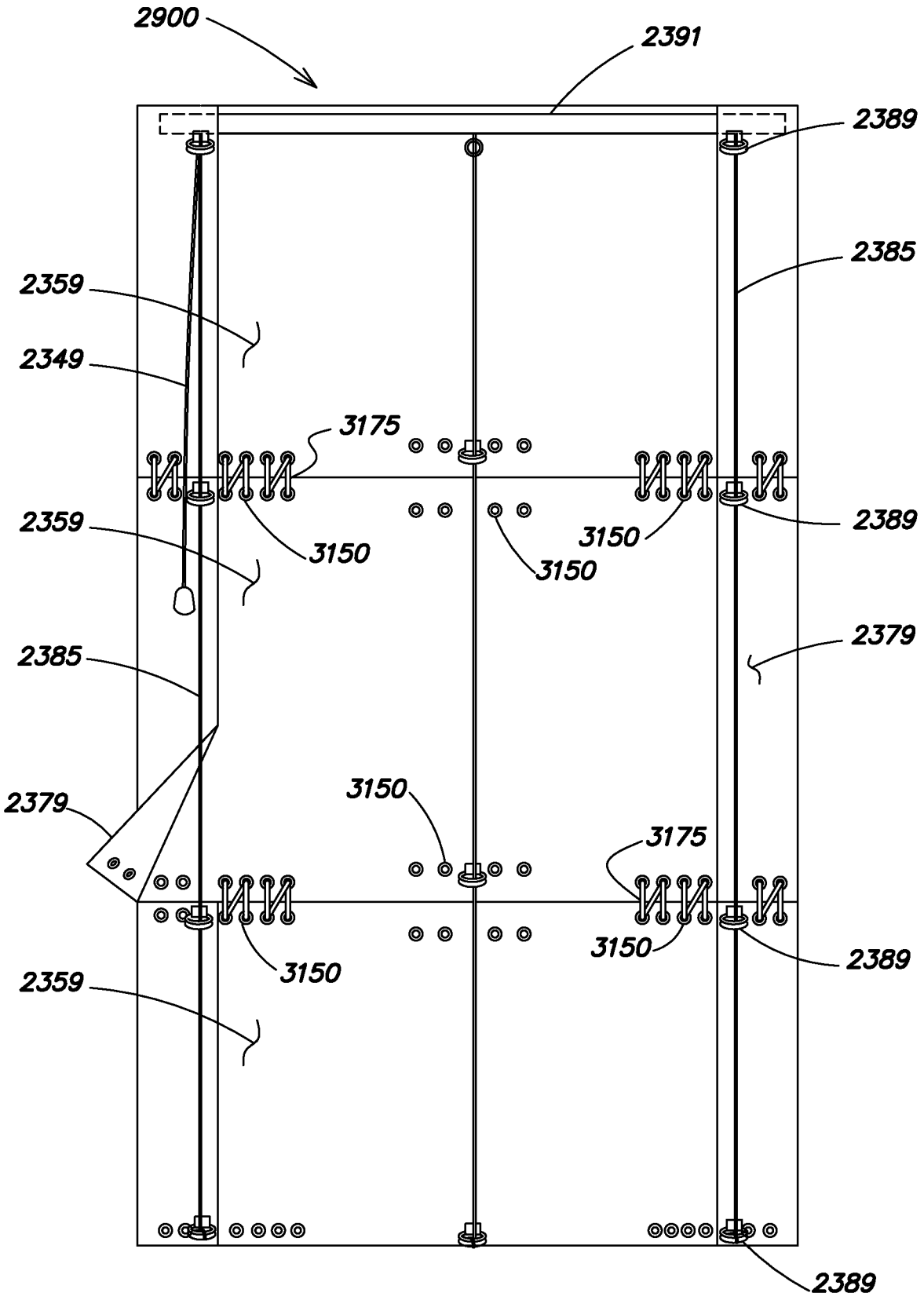

FIG. 31C is a detailed depiction of an embodiment of a back of a roman shade. Different than FIG. 31A, the roman shade 2900 of FIG. 31C does not include dowels 2381 and dowel acceptor 2383. Instead, the plurality of slat components 2359 are coupled to each other utilizing the plurality of through holes 3150 that run along the bottom and top edge of each slat component 2359. The through holes 3150 may run along the entire edge or only on selected portions of the edges as depicted in FIG. 31C. In addition to being utilized to couple the slats together, the through holes 3150 may be utilized to fold over the excess material 2379 as described with respect to FIG. 31A. Although FIG. 31C only illustrates utilizing the strings 3175 that is fed through the through holes 3150, it is expressly contemplated that an additional securing mechanism, such as a zipper, may be utilized with or in place of the strings 3175 and through holes 3150 to couple the slats together.

Figure 31D:
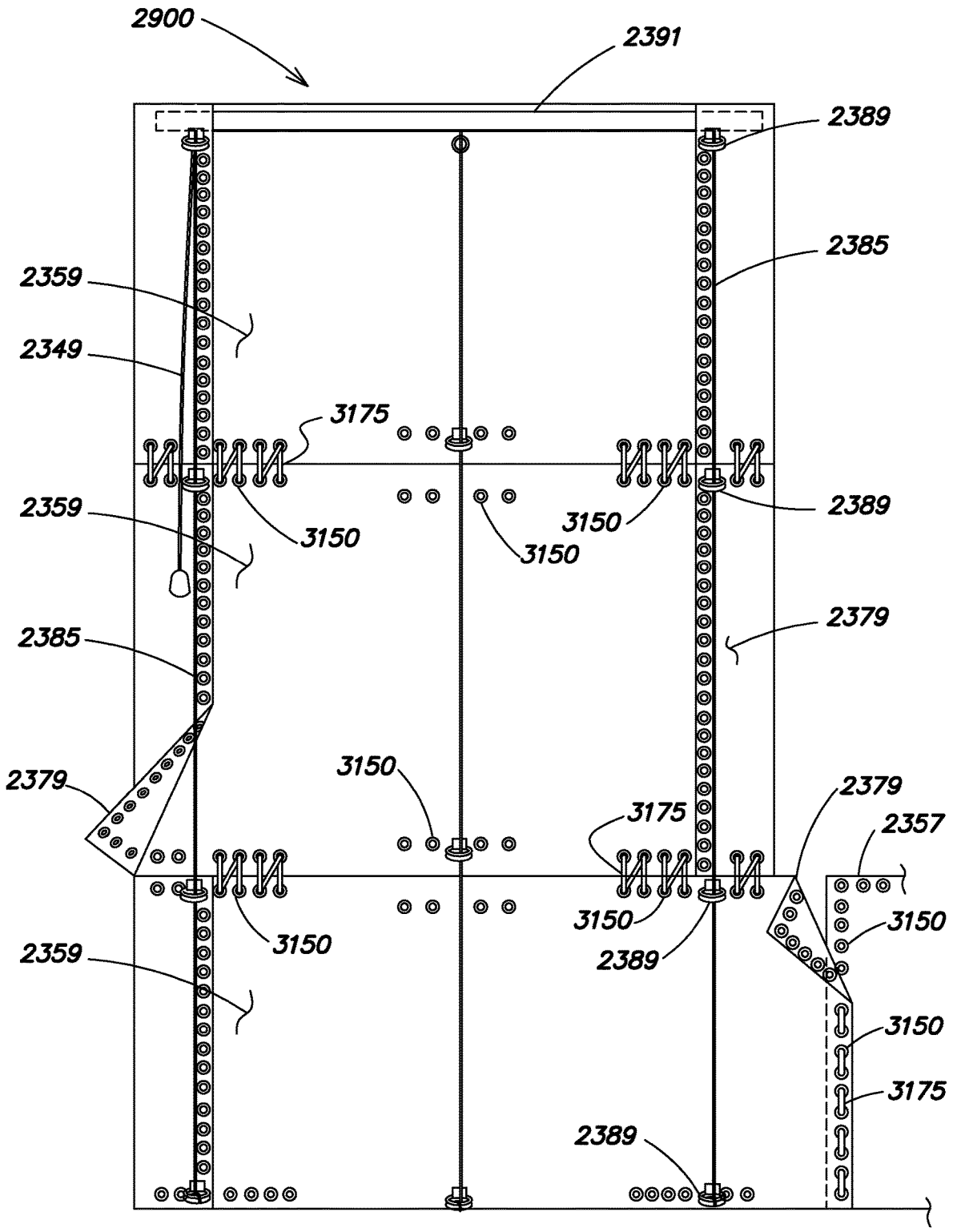

FIG. 31D is a detailed depiction of an illustrative embodiment of a back of a roman shade. Similar to FIG. 31C, the plurality of slat components 2359 are coupled to each other and the excess material 2379 is folded over utilizing the plurality of through holes 3150 and strings 3175. In addition, and as illustrated in FIG. 31D, the edges of each of the plurality of slat components 2359 include through holes 3150 that run vertically. The through holes 3150 that run vertically on the edges of slat components 2359 may be utilized to couple a slat component 2359 to an adjacent slat component 2357 to alter the overall width of the roman shade, to, for example, fit window openings of differing widths. Specifically, and as illustrated in FIG. 31D, the strings 3175 may be fed through the through holes 3150 on the edges of the slat component 2359 and the adjacent slat component 2357 to alter the overall width and/or length of the roman shade.

Although FIG. 31D shows the slat component 2349 being coupled to the adjacent slat component 2357 on the right side and the excess material 2379 being folded over on the left side, it is expressly contemplated that the adjacent slat component 2357 may be coupled to either, both, or neither side of the slat component 2359. Further, and although the adjacent slat component 2357 is coupled to the bottom most slat component 2359, it is expressly contemplated that the adjacent slat component 2357 may be attached to any of the slat components 2359 (e.g., top, middle or bottom) and that the depiction in FIG. 31D is for illustrative purposes only. Further, and although FIG. 31D depicts utilization of string 3175 and through holes 3150 to couple the slat component 2359 to the adjacent slat component 2357, it is expressly contemplated that the slat component 2359 and adjacent slat component 2357 may be coupled to each other utilizing a variety of other securing mechanism, such as, but not limited to buttons, magnets, hook and loop fasteners, such as Velcro®, clips, etc. Moreover, it is expressly contemplated that the adjacent slat component 2357 as described with respect to FIG. 31D may be utilized with any of the shades as described herein.

Figure 31E:
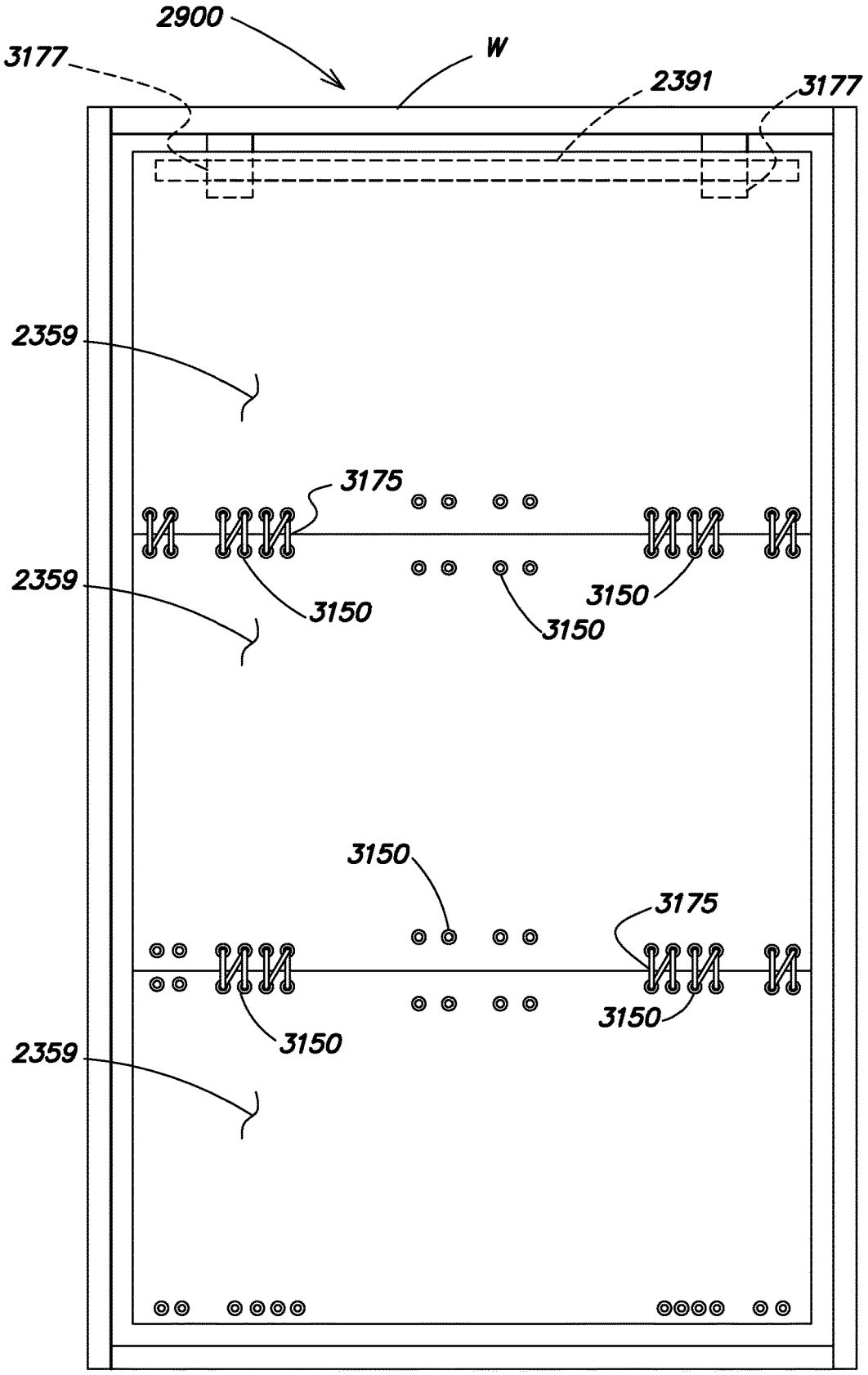

FIG. 31E is a detailed depiction of an embodiment of a front of a roman shade secured to a window opening W. Specifically, one or more brackets 3177 that are secured to the window opening W utilizing, for example, screws or a variety of different type of fasteners. With the one or more brackets 3177 secured to the window opening W, the housing 2391 may be "snapped" or secured within the openings of the bracket to secure the roman shade 2900 to the window opening W. Although FIG. 31E depicts the one or more brackets 3177 being placed on the top of the window opening W, it is expressly contemplated that the brackets 3177 may be placed anywhere. It is expressly contemplated that the housing 2391 may be adjusted in width to accommodate a window of a variety of sizes. Thus, for example, the brackets 3177 may be placed on the sides of the window opening such that the housing 2391 slides within the openings of the brackets 3177, in a similar fashion to inserting a rod within an opening of a hollow tube. Thus, In addition, the brackets 3177 may be of any width and size to accommodate a variety of window frames.

Figure 32:
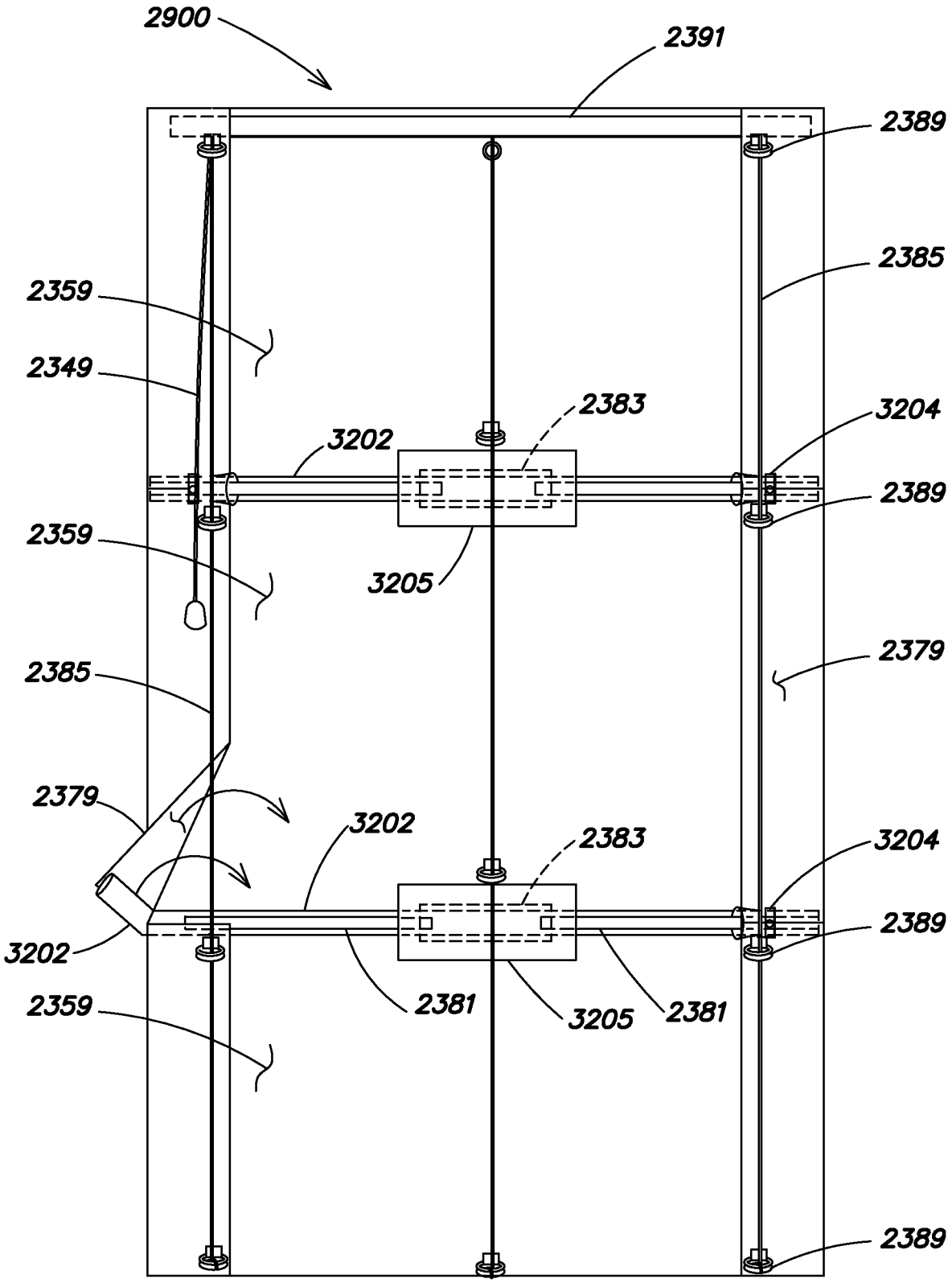
FIG. 32 is a detailed depiction of an adjustable roman shade in accordance with an illustrative embodiment of the present invention.

FIG. 32 is a detailed depiction of an embodiment of a back of a roman shade. The plurality of slat components 2359 may be coupled to each other with a zipper mechanism 2363, as described above with respect to FIGS. 26C and 26D, or a variety of other securing mechanism, such as, but not limited to strings, buttons, magnets, hook and loop fasteners, such as Velcro®, clips, etc. Casing 3205 is utilized to house a portion of the one or more dowels 2381 and the entirety of the dowel acceptor 2383. As explained above, the dowels 2381 and screw structure are utilized to alter change the overall width to match that of the desired shade. Each of the plurality of slat components 2359 may include a cylindrical sheath 3202 that extends horizontally along one or more edges of the slat component. That is, the cylindrical sheath 3202 may be positioned on one or all of the slat components. Further, the casing 3205 may be stitched or attached to the exterior of the sheath 3202 in a variety of different ways and the casing 3205 may be of any size such that it can accommodate the dowels 2381 and/or dowel acceptor 2383. The sheath 3202 may extend from, for example, the entire length of the slat component.

Thus, when the excess material 2379 is folded over, the end of the dowels 2381 closest to the edges of the slats (e.g., left and right sides of the slat), that are not within the casing 3205 and not secured to the dowel acceptor 2383, are inserted into the sheaths 3202. The dowels 2381 may then be secured inside the sheaths 3202 utilizing a clip 3204 or other fastener that is positioned on the exterior of the sheath 3202. Thus, when the dowels 2381 are secured inside the sheaths 3202, the fold over is secured to ensure the shade remains at the desired width. It is expressly contemplated that clip 3204 and eye hook 2389 may be coupled to each other, or may be a single piece, such that single piece adds more rigidity to the structure.

Figure 33:
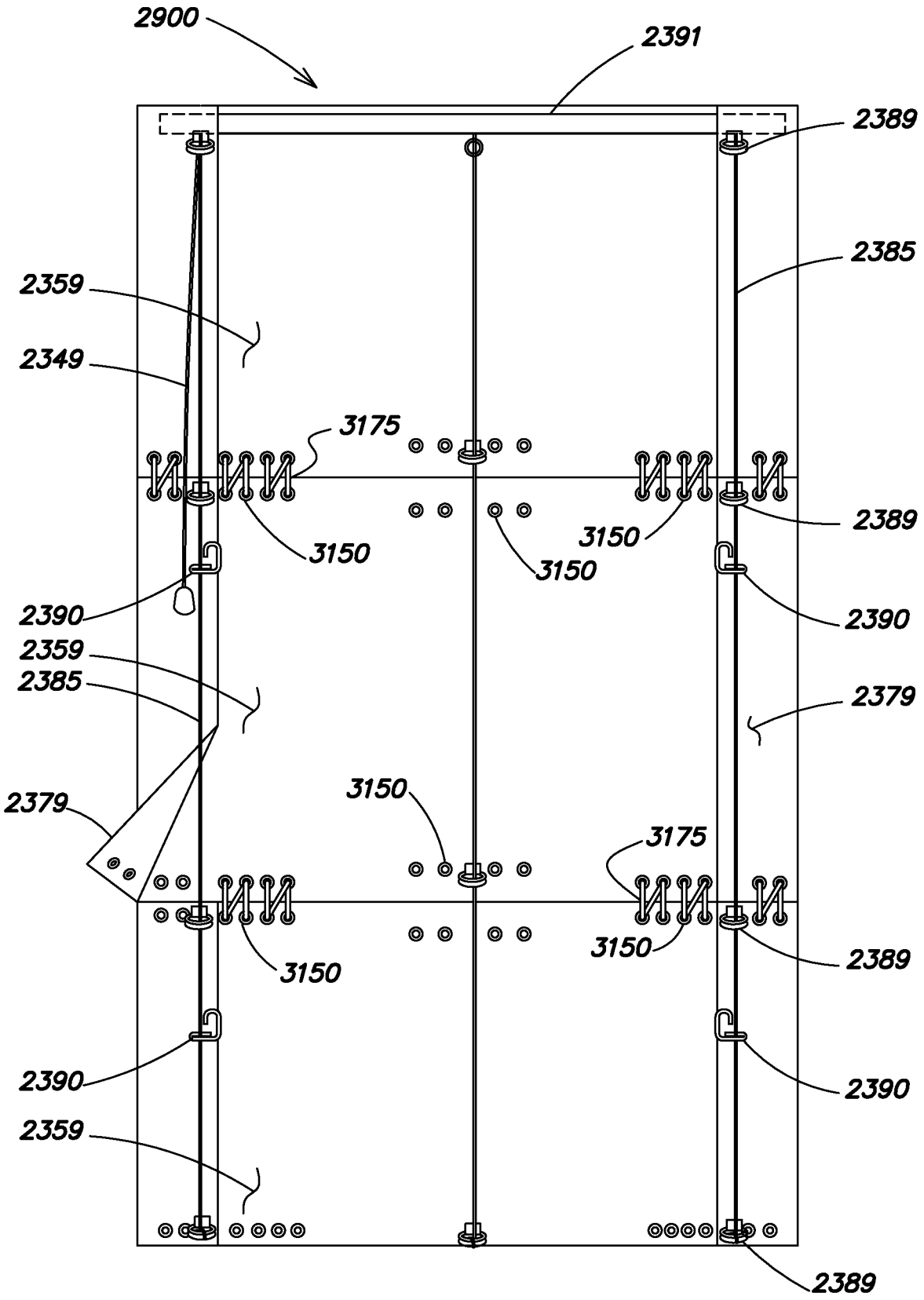
FIG. 33 is a detailed depiction of an adjustable roman shade in accordance with an illustrative embodiment of the present invention.

FIG. 33 is a detailed depiction of an embodiment of a roman shade. The roman shade 2900 in FIG. 33 is similar to the shade in FIG. 31, however the roman shade 2900 in FIG. 33 includes one or more clips 2390, wherein the draw string 2385 is fed through the eye hooks 2389. In addition, the one or more clips 2390 may be utilized to secure a particular point on the drawstring 2385 to the eye hooks 2389 such that the roman shade can be altered in overall length.

Figure 34A:
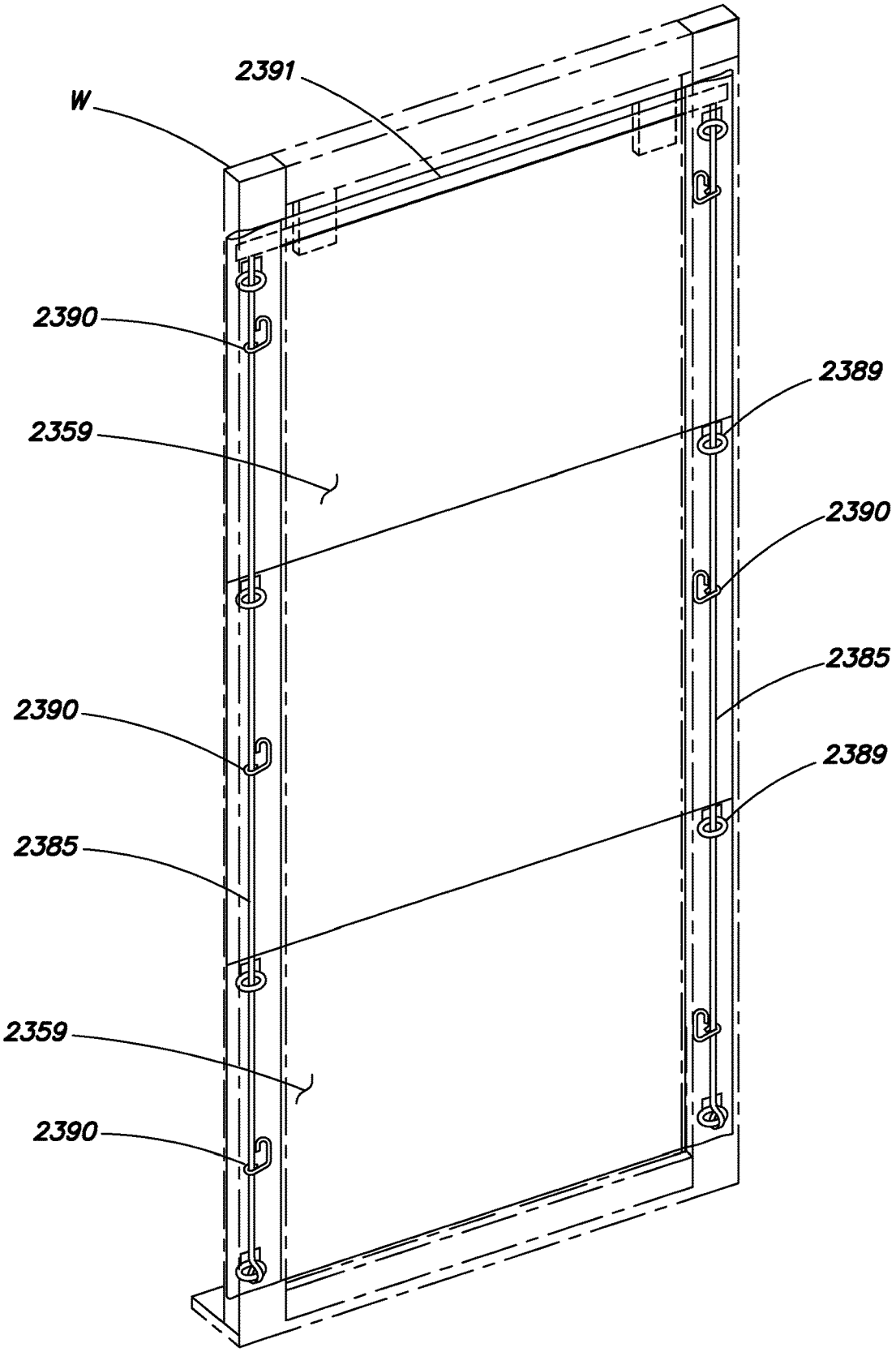
FIGS. 34A and 34B are detailed depictions of an adjustable roman shade in accordance with an illustrative embodiment of the present invention.
Figure 34B:
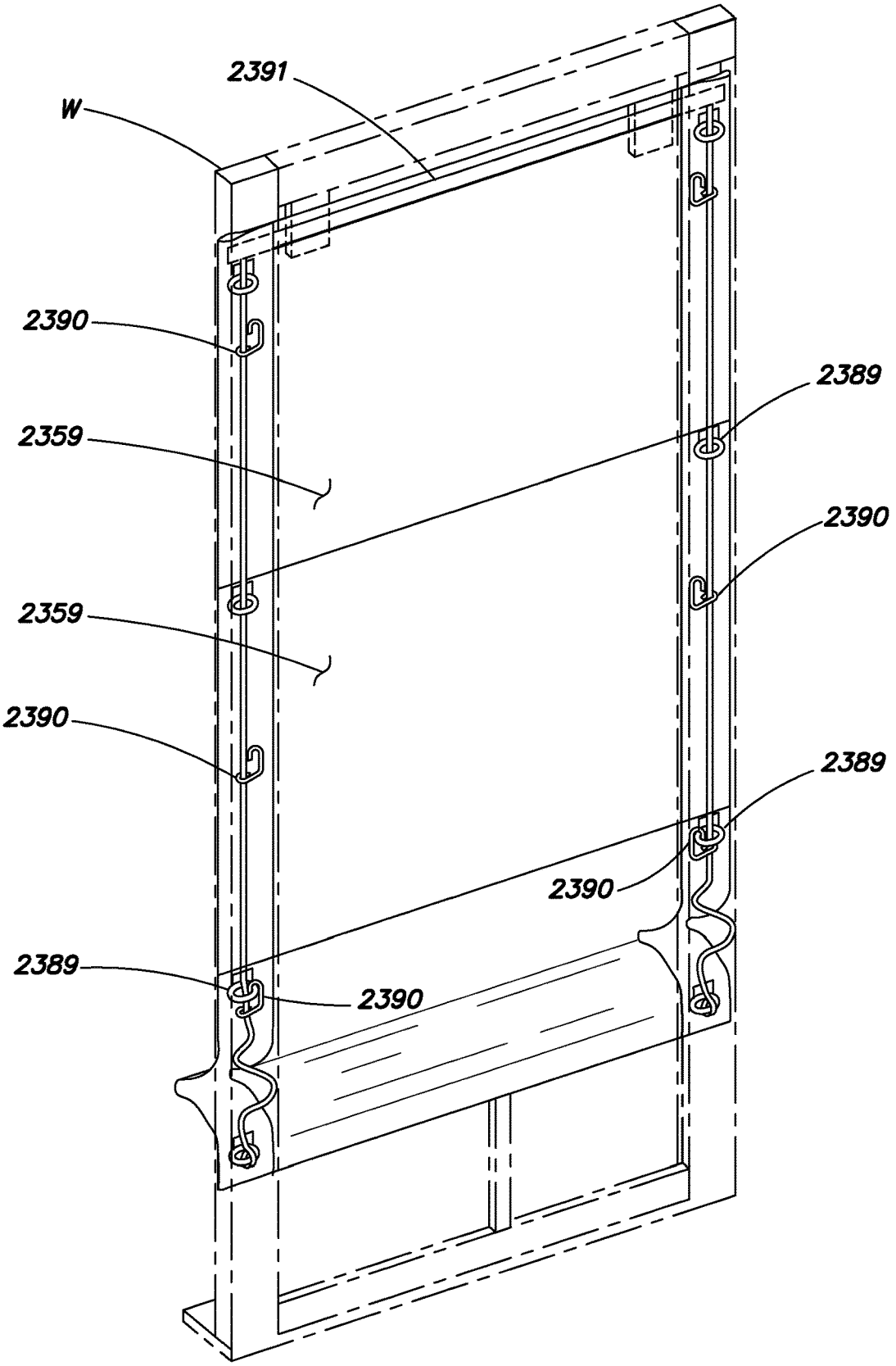

Specifically, and when no clips 2390 are utilized, the roman shade 2900 appears as one seamless shade to, for example, cover a window open (as seen in phantom) of a particular size as shown in FIG. 34A. However, if the roman shade 2900 is to be shortened to allow light to enter or to fit a smaller window, the one or more clips 2390 may be utilized to secure the draw string 2385 to the eye hooks 2389 to shorten the length of the roman shade as shown in FIG. 34B. Alternatively, and not shown, the clips 2390 may be utilized to secure two eye hooks 2385 together to shorter the overall length of the roman shade 2900. It is expressly contemplated that any number of clips 2390 may be secured to any number of eye hooks 2389 to change the overall size of the roman shade 2900.

Figure 35A:
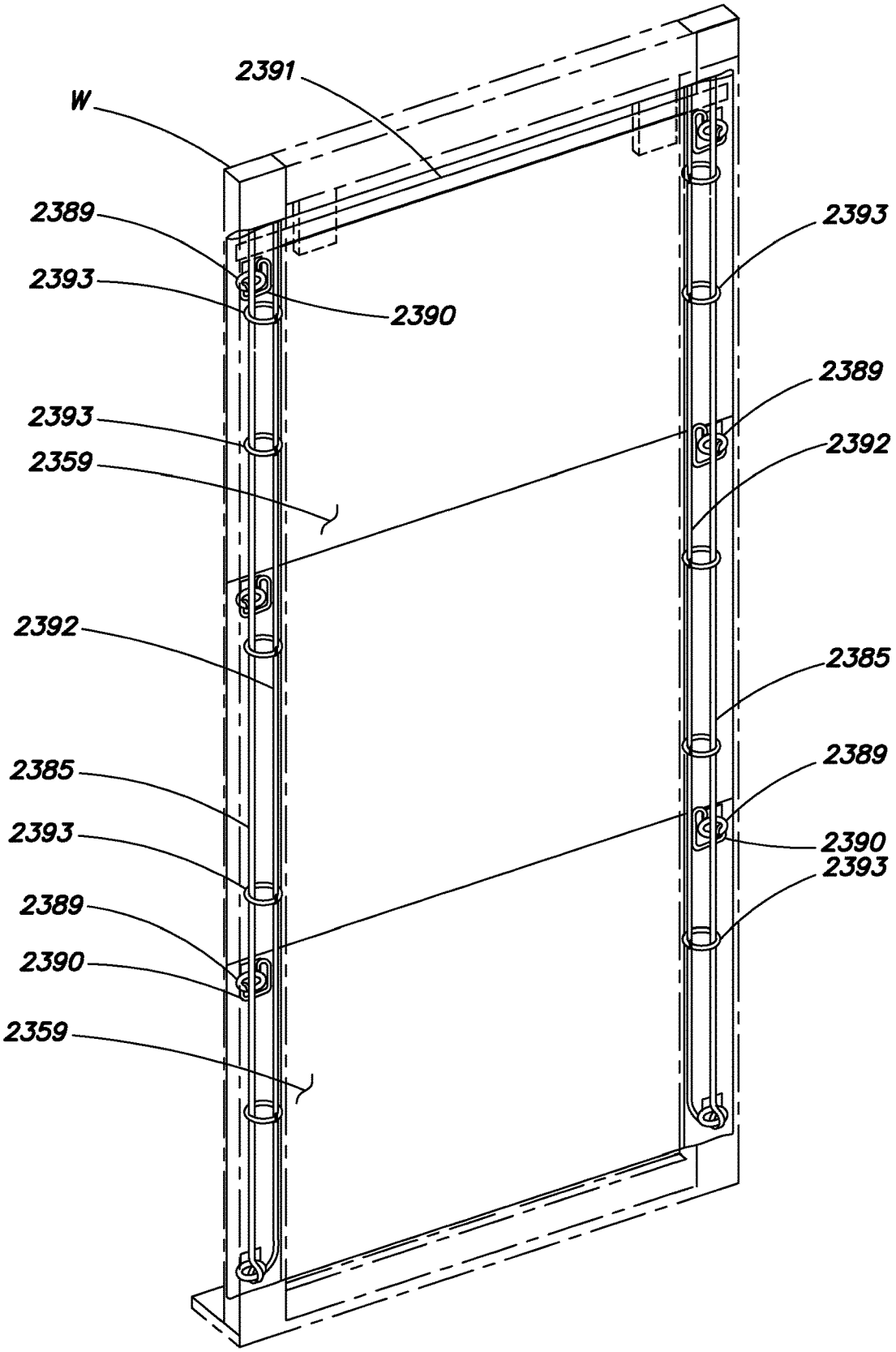
FIGS. 35A and 35B are detailed depictions of an adjustable roman shade in accordance with an illustrative embodiment of the present invention.
Figure 35B:
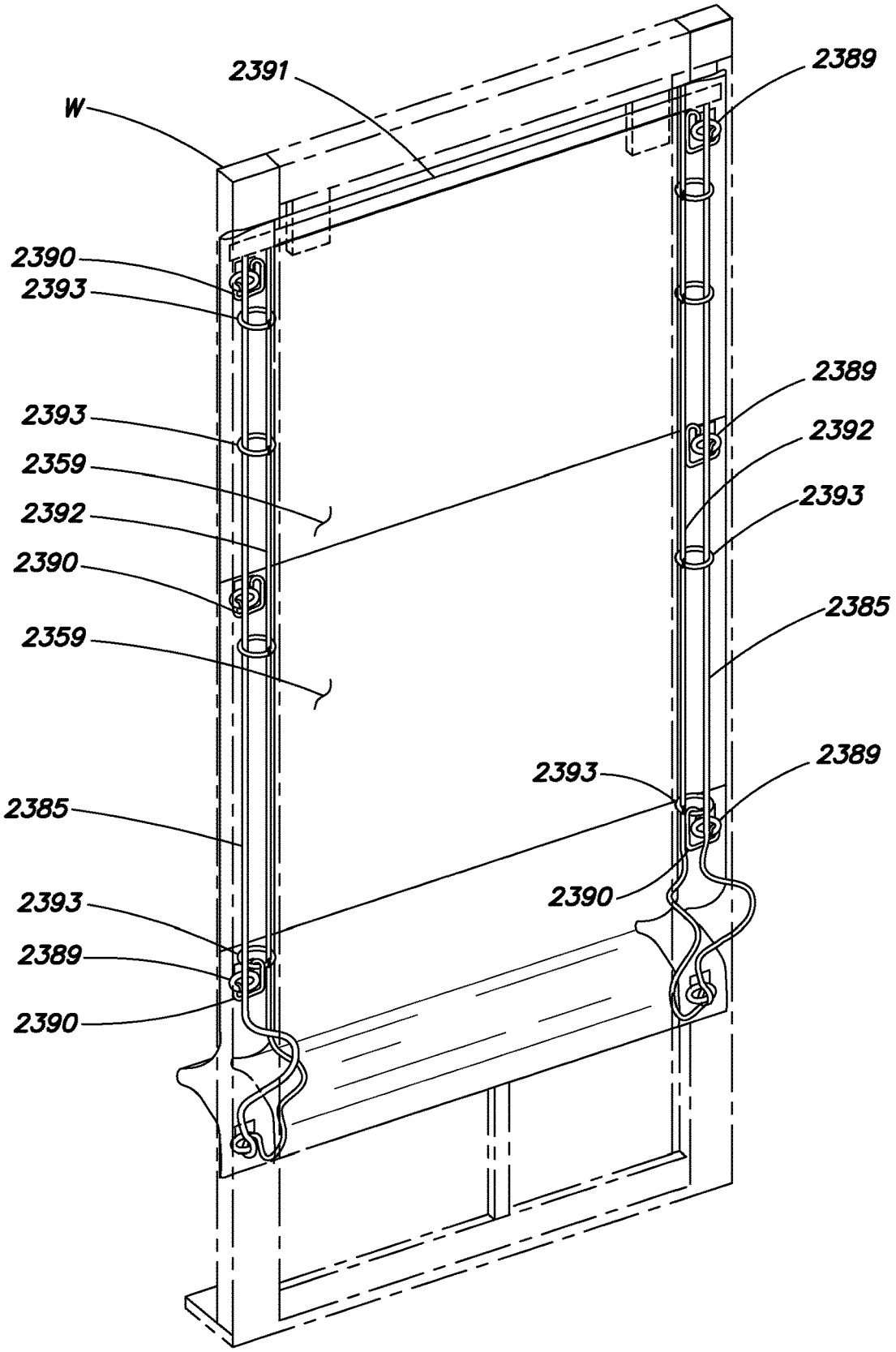

FIGS. 35A and 35B are detailed depiction of an embodiment of a roman shade. The roman shade 2900 in FIG. 35A is similar to the shade in FIG. 33, however the roman shade 2900 in FIG. 35A includes looped string 2392 that includes one or more loops 2393. The looped string 2392 may be attached to the housing 2391 or be secured within the housing 2391. The other end of the looped string 2392 may be, for example, attached to the bottom most eye hook 2389. In addition, the loop string 2392 may include any number of loops 2393 and the draw string 2385 may be fed through each loop 2393 of the looped string 2392. Further, one or more clips 2390 may be secured to each eye hook 2389. Specifically, the clips 2390 may be utilized to secure the looped string 2392 to the eye hook 2389 as shown in FIG. 35B, to, for example, change the length of the roman shade 2900. Specifically, the clip 2390 may be utilized to secure a particular eye hook 2389 to a particular loop 2393 (that does not have drawstring 2385 fed through it) such that the length of the roman shade 2900 is altered to include a crease, for example. It is noted that although the clips 2390 are shown as a separate structure, it is expressly contemplated that clip 2390 may be part of the eye hook 2389 such that the eye 2389 and the clip 2390 are one single structure.

Figure 36A:
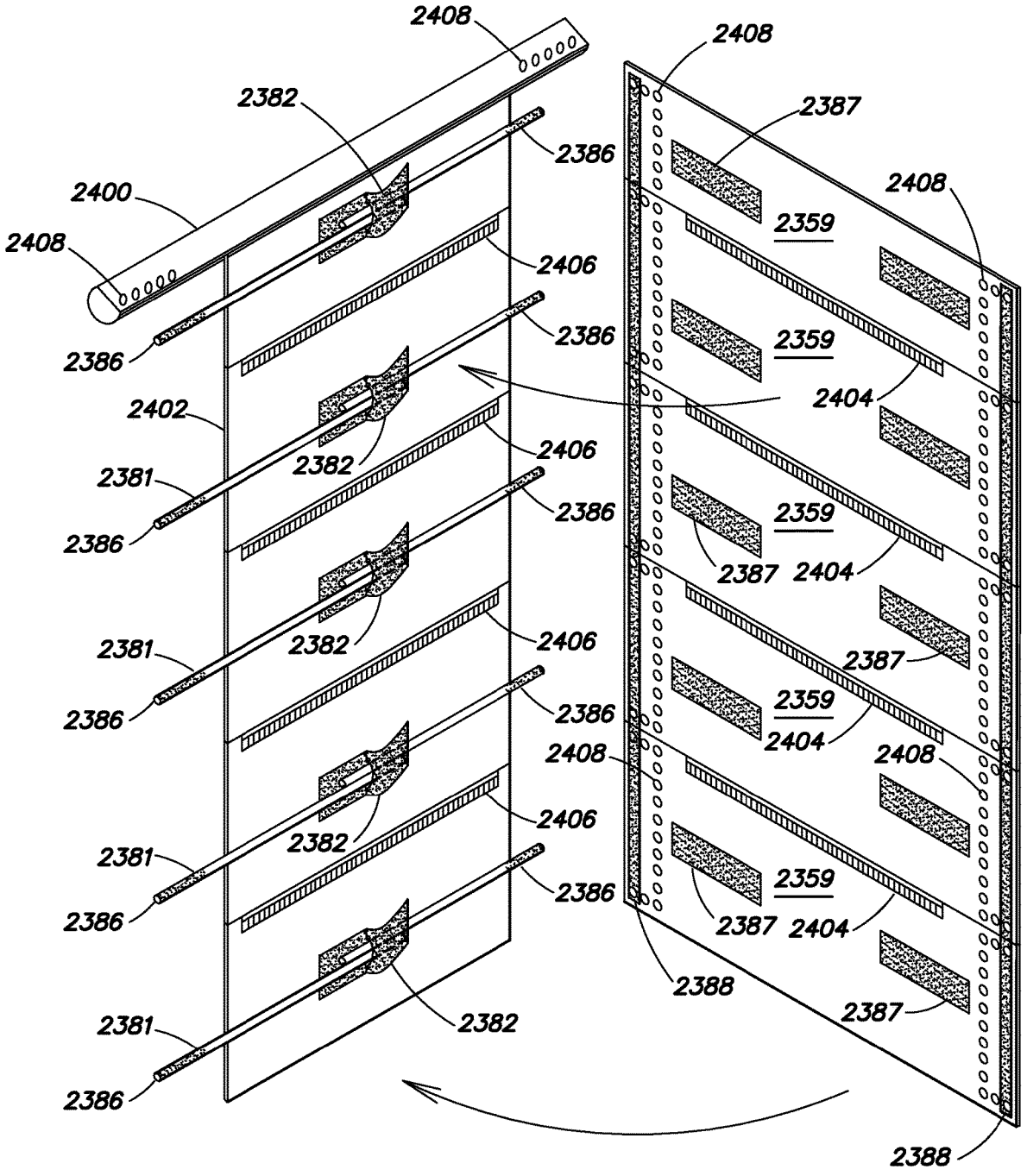
FIGS. 36A-36C are detailed depictions of an adjustable roman shade in accordance with an illustrative embodiment of the present invention.

FIG. 36A is a detailed depiction of an alternative embodiment of a roman shade. The plurality of slat components 2359 may be coupled to each, as described above with respect to FIGS. 31C and 31D, or utilizing a variety different of securing mechanisms, such as, but not limited to buttons, magnets, hook and loop fasteners (e.g., Velcro®), etc. In addition, it is expressly contemplated that a combination of different types of securing mechanisms may be utilized together to secure the slat components 2359 to each other. Further, the roman shade may include a roller 2400 that may be smaller or larger in width than the slat components 2359. The roller illustratively contains a sheath 2402 that exits the roller and retracts into the roller 2400. Specifically, a user, may, for example, pull the sheath 2402 that exits the roller 2400 to make the sheath 2402 longer in length. By pulling on the sheath 2402 a second time, the sheath 2402 may roll back into the roller 2400 to shorten the length of the sheath 2402, as is known by those skilled in the art and in a similar fashion to that of a retractable tape measure configuration. In an alternative embodiment, a pull string, motor, or counterbalance (not shown) may be utilized to manipulate the sheath 2402, such that the sheath 2402 extends from and retracts into the roller 2400.

The slat components 2359 individually or as attached as a single slat unit may be coupled to the sheath 2402 utilizing a variety of different securing mechanism, such as, but not limited to strings, buttons, magnets, hook and loop fasteners, such as Velcro®, clips, etc. For example, a first portion 2404 of a zipper mechanism may be sewn and/or attached to the slat component 2359. In addition, a second portion 2406 of the zipper mechanism may be sewn or attached to the sheath 2402. Thus and when a user wants to attach the slat components 2359 to the sheath 2402, the two different portions (2404 and 2406) of the one or more zipper mechanisms may be zipped together, as known by those skilled in the art.

Although reference is made to utilization of a zipper mechanism, it is expressly contemplated that any of a variety of securing mechanisms may be utilized such as, but not limited to strings, buttons, magnets, hook and loop fasteners, such as Velcro®, clips, etc. Advantageously, if the slat components need to be cleaned or washed, a user can simply disengaging the slat components 2359 from the sheath 2402 and simply put the slat components 2359 in a laundry machine, or may wash the slat components 2359 in any manner.

In addition, it is expressly contemplated that the securing mechanism may be positioned anywhere on the sheath 2402 and the depiction in FIG. 36A is for illustrative purposes only. Further, and although FIG. 36A depicts a single slat components 2359 on top of each other, it is expressly contemplated that a first slat component 2359 and second slat component 2359 may both attach to the sheath 2402 at the same height such that the first slat component and the second slat component are adjacent to each other, and such that there is excess material from both slat components that extend a width that exceeds the sheath 2402. Further, the slat components may include holes 2408, for example, on the edges of the slat components such that the slat component 2359 may be coupled to an adjacent slat component 2359, as described in further detail with respect to FIG. 36B. In addition, the holes 2408 may be utilized to secure excess material as will be described in further detail below. In addition, and for the top most slat component 2359, holes 2408 in the roller 2400 may be utilized with holes 2408 in the slat component 2359 to couple the top most slat component 2359 to the roller 2400. Specifically, a string may be fed through the holes to secure the top most slat component 2359 to the roller 2400. Alternatively, the top most slat component 2359 may be attached to the sheath 2402 such that when the sheath 2402 rolls into and exits the roller 2400, the slat components 2359 also roll into and exit the roller 2400.

The roman shade may further include one or more dowels 2381 that are secured to the sheath 2402 at any position on the sheath 2402, where the one or more dowels 2381 may overlap to alter the overall width of the roman shade. The dowels 2381 may be attached to the sheath 2402 utilizing, for example, a hook and loop fastener. For example, a Velcro® patch 2382 may be sewn to the sheath 2402, wherein a front flap of the patch 2402 includes a hole such that the two dowels 2381 may be sent through the holes and the dowels 2381 may be secured to the sheath 2402. In addition, the slat components 2359 may be secured to the sheath 2402 when the back of the slat components 2359 make contact with the patch 2382 that is the exemplary hook and loop fastener. Although reference is made to the use of hook and loop fasteners (e.g., Velcro®), it is expressly contemplated that a variety of other securing mechanisms such as, but not limited to strings, buttons, magnets, hook and loop fasteners, clips, etc. may be utilized. In addition, the amount that the one or more dowels 2381 overlap may be based on the desired width of the shade. For example, the total width of the overlapping dowels 2381 may be based on the overall width of a window opening. That is, when the window open is smaller in width, the dowels will overlap more than when the window opening is larger in width.

In addition, the slat components 2359 may be attached to the dowels 2381 utilizing, for example, a Velcro®. Specifically, a first portion 2386 of the hook and loop fastener may be coupled to the dowel 2381 and a second portion 2387 of the Velcro® may be sewn to the back of the slat component 2359 such that the dowel 2381 can be coupled to the slat component 2359. For example, for the portion of the slat component 2359 that extends beyond the width of the sheath 2402 but not the dowels 2381, the portion of the slat component 2359 may be secured to the dowel 2381, utilizing the two portions (2386 and 2387) of the hook and loop fastener. Although the second portion 2387 of the hook and loop fastener is depicted as being a single rectangle, it is expressly contemplated that the second portion 2387 of the hook and loop fastener may be a variety of different configurations, such as, but not limited, a plurality of stripes, etc. In addition, although reference is made to the utilization of the hook and loop fastener (e.g., Velcro®), it is expressly contemplated that a variety of mechanisms may be utilized to couple the slat component 2359 and the dowel 2381. Such mechanisms may be, but are not limited to strings, buttons, magnets, hook and loop fasteners clips, etc.

Further, additional excess material of the slat components 2359 that extends even further than the width of the dowel 2381 may be folded over and attached to the back of the dowel 2381 and/or sheath 2402 such that the width of the roman shade may be altered, as described above with respect to FIGS. 30-35. Specifically, the excess material may simply be folded over and a securing mechanism, such as a hook and loop fastener, for example, may be utilized to secure the excess material to the back of the dowel 2381 and/or back of the sheath 2402. Specifically, a first portion 2388 of the hook and loop fastener may attach to the second portion 2387 (that also attaches to the first portion 2386) of the hook and loop fastener to secure the excess material to the back of the slat component 2359. Although reference is made to the utilization of the hook and loop fastener, it is expressly contemplated that a variety of mechanisms may be utilized to couple the slat component 2359 and the dowel 2381. Such mechanisms may be, but is are not limited to strings, buttons, magnets, hook and loop fasteners clips, etc. For example, the holes 2408 may be utilized to secure the excess material to the back of the shade as described with respect to FIG. 31D.

In addition, it is expressly contemplated that the excess material may be folded over to form various shapes. For example, a user may fold over the excess material such that the excess material fits a round window opening. Advantageously, and by utilizing the roller 2400 with sheath 2402 and the attached slat components 2359, a user can simply change the overall length and width of the roman shade. Although FIG. 36A depicts a single layer of slat components 2359 being coupled to the sheath 2402, it is expressly contemplated that a plurality of layers of slat 2359 may be coupled to the sheath 2402. Further, although FIG. 36A illustrates the slat components 2359 being coupled to a single side of the sheath 2402, it is expressly contemplated that the slat components 2359 may be coupled to both sides of the sheath 2402.

Figure 36B:
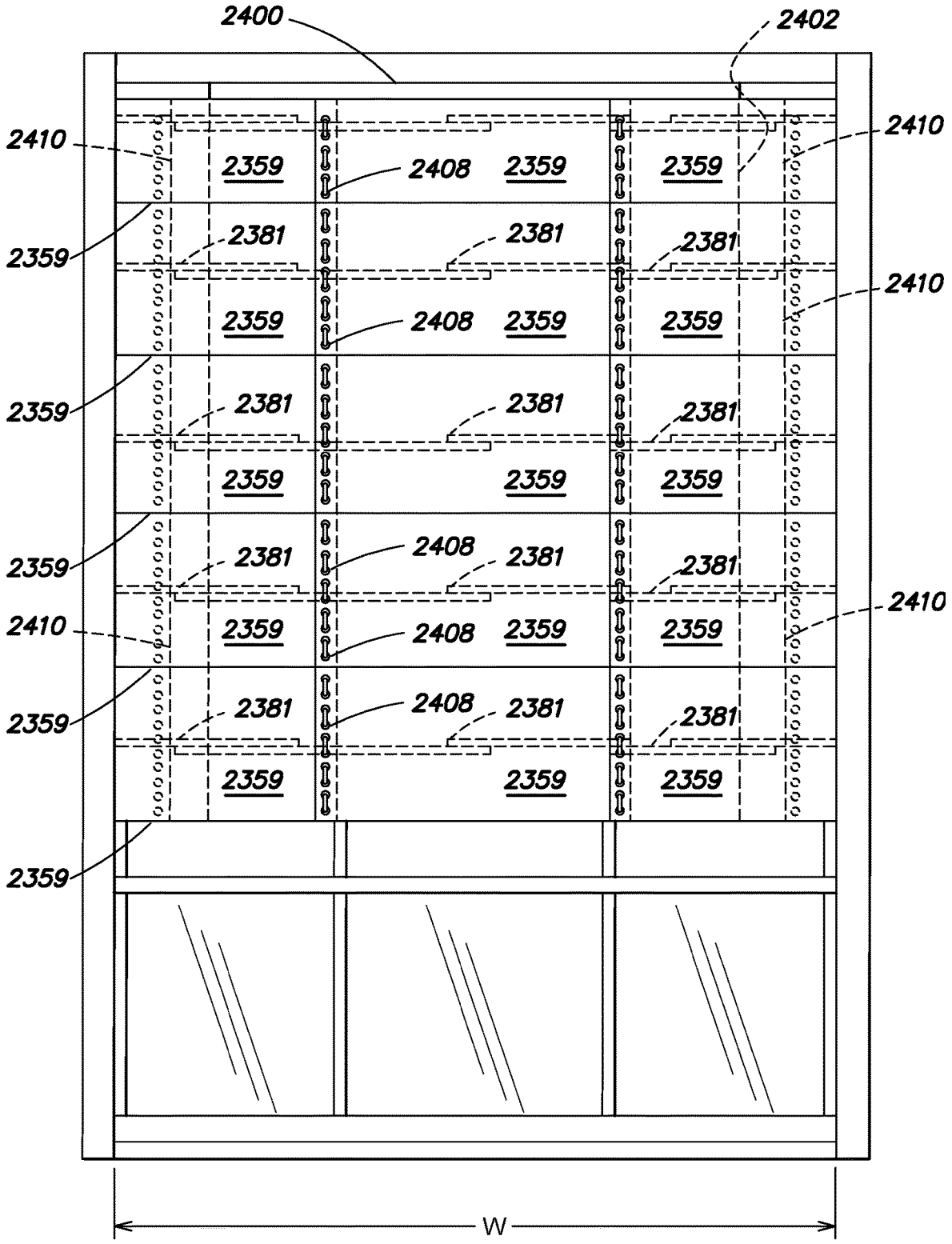
Figure 36C:
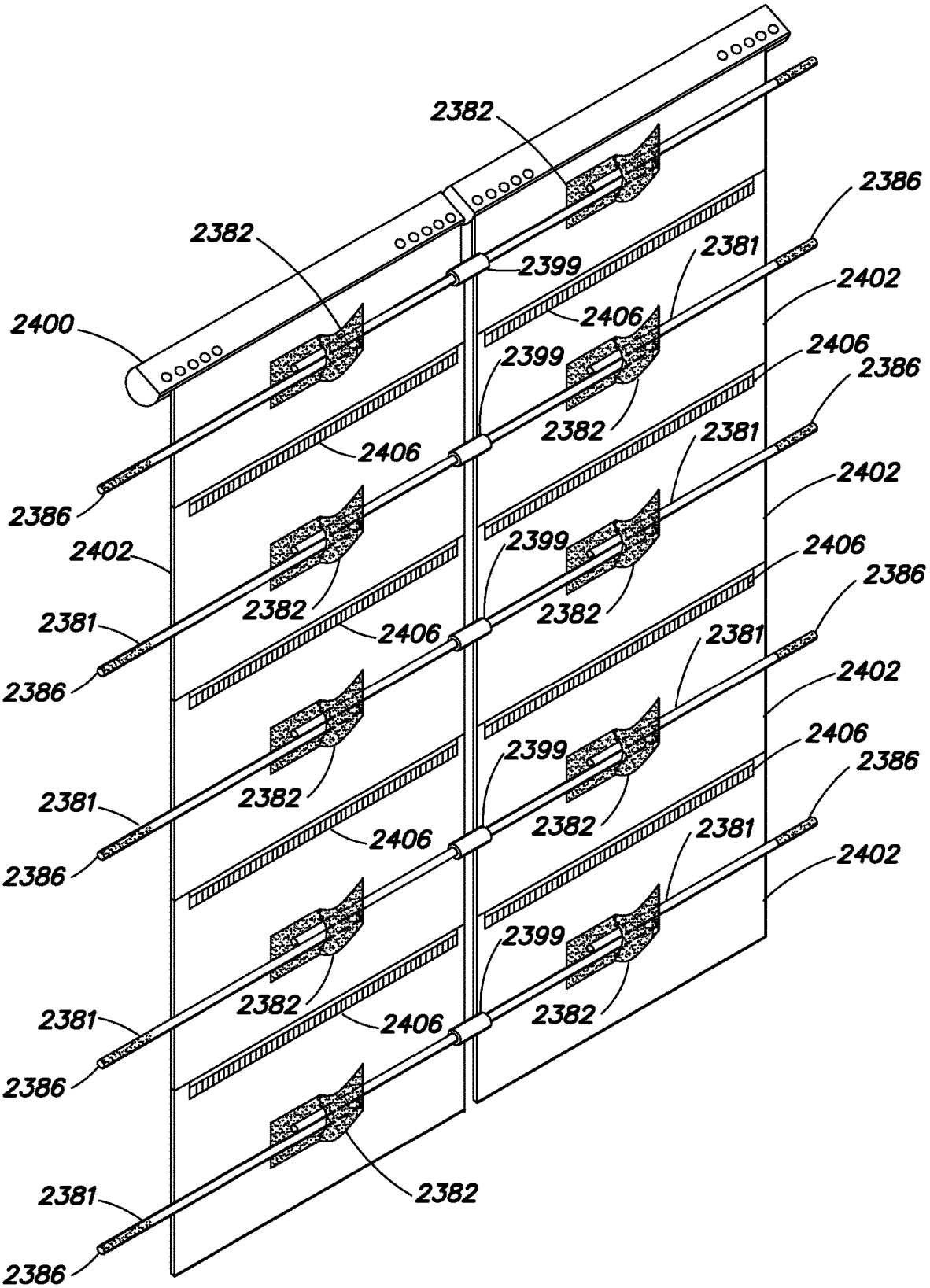

Further, and although FIG. 36A depicts a single sheath 2402 and a plurality of slat components 2359 being secured to the sheath 2402, it is expressly contemplated that the sheath 2402 may be secured to an adjacent sheath 2402 to extend the width of the sheath 2402, to, for example, fit a window that is larger in width as depicted in FIG. 36C. For example, the dowels 2381 associated with each of the adjacent sheaths 2402 and/or the adjacent sheaths 2402 may be secured together. Specifically, the dowels 2381 may be secured together utilizing a junction connector 2399. Alternatively, a variety of mechanisms, such as, but not limited to strings, buttons, magnets, hook and loop fasteners, such as Velcro®, clips, etc., may be utilized to connect adjacent dowels 2381. In addition, adjacent slats, associated with the adjacent and different sheaths 2402, may be coupled together as described with respect to FIGS. 31D and 36B utilizing a variety of mechanisms, such as, but not limited to strings, buttons, magnets, hook and loop fasteners, such as Velcro®, clips, etc.

FIG. 36B is a detailed depiction of the roman shade in FIG. 36A wherein a slat component is attached to adjacent slat components. Specifically, and as depicted in FIG. 36B, a plurality of adjacent slat components 2359 are coupled to each other through use of holes 2408. More specifically, a string may be fed through holes 2408 of adjacent slat components to attach the slat components to each other, wherein the adjacent slat components may also be coupled to sheath 2402, as described with reference to FIG. 36A. It is expressly contemplated that the adjacent slat components may be coupled to each other utilizing a variety of different mechanisms such as, but not limited to, buttons, magnets, hook and loop fasteners, such as Velcro®, clips, etc. Further, for the material of the slat component 2359 that extends past the width of the sheath 2402 but does not extend past the width of the dowels, the portion of the slat component 2359 may be secured to the dowel 2381, as described above with reference to FIG. 36A.

In addition, the slat components 2359 on the ends may have excess material 2410 that may be folded and attached to the back of the slat component 2359 to fit window width W, as described above with reference to FIG. 36A. In addition, it is expressly contemplated that the excess material 2410 may be folded over in any shape to, for example, accommodate a window of a different shape such as a circle.

Figure 37A:
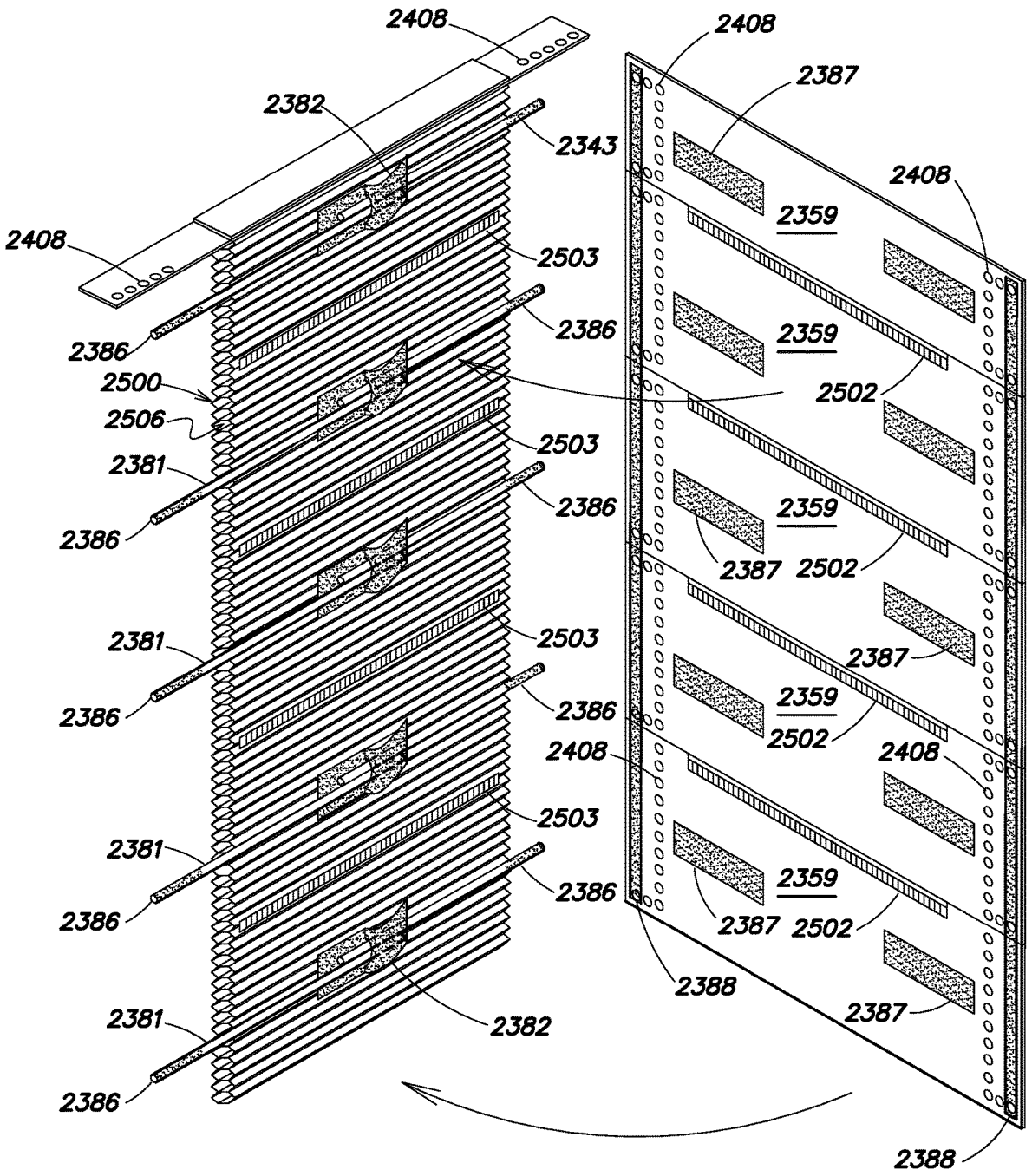
FIGS. 37A-37C are detailed depictions of an adjustable roman shade in accordance with an illustrative embodiment of the present invention.

FIG. 37A is a detailed depiction of an alternative embodiment of a roman shade. The plurality of slat components 2359 may be coupled to each, as described above with respect to FIGS. 31C and 31D, or utilizing a variety different of securing mechanisms, such as, but not limited to buttons, magnets, hook and loop fasteners (e.g., Velcro®), etc. In addition, it is expressly contemplated that a combination of different types of securing mechanisms may be utilized together to secure the slat components 2359 to each other. Further, the roman shade includes a cellular extension 2500 that includes a plurality of cells 2506 (e.g., honeycombs). Specifically, a user, may, for example, pull and push the cellular extension 2500 to alter the overall length of the cellular extension, as known by those skilled in the art. Specifically, and by pulling on the cellular extension 2500 again, the cellular extension 2500 may be increased in length, as known by those skilled in the art. Conversely, and by pushing the cellular extension 2500, the cellular extension 2500 may be reduced in length, as known by those skilled in the art. In an alternative embodiment, a pull string, motor, or counterbalance (not shown) may be utilized to manipulate the cellular extension 2500 such that the cellular extension 2500 changes in length. In addition, other various mechanisms may be utilized to change the overall length of the cellular extension.

The slat components 2359 individually or as attached as a single slat unit may be coupled to cellular extension 2500 utilizing a variety of different securing mechanism, such as, but not limited to strings, buttons, magnets, hook and loop fasteners, such as Velcro®, clips, etc. For example, a first portion 2502 of a zipper mechanism may be sewn or attached to the slat component 2359. In addition, a second portion 2503 of the zipper mechanism may be sewn or attached to the cellular extension 2500. Thus and when a user wants to attach the slat components 2359 to the cellular extension 2500, the two different portions (2502 and 2503) of the zipper mechanisms may be zipped together, as known by those skilled in the art. Although reference is made to utilization of a zipper mechanism, it is expressly contemplated that any of a variety of securing mechanisms may be utilized such as, but not limited to strings, buttons, magnets, hook and loop fasteners, such as Velcro®, clips, etc. Advantageously, if the slat components need to be cleaned or washed, a user can simply disengage the slat components 2359 from the cellular extension 2500 and simply put the slat components 2359 in a laundry machine, or may wash the slat components 2359 in any manner.

In addition, it is expressly contemplated that the securing mechanism may be positioned anywhere on the cellular extension and the depiction in FIG. 37A is for illustrative purposes only. Further, and although FIG. 37A depicts a single slat components 2359 on top of each other, it is expressly contemplated that a first slat component 2359 and second slat component 2359 may both attach to the cellular extension 2500 at the same height such that the first slat component and the second slat component may be adjacent to each other, and such that there is excess material from both slat components that extend a width that exceeds the cellular extension 2500.

Further, one or more dowels 2381 may be secured to the cellular extension 2500 at any position on the cellular extension 2500. For example, the one or more dowels 2381 may be inserted in a particular cell 2506 and secured to the cellular extension 2500 utilizing, for example, a clip, string, etc. Specifically, the depth the dowels 2381 are inserted into a particular cell 2506 may be based on the desired width of the roman shade and/or a window opening size. Alternatively, the one or more dowels 2381 may be attached to the exterior of the cellular extension 2500, as shown in FIG. 37A, in a similar manner as described with respect to FIG. 36A, and specifically utilizing a hook and loop fastener patch 2382 to secure the dowels 2381 to the cellular extension 2500. Alternatively, any of a variety of securing mechanism may be utilized, such as, but not limited to, such as, but not limited to, magnets, buttons, etc.

In addition, the portion of the slat components 2359 that extends past the width of the cellular extension 2500 but that does not extend past the dowel 2381 may be attached to the dowels 2381, as described above with respect to FIG. 36A. Specifically, a first portion 2386 of a hook and loop fastener may be attached to the dowel 2381 and a second portion 2387 of a hook and loop fastener may be attached to the slat component 2359 to couple the dowel 2381 to the slat component 2359. Alternatively, any of a variety of securing mechanism may be utilized, such as, but not limited to, magnets, buttons, etc.

In addition, excess material that extends past the dowels 2381 may be folded over such that the width of the roman shade may be altered. Specifically, a first portion 2388 of the hook and loop fastener may attach to the second portion 2387 of the hook and loop fastener (that is also attached to the first portion 2386), as described with reference to FIG. 36A. Specifically, the excess material may simply be folded such that the overall width of the roman shade fits window opening. Alternatively, any of a variety of securing mechanism may be utilized, such as, but not limited to, such as, but not limited to, magnets, buttons, etc. For example, the holes 2408 may be utilized to secure the excess material to the back of the shade as described with respect to FIG. 31D. In addition, and for the top most slat component 2359, holes 2408 in the cellular extension may be utilized with holes 2408 in the slat component 2359 to couple the top most slat component 2359 to the cellular extension 2500. Specifically, a string may be fed through the holes 2408 to secure the top most slat component 2359 to the cellular extension. Advantageously, and by utilizing the cellular extension 2500, a user can simply change the overall length and width of the roman shade.

Further, and if the slat components need to be cleaned or washed, a user can simply disengage the slat components from each other and the one or more dowels 2381 and simply put the slat components 2359 in a laundry machine, or may wash the slat components 2359 in any manner. Although FIG. 37A depicts a single layer of slat components 2359 being coupled to the cellular extension 2500, it is expressly contemplated that a plurality of layers of slat 2359 may be coupled to the cellular extension 2500. Further, although FIG. 37A illustrates the slat components 2359 being coupled to a single side of the cellular extension 2500, it is expressly contemplated that the slat components 2359 may be coupled to both sides of the cellular extension 2500.

Further, and although FIG. 37A depicts a single cellular extension 2500 and a plurality of slat components 2359 being secured to the cellular extension 2500, it is expressly contemplated that the cellular extension 2500 may be secured to an adjacent cellular extension 2500 to extend the width of the cellular extension 2500, to, for example, fit a window that is larger in width as depicted in FIG. 36C. For example, the dowels 2381 associated with each of the adjacent cellular extensions 2500 and/or the adjacent cellular extensions 2500 may be secured together. Specifically, the dowels 2381 may be secured together utilizing a junction connector 2399. Alternatively, a variety of mechanisms, such as, but not limited to strings, buttons, magnets, hook and loop fasteners, such as Velcro®, clips, etc., may be utilized to connect adjacent dowels 2381. In addition, adjacent slats, associated with the adjacent and different cellular extensions 2500, may be coupled together as described with respect to FIGS. 31D and 37B utilizing a variety of mechanisms, such as, but not limited to strings, buttons, magnets, hook and loop fasteners, such as Velcro®, clips, etc.

Figure 37B:
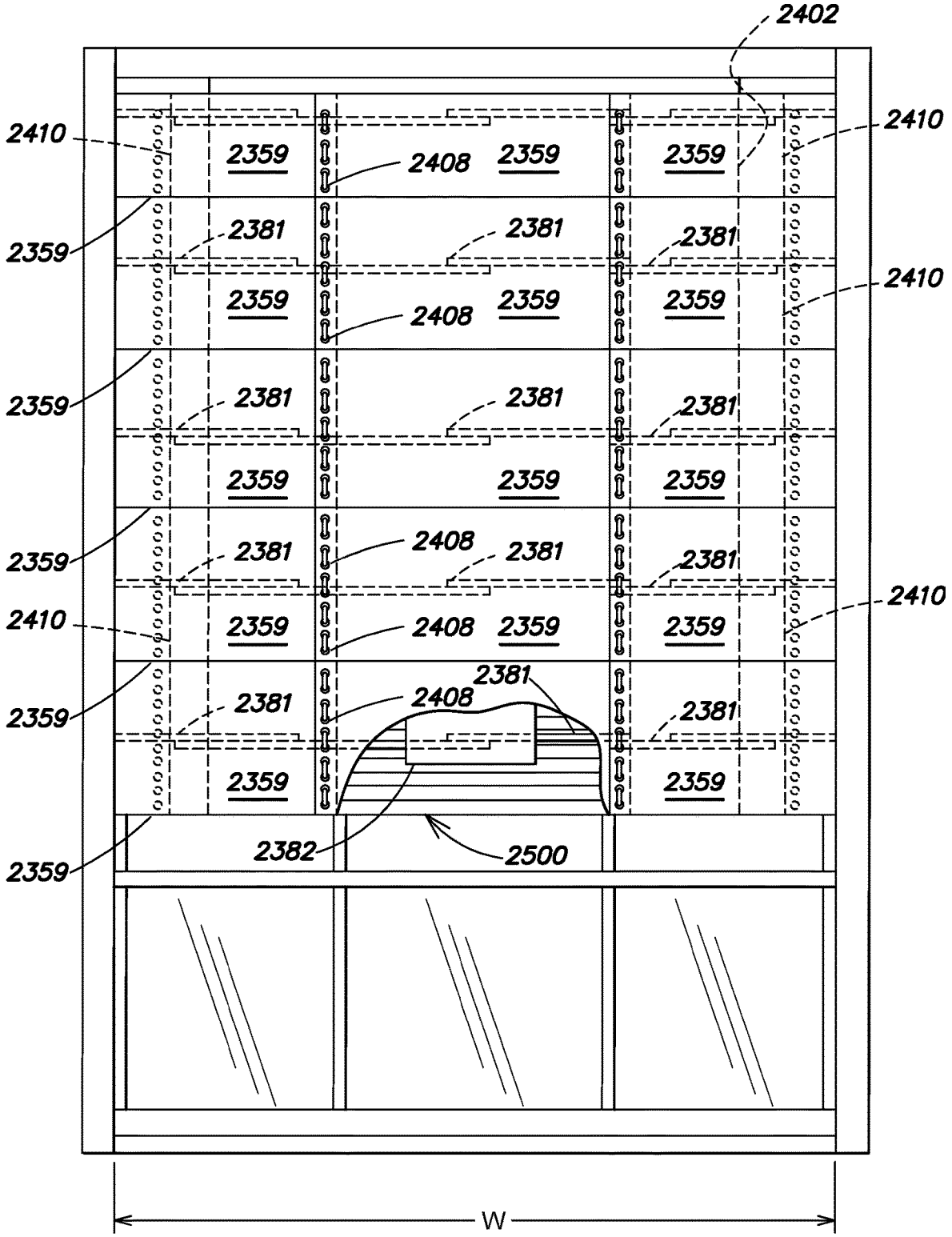
Figure 37C:
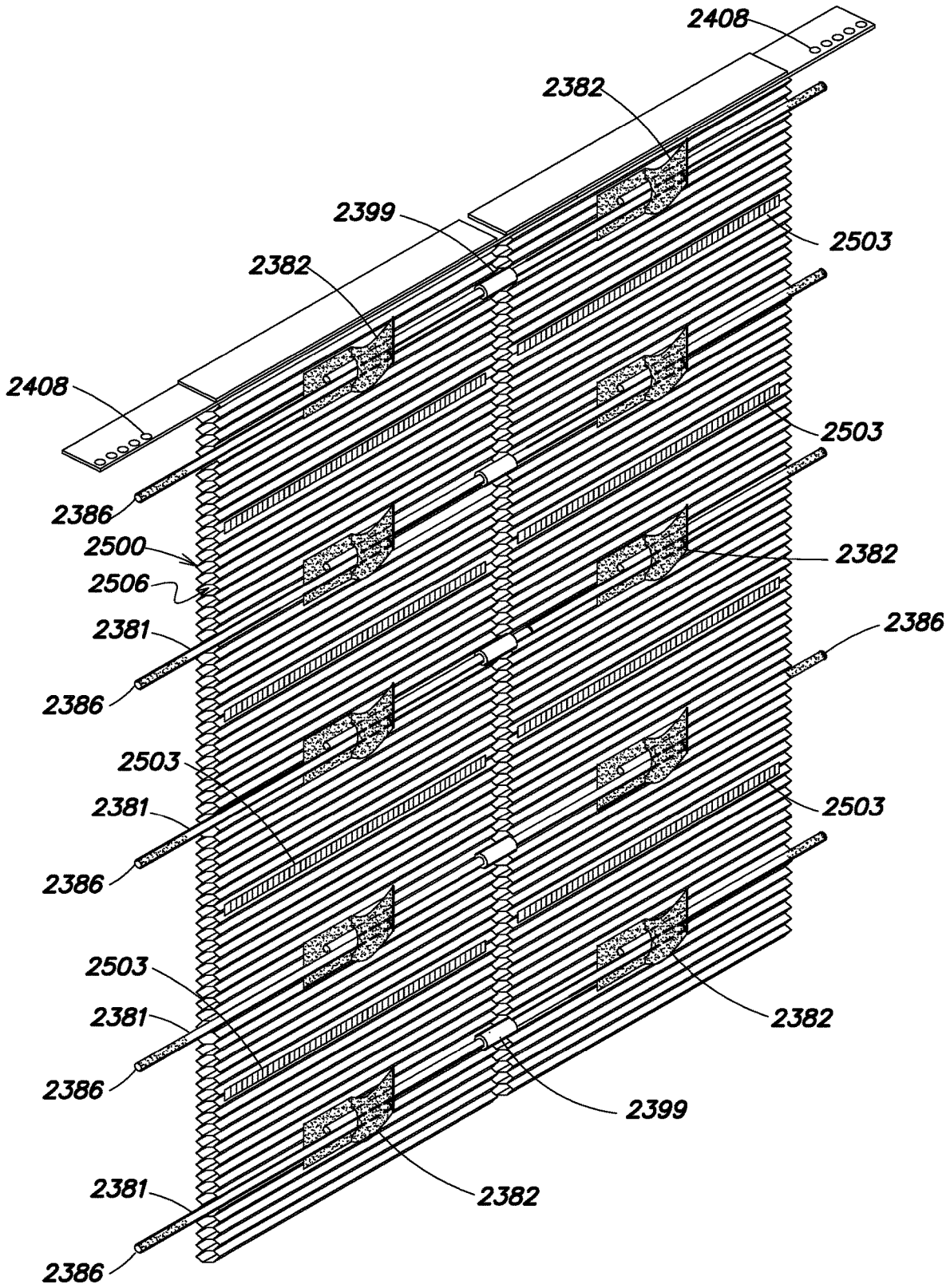

FIG. 37B is a detailed depiction of the roman shade in FIG. 37A wherein a slat component is attached to adjacent slat components. Specifically, and as depicted in FIG. 37B, a plurality of adjacent slat components 2359 are coupled to each other through use of holes 2408. More specifically, a string may be fed through holes 2408 of adjacent slat components to attach the slat components to each other, wherein the adjacent slat components may also be coupled to cellular extension 2500. It is expressly contemplated that the adjacent slat components may be coupled to each other utilizing a variety of different mechanisms such as, but not limited to, buttons, magnets, hook and loop fasteners, such as Velcro®, clips, etc. In addition, and as illustrated in FIG. 37B, the slat component on the end may have excess material 2410 that may be folded and attached to the back of the roman shade, as described above with reference to FIG. 37A. In addition, it is expressly contemplated that the excess material 2410 may be folded over in any shape to, for example, accommodate a window of a different shape, such as a circle.

Figure 38A:
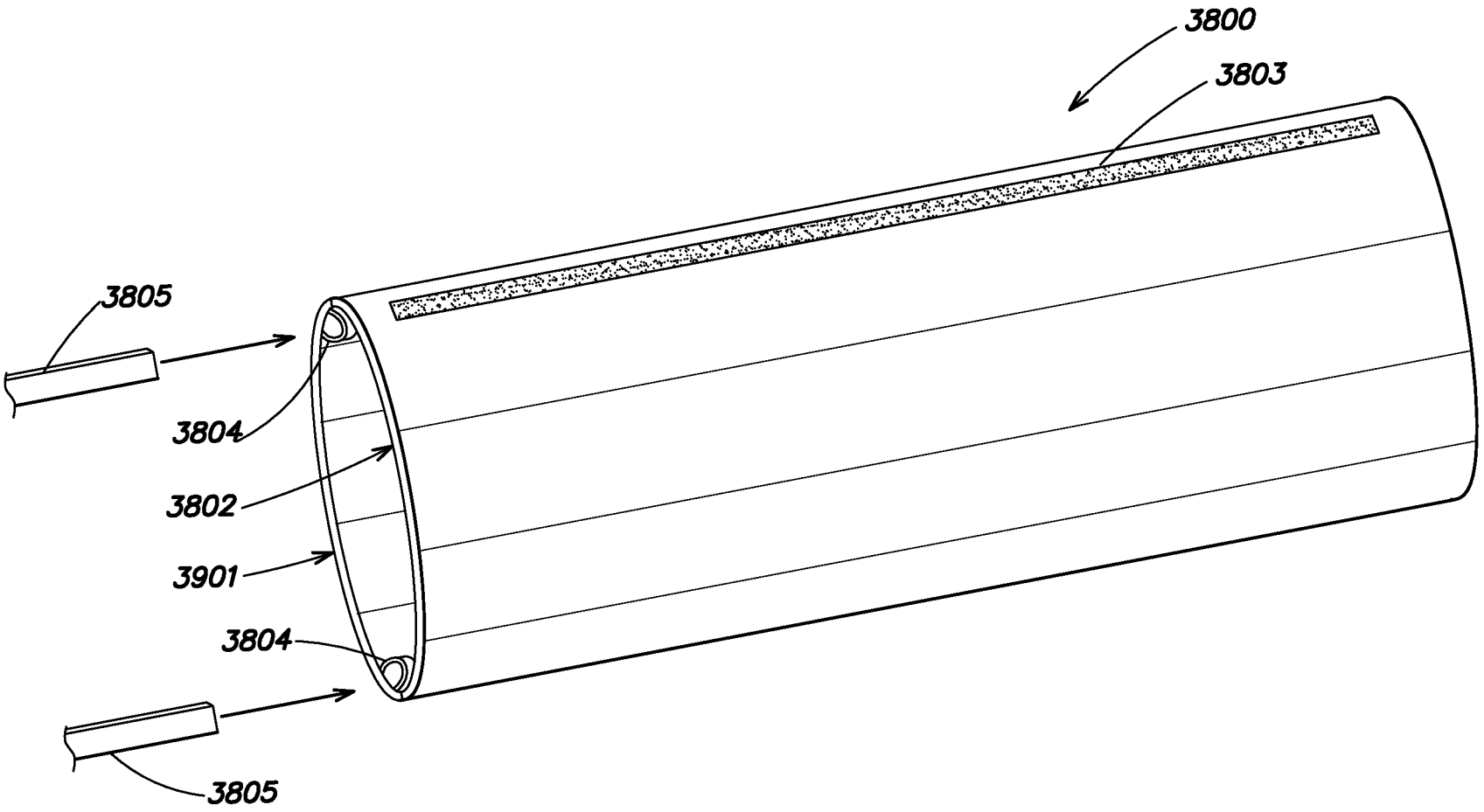
FIGS. 38A-38C are detailed depictions of a slat for one or more embodiments described herein.

FIG. 38A is a perspective view of a slat component for one or more embodiments described herein. The slat component 3800 may include a first layer 3801 and a second layer 3802. The first layer 3801 and the second layer 3802 may be coupled to each other at a top edge and a bottom edge where the first layer 3801 and the second layer 3802 meet as depicted in FIG. 38A. The first layer 3801 and the second layer 3802 may be coupled to each other in a variety of different ways, such as, but not limited to utilizing strings, buttons, magnets, hook and loop fasteners, such as Velcro®, clips, etc.

Each of the first layer 3801 and the second layer 3802 may include a first portion of a securing mechanism 3803 located on the exterior of each of the first layer 3801 and the second layer 3802. The first portion of the securing mechanism 3801 may be of any size. For example, the first portion of the securing mechanism 3801 may run the entire length of the slat component 3800 or a smaller length of the slat component 3800. The first portion of the securing mechanism may be the same or different for the first layer 3801 and the second layer 3802.

As depicted in FIG. 38A, the first portion of the securing mechanism 3803 is located at the top of the layer of the slat component 3800, however it is expressly contemplated that the first portion of the securing mechanisms 3803 may be located at any location on the exterior of the layers 3801 and 3802. In addition, although FIG. 38A depicts a single first portion of the securing mechanism 3803 on the exterior of the slat component, it is expressly contemplated that the slat component may include a plurality of the first portions of the securing mechanism 3803. The first portion of the securing mechanisms 3803 may be utilized to secure the slat component 3800 to the exterior of a sheath, that includes the other or second portion of the securing mechanism, as described in further detail below with respect to FIG. 38C.

In addition, each layer may include one or more interior clasps 3804 that are utilized to hold or secure one or more strips 3805 to the interior of the layer, as will be described in further detail below. In an embodiment, the one or more strips 3805 may be curved or any shape. In addition, the one or more strips 3805 do not have to be uniform and may be wider at some locations and narrower at other locations along the length of the one or more strips 3805.

Figure 38B:
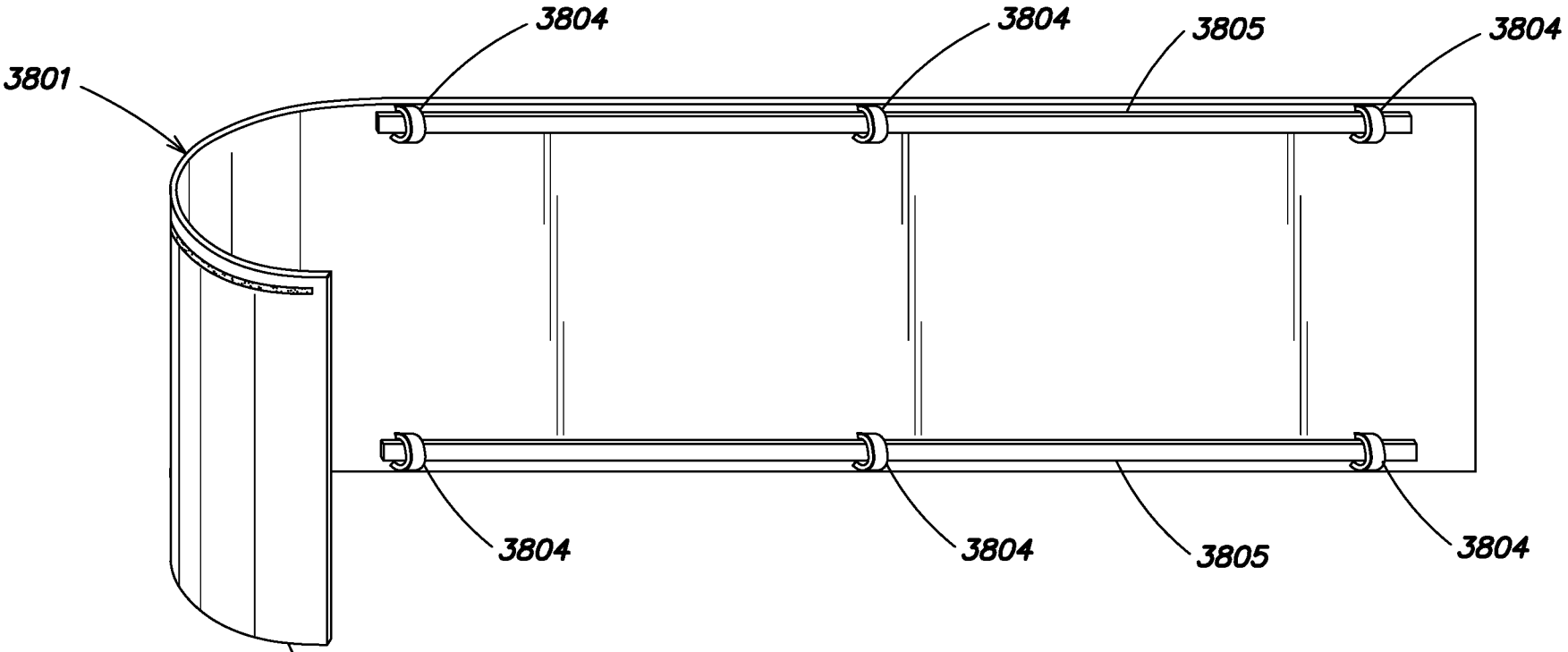

FIG. 38B is an interior view of first layer 3801, however it is expressly contemplated that the description of the interior view of the first layer 3801 can be applied to the second layer 3802 or any other layer. As depicted in FIG. 38B, there are a plurality of interior clasps 3804 that secure the strips 3805 to the interior of the layer 3801.

Specifically, the strips 3805 may sit on the interior clasps 3804 such that the strips 3805 remain within the interior of the slat component 3800. It is noted that FIG. 38B depicts a single strip 3805 being inserted within the three interior clasps 3804 on the top and bottom of the first layer 3801, however it is expressly contemplated that two or more strips 3805 may overlap and be coupled together, in a similar manner as described above with respect to the dowels 2381 in FIG. 36A, and sit on any number of interior clasps 3804 such that the width of the overall first layer 3801 may be altered. Specifically, the two or more strips 3805 may be secured to each other in a variety of different ways, such as, but not limited to utilizing strings, buttons, magnets, hook and loop fasteners, such as Velcro®, clips, etc. For example, the width of the overall layers may be altered based on any different size windows, for example.

In addition, excess material 3806 of the first layer 3801 may be folded over and secured to the interior of the first layer 3801 in a variety of different ways, such as, but not limited to utilizing strings, buttons, magnets, hook and loop fasteners, such as Velcro®, clips, etc.

Figure 38C:
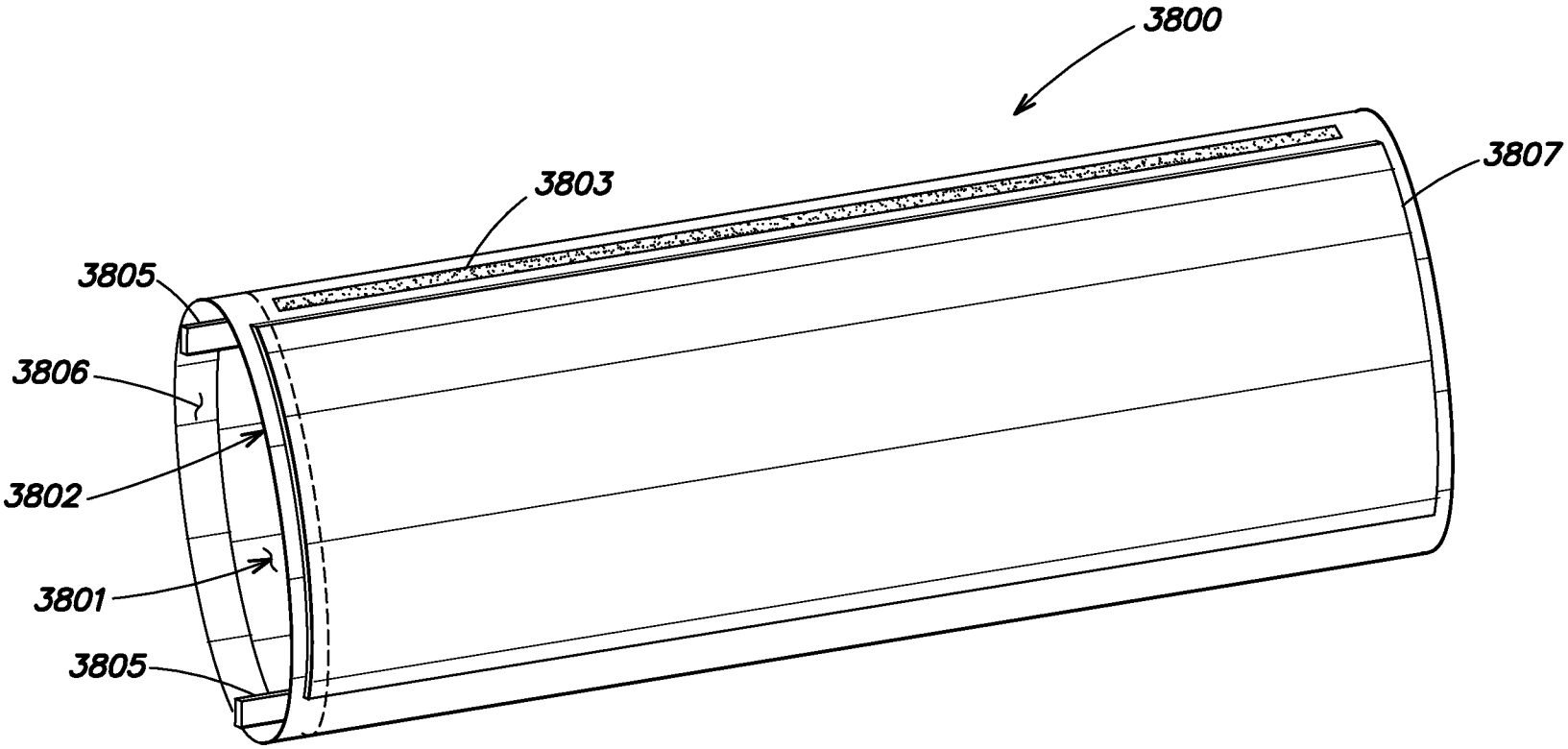

FIG. 38C is a perspective view of a slat component for one or more embodiments described herein, wherein excess material 3806 of the first layer 3801 and second layer 3802 are secured to the interior of the slat component 3800 and the strips 3805 are secured to the interior of the first layer 3801. As can be seen in FIGS. 38B and 38C, the excess material 3806, that extends past the length of the strips 3805, is folded over and inserted within the opening created by the coupling of the first layer 3801 and the second layer 3802. In an embodiment, the excess material 3806 may then be secured to the interior of the sheath 3800 using any of a variety of securing mechanisms such as, but not limited to strings, buttons, magnets, hook and loop fasteners, such as Velcro®, clips, etc. Advantageously, the overall width of the slat component, and thus the shade, can be altered.

The first layer 3801 and the second layer 3802 may include one or more additional layers 3807 that are coupled to the exterior of the first layer 3801 and/or second layer 3802. The additional layers 3807 may be of any material, such as, but not limited to, vinyl or any other materials to add rigidity or a different look to the slat component 3800. It is noted that the one or more additional layers 3807 can be any size and do not have to match the size of the first layer 3801 or second layer 3802. The additional layers 3807 may be attached to the first layer 3801 and/or second layer 3802 using any of a variety of securing mechanisms such as, but not limited to strings, buttons, magnets, hook and loop fasteners, such as Velcro®, clips, etc.

Figure 38D:
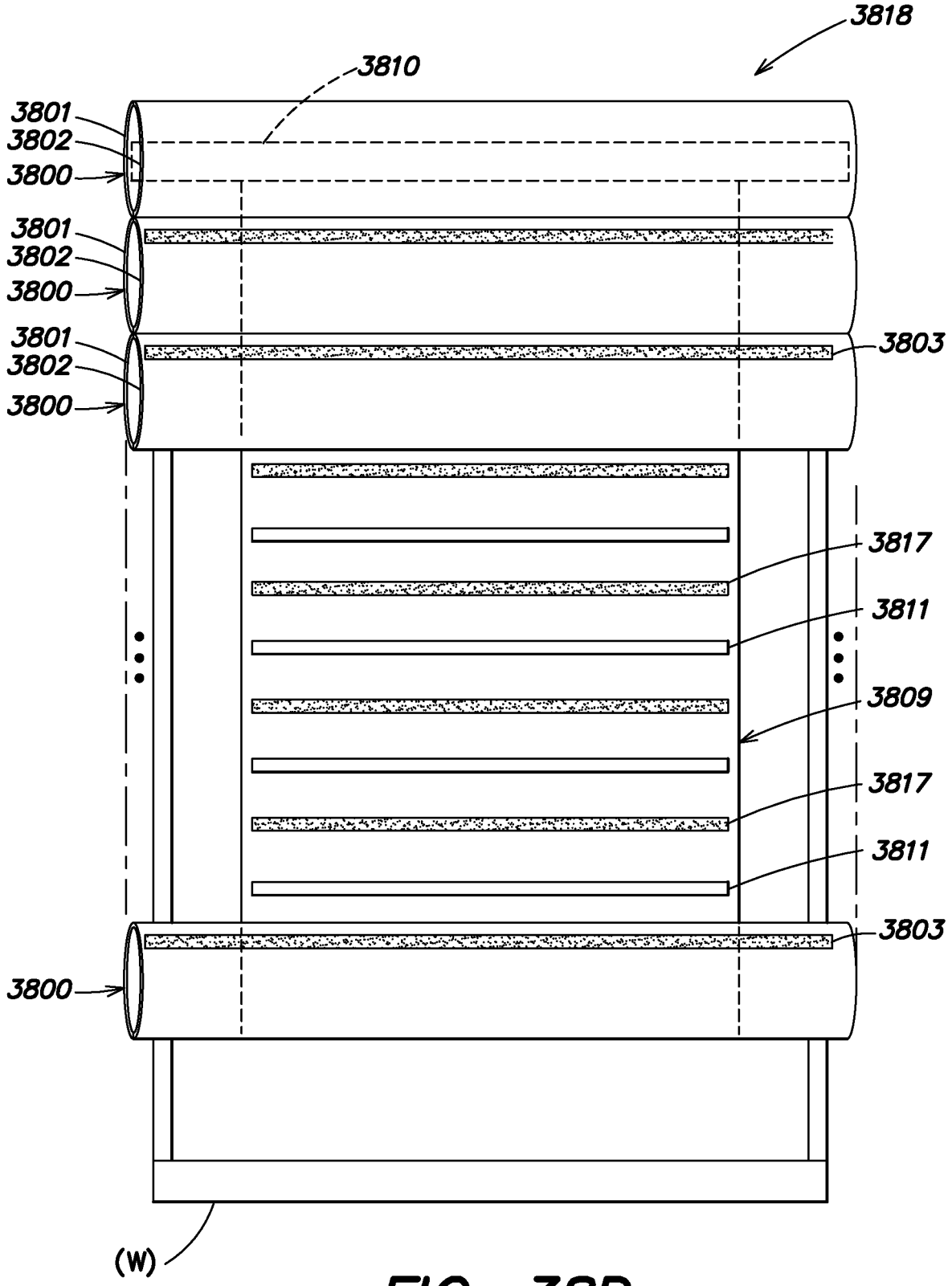

FIG. 38D is a detailed depiction of a shade 3818 including the slat component 3800 as depicted in FIGS. 38A-38C. The slat components 3800, each including at least a first layer 3801 and second layer 3802, are secured to sheath 3809. Specifically, the first portion of the securing mechanism 3803 on the exterior of the first layer 3801 engages with the second portion of the securing mechanism 3817 that is attached to exterior of the sheath 3809 such that the slat components 3800 are secured to the exterior of the sheath 3809. For example, the first portion of the securing mechanism 3803 may be a first portion of a zipper mechanism and the second portion of the securing mechanism 3817 may be a second portion of the zipper mechanism, such that the engagement (e.g., "zipping") of the first and second portions causes the slat component 3800 to be secured to or attached to the sheath 3809. Therefore, the sheath 3809 connects to at least one point on a slat component 3800.

In addition, a head rail unit 3810 may be located at the top of the shade 3818. The head rail unit 3810 may be coupled to the sheath and a slat component 3800 may be attached the exterior of the head rail unit 3810. For example, the slat component 3800 may be secured to the head rail unit 3810 using any of a variety of securing mechanisms such as, but not limited to strings, buttons, magnets, hook and loop fasteners, such as Velcro®, clips, etc. In addition, the head rail unit 3810 may be coupled to a roller spring system, counterbalance system, cord system, or motor that is utilized to raise and lower the shade as will be described in further detail below.

In addition, although FIG. 38D depicts a plurality of slat components 3800 being utilized, it is expressly contemplated that a single slat component 3800 may be utilized. For example, a single slat component 3800 may be secured at a top of the sheath 3809 at one or more different locations on the sheath 3809 (e.g., where each of the second portions of the securing mechanisms 3817 are located) or at the head rail unit 3810 such that the single slat component 3800 covers the entire sheath 3809 or a portion of the sheath 3809. The single slat component 3800 may be coupled to the sheath 3809 and/or head rail unit 3810 in the manner described above.

In addition, it is expressly contemplated that the slat components 3800 may be disengaged from the sheath 3809 (e.g., "unzipped") and/or head rail unit 3810, and the slat components 3800 may be reversed such that the second layer 3802 is attached to the sheath 3809 and/or head rail unit 3810 in a similar manner as described above. As such, the first layer 3801 and second layer 3802 may be different patterns or materials and thus provide a user with the ability to alter or change the appearance of the shade 3818 by simply reversing the slat component 3800.

Specifically, FIG. 38D depicts the second layer 3802 facing outward from the window opening (W) such that the second layer is in view of a user who is located indoors, for example. If the user wanted to have the first layer 3801 in view, the user would simply disengage the securing mechanism between the sheath 3809 and the first layer 3801, and then engage the securing mechanism between the sheath 3809 and the second layer 3082. As such, the second layer 3802 would be hidden and the first layer 3801 would be in view of the user who is located indoors, for example.

Although reference is made to utilizing a zipper mechanism, it is expressly contemplated that any of a variety of securing mechanisms may be utilized such as, but not limited to strings, buttons, magnets, hook and loop fasteners, such as Velcro®, clips, etc. Advantageously, if the layers 3801 and 3802 need to be washed or replaced, a user can simply disengage the slat component 3800 from the sheath 3809 and place the slat component 3808 in a laundry machine, or may wash the slat component 3800 in any manner.

In addition, the sheath 3809 may include one or more rods 3811 that travel horizontally across the sheath 3809 to provide rigidity to the sheath. The one or more rods 3811 may be secured to sheath 3809 in a variety of different ways, such as, but not limited to utilizing strings, buttons, magnets, hook and loop fasteners, such as Velcro®, clips, etc. Although FIG. 38D shows a single rod 3811 traveling across the sheath 3809, it is expressly contemplated that two or more rods 3811 may be coupled together, in a similar manner as described above with respect to the dowels 2381 of FIG. 36A, and secured to the sheath 3809.

Further, the sheath 3809 may be coupled to an additional sheath 3809 (not shown) which allows the user to increase the width and/or length. For example, and with reference to FIG. 38D, a zipper may be included at the bottom of the sheath 3809 such that the sheath 3809 may be coupled to an additional sheath to adjust the overall length. In addition or alternatively, a zipper may be included at the left and/or right side of the sheath 3809 such that the sheath 3809 may be coupled to an additional sheath to adjust the overall width.

Figure 38E:
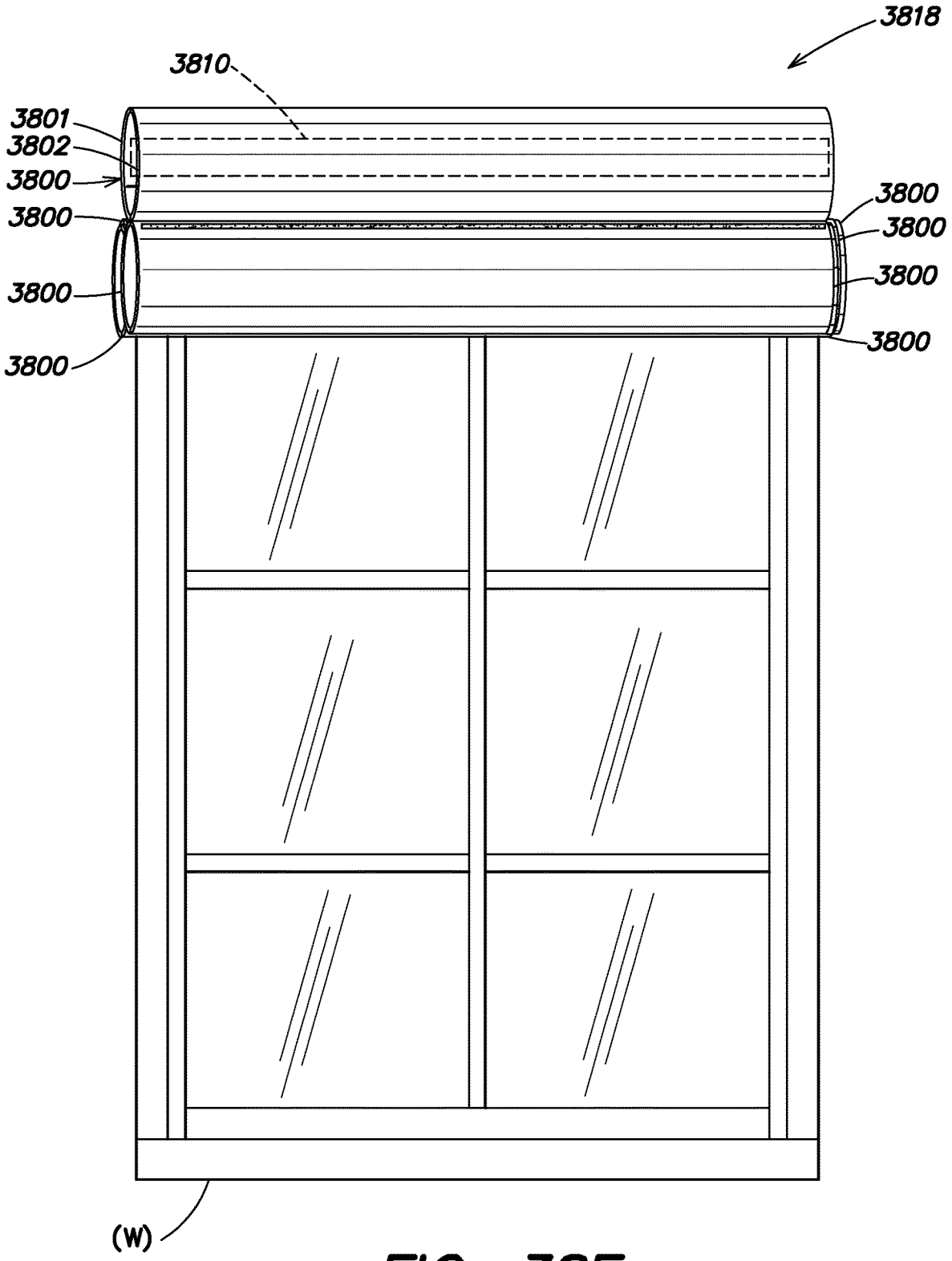
Figure 38F:
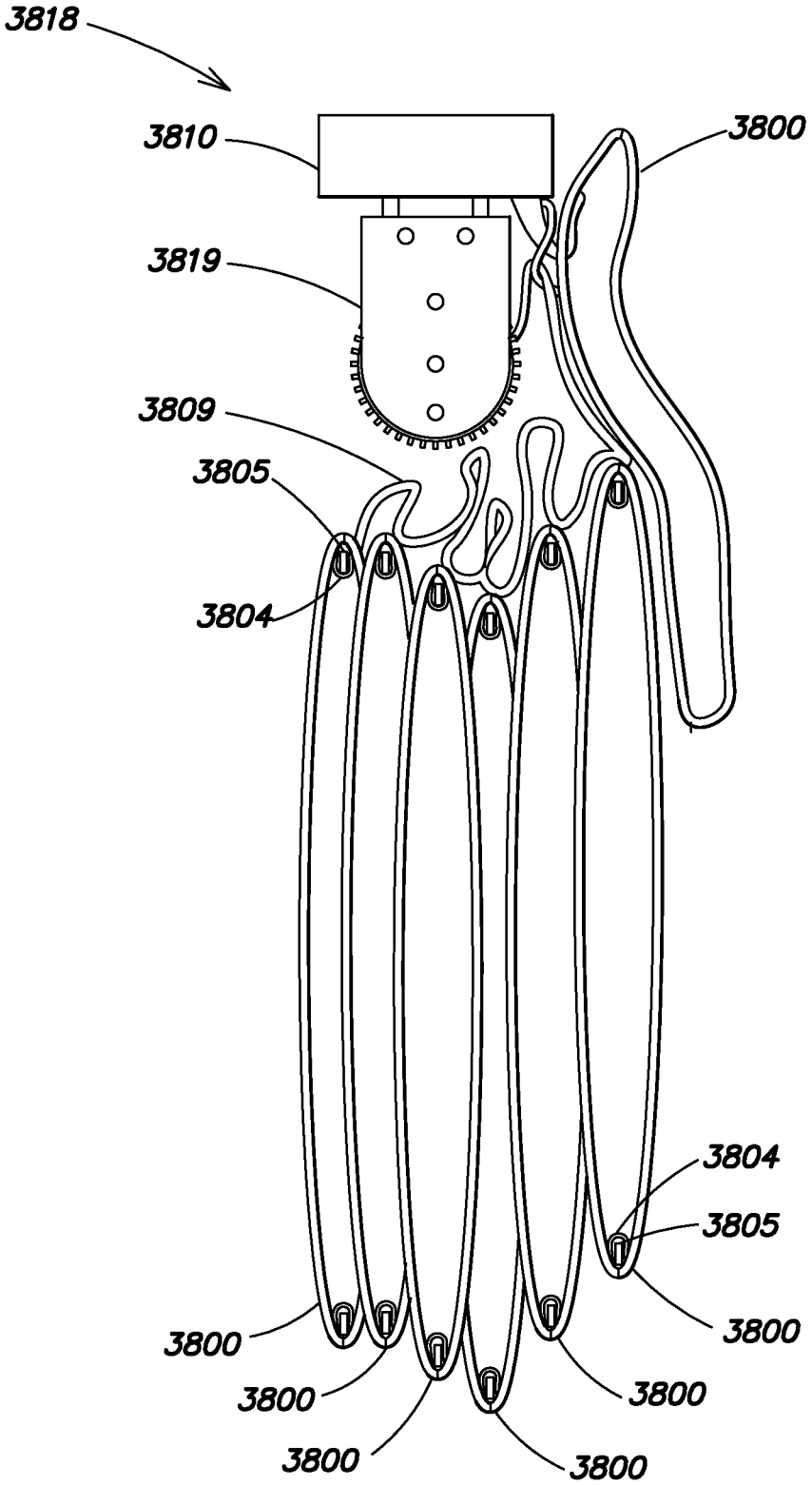

In an embodiment, sheath 3809 may be controlled by roller spring system (as seen in FIG. 38F) that is connected to a head rail unit 3810, such that the roller spring system may allow the sheath 3809 to be raised and lowered based on a user pulling or pushing the sheath 3809 and/or slat components 3800, as known by those skilled in the art. Specifically, a user may push up on the sheath 3809 and/or slat component 3800 to raise the shade 3818 and may pull down on the sheath 3809 and/or slat component to lower the shade 3818. Alternatively, the sheath 3809 may be controlled by a counterbalance system and/or a different type of system that allows the user to push up or pull down the sheath 3809 and/or slat component 3800 to raise or lower the shade 3818. Alternatively, the sheath 3809 may be controlled by a cord system or an electric motor as described above or other types of systems, as know by those skilled in the art, for raising and lowering a shade.

For example, FIG. 38E depicts the shade 3818 in a raised configuration, where the slats components 3800 "collapse" or "bunch" up at the top of the shade 3818 and the window opening is exposed. As shown in FIG. 38E, the top most slat component 3800 may be coupled to the head rail unit 3810 and the other slat components 3800 may be coupled to the sheath.

FIG. 38F shows a side view of the shade 3818 when the shade is in the raised configuration and the slat components are collapsed. As depicted in FIG. 38F, the sheath 3809 is also collapsed when the shade 3818 is in the raised configuration. In addition, the roller spring system 3819 is coupled to the head rail unit 3810 such that the roller spring system 3819 is hidden from view.

Figure 38G:
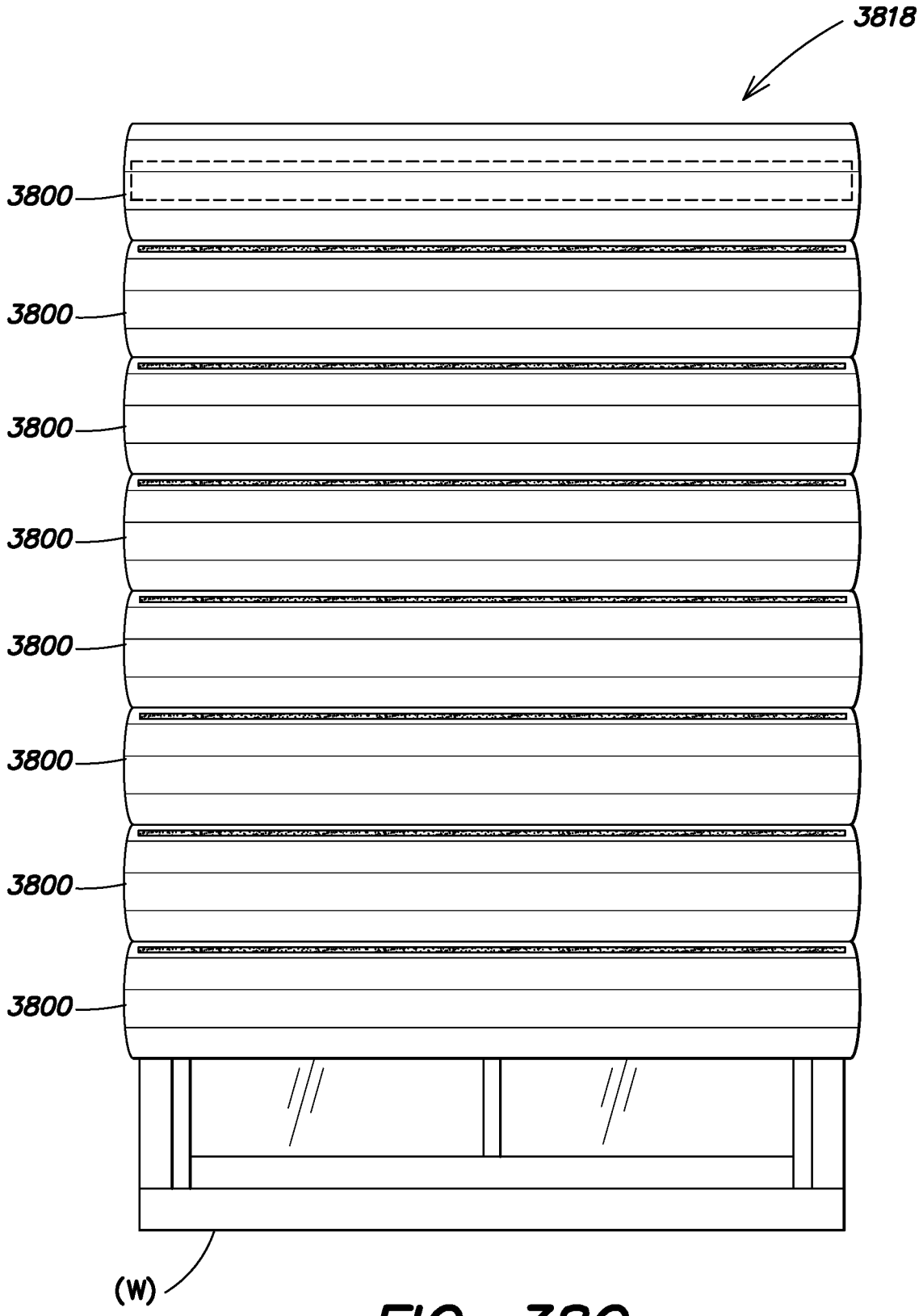
Figure 38H:
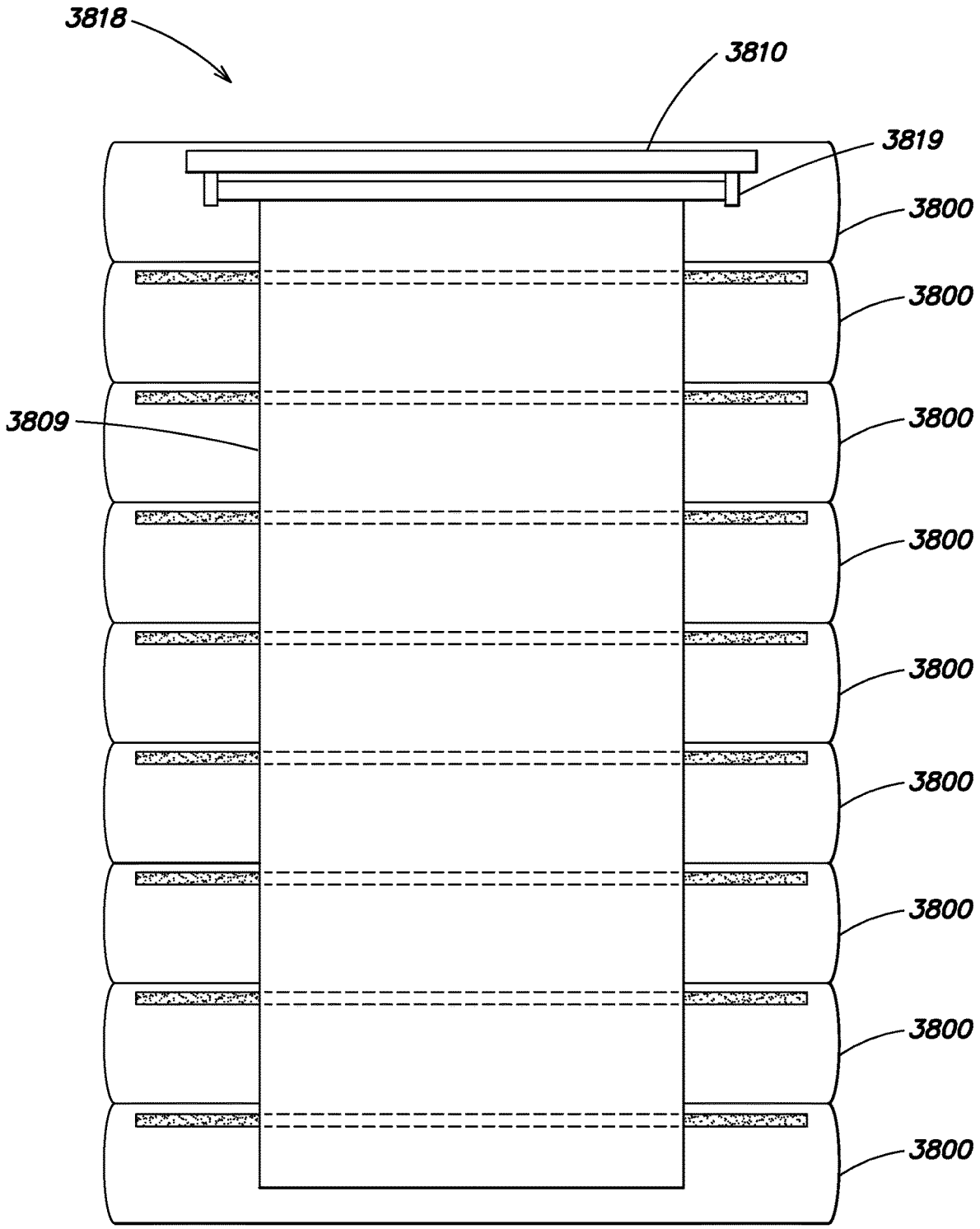
Figure 381:
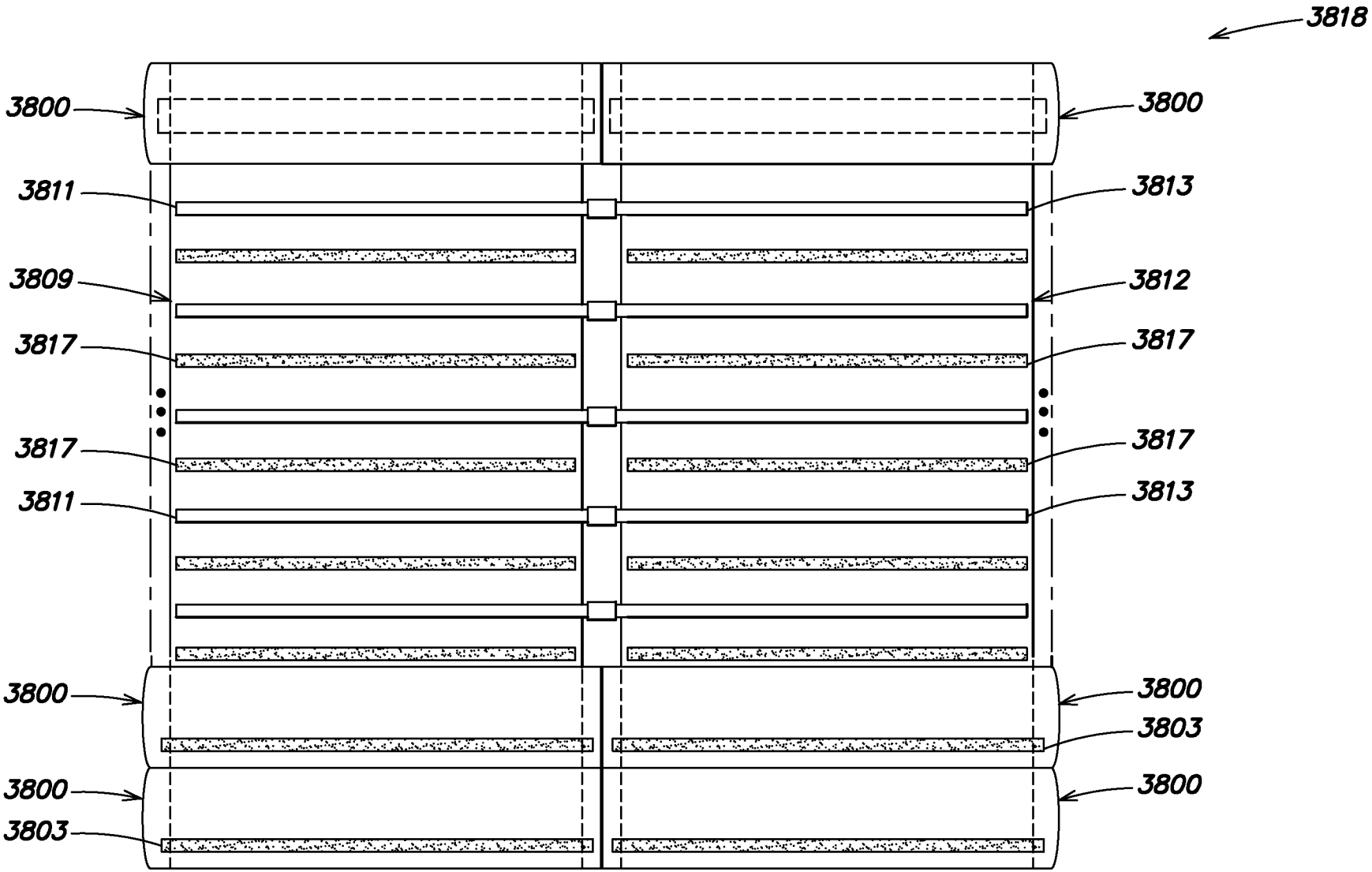

In addition, FIG. 38G depicts the shade 3818 in the lowered configuration, where the slat components 3800 are not collapsed. Further, FIG. 38H depicts a back view of the shade 3818 in the lowered configuration, where the slat components 3800 are not "collapsed" and may cover the entire window opening. As can be seen in FIG. 38H, the slat components 3800 may be wider than the sheath 3809 and/or head rail unit 3810.

In an embodiment, the sheath 3809 may be coupled to an adjacent sheath 3812 as depicted in FIG. 38I. As depicted in FIG. 38I, rod 3811 extends past one end of the sheath 3809 and is coupled to an adjacent rod 3813 that extends past one end of the adjacent sheath 3812. For example, the rod 3811 may be coupled to the adjacent rod 3813 utilizing strings, buttons, magnets, hook and loop fasteners, such as Velcro®, clips, etc. As such, the front of the overall shade may appear or look like a single shade.

In addition or alternatively, the slat components 3800 may be coupled to each other as depicted in FIG. 38I. Specifically, the ends of the slat components 3800 that is coupled to sheath 3809 may be coupled to the slat component 3800 of the adjacent sheath 3812. For example, the slat component 3800 of the sheath 3809 may be coupled to the slat component 3800 of the adjacent sheath 3812 utilizing strings, buttons, magnets, hook and loop fasteners, such as Velcro®, clips, etc. As such, the front of the overall shade may appear or look like a single shade.

Figure 38J:
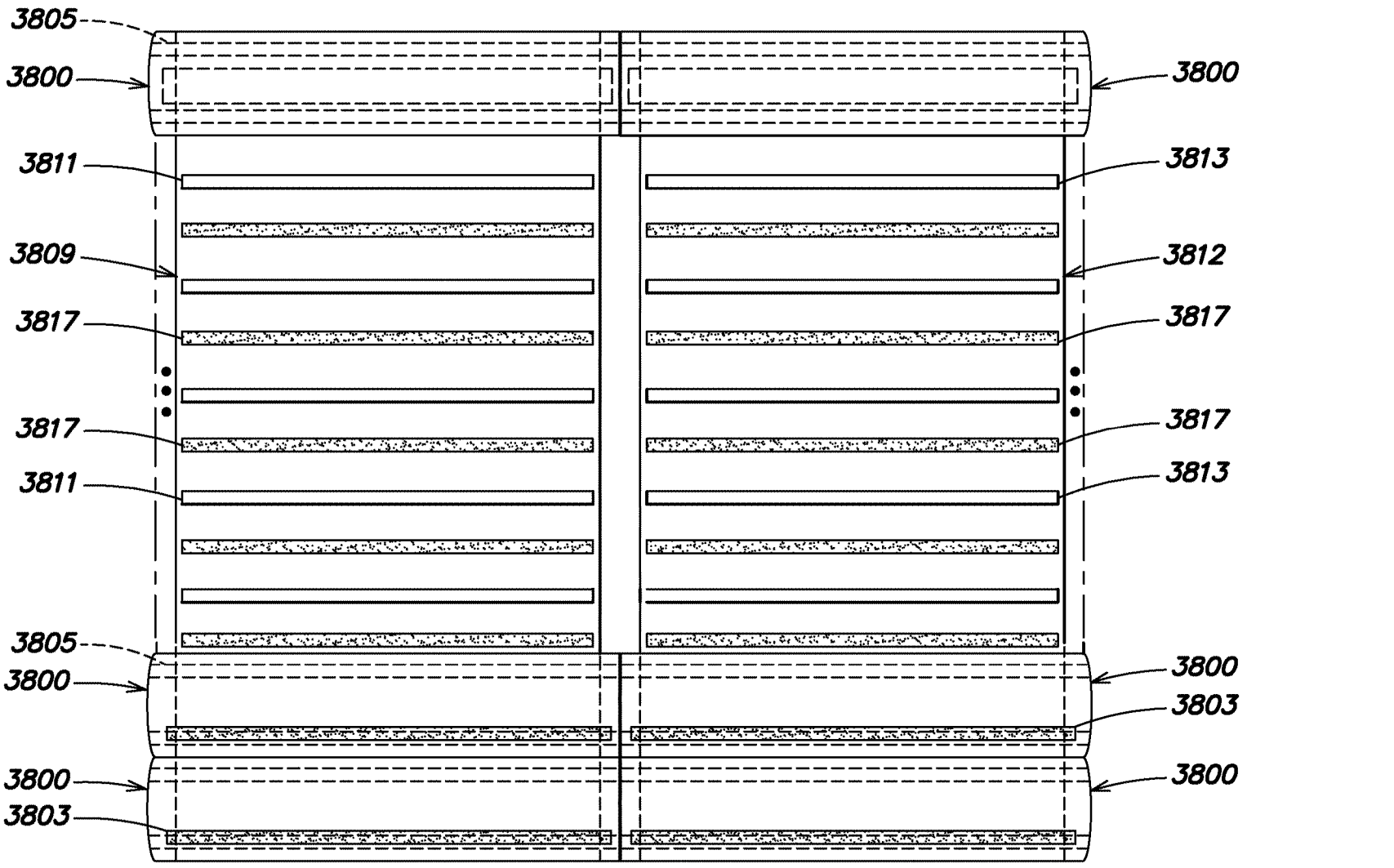

In an embodiment, and as depicted in FIG. 38J, the strip 3805 within the slat component 3800 of sheath 3809 may be coupled to a strip 3805 within the slat component 3800 of the adjacent sheath 3812, utilizing strings, buttons, magnets, hook and loop fasteners, such as Velcro®, clips, etc. As such, the front of the overall shade may appear or look like a single shade.

Figure 38K:
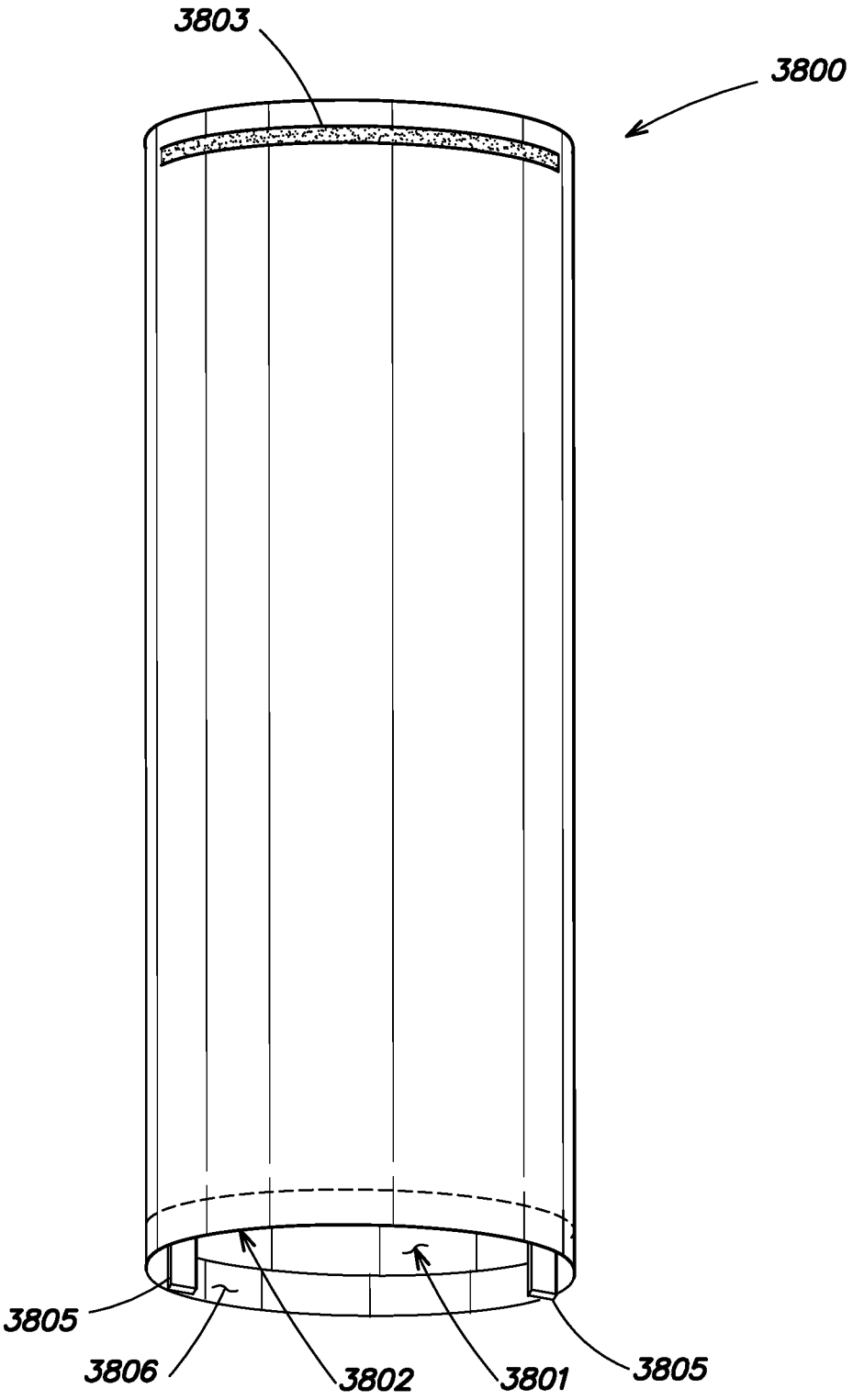
FIG. 38K is a detailed depiction of a slat for one or more embodiments described herein.

In an embodiment, and as depicted in FIG. 38K, the first portion of the securing mechanism 3803, of the slat component 3800, may be located at a position parallel to the opening created by the coupling of the first layer 3801 and 3802. The slat component 3800 may be coupled to the sheath and/or head rail unit 3801 and the excess material 3806 may be secured to interior of the slat component 3800 in a similar manner as described above. However, because the excess material is running horizontally instead of vertically as depicted in FIG. 38A when the slat component 3800 is attached to the sheath 3809 and/or head rail unit 3810, the overall length of the shade 3818 may be adjusted utilizing the excess material.

Figure 38L:
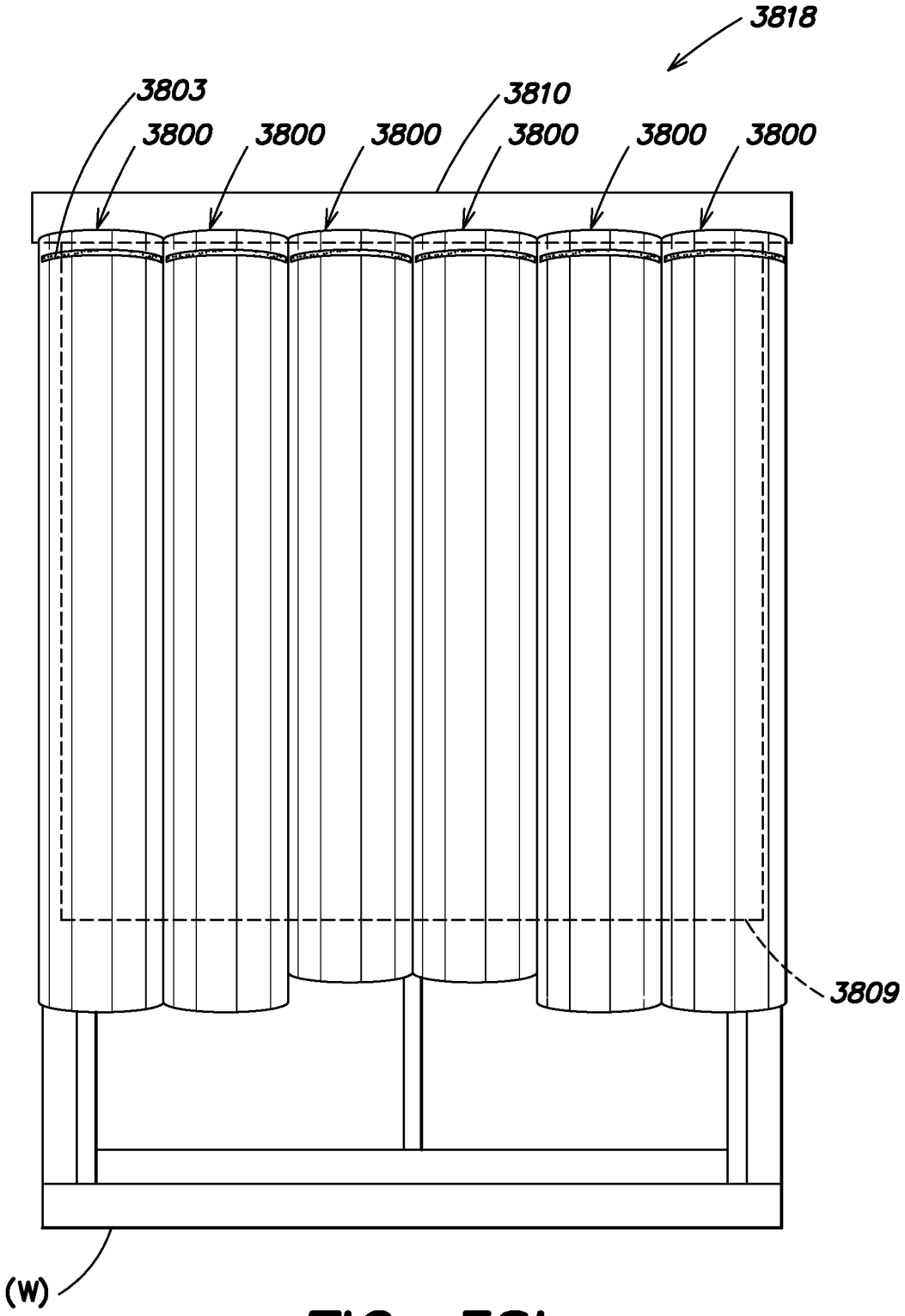
FIG. 38L is a detailed depiction of a shade that includes exemplary slat components as described with respect to FIG. 38K.

Specifically, and as depicted in FIG. 38L, a plurality of slat components 3800 as depicted in FIG. 38K are coupled to sheath 3809 where the width of the shade 3818 is based on the width of each individual slat component 3800 as depicted in FIG. 38K and the number of slat components 3800 attached to the sheath 3809 and/or head rail unit 3810. The length of the shade 3818 is based on the excess material 3806 and the how much excess material 3806 the user decides to insert into the opening created by the two layers 3801 and 3802 of the slat component 3800 that are coupled together. As depicted in FIG. 38L each the slat components 3800 may be the same length or a different length based on the user's choice. For example, the user may change the lengths of particular slat components 3800 such that the shade 3818 surrounds an air conditioner or other object in a window. Alternatively, the shade 3818 may be coupled to a wall and the user may change the lengths of particular slat components 3800 such that the shade surrounds books on a book case or other items attached to the wall or that lie against a wall.

In addition, although FIG. 38L depicts a single sheath 3809, it is expressly contemplated that a plurality of sheaths 3809 (not shown) may be utilized. For example, each slat component 3800 may be attached to a different sheath 3809 and the plurality of different sheaths 3809 may be coupled together and attached to a common head rail unit 3810, as described above.

Figure 39A:
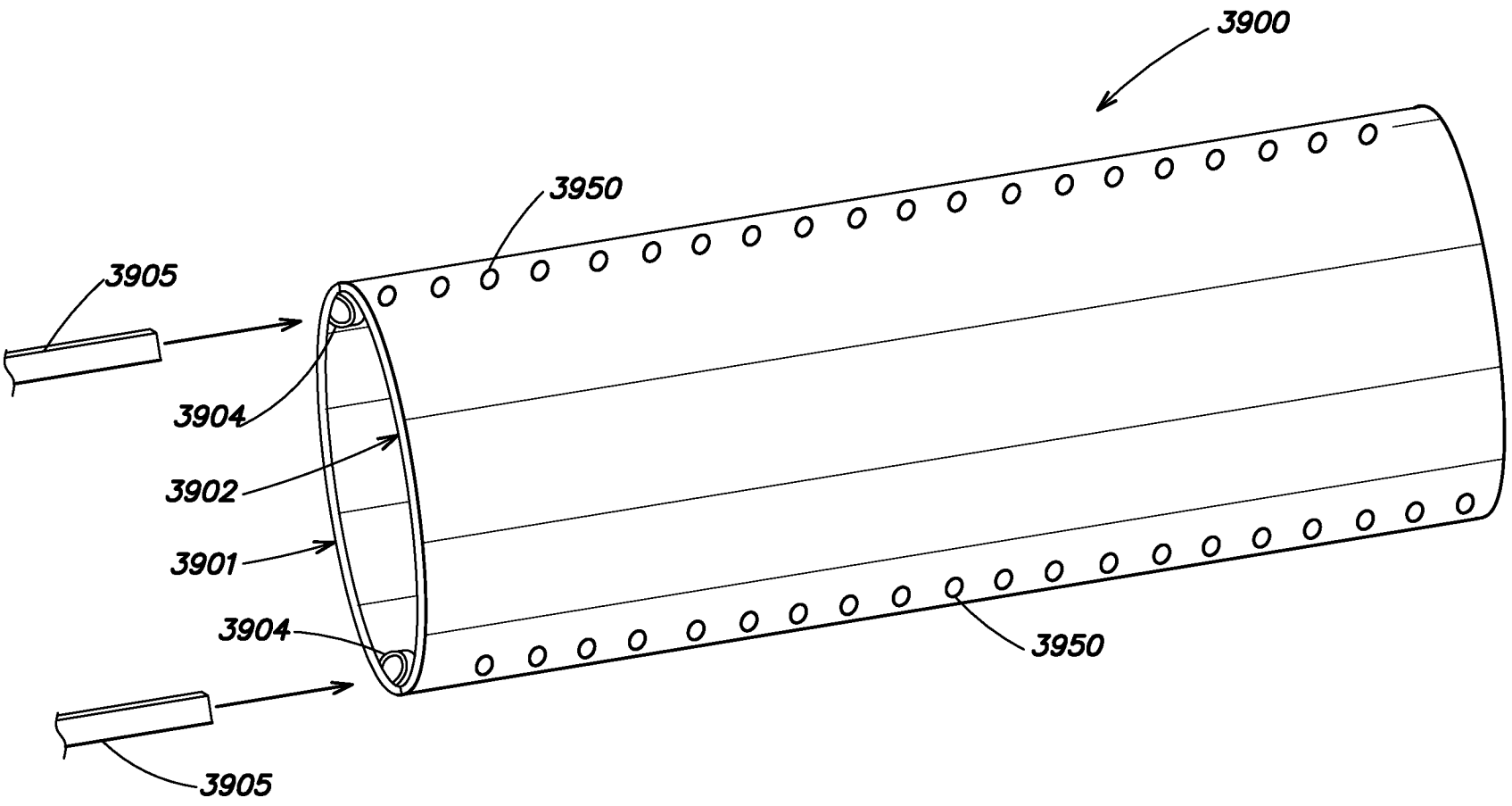
FIGS. 39A-39C are detailed depictions of a slat component for one or more embodiments described herein.

FIG. 39A is a perspective view of a slat component for one or more embodiments described herein. The slat component 3900 may include a first layer 3901 and a second layer 3902. The first layer 3901 and the second layer 3902 may be coupled to each other at a top edge and a bottom edge where the first layer 3901 and the second layer 3902 meet as depicted in FIG. 39A. The first layer 3901 and the second layer 3902 may be coupled to each other in a variety of different ways, such as, but not limited to utilizing one or more or a combination of strings, zippers, buttons, magnets, hook and loop fasteners, such as Velcro®, clips, etc.

Each of the plurality of slat components 3900 may be coupled to each other utilizing a plurality of through holes 3950 that run along the bottom and top edge of each slat component 3900. For example, the first layer 3901, the second layer 3902, or the first layer 3901 and the second layer 3950 may include the through holes 3950. The through holes 3950 may run along the entire edge or only on selected portions of the edges of the slat components. Specifically, and as depicted in 39D, 39F, and 39G, string 3951 may be fed through respective through holes of the slat components 3900 to couple the slat components together. Although reference is made to utilizing through holes 3950 and string 3951, it is expressly contemplated that any of a variety of different securing mechanism may be utilized to couple the slat components 3900 together. For example, such securing mechanisms may include, but are limited to one or more or a combination of zippers, buttons, magnets, hook and loop fasteners, such as Velcro®, clips, etc.

In addition, each layer may include one or more interior clasps 3904 that are utilized to hold or secure one or more strips 3905 to the interior of the layer, as will be described in further detail below. In an embodiment, the one or more strips 3905 may be curved or any shape. In addition, the one or more strips 3905 do not have to be uniform and may be wider at some locations and narrower at other locations along the length of the one or more strips 3905.

Figure 39B:
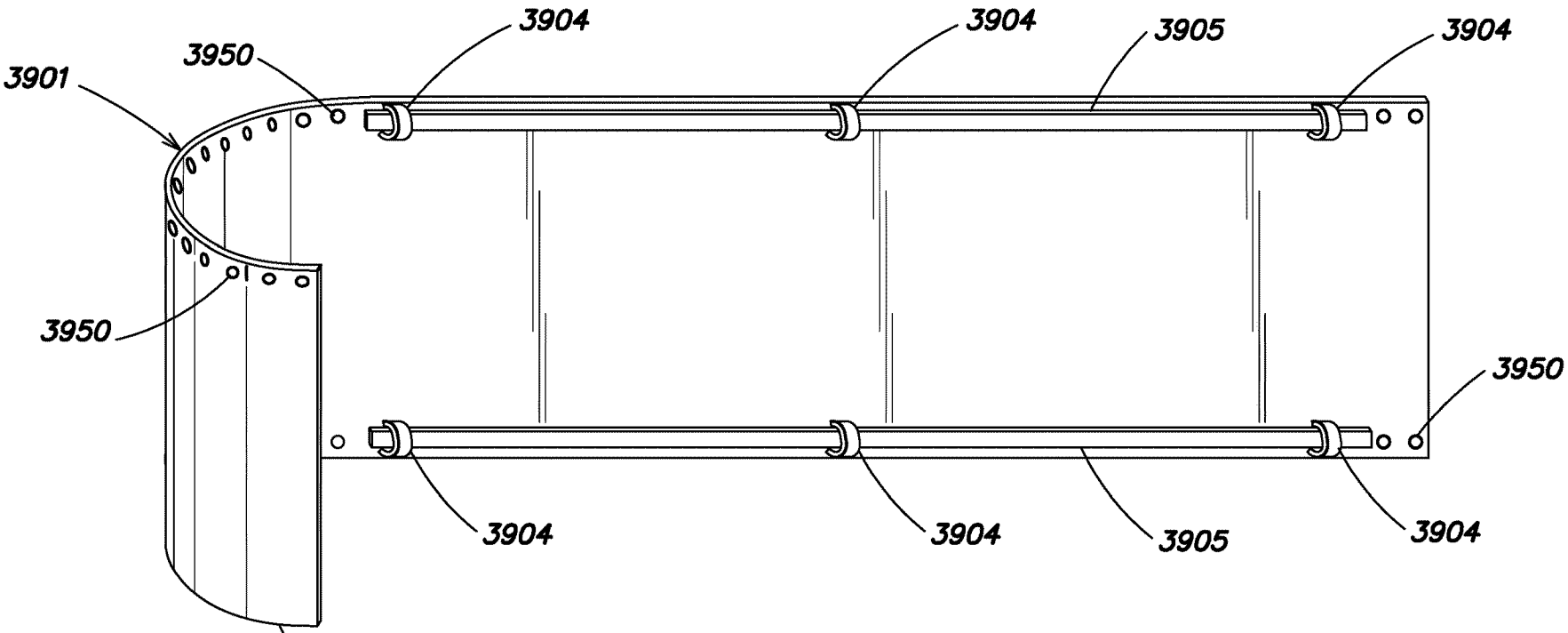

FIG. 39B is an interior view of first layer 3901, however it is expressly contemplated that the description of the interior view of the first layer 3901 can be applied to the second layer 3902 or any other layer. As depicted in FIG. 39B, the plurality of through holes 3950 run along the top and bottom of the first layer 3901.

In addition, there are a plurality of interior clasps 3904 that secure the strips 3905 to the interior of the layer 3901. Specifically, the strips 3905 may sit on the interior clasps 3904 such that the strips 3905 remain within the interior of the slat component 3900. It is noted that FIG. 39B depicts a single strip 3905 being inserted within the three interior clasps 3904 on the top and bottom of the first layer 3901, however it is expressly contemplated that two or more strips 3905 may overlap and be coupled together, in a similar manner as described above with respect to the dowels 2381 in FIG. 36A, and sit on any number of interior clasps 3904 such that the width of the overall first layer 3901 may be altered. Specifically, the two or more strips 3905 may be secured to each other in a variety of different ways, such as, but not limited to utilizing one or more or a combination of strings, zippers, buttons, magnets, hook and loop fasteners, such as Velcro®, clips, etc. For example, the width of the overall layers may be altered based on any different size windows, for example. Although FIG. 39B depicts the utilization of clasps 3904, it is expressly contemplated that the strips 3905 may be secured to the slat component 3900 without the use of clasps 3904.

For example, a single strip 3905 may have a height that is substantially similar to the height of the slat component 3900, such that the single strip 3905 may be inserted and secured to the interior of the slat component 3900 without using the clasps 3904. That is, because the single strip 3905 is substantially similar in height to the slat component 3900, the single strip 3905 can be securely fit inside the interior open of the slat component 3900 and provide rigidity to the slat component 3900. The overall width of the single strip 3905 may, for example, be less than the overall width of the slat component 3900 such that the single strip 3905 is only in a middle portion of the slat component 3900. Alternatively, the overall width of the single strip 3905 may be substantially similar in size to the width of the slat component 3900.

In addition, excess material 3906 of the first layer 3901 may be folded over and secured to the interior of the first layer 3901 in a variety of different ways, such as, but not limited to utilizing one or more or a combination of strings, zippers, buttons, magnets, hook and loop fasteners, such as Velcro®, clips, etc.

Figure 39C:
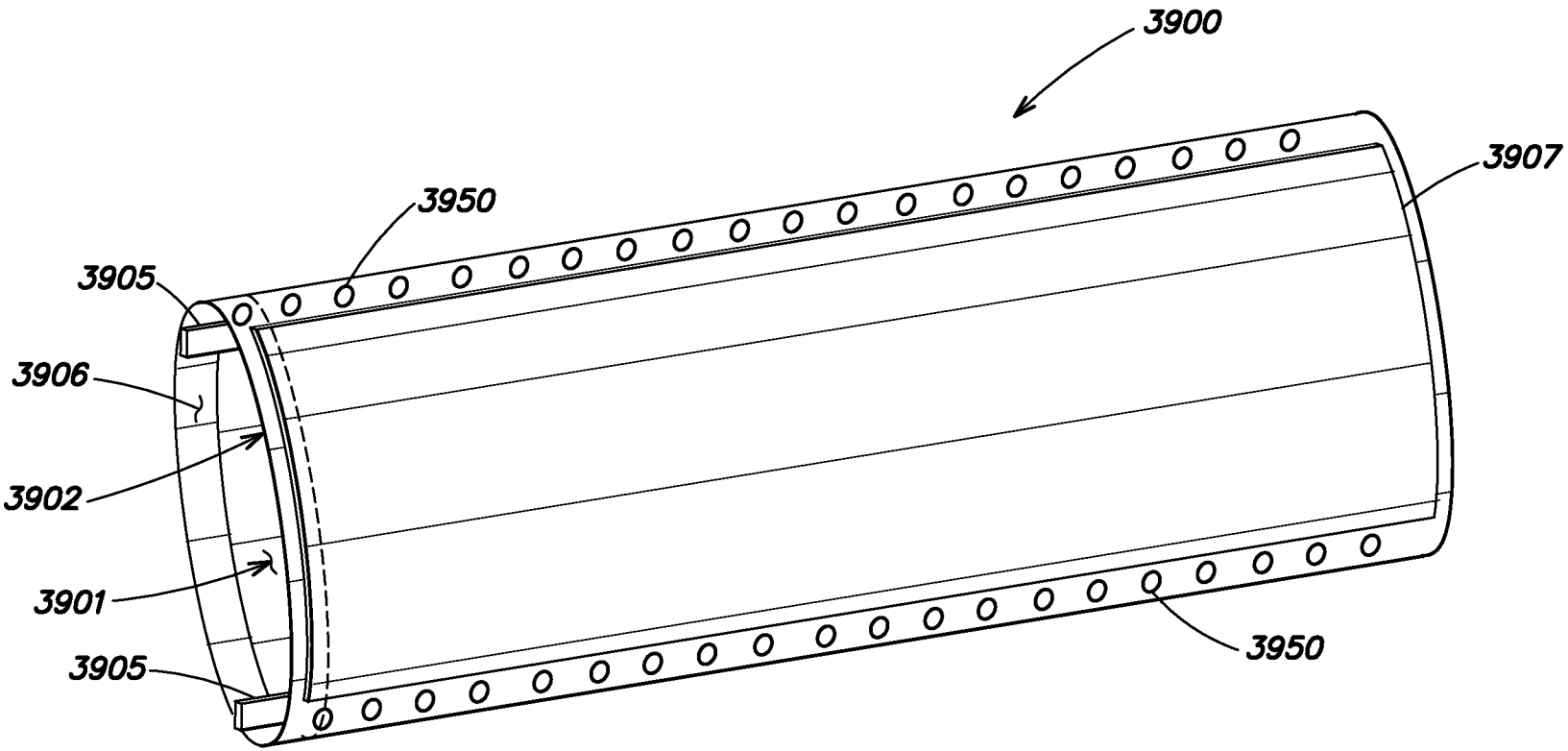

FIG. 39C is a perspective view of a slat component for one or more embodiments described herein, wherein excess material 3906 of the first layer 3901 and second layer 3902 are secured to the interior of the slat component 3900 and the strips 3905 are secured to the interior of the first layer 3901. As can be seen in FIGS. 39B and 39C, the excess material 3906, which extends past the length of the strips 3905, is folded over and inserted within the opening created by the coupling of the first layer 3901 and the second layer 3902. In an embodiment, the excess material 3906 may then be secured to the interior of the slat component 3900 using any of a variety of securing mechanisms such as, but not limited to one or more or a combination of strings, zippers, buttons, magnets, hook and loop fasteners, such as Velcro®, clips, etc. Advantageously, the overall width of the slat component 3900, and thus the shade, can be altered.

The first layer 3901 and the second layer 3902 may include one or more additional layers 3907 that are coupled to the exterior of the first layer 3901 and/or second layer 3902. The additional layers 3907 may be of any material, such as, but not limited to, vinyl or any other materials to add rigidity or a different look to the slat component 3900. It is noted that the one or more additional layers 3907 can be any size and do not have to match the size of the first layer 3901 or second layer 3902. The additional layers 3907 may be attached to the first layer 3901 and/or second layer 3902 using any of a variety of securing mechanisms such as, but not limited to one or more or a combination of strings, zippers buttons, magnets, hook and loop fasteners, such as Velcro®, clips, etc.

Figure 39D:
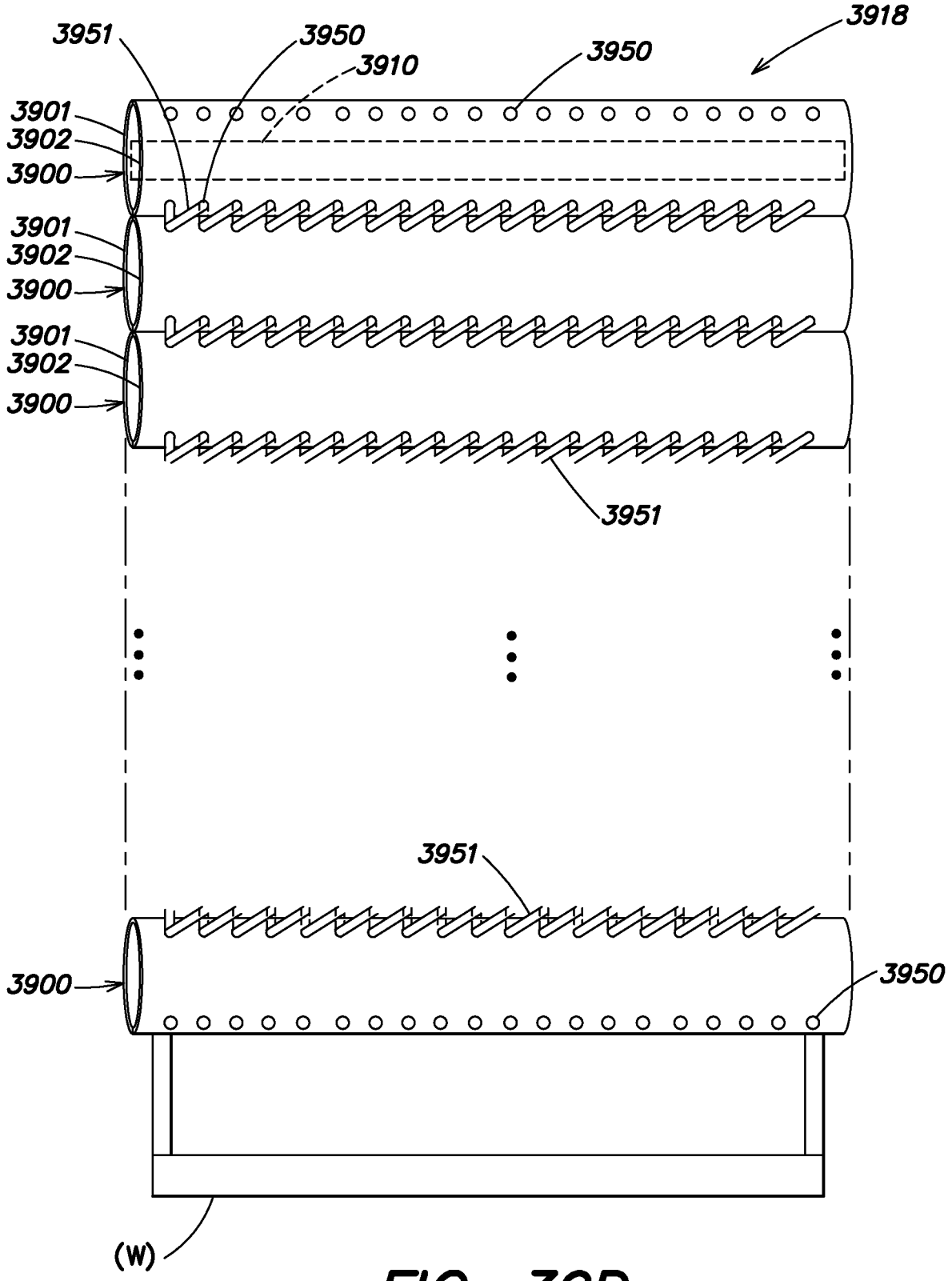
FIG. 39D is a detailed depiction of a shade that includes exemplary slat component as described with respect to FIGS. 39A-39C.

FIG. 39D is a detailed depiction of a shade 3918 including the slat component 3900 as depicted in FIGS. 39A-39C. The slat components 3900, each including at least a first layer 3901 and second layer 3902, are secured to each other utilizing the through holes 3950 and strings 3950 to make up the shade 3918. Specifically, a user may couple a plurality of slat components 3900 into any user desired configuration. In addition, the top most slat component 3900 is attached to a head rail unit 3910 utilizing a securing mechanism, such as, but not limited to one or more or a combination of strings, zippers buttons, magnets, hook and loop fasteners, such as Velcro®, clips, etc.

Although FIG. 39D depicts the securing mechanism (e.g., through holes 3950 and strings 3950) being visible, it is expressly contemplated that the securing mechanism may be hidden from view. Specifically, the second layer 3902 of a top slat component may be coupled to the first layer 3901 of a bottom slat component such that the securing mechanism is hidden. For example, if the securing mechanism is a zipper, a first portion of the zipper may be located on the bottom exterior portion of the second layer 3902, of a top slat component, that is facing a window. In addition, the second portion of the zipper may be located on a top exterior portion of the first layer 3902, of a bottom slat component, that is not facing the window. As such and when the top slat component and bottom slat component are coupled to each other, the two portions of the zipper are hidden from view.

Figure 39E:
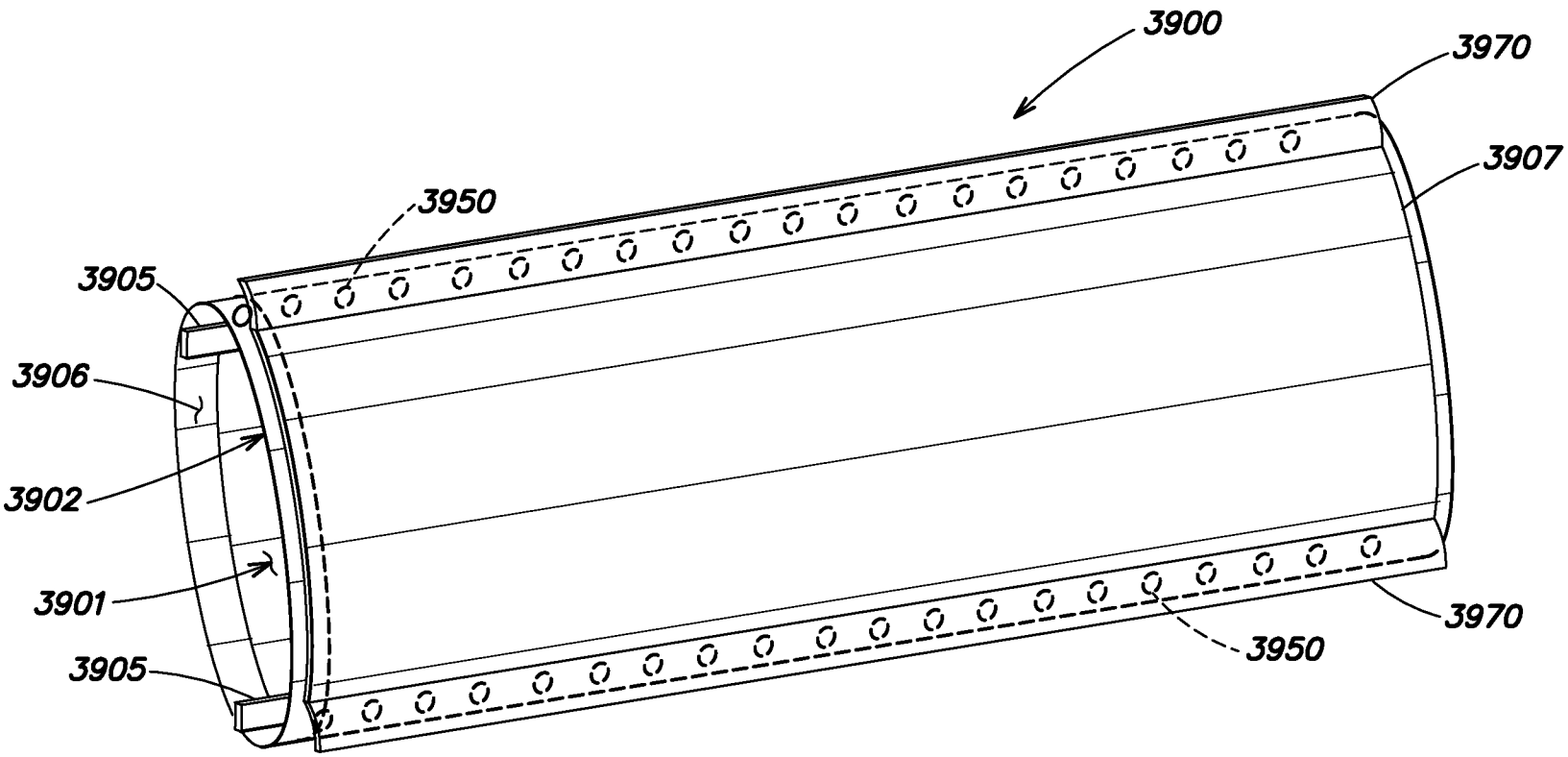
FIG. 39E is a detailed depiction of a slat component for one or more embodiments described herein.

Alternatively, the securing mechanism between two slat components may be hidden in a variety of different ways. For example, the additional layer 3907 may have one or more flaps 3970 that extend past the securing through holes 3950, or other securing mechanism (not shown), as shown in FIG. 39E such that the through holes 3950 and/or string 3951 utilized with the through holes are not visible to the user. It is noted that the flaps 3970 may be the same or different material from the additional layer 3907. For example, the flaps 3970 may be a material with enough rigidity (e.g., vinyl, plastic, cloth, etc.) such that the top flap 3970 can stay up to hide the through holes 3950 and/or strings 3951. As such the securing mechanism, utilized to couple the slat components 3900 together, are not visible when, for example, the shade is within a window opening.

A head rail unit 3910 may be located at the top of the shade 3918. The head rail unit 3910 may be coupled to a top slat component 3900. Specifically, the top slat component 3900 may be attached the exterior of the head rail unit 3910. For example, the top slat component 3900 may be secured to the head rail unit 3910 using any of a variety of securing mechanisms such as, but not limited to, one or more or a combination of strings, zippers buttons, magnets, hook and loop fasteners, such as Velcro®, clips, etc. In addition, the head rail unit 3910 may be coupled to a roller spring system, counterbalance system, cord system, or motor that is utilized to raise and lower the shade as will be described in further detail below.

In addition, although FIG. 39D depicts a plurality of slat components 3900 being utilized, it is expressly contemplated that a single slat component 3900 may be utilized. For example, a single slat component 3900 may be secured to the head rail unit 3910 in the manner described above.

In addition, it is expressly contemplated that the slat components 3900 may be disengaged from each other, by removing the strings 3951 form the through holes 3950 and/or also disengaging a slat component 3900 from the head rail unit 3910. Further, the slat components 3900 may be reversed such that the second layer 3902 is facing outward from the window opening (W). As such, the first layer 3901 and second layer 3902 may be different patterns or materials and thus provide a user with the ability to alter or change the appearance of the shade 3918 by simply reversing the slat component 3900.

Advantageously, if the layers 3901 and 3902 need to be washed or replaced, a user can simply disengage the slat components 3900 from each other and place the slat component 3900 in a laundry machine, or may wash the slat component 3900 in any manner.

Figure 39F:
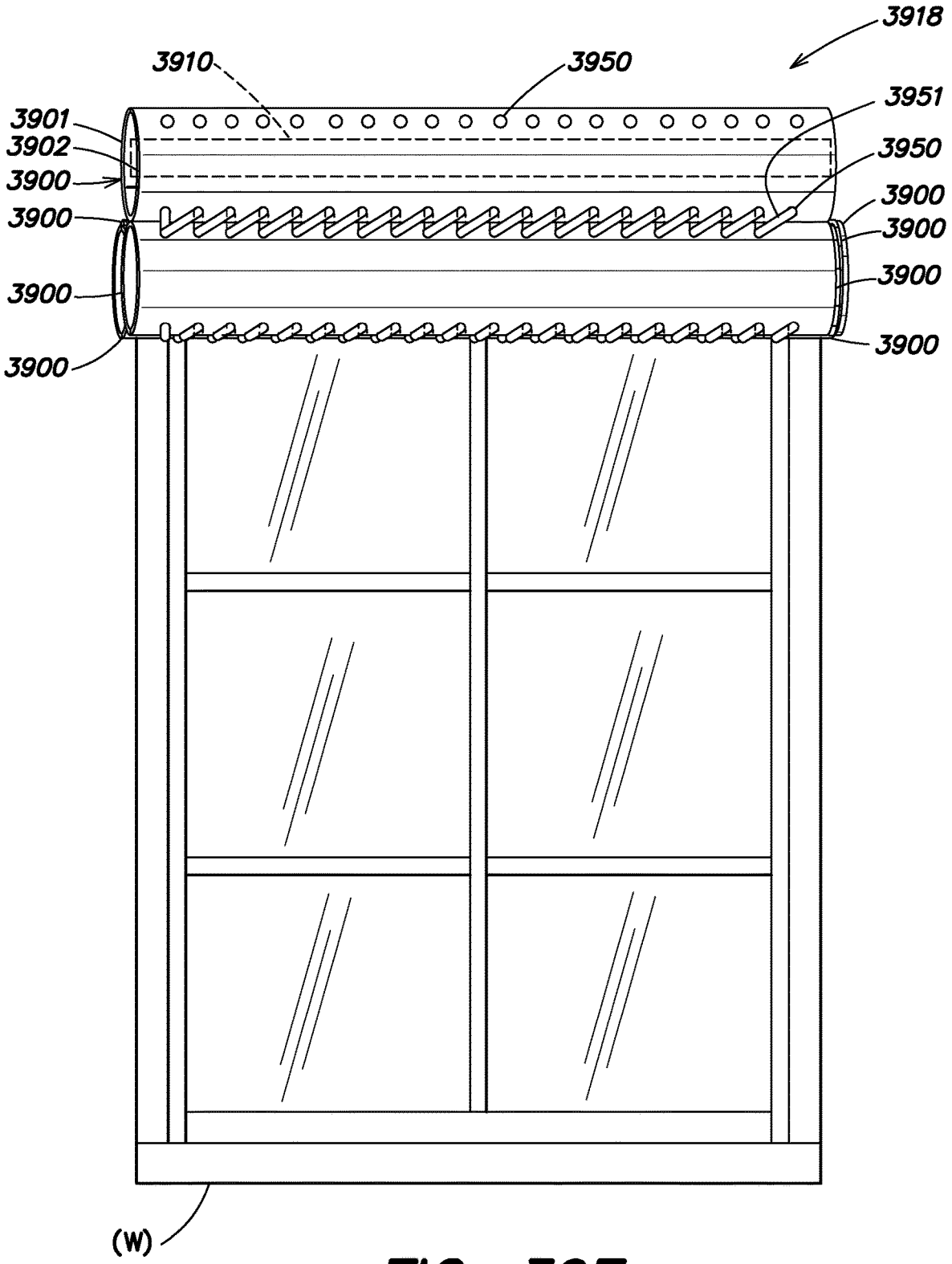
Figure 39G:
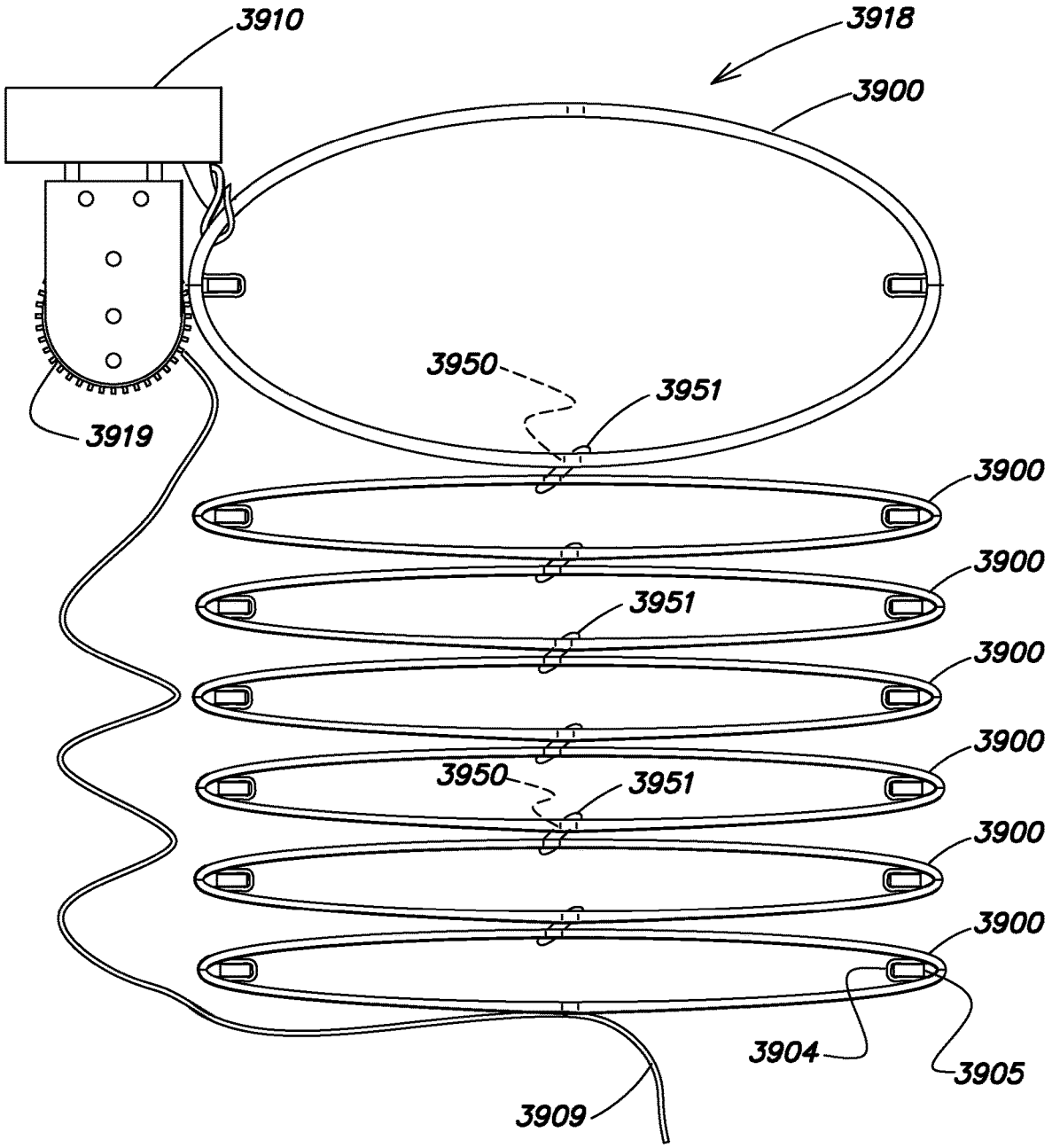

In an embodiment, the slat components 3900 may be controlled by roller spring system (as seen in FIG. 39G) that is connected to a head rail unit 3910, such that the roller spring system 3919 may allow the slat components 3900 to be raised and lowered based on a user pulling or pushing the bottom most slat component 3900, for example and as known by those skilled in the art. Specifically, a user may push up on the bottom most slat component 3900 to raise the shade 3918 and may pull down on the bottom most slat component 3900 to lower the shade 3918. Alternatively, the slat components 3900 may be controlled by a counterbalance system and/or a different type of system (not shown) that allows the user to push up or pull down the slat component 3900 to raise or lower the shade 3918. Alternatively, the slat components 3900 may be controlled by a cord system or an electric motor as described above or other types of systems, as know by those skilled in the art, for raising and lowering a shade.

For example, FIG. 39F depicts the shade 3918 in a raised configuration, where the slats components 3900 "collapse" or "bunch" up at the top of the shade 3918 and the window opening is exposed. As shown in FIG. 39F, the top most slat component 3900 may be coupled to the head rail unit 3910 while all the slat components 3900 are coupled to each other to make up the shade 3918.

FIG. 39G shows a side view of the shade 3918 when the shade is in the raised configuration and the slat components 3900 are collapsed. Specifically, a string 3909 of the roller spring system 3919 may be attached to the bottom most slat component 3900 such that when the string is drawn into the roller spring system 3919, the plurality of slat components 3900 collapse to raise the shade 3918. As depicted in FIG. 39G, the roller spring system 3919 is also coupled to the head rail unit 3910 such that the roller spring system 3919 is hidden from view. Although FIG. 39G shows the string 3909 attached to only the bottom most slat component 3900, it is expressly contemplated that the string 3909 may be attached to a plurality of slat components 3900.

Alternatively, the roller spring system 3919 may be utilized without the string 3909, where the plurality of slat components 3900 roll onto a roller shade (mot shown) when the shade 3918 is to be raised and roll off the roller shade when the shade 3918 is to be lowered, as known by those skilled in the art.

Figure 39H:
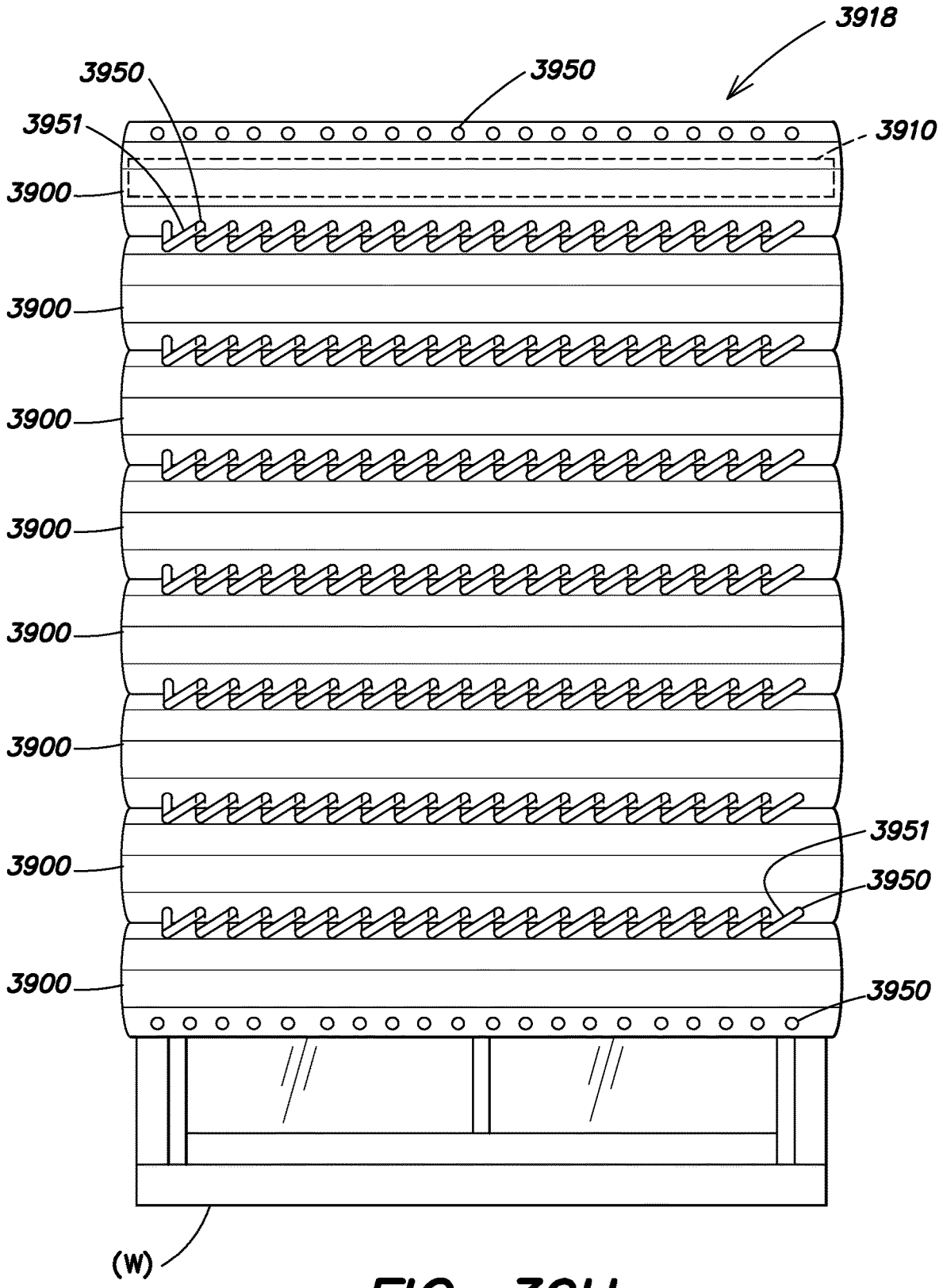
Figure 391:
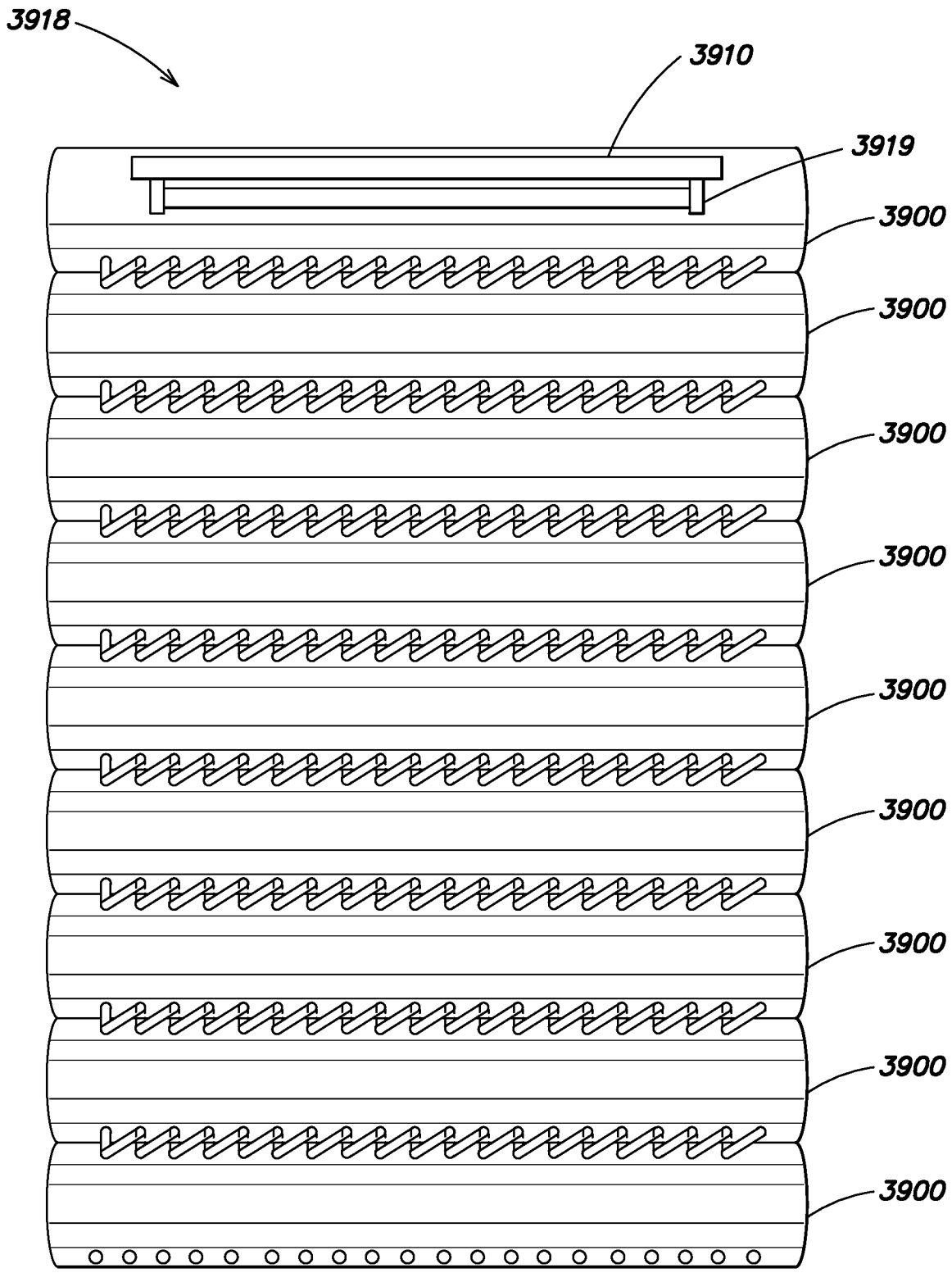

In addition, FIG. 39H depicts the shade 3918 in the lowered configuration, where the slat components 3900 are not collapsed. Further, FIG. 39I depicts a back view of the shade 3918 in the lowered configuration, where the slat components 3900 are not collapsed and may cover the entire window opening. As can be seen in FIG. 39I, the slat components 3900 may be wider than the head rail unit 3910. In addition, and as mentioned above, the second layer that is visible in FIG. 39I may have a different look/pattern than the first layer that is visible in FIG. 39H.

Figure 39J:
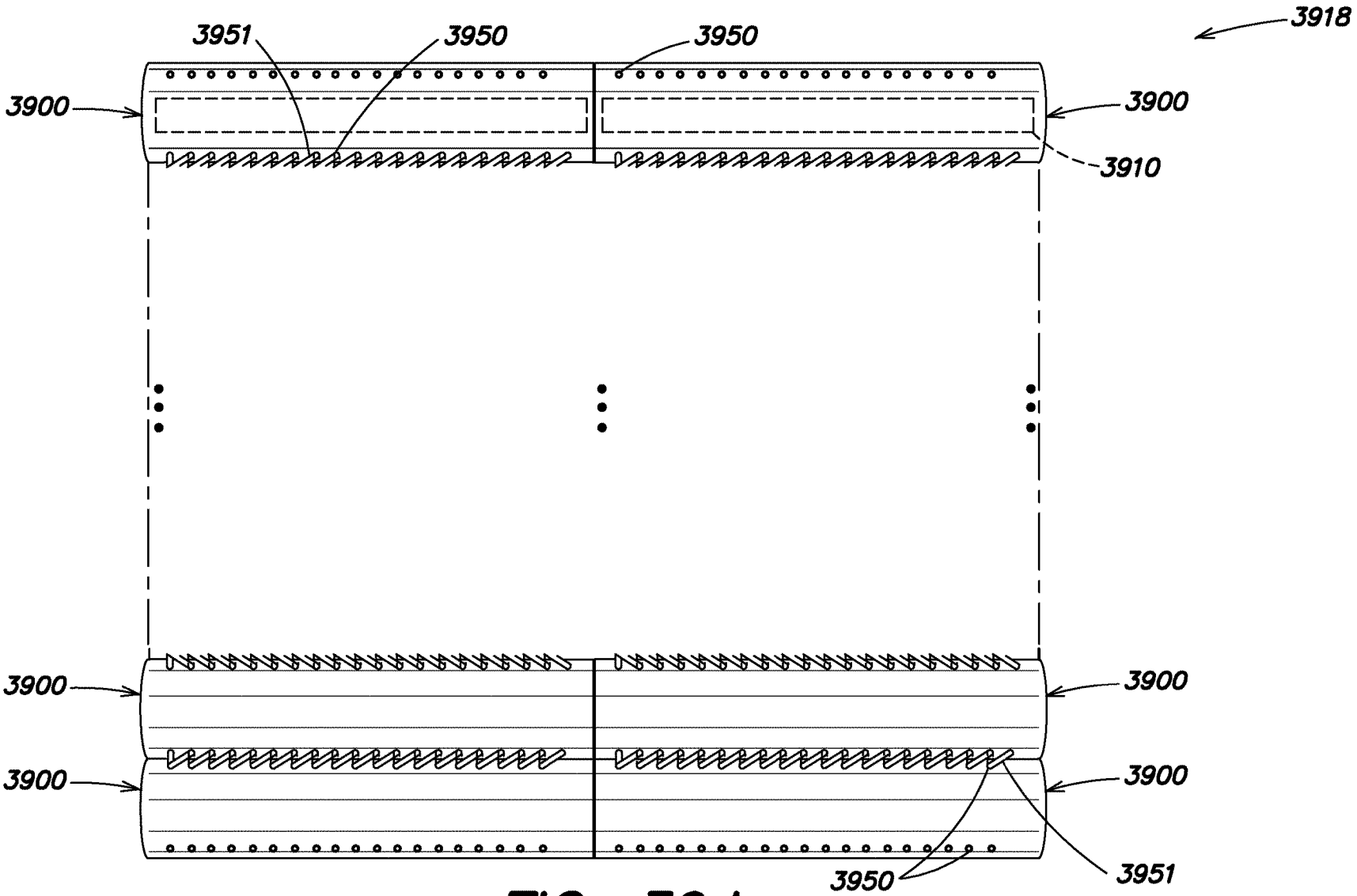

In an embodiment, a slat components 3900 may be coupled to an adjacent or different slat component 3900 as depicted in FIG. 39J. Specifically, the ends of the slat component 3900 may be coupled to an adjacent or different slat component 3900 to alter the overall width the shade. For example, adjacent or different slat components 3900 may be coupled utilizing one or more or a combination of strings, zippers, buttons, magnets, hook and loop fasteners, such as Velcro®, clips, etc. As such, the front of the overall shade may appear or look like a single shade.

Figure 39K:
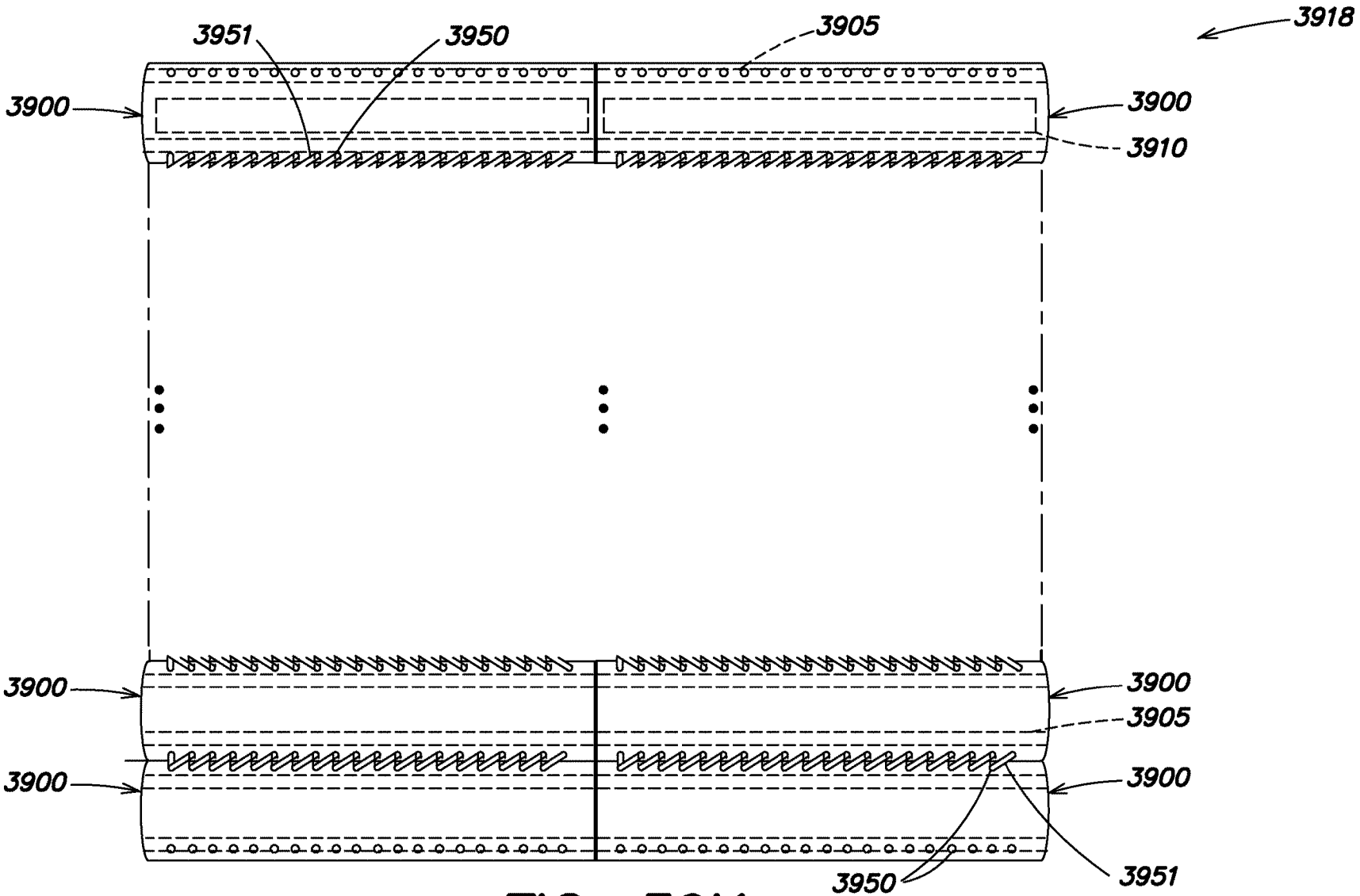

In an embodiment, and as depicted in FIG. 39K, the strip 3905 within the slat component 3900 may be coupled to a strip 3905 within the adjacent or different slat component 3900 utilizing one or more or a combination of strings, zippers, buttons, magnets, hook and loop fasteners, such as Velcro®, clips, etc. As such, the front of the overall shade may appear or look like a single shade.

Figure 39L:
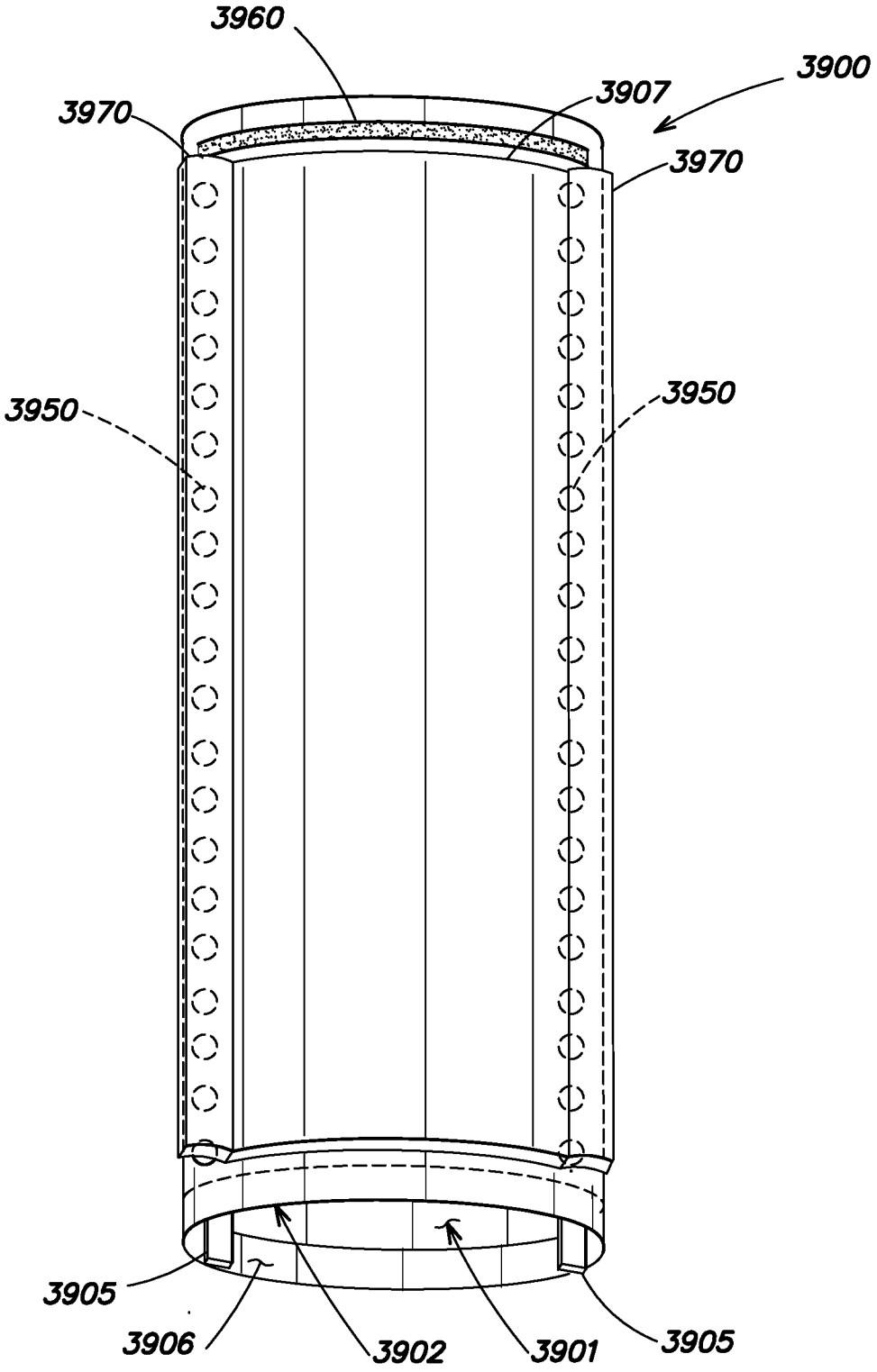
FIG. 39L is a detailed depiction of a slat for one or more embodiments described herein.

In an embodiment, and as depicted in FIG. 39L, a securing mechanism 3960 may be located at a position parallel to the opening created by the coupling of the first layer 3901 and 3902. The slat component 3900 may be coupled to head rail unit 3910 utilizing the securing mechanism 3960 and the excess material 3906 may be secured to interior of the slat component 3900 in a similar manner as described above. However, because the excess material is running horizontally, when the slat component 3900 is attached to the head rail unit 3910 the overall length of the shade 3918 may be adjusted utilizing the excess material. In addition, the slat component 3900 of FIG. 39L may include the additional layer 3907 with flaps 3970 that run vertically to hide the through holes 3950 and/or strings 3951 as depicted in FIG. 39M that also run vertically.

Figure 39M:
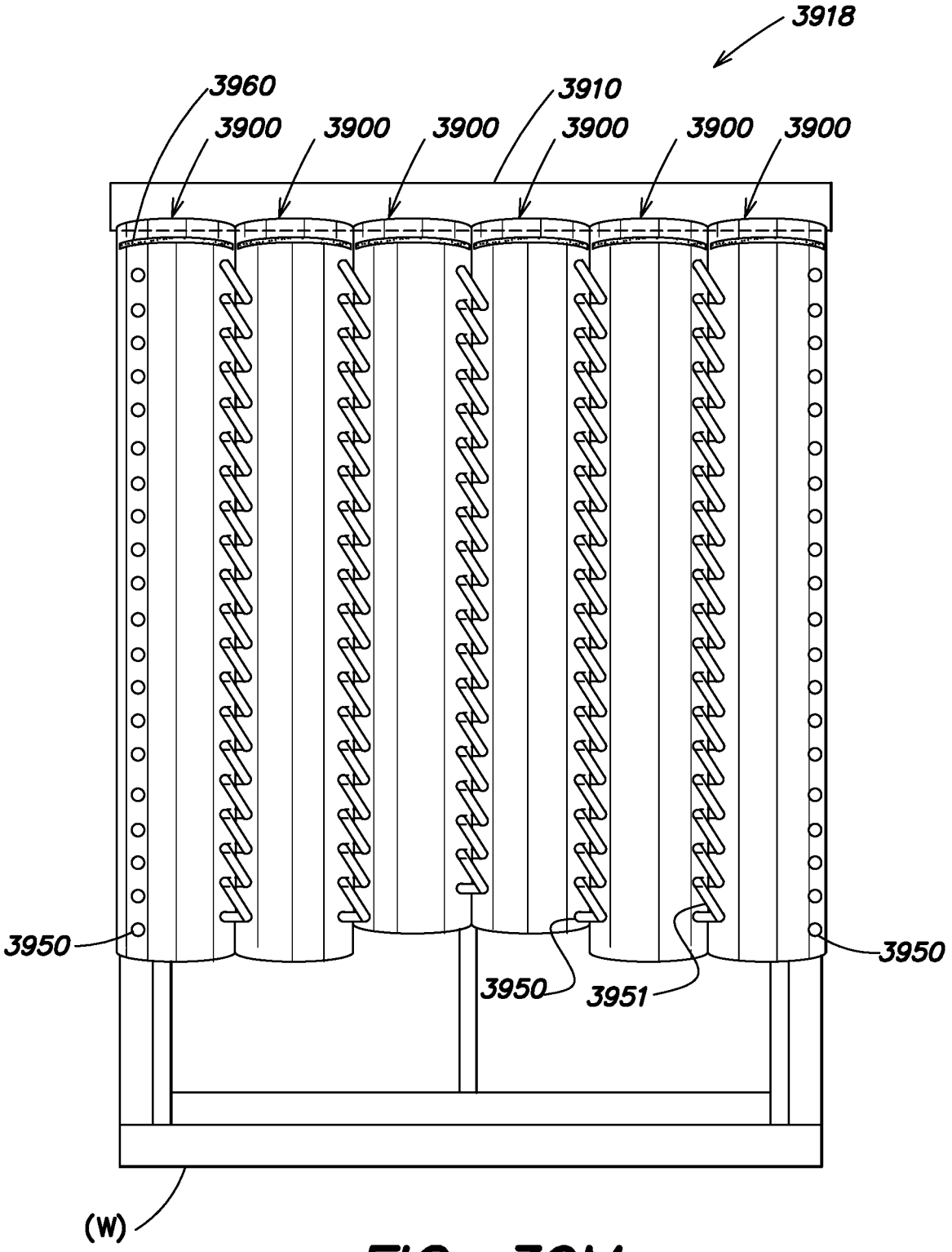
FIG. 39M is a detailed depiction of a shade that includes exemplary slat components as described with respect to FIG. 39L.

Specifically, and as depicted in FIG. 39M, a plurality of slat components 3900 as depicted in FIG. 39L are coupled to the head rail unit 3910, which may be a bar, utilizing the securing mechanism 3960, where the width of the shade 3918 is based on the width of each individual slat component 3900 as depicted in FIG. 39L and the number of slat components 3900 attached to the head rail unit 3910. In addition, the plurality of slat components 3900 may be coupled to each other utilizing the through holes 3950 and strings 3951 as described above. Although not shown in FIG. 39M, the through holes 3950 and strings 3951 may be hidden from view of the additional layer 3907 with the flaps 3970 that are coupled to the exterior of the slat components 3900 as described above with reference to FIG. 39L. The length of the shade 3918 is based on the excess material 3906 and how much excess material 3906 the user decides to insert into the opening created by the two layers 3901 and 3902 of the slat component 3900 that are coupled together. As depicted in FIG. 39M, each the slat components 3900 may be the same length or a different length based on the user's choice. For example, the user may change the lengths of particular slat components 3900 such that the shade 3918 surrounds an air conditioner or other object in a window. Alternatively, the shade 3918 may be coupled to a wall and the user may change the lengths of particular slat components 3900 such that the shade surrounds books on a book case or other items attached to the wall or that lie against a wall.

Figure 40A:
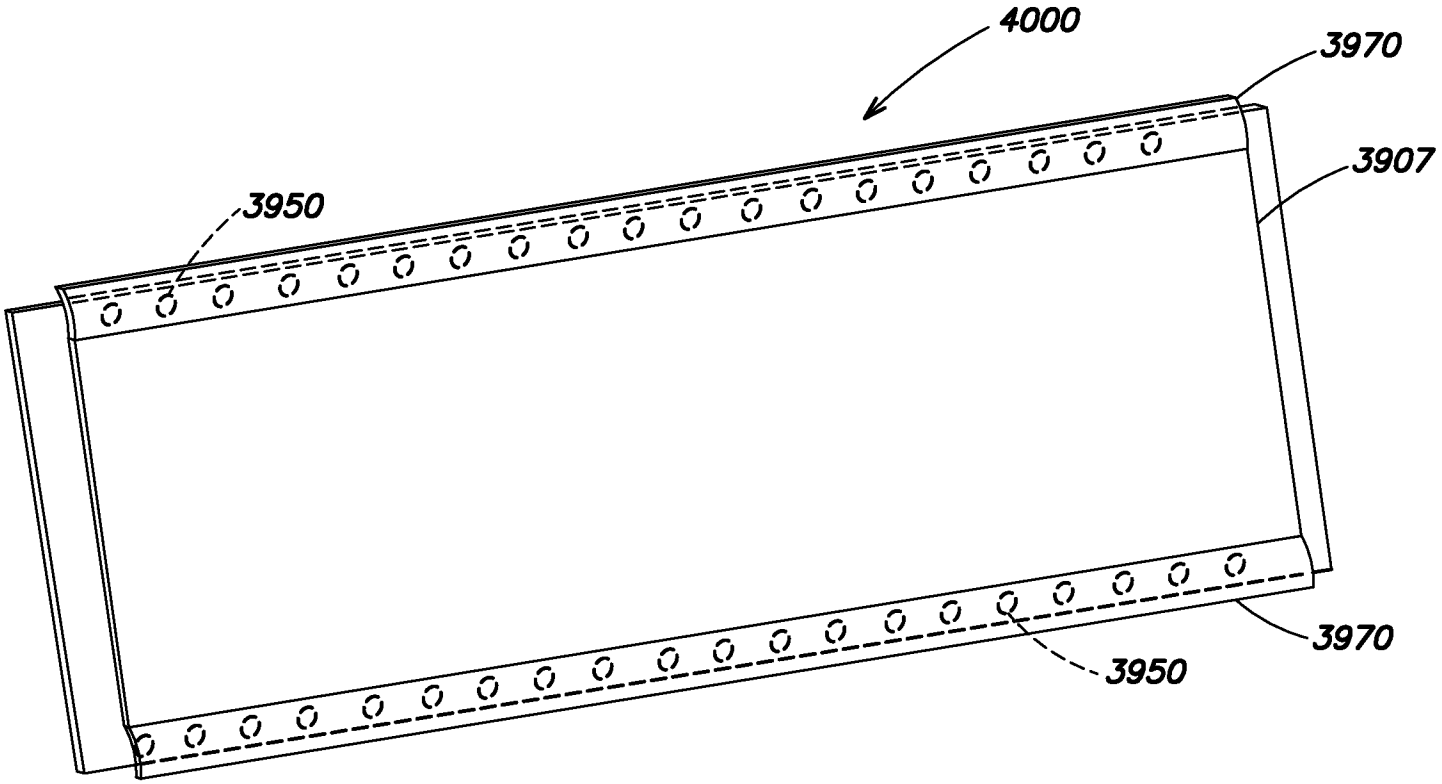
FIGS. 40A and 40B are detailed depictions of a slat component for one or more embodiments described herein.

FIG. 40A is a perspective view of a slat component for one or more embodiments described herein. The slat component 4000 may be a single layer instead of two layers as describe with respect to FIGS. 39A-39M. The slat component 4000 may include a plurality of through holes 3950 at the top and bottom edge that may be utilized to couple a plurality of slat components 4000 together in a similar manner as described above. In addition, the slat component 4000 may include an additional layer 3907 that includes flaps 3970 to hide, from view, the securing mechanism utilized to couple the slat components 4000 together. The flaps 3970 may be the same or different material from the additional layer 3907. For example, the flaps may be vinyl, plastic, cloth, etc.

Figure 40B:
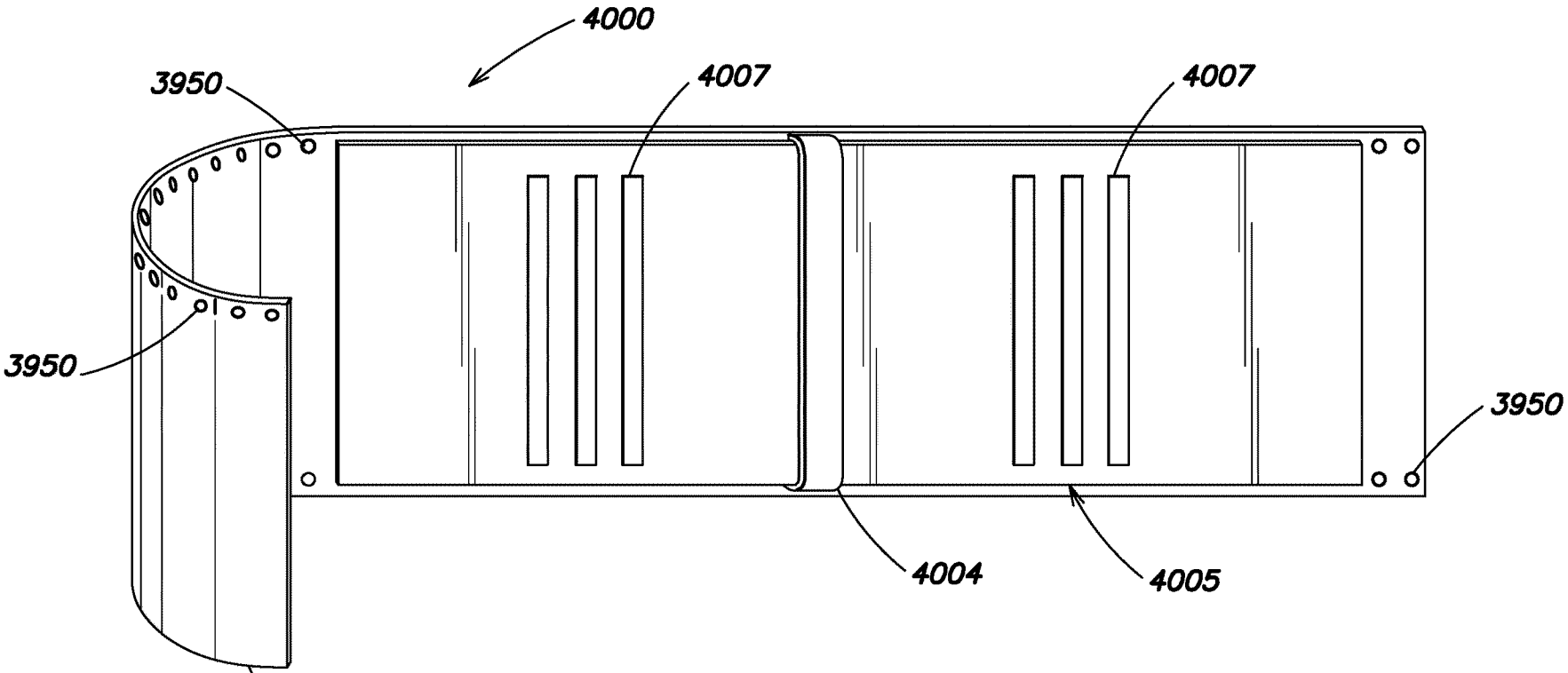

FIG. 40B is a backside view of the slat component 4000 that is a single layer. As depicted in FIG. 40B, the plurality of through holes 3950 run along the top and bottom of the slat component 4000. In addition, the backside of the slat component 4000 may include a single clasp 4004 that runs vertically from the top to the bottom of the slat component 4000. The single clasp 4004 may, for example, hold a single strip 4005 to the backside of the slat component 4000 to provide rigidity to slat component 4000. That is, the single strip 4005 may be positioned to rest on the clasp 4004. Although reference is made to a single strip 4005 and a single clasp 4004, it is expressly contemplated that any number of strips 4005 and/or clasps 4004 may be utilized. For example, the single strip 4005 may be attached to the backside of the slat component 4000 utilizing a securing mechanism (e.g., hook and loop fastener), such that no clasp 4004 is required or utilized.

In addition, excess material 4006 may be attached to the backside of the slat component 4000 and/or the single strip 4005. For example, and as depicted in FIG. 40B, the single strip 4005 may include one or more slits 4007. The excess material 4006 may be weaved in and out of consecutive slits 4007 to attach the excess material 4006 to the single strip 4005, to thus adjust the overall width of the slat component 4000. Alternatively, the excess material 4006 may be attached to the backside of the slat component 4000 and/or strip 4005 utilizing a securing mechanism, such as, but not limited to, one or more or a combination of strings, zippers, buttons, magnets, hook and loop fasteners, such as Velcro®, clips, etc.

Figure 40C:
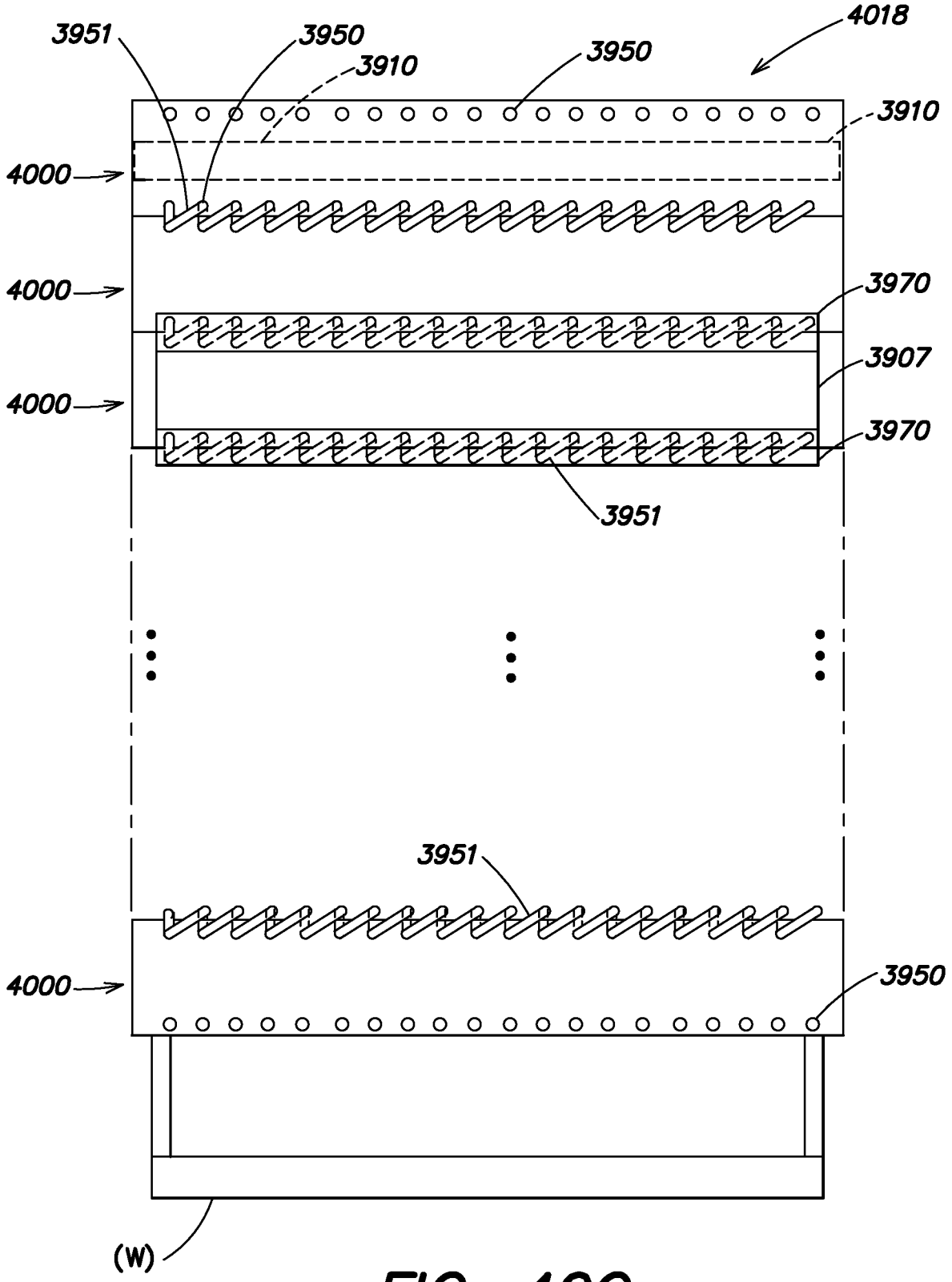
FIG. 40C is a detailed depiction of a shade that includes exemplary slat component as described with respect to FIGS. 40A and 40B.

FIG. 40C is a detailed depiction of a shade 4018 including the slat component 4000 as depicted in FIGS. 40A and 40B. The top most slat component 4000 may be attached to head rail unit 3910 utilizing a securing mechanism, such as, but not limited to one or more or a combination of strings, zippers buttons, magnets, hook and loop fasteners, such as Velcro®, clips, etc. The slat components 4000 may be coupled together such that the shade 4018 covers a window opening (W). For example, a user may alter the width of the slat components 4000 utilizing the excess material 4006 as described above with reference to FIG. 40B such that the shade 4018 fits the window opening W. In addition, the shade 4018 may be raised/lowered in any of a variety of ways as described above and as known by those skilled the art. Further, although FIG. 40C depicts the plurality of slat components 4000 being coupled together utilizing through holes 3950 and strings 3951, it is expressly contemplated that the slat components 4000 may be coupled together utilizing any of a variety of different securing mechanisms, such as, but not limited to one or more or a combination of strings, zippers buttons, magnets, hook and loop fasteners, such as Velcro®, clips, etc.

Moreover, the slat components 4000 in FIG. 40C may include additional layer 3907 with flaps 3970. For example and with reference to FIG. 40C, the third slat component 4000 from the top of the shade 4018 includes the additional layer 3907 with flaps 3970 that hide from view the through holes 3950 and string 3951. Although FIG. 40C depicts the third slat component 4000 including the additional layer 3907 with flaps 3970, it is expressly contemplated that any number of slat components 4000 may include the additional layer 3907 with flaps 3970.

Figure 41:
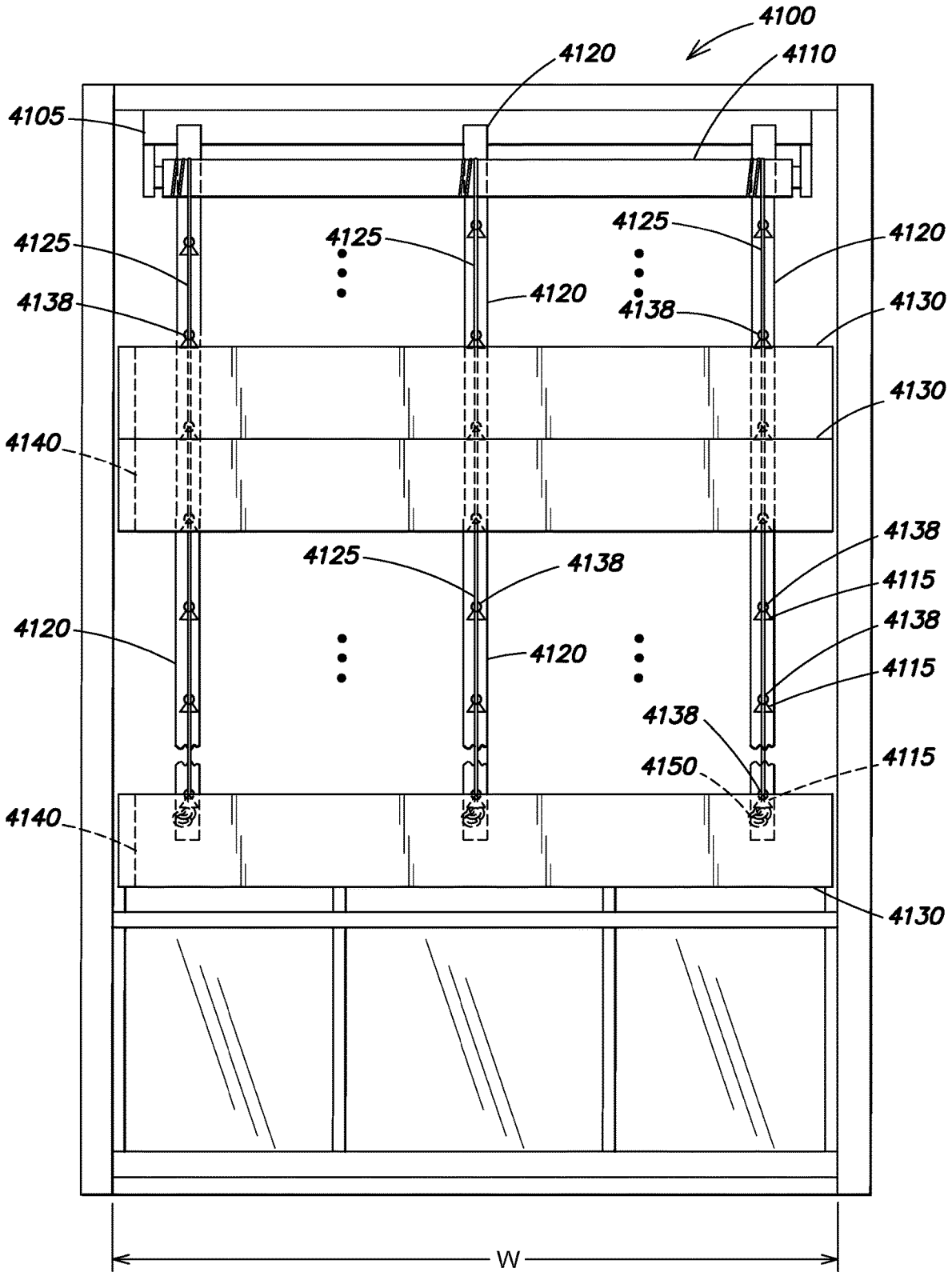
FIG. 41 is a detailed depiction of a shade that includes one or more vertical sheaths and one or more slat components for one or more embodiments described herein

In an embodiment, and in a front view as depicted in FIG. 41, a shade 4100 may include a head rail unit 4105 that travels horizontally. A raising system 4110 also traveling horizontally and may be attached to the head rail unit 4105. For example, the raising system may include, but is not limited to, a roller spring system, a counterbalance system, cord system, a motor, or another raising/lowering mechanism that is utilized to raise and lower the shade 4100 as known by those skilled in the art and/or as described above. The head rail unit 4105 and the raising system 4110 may be mounted on a top part of a window (W) or mounted to a front part of the window (W).

A top portion of one or more sheaths 4120 that travel vertically may be attached to the head rail unit 4105. Although FIG. 41 depicts three sheaths 4120 traveling vertically and attached to the head rail unit 4105, it is expressly contemplated that the shade 4100 may include less or more sheaths 4120 that are attached to the head rail unit 4105. The one or more sheaths 4120 may be attached to the head rail unit 4105 utilizing one or more or a combination of strings, zippers, buttons, magnets, hook and loop fasteners, such as Velcro®, clips, etc.

The one or more sheaths 4120 may include one or more exterior securing mechanisms 4115 that are positioned at one or more points on the exterior of the sheaths 4120. The one or more exterior securing mechanisms 4115 may include one or more or a combination of strings, zippers, buttons, magnets, hook and loop fasteners, such as Velcro®, clips, etc. Further, each of the one or more exterior securing mechanisms may include a slot opening 4138. In addition, the one or more exterior securing mechanisms may be attached and removed from the one or more sheaths in a variety of different ways as know by those skilled in the art. For example, and if the exterior securing mechanism 4115 is a clip, the clip may be tied, sewn, or hook and loop fastened to the exterior of the sheaths 4120.

Figure 42:
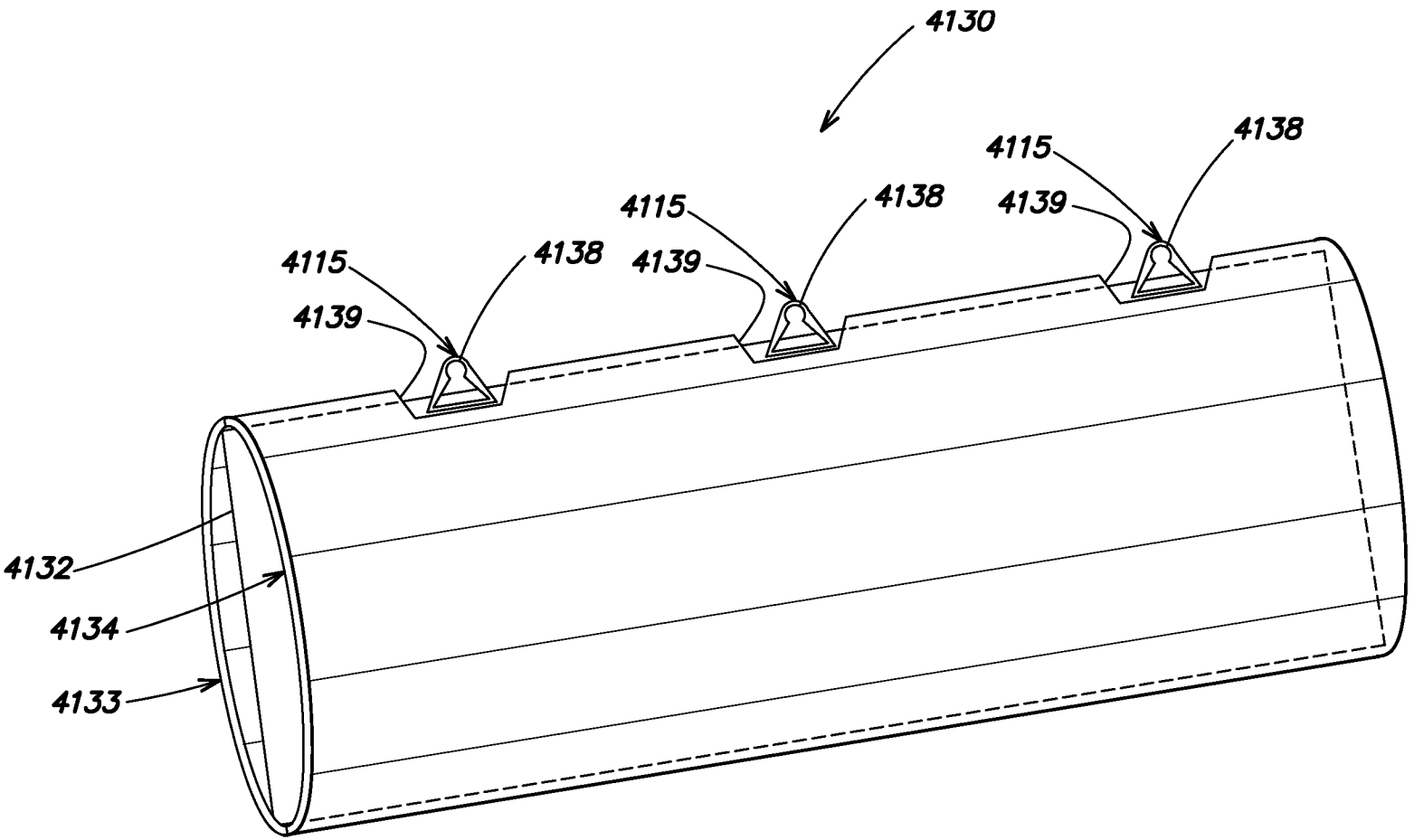
FIG. 42 is a detailed depiction of a slat component for one or more embodiments described herein.

In addition, one or more slat components 4130 as depicted in FIG. 42 may be secured to the shade 4100 through engagement of the exterior securing mechanisms 4115 of the sheaths 4120 with the slat component 4130 and/or one or more inserts 4132 positioned within the slat component 4130. For example, the exterior securing mechanism 4115 may attach to a top portion of the slat component, a bottom portion of the slat component, a middle portion of the slat component, and/or the slat component 4130 may have notches 4139 as depicted in FIG. 42 such that the one or more inserts 4132 inside the slat component 4130 are visible and the exterior securing mechanism 4115 may attach to the one or more inserts 4132. For example, the one or more exterior securing mechanisms 4115 may be a clip that clips onto a portion of the one or more inserts 4132 that is exposed in the notches. Alternatively, the exterior securing mechanism 4115 may be attached directly to the top portion, the bottom portion, and/or the middle portion of the slat component 4130.

Figure 46:
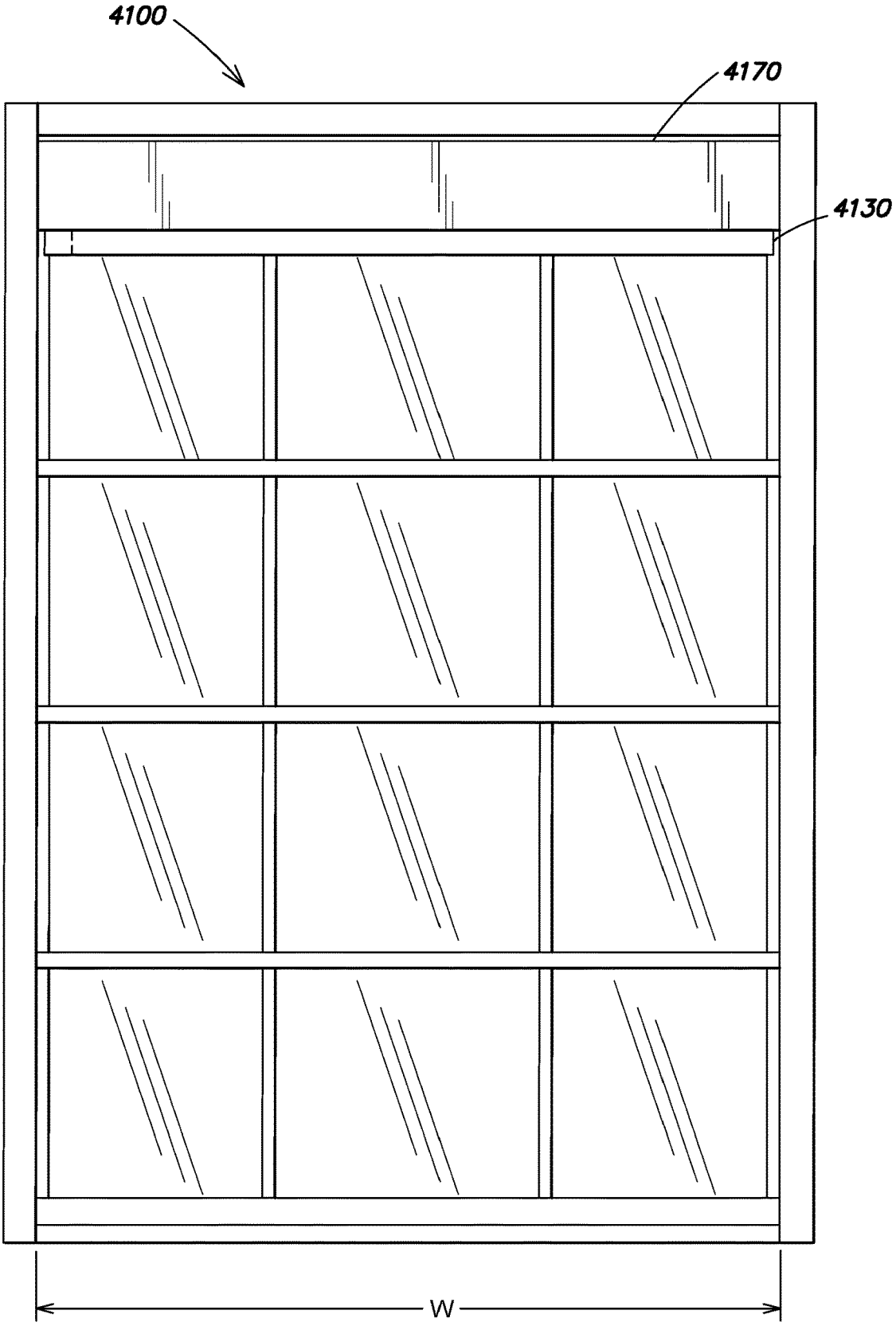

In addition, a valence or additional sheath 4170 may be attached to the head rail unit 4105 and/or raising system 4110 to hide the roller from the view of a user (as depicted in FIG. 46) utilizing one or more or a combination of strings, zippers, buttons, magnets, hook and loop fasteners, such as Velcro®, clips, etc. In addition, the height of the slat component 4130 and the positions of the exterior securing mechanisms 4115 may be configured such that the lower portion of a first slat component 4130 hides or covers the securing mechanism(s) associated with a second slat component that is secured to the sheaths 4120 and located directly underneath the first slat component. Although FIG. 41 depicts three slat components 4130 being attached to the sheaths 4120, it is expressly contemplated that any number of slat components may be attached to the sheaths 4120.

FIG. 42 depicts slat component 4130 that includes include a first layer 4133 and a second layer 4134. The first layer 4133 and the second layer 4134 may be coupled to each other at a top edge and a bottom edge where the first layer 4133 and the second layer 4134 meet such that an opening is created between the first layer 4133 second layer 4134, as depicted in FIG. 42. In addition, the first layer 4133 and the second layer 4134 may be coupled to each other in a variety of different ways, such as, but not limited to utilizing one or more or a combination of strings, zippers, buttons, magnets, hook and loop fasteners, such as Velcro®, clips, etc. In addition, the slat component 4130 may include one or more slot opening 4138 and the notches 4139.

The one or more inserts 4132 may have a height that is substantially similar to the height of the slat component 4130, such that the one or more inserts 4132 may be inserted and secured to the interior of the slat component 4130. Alternatively, the one or more inserts 4132 may have adjustable heights. Because the one or more inserts 4132 are substantially similar in height to the slat component 4130, the one or more inserts 4132 can be securely fit inside the interior open of the slat component 4130 and provide rigidity to the slat component 4130. The overall width of the one or more inserts 4130 may, for example, be less than the overall width of the slat component 4130 such that the one or more inserts 4132 are only in a middle portion of the slat component 4130. Alternatively, the overall width of the one or more inserts 4132 may be substantially similar in size to the width of the slat component 4130. Alternatively, the one or more insets 4132 may have an adjustable width.

The one or more inserts 4132 may be any of a variety of different shapes and sizes. For example, the one or more inserts 4132 may have rounded ends such that when the slat component 4130 is folded over, the shade 4100 has rounded edges. With rounded edges, the shade 4100 appears as a rounded window shade/blind.

The first and second layers of the slat components 4130 may be any of a variety of different materials such as, but not limited to, vinyl, plastic, bamboo, cloth, etc. In addition, the first and second layers of the slat component 4130 may be different designs, patterns, etc. For example, a front layer of the slat component 4130 that is facing a user may be a first pattern/material while a back layer of the slat component 4130 that is not facing the user may be a second pattern/material.

In addition, the slat components 4130 may include excess material 4140 that may extend beyond the width of the headrail unit 4105, the roller 4110, and/or the window opening (W). The excess material 4140 of the first layer 4133 and second layer 4134 may be secured to the interior opening of the slat component 4130 as described above with reference to FIG. 39C. Advantageously, the width of the slat components 4130 may be altered to any size as desired by a user (e.g., to match the width of the head rail unit 4105, the roller 4110, and/or the window opening (W)). In addition, the user can remove any number of slat components 4130 and have those slat components washed or replaced, for example. In addition or alternatively, the slat components 4130 may be turned around to view a different pattern (e.g., the second layer 4134). In addition or alternatively, the slat components 4130 can even be replaced with entirely new slat components 4130.

The raising system 4110 is utilized to raise and lower the shade 4100 as known by those skilled in the art and/or as described above. The raising system 4110 may include one or more pull strings 4125, wherein each pull string 4125 is associated with a different sheath 4120 of the one or more sheaths 4120. Specifically, a first end of each pull string 4125 may be secured to the raising system 4110. The pull string 4125 may then be fed through the one or more slot opening 4138 of each exterior securing mechanism 4115 associated with a particular sheath 4120, but at least the slot opening 4138 of the bottom most exterior securing mechanism 4115 associated with the particular sheath 4120. The second end of the pull string 4125 is knotted to form knot 4150 at a location where the pull string 4125 passes the slot opening 4138 of the bottom most exterior securing mechanism. The knot 4150 of the pull string 4125 is greater in size than the slot opening 4138 of the bottom most exterior securing mechanism 4115 such that when the raising system 4110 is activated to raise the shade 4100, the knot 4150 catches the slot opening 4138 of the bottom most exterior securing mechanism 4115 to raise the shade 4100.

Specifically, and when the shade 4100 is activated to be raised utilizing the raising system 4110, the pull string 4125 rises upwardly and towards the raising system 4110, and the knots 4150 of the pull strings 4125 make contact with the underside of the slot openings 4138 of the exterior securing mechanisms, thus causing the sheaths 4120 and slat components 4130 to rise.

In an embodiment and when the exterior securing mechanism 4115 is attached to the bottom portion of the slat component 4130, the pull string 4125 rises upwardly and towards the raising system 4110. As such, the knots 4150 of the pull strings 4125 make contact with the underside of the slot openings 4138 of the exterior securing mechanism 4115, thus causing the sheath 4120 to rise and also the slat components to rise from the bottom in a venetian-blind type manner.

In an embodiment, when the exterior securing mechanism 4115 is attached to the bottom portion of the last slat component 4130, the pull string rises upwardly and towards the raising system 4110. As such, the knots 4150 of the pull strings 4125 make contact with the underside of the slot openings 4138 of the exterior securing mechanism 4115, thus causing the slats 4130 to sequentially rise from the bottom in a venetian-blind type manner.

Figure 43:
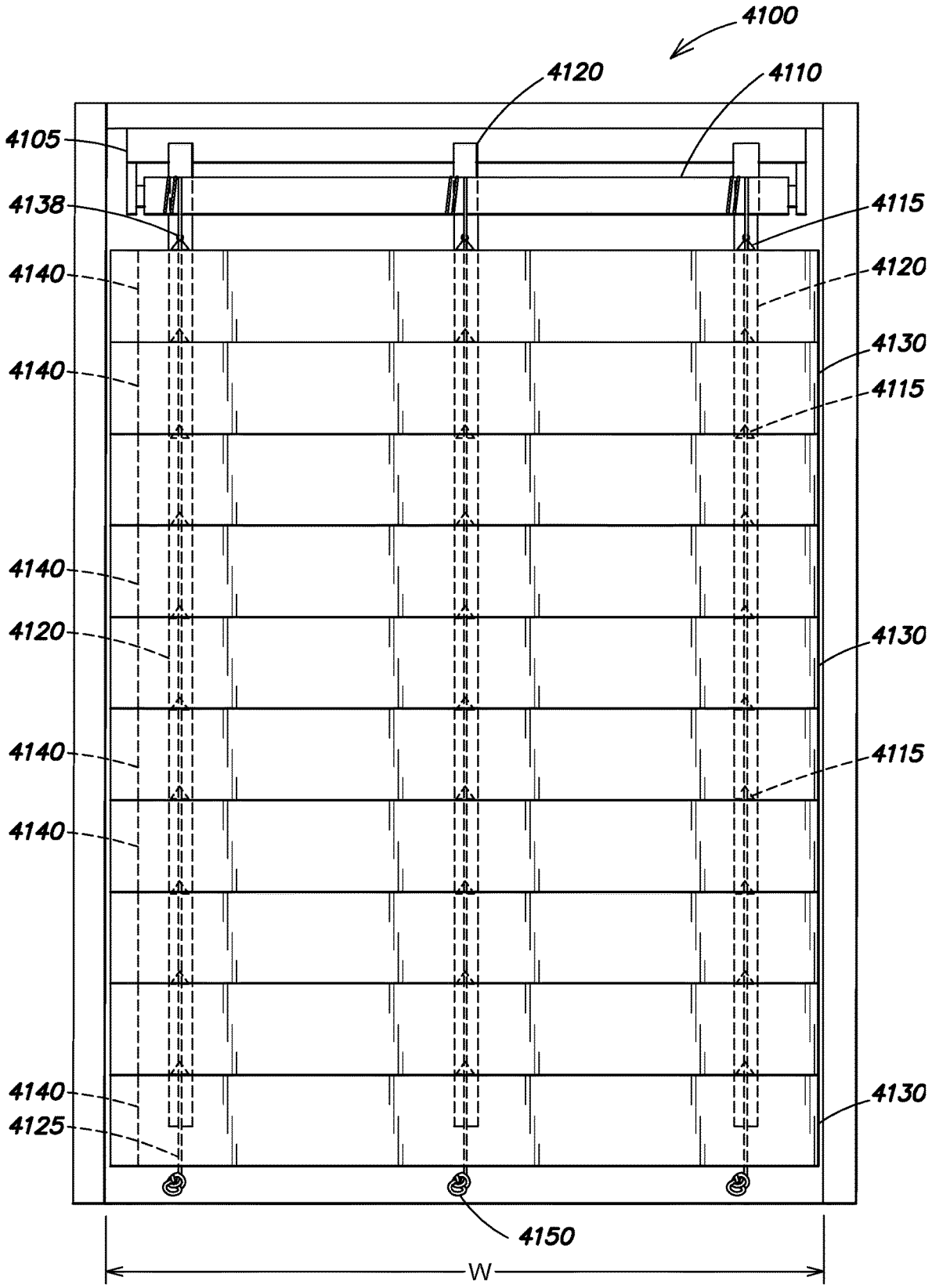
FIG. 43-47 are detailed depictions of a shade that includes one or more vertical sheaths and one or more slat components for one or more embodiments described herein.
Figure 44:
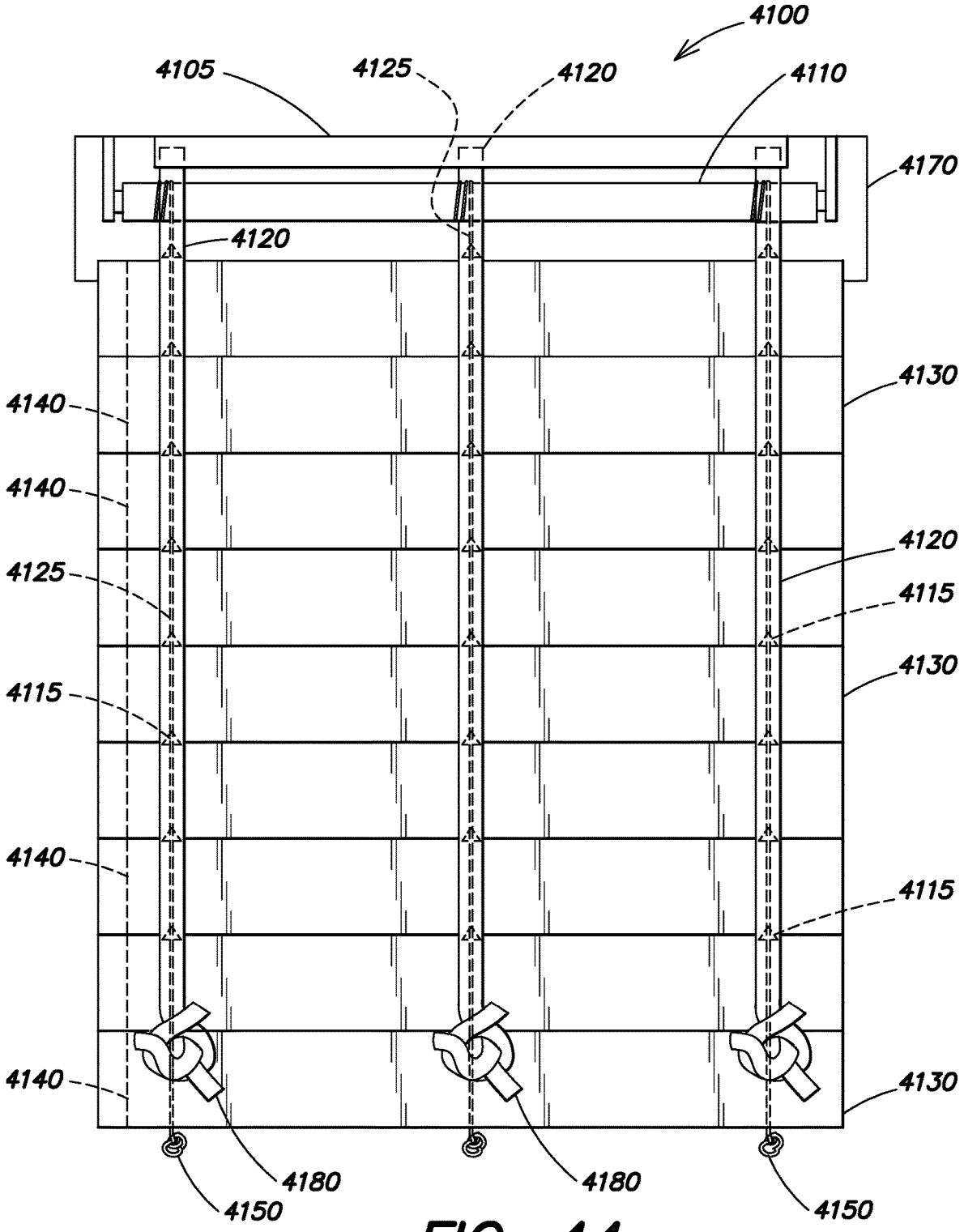

FIG. 43 depicts a front view of the shade 4100 in a lowered configuration with a plurality of slat components 4130 without a valence, while FIG. 44 depicts a back view of the shade 4100 in a lowered configuration with a plurality of slat components 4130 and a valence 4170. As can be seen in FIG. 43, the lower portions of the slat components 4130 cover/hide the securing mechanism(s) utilized to secure the slat component 4130 located directly underneath. In addition, and as depicted in FIG. 44, the sheaths 4120 may be tied up or knotted as sheath knots 4180 such that the vertical length of the sheaths may be altered to, for example, match a vertical height of different sized window openings (W).

Figure 45:
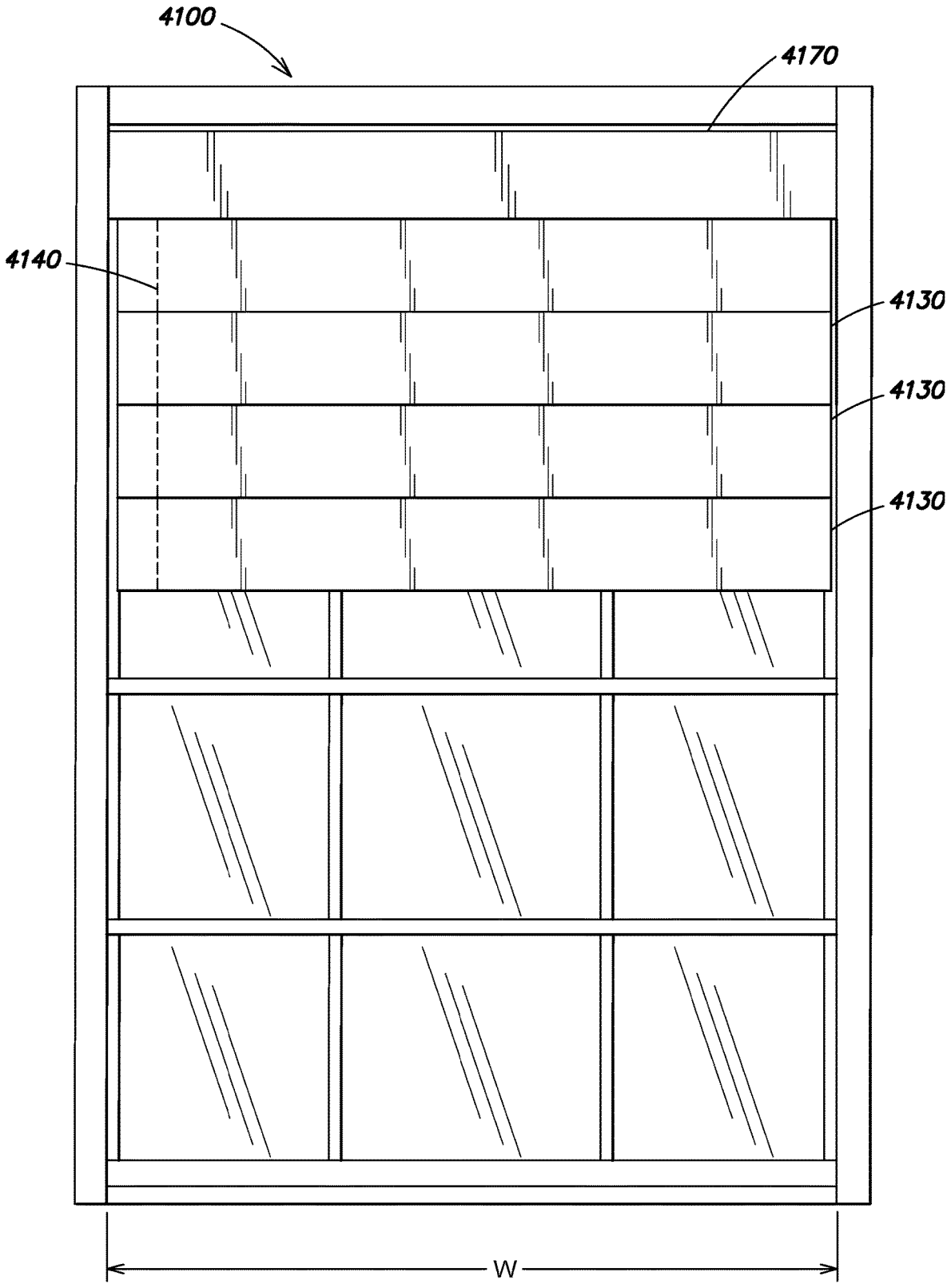
Figure 47:
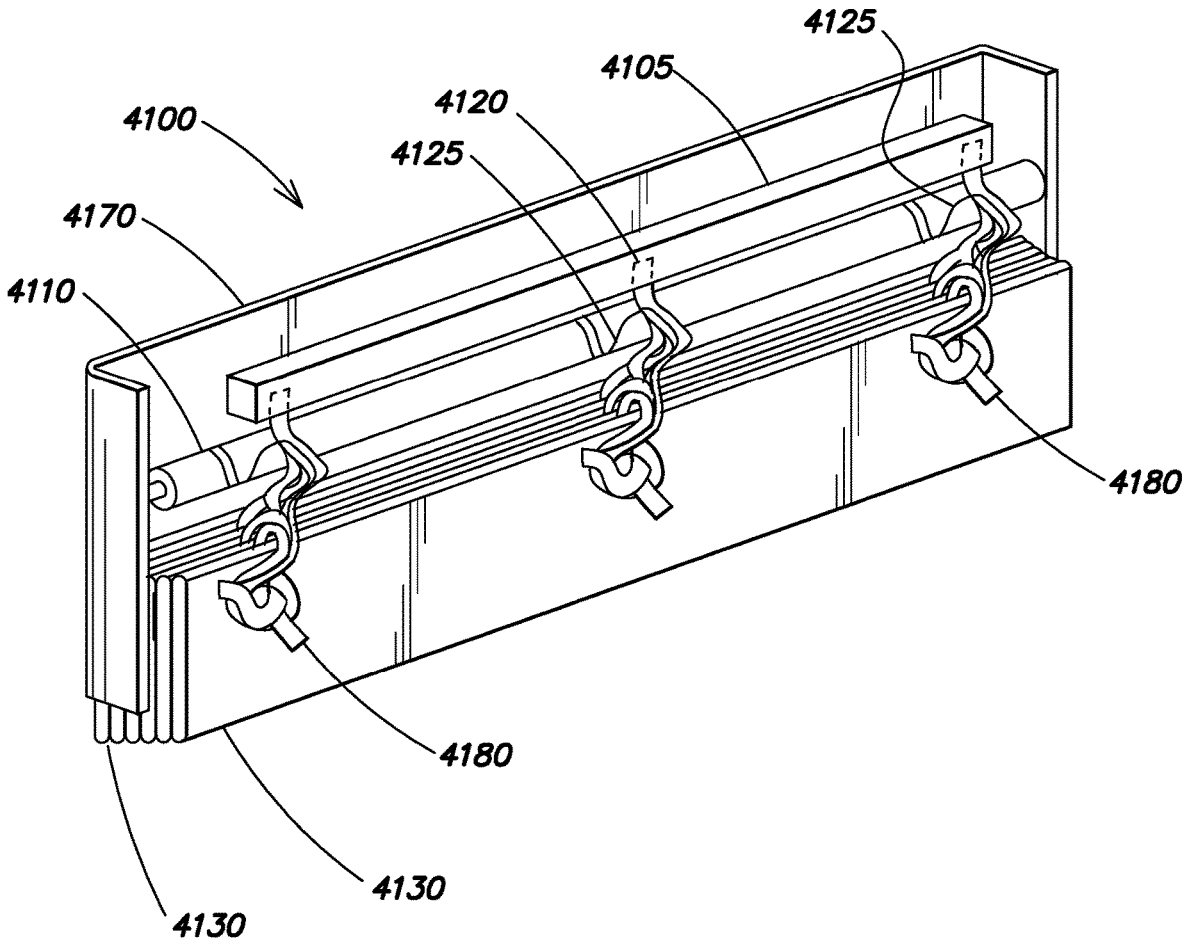

In addition, FIG. 45 depicts a front view of the shade 4100 in a partially raised configuration, while FIG. 46 depicts a front view of the shade 4100 in a fully raised configuration. Further, FIG. 47 depicts a back view of the shade 4100 in a fully raised configuration. As can be seen in FIGS. 45, 46, and 47, the slat components 4130 rise up in a uniform manner where, for example, the slat components 4130 are positioned one after the other with the lowest slat component 4130 in the back and the highest slat component 4130 in the front in a raised configuration.

It should be apparent from the foregoing that all of my vertical blind assembly embodiments have great versatility and can be adapted to many window configurations. In addition, it is expressly contemplated that the different features of the different embodiments described herein, can be utilized each of the other embodiments described herein. For example, although an exemplary clip 2403 is depicted in relation to an illustrative embodiment described in reference to FIG. 28B, the clip 2403 can be utilized with all embodiments in various alternative embodiments. Similarly, the other components described with respect to particular figures in the application, can be utilized with all figures and embodiments described in this application. The various modules comprising the blind assembly can be made and sold separately and connected together to fit most window dimensions and shapes. Also, since the assembly can be sold as individual parts/components, it allows individual components to be cleaned, moved, packaged and stored in a minimum amount of space for easy shipment, etc. Moreover, it is easy to install by the average homeowner without requiring any special tools. In addition, although reference is made to the foot rail being lowered and raised to expand and retract the one or more slats, it is expressly contemplated that the foot rail may remain stationary, and the housing units may be lowered (to retract the slat) and raised (to extend the slat) to manipulate the slats.

It will thus be seen that the objects set forth above among those made apparent from the preceding description are efficiently attained. Also, since certain changes may be made to the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

The invention claimed is:

1. A shade comprising:

a horizontal head rail unit;

a horizontal raising system coupled to the head rail unit wherein the raising system includes a pull string;

a vertical sheath coupled to the head rail unit;

one or more exterior securing mechanisms associated with an exterior of the vertical sheath; and one or more slat components coupled to the vertical sheath utilizing the one or more exterior securing mechanisms associated with the vertical sheath, wherein an entirety of the one or more securing mechanisms are between the one or more slat components and the vertical sheath, and wherein the one or more slat components are configured to cover a window opening to provide shading, and wherein each of the one or more exterior securing mechanisms is configured to (1) be attached to the vertical sheath at a plurality of different user selected longitudinal positions along the vertical sheath, and (2) only couple a single slat component to the vertical sheath, wherein the pull string travels a length of the shade and the pull string engages with the one or more exterior securing mechanisms passes through a slot opening of each of the one or more exterior securing mechanisms such that when the pull string retracts, the one or more slat components rise, and wherein the pull string and the vertical sheath are different and distinct, and where each slat component of the one or more slat components are individually removed and attached to the shade utilizing at least the one or more exterior securing mechanisms, and wherein the one or more slat components are modifiable in at least width to alter the size of the shade to cover different sized window openings.

2. The shade as defined in claim 1, wherein a first slat component includes an opening created by two layers and excess material of the first slat component is inserted within the opening to alter the width of the first slat component.

3. The shade as defined in claim 1, wherein the pull string rolls up around the raising system when the shade is configured to be raised, and wherein the one or more slat components include a plurality of slat components that are adjacent to each other when the shade is in a raised position.

4. The shade as defined in claim 1, wherein a first slat component includes an opening created by two layers and one or more inserts are positioned within the opening, wherein the length and width of the one or more inserts are adjustable.

5. A window shade comprising:

a sheath;

at least one slat component including a first slat side and a second slat side, wherein the at least one slat component is configured to be attached and removed from the sheath utilizing one or more securing mechanisms, and an entirety of the one or more securing mechanisms are positioned between the sheath and the at least one slat component;

one or more inserts each having a first insert side and a second insert side, wherein the one or more inserts define an adjustable first dimension of the window shade, and wherein the first insert side of each of the one or more inserts is configured to contact the first slat side of the at least one slat component, and wherein each of the one or more securing mechanisms is configured to (1) be attached to the vertical sheath at a plurality of different user selected longitudinal positions along the vertical sheath, and (2) only couple a single slat component to the vertical sheet; and excess material, of the at least one slat component that extends past the adjustable first dimension that is defined by the one or more inserts, is folded over to modify the adjustable first dimension of the window shade to fit a window opening, wherein the adjustable first dimension of the at least one slat component is adjustable to cover different sized window openings.

6. The window shade of claim 5, wherein the first slat side is an interior of the at least one slat component.

7. The window shade of claim 5, wherein the at least one slat component, the one or more inserts, and the excess material form a geometric shape.

8. A shade comprising:

a horizontal head rail unit;

a horizontal raising system coupled to the head rail unit wherein the raising system includes a pull string;

a vertical sheath coupled to the head rail unit;

one or more exterior securing mechanisms associated with an exterior of the vertical sheath; and one or more slat components coupled to the vertical sheath utilizing the one or more exterior securing mechanisms associated with the vertical sheath, wherein an entirety of the one or more securing mechanisms are between the one or more slat components of the vertical sheath, and wherein the one or more slat components are configured to cover a window opening to provide shading, and wherein each of the one or more exterior securing mechanisms are configured to (1) be attached to the vertical sheath at a plurality of different user selected longitudinal positions along the vertical sheath, and (2) only couple a single slat component to the vertical sheath, wherein the pull string travels a length of the shade and the pull string engages with the one or more exterior securing mechanisms such that when the pull string retracts, the one or more slat components rise, and wherein the pull string and the vertical sheath are different and distinct, and where each slat component of the one or more slat components are individually removed and attached to the shade utilizing at least the one or more exterior securing mechanisms, and wherein the one or more slat components are modifiable in at least width to alter the size of the shade to cover different sized window openings.

* * * * *